US006184828B1

(12) United States Patent
Shoki

(10) Patent No.: US 6,184,828 B1
(45) Date of Patent: Feb. 6, 2001

(54) BEAM SCANNING ANTENNAS WITH PLURALITY OF ANTENNA ELEMENTS FOR SCANNING BEAM DIRECTION

(75) Inventor: Hiroki Shoki, Kawasaki (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/372,807

(22) Filed: Aug. 12, 1999

Related U.S. Application Data

(63) Continuation of application No. 08/602,690, filed on Feb. 16, 1996, now abandoned, which is a continuation of application No. 08/153,056, filed on Nov. 17, 1993, now abandoned.

(30) Foreign Application Priority Data

| | | |
|---|---|---|
| Nov. 18, 1992 | (JP) | 4-331277 |
| Mar. 16, 1993 | (JP) | 5-55314 |
| Sep. 14, 1993 | (JP) | 5-228379 |

(51) Int. Cl.[7] ..... H01Q 3/26
(52) U.S. Cl. ..... 342/372
(58) Field of Search ..... 342/368, 371, 342/372, 425; 343/700 MS

(56) References Cited

U.S. PATENT DOCUMENTS

| | | | | |
|---|---|---|---|---|
| 3,008,142 | | 11/1961 | Saltzman et al. | 343/777 |
| 3,307,188 | | 2/1967 | Marchetti et al. | 342/373 |
| 3,460,140 | | 8/1969 | Logan | 342/157 |
| 3,718,935 | * | 2/1973 | Ranghelli et al. | 343/797 |
| 3,893,124 | | 7/1975 | Barker | 343/768 |
| 4,045,800 | | 8/1977 | Tang et al. | 342/372 |
| 4,053,895 | | 10/1977 | Malagisi | 343/700 MS |
| 4,197,542 | * | 4/1980 | Hofgen | 342/398 |
| 4,379,296 | | 4/1983 | Farrar et al. | 343/700 MS |
| 4,414,550 | * | 11/1983 | Tresselt | 343/700 MS |
| 4,633,256 | | 12/1986 | Chadwick | 342/368 |
| 4,791,428 | | 12/1988 | Andersen | 343/758 |
| 4,857,936 | | 8/1989 | Drabowitch et al. | 342/368 |
| 4,947,178 | | 8/1990 | Shafai | 343/700 MS |
| 4,973,972 | * | 11/1990 | Huang | 343/700 MS |

OTHER PUBLICATIONS

"Handbook of Microstrip Antennas (Chapter 19)," Fujimoto et al., IEE Electromagnetic Waves Series 28, pp. 1126–1133, 1989.

"Scan Gain Enhancement in Phased Arrays by Element Pattern Synthesis," Shafai, L., Proc. of ICAP 1991, pp. 914–917, 1991.

* cited by examiner

*Primary Examiner*—Gregory C. Issing
(74) *Attorney, Agent, or Firm*—Finnegan, Henderson, Farabow, Garrett & Dunner, L.L.P.

(57) ABSTRACT

An array antenna is formed of a plurality of antenna elements, each of which scans a beam in the direction of an angle θ to a boresight of the antenna and electrically varies the direction of a rotation angle ϕ of the beam. The antenna elements are disposed so that the optical path difference of radio waves transmitted or received by two adjacent antenna elements in the directions of a plurality of direction angles ϕ on the plane tilted for an angle θ to the boresight of the antenna is nearly a multiple of the wave length of the radio waves.

11 Claims, 95 Drawing Sheets

EXCITING PHASE OF EACH ANTENNA ELEMENT
(+:PHASE(0 DEG), −:REVERSE PHASE (180 DEG))

| | #1 | #2 | #3 | #4 | #5 | #6 | #7 | #8 | #9 |
|---|---|---|---|---|---|---|---|---|---|
| ① | + | + | + | + | + | + | + | + | + |
| ② | + | − | − | + | − | − | + | + | − |
| ③ | + | − | + | + | − | + | + | − | + |
| ④ | + | − | + | − | − | + | − | + | − |
| ⑤ | + | + | − | + | − | + | − | + | + |

ELEMENT PITCH a
= 1.305λ

- DISPOSITION : REGULAR TRIANGLE (SUB ARRAY PITCH l = 1.49 λ)
- FREQUENCY : f = 1.50 GHz
- SUBSTRATE : PERMITTIVITY ε = 10.0, THICKNESS d = 0.80mm
- SUB ARRAY : FOUR CIRCULAR PATCHES ARE DISPOSED IN SQUARE SHAPE (ELEMENT PITCH = 0.20 λ)
- BIT NUMBER OF PHASE SHIFTER : ONE BIT FOR EACH SUB ARRAY; FOUR BITS FOR EACH ELEMENT
- ELEMENT ANTENNA : CIRCULAR PATCH, RADIUS a = 18.40mm

- BEAM DIRECTION : BEAM SCANNED IN DIRECTION OF DIRECTION ANGLE $\phi$ ON PLANE OF $\theta = 50$ DEG
- NUMBER OF CIRCULAR ARRAYS : 8 ( m = 1 TO 8 )
- ANTENNA ELEMENT : NON-DIRECTIVITY
- NUMBER OF ANTENNA ELEMENTS SHOULD BE SET SO THAT DIFFERENCE OF ANGLES OF EXCITING PHASES OF ADJACENT ANTENNA ELEMENTS BECOMES 90 DEG.

PHASE OF PHASE SHIFTER

| | | |
|---|---|---|
| CIRCULAR ARRAY | (m = 1) → | PHASE OF PHASE SHIFTER = 0 |
| | (m = 2) → | = -Ø |
| | (m = 3) → | = -Ø x 2 |
| | (m = 4) → | = -Ø x 3 |
| | (m = 5) → | = -Ø x 4 |
| | (m = 6) → | = -Ø x 5 |
| | (m = 7) → | = -Ø x 6 |
| | (m = 8) → | = -Ø x 7 |

FIG. 96

THREE-BIT SCANNING (AT EVERY 45 DEG)

| BEAM DIRECTION ANGLE Φ (DEG) | PHASE (DEG) | | | | | | | |
|---|---|---|---|---|---|---|---|---|
| | CIRCULAR ARRAY 1 (m=1) | CIRCULAR ARRAY 2 (m=2) | CIRCULAR ARRAY 3 (m=3) | CIRCULAR ARRAY 4 (m=4) | CIRCULAR ARRAY 5 (m=5) | CIRCULAR ARRAY 6 (m=6) | CIRCULAR ARRAY 7 (m=7) | CIRCULAR ARRAY 8 (m=8) |
| 0 | 0 | 0 | 0 | 0 | 0 | 0 | 0 | 0 |
| 45 | 0 | 45 | 90 | 135 | 180 | 225 | 270 | 315 |
| 90 | 0 | 90 | 180 | 270 | 0 (360) | 90 (450) | 180 (540) | 270 (630) |
| 135 | 0 | 135 | 270 | 45 (405) | 180 (540) | 315 (675) | 90 (810) | 225 (945) |
| 180 | 0 | 180 | 0 (360) | 180 (540) | 0 (720) | 180 (900) | 0 (1080) | 180 (1260) |
| 225 | 0 | 225 | 90 (450) | 315 (675) | 180 (900) | 45 (1125) | 270 (1350) | 135 (1575) |
| 270 | 0 | 270 | 180 (540) | 90 (810) | 0 (1080) | 270 (1350) | 180 (1620) | 90 (1890) |
| 315 | 0 | 315 | 270 (630) | 225 (945) | 180 (1260) | 135 (1575) | 90 (1890) | 45 (2205) |
| NUMBER OF BIST REQUIRED | 0 | 3 | 2 | 3 | 1 | 3 | 2 | 3 |

FIG. 97

TWO-BIT SCANNING ( AT EVERY 90 DEG )

| BEAM DIRECTION ANGLE Ø (DEG) | PHASE (DEG) | | | | | | | |
|---|---|---|---|---|---|---|---|---|
| | CIRCULAR ARRAY 1 (m=1) | CIRCULAR ARRAY 2 (m=2) | CIRCULAR ARRAY 3 (m=3) | CIRCULAR ARRAY 4 (m=4) | CIRCULAR ARRAY 5 (m=5) | CIRCULAR ARRAY 6 (m=6) | CIRCULAR ARRAY 7 (m=7) | CIRCULAR ARRAY 8 (m=8) |
| 0 | 0 | 0 | 0 | 0 | 0 | 0 | 0 | 0 |
| 90 | 0 | 90 | 180 | 270 | 0 | 90 | 180 | 270 |
| 180 | 0 | 180 | 0 (360) | 180 (540) | 0 (720) | 180 (900) | 0 (1080) | 180 (1260) |
| 270 | 0 | 270 | 180 (540) | 90 (810) | 0 (1080) | 270 (1350) | 180 (1620) | 90 (1890) |
| NUMBER OF BIST REQUIRED | 0 | 2 | 1 | 2 | 0 | 2 | 1 | 2 |

BEAM SCANNING ANTENNAS WITH PLURALITY OF ANTENNA ELEMENTS FOR SCANNING BEAM DIRECTION

This is a continuation of U.S. patent application Ser. No. 08/602,690, filed Feb. 16, 1996, now abandoned which is a continuation of U.S. patent application Ser. No. 08/153,056, filed Nov. 17, 1993, now abandoned all which are incorporated herein by reference.

BACKGROUND OF THE INVENTION

1. Field of the Invention

The present invention relates to beam scanning antennas used for radar antennas, mobile communication antennas, satellite broadcasting receiving antennas, satellite-installed-antennas, and so forth.

2. Description of the Related Art

In antennas used for radars, mobile communications, satellite broadcasting reception, and so forth, a function which freely scans a beam in a desired direction is important. For example, when a mobile communication is performed, a mobile station (for example, an automobile or an airplane) is usually moving. Thus, a beam radiated from the antenna of the mobile station is not always directed to a predetermined direction. In this case, the beam of the antenna should be tracked to the predetermined direction (namely, the direction of an objective station which receives and/or transmits radio waves). As a means for scanning the beam of an antenna, the following methods have been employed.

As a first method, a beam is scanned by a mechanical driving means. FIG. 103 shows the construction of an example of a mechanical driving means which scans a beam. The mechanical driving means for scanning the beam requires an elevation (vertical plane) driving member and an azimuth (horizontal plane) driving member. In the mechanical driving means, the beam scanning process does not adversely affect the electric characteristics (such as radiation directivity) of an antenna 1.

However, the construction of the driving mechanism becomes complicated. In addition, there is a problem on durability of the rotary joint used for the driving mechanism. In particular, in a mobile communication, a lower and flat antenna is required. Thus, the mechanical driving method is disadvantageous.

As a second method, an electrical beam-scanning method is known. FIG. 104 shows the construction of an example of an electrical beam-scanning method. As shown in the figure, a plurality of antenna elements 2 are electrically connected to corresponding phase shifters 3. In the receiving operation, signals received from the antenna elements are combined by a feeding circuit 4. In the transmitting operation, a signal is distributed to the antenna elements 2 by the feeding circuit 4. The exciting phases of the antenna elements are adjusted by the phase shifters so as to scan the beam in a desired direction. In this method, since all the antenna elements 2, the phase shifters 3, and the feeding circuit 4 are disposed on the same plane, the beam scanning antenna can be thinly formed.

However, in this method, since each antenna element requires a phase shifter, the size of the beam scanning antenna becomes large. In addition, the cost of the antenna increases. Moreover, to control the phases of the phase shifters 3, a control circuit is required. Thus, the construction of the antenna becomes complicated.

SUMMARY OF THE INVENTION

A first object of the present invention is to provide a beam scanning antenna whose feeding system is simply constructed.

A second object of the present invention is to provide a beam scanning antenna which is easily produced.

A third object of the present invention is to provide a beam scanning antenna which is produced at low cost.

A fourth embodiment of the present invention is to provide a beam scanning antenna which is very effective for an antenna installed in a mobile station.

To solve the above problems, the present invention is a beam scanning antenna, comprising: a plurality of unit radiation elements for receiving or transmitting radio waves, a radiation direction of each of said unit radiation elements being discretely selected so as to be along a conical plane, the conical plane being composed of a set of lines which are disposed with a predetermined angle to a reference direction, the radiation elements being disposed so that the received or transmitted radio waves are strengthen by each other.

The present invention is an array antenna having a plurality of antenna elements, each of which has a means for scanning a beam in the direction of a tilt angle $\theta$ from a boresight of the beam scanning antenna and electrically varying the direction of a rotation angle $\phi$ of the beam. By arraying the antenna elements, the beam is formed in the direction of the angle $\theta$ to the boresight of the antenna. The rotation angle $\phi$ of the beam on an antenna element pattern can be electrically varied. The present invention is an array antenna having a plurality of antenna elements which form a plurality of antenna arrays, wherein the optical path difference of radio waves transmitted or received by each of the antenna arrays in the directions of a plurality of direction angles $\phi$ on the plane tilted for an angle $\theta$ to a boresight of the beam scanning antenna is nearly a multiple of the wave length. Thus, when the antenna elements are excited in the same phase, the gains in these directions can be increased.

The present invention is a beam scanning antenna having a means for shifting the exciting phases of signals of the radiation elements for every 180 degrees or 90 degrees.

The present invention is an array antenna comprising a plurality of antenna elements, each of which has a means for electrically varying the direction of a beam, the direction of the beam can be controlled for each antenna element. When these antenna elements are arrayed, under the control of one-bit or two-bit variable phase shifters connected thereof, the exciting phase can be varied for every 180 degrees or 90 degrees. Thus, the beam of the composite radiation field of the array antenna can be scanned to the desired direction.

The present invention is a beam scanning antenna, comprising a plurality of antenna elements, each of which has a plurality of operation modes, wherein the antenna elements are microstrip antenna members or horn antenna members, wherein each of the antenna element is connected to a low-bit variable phase shifter, and wherein a feeding circuit or a distributing circuit Us formed for each of the modes, the feeding circuit or the distributing circuit being connected to a high-bit variable phase shifter, so as to combine or distribute radio waves of each of the modes. Thus, the beam direction can be controlled for each antenna element. In addition, the phase of each mode for each antenna element can be coarsely varied. In the receiving operation, the signals received from all the antenna elements are combined by the feeding circuit. In the transmitting operation, the signal is distributed to all the antenna elements. The signal which has been combined or the signals which have not been distributed are precisely phase-shifted. Signals with a phase difference in each mode can be combined or distributed by the combining device or distributing device. Thus, the direction of the beam can be controlled for each element antenna. Consequently, the phase of each mode for each antenna element can be coarsely varied. In addition, when a sub array is constructed of at least two antenna elements, the direction of a beam can be controlled for the sub array. When an array antenna has a plurality of such sub arrays, each of which has a means for shifting the exciting phase thereof for every 180 degrees or 90 degrees, the beam of the composite radiation field of the array antenna can be scanned to a desired direction.

According to the present invention, a beam scanning antenna which electrically varies the direction of the rotation angle $\phi$ on the plane tilted for the elevation angle $\theta$ from the boresight can be provided. In comparison with the conventional electrically scanning antenna, the number of phase shifters can be remarkably reduced. Thus, the construction of the feeding system can be simplified, thereby decreasing the production steps of the antenna. Since the number of phase shifters is reduced, the production cost is also decreased. Since the antenna which electrically scans the beam can be formed in a plane shape, it is very effective for an antenna installed in a mobile station.

According to the present invention, a beam scanning antenna which electrically scan a beam in any direction can be provided. Thus, in comparison with a conventional electrically scanning antenna, phase shifters can be simply constructed. In other words, most of phase shifters can be low-bit phase shifters. Therefore, the control circuit and DC circuit can be shared with most of the phase shifters. In addition, the number of low-noise amplifiers which prevents C/N deterioration but result in power loss of the phase shifters can be remarkably reduced. Thus, the construction of the feeding system can be simplified, thereby decreasing the production steps. Because of simple construction of phase shifters, sharing of control circuit, and decrease of low noise amplifiers, the cost of the beam scanning antenna can be remarkably reduced. Since the beam scanning antenna can be formed in a plane shape, it is very effective for an antenna installed in a mobile station.

In addition, according to the present invention, an array antenna which forms a conical beam can be thinly formed. In addition, the antenna can be optimally designed to have a peak in the direction of a predetermined elevation angle $\theta$. This antenna is effectively used for an antenna installed in a mobile station which communicates with stationary communicating and/or broadcasting satellites. Moreover, according to the present invention, since the degree of freedom in design is high and the frequency band can be widened. When a plurality of such antenna elements are used and switched, an antenna which can scan a beam in the $\theta$ direction, an antenna which can select or share a polarized wave, an antenna which can select or use transmitting and receiving operations, and so forth can be easily formed. Furthermore, when a plurality of such antenna elements are used and radio waves with proper phase differences are combined, a beam scanning antenna which scans the composite beam in the direction of any rotation angle $\phi$ can be easily formed.

Moreover, according to the present invention, since an array antenna which scans a conical beam can be thinly formed, it can be optimally designed so that the peak of the beam is present in the direction of a predetermined elevation angle $\theta$. This antenna is effectively used for an antenna installed in a mobile station which communicates with stationary communicating and/or broadcasting satellites. In addition, according to the present invention, the degree of freedom in design is high and the frequency band can be widened. When a plurality of conical beams with phase differences with respect to the rotation angle $\phi$ are combined, a beam scanning antenna with a high gain can be provided. With phase shifters whose number is less than the number of conical beams, a beam can be scanned in the direction of the rotation angle $\phi$. Thus, the number of phase shifters can be remarkable reduced, thereby simplifying the construction of the feeding system and lowering the cost of the antenna.

These and other objects, features and advantages of the present invention will become more apparent in light of the following detailed description of a best mode embodiment thereof, as illustrated in the accompanying drawings.

BRIEF DESCRIPTION OF DRAWINGS

FIG. 96 is a table showing the phases of phase shifters (for three-bit scanning) of the array antenna according to the twenty-second embodiment of the present invention;

FIG. 97 is a table showing the phases of phase shifters (for two-bit scanning) of the array antenna according to the twenty-second embodiment of the present invention;

FIG. 104 is a schematic diagram showing a conventional beam scanning antenna.

DESCRIPTION OF PREFERRED EMBODIMENTS

Next, with reference to the accompanying drawings, embodiments of the present invention will be described. In the following description, unless otherwise specified, the construction for the receiving operation of the antennas according to the present invention will be described.

Figure 1:
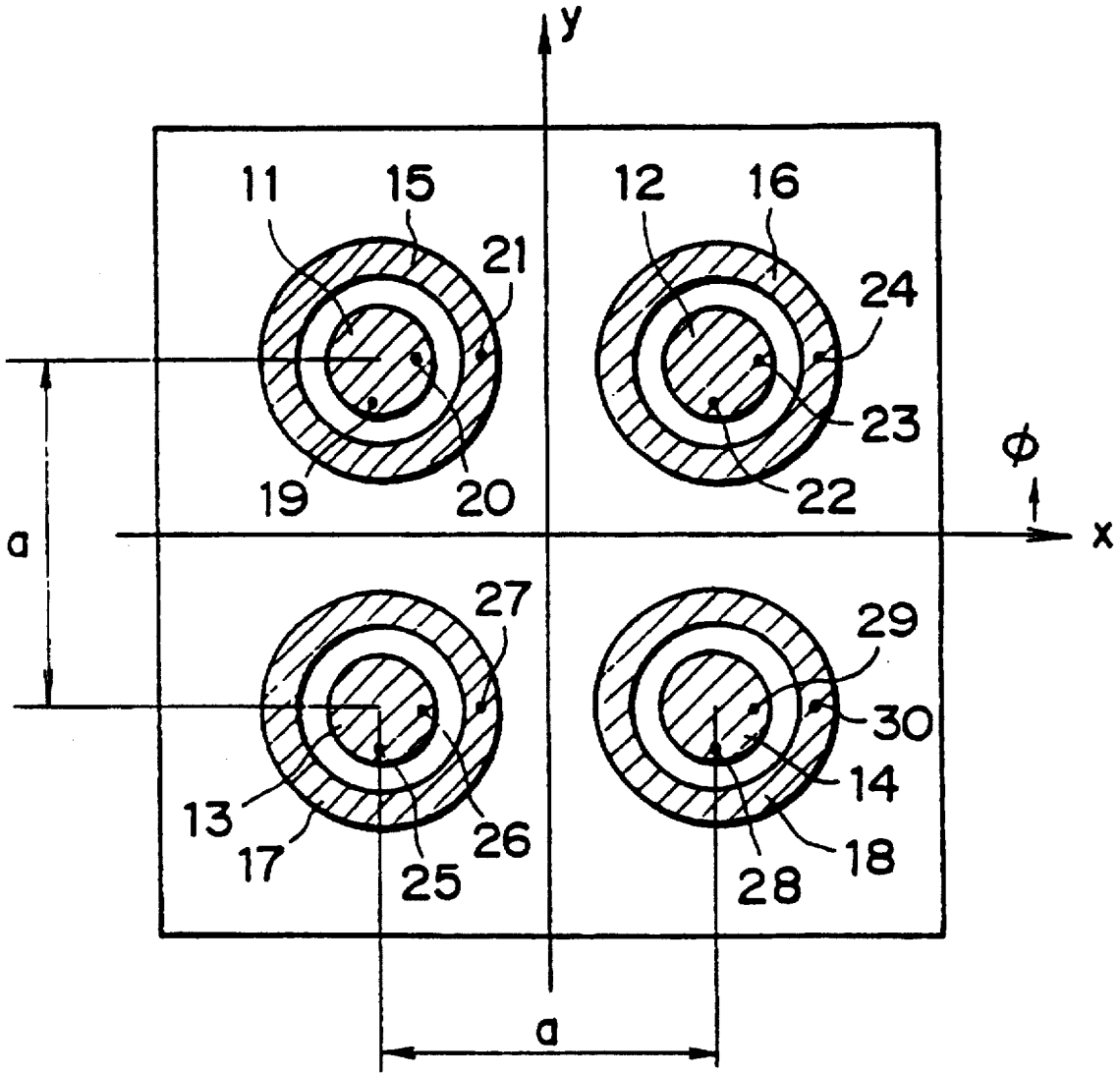
FIG. 1 is a top view showing a beam scanning antenna according to a first embodiment of the present invention.

FIG. 1 is a top view showing a beam scanning antenna according to a first embodiment of the present invention. In this embodiment, a vertically polarized radio wave (which has Eθ component) is received. A beam is scanned in the directions of direction angles ϕ=0 degree, ±90 degrees, and 180 degrees on a plane tilted for an angle θ to the boresight (z direction) of the antenna. In this embodiment, the beam scanning antenna is an array antenna which is constructed of four antenna elements.

The antenna is constructed of dominant mode exciting antenna members 11 to 14 and higher-order mode exciting antenna members 15 to 18. Each antenna element is constructed of one dominant mode exciting antenna member and one higher-order mode exciting antenna member. Each antenna member is a pin-feed (coaxial feed) microstrip antenna member. The antenna has feed points 19 to 30. Each antenna element can radiate a beam in the direction of with an angle θ to the boresight (z direction) of the antenna as will be described later. In addition, the beam can be electrically scanned in the directions of the direction angles ϕ=0 degree, ±90 degrees, and 180 degrees by an electric means such as an RF switch.

Figure 2:
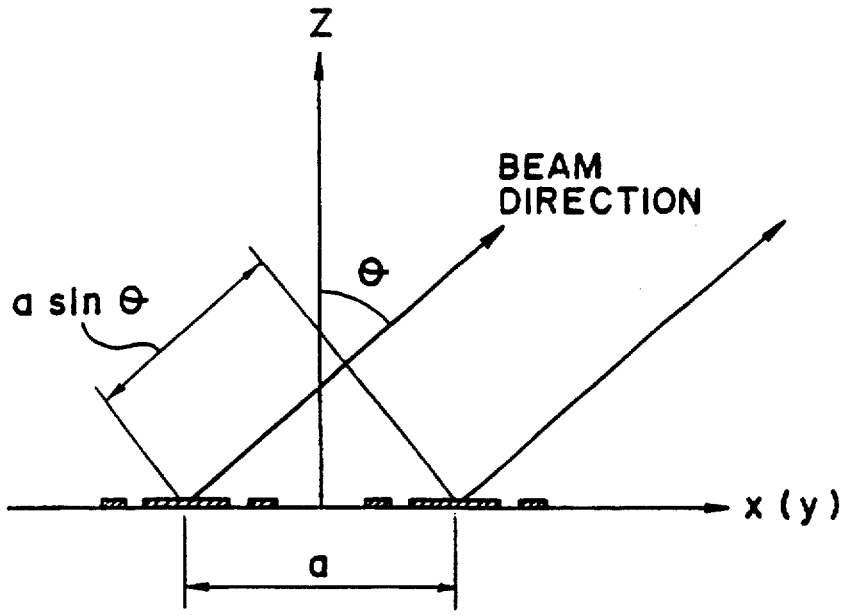
FIG. 2 is a schematic diagram showing the optical path difference between antenna elements of the beam scanning antenna according to the first embodiment of the present invention.

The optical path difference [a×sin θ] of a radio wave received between adjacent antenna elements is set to a multiple of the wave length of the radio wave as in Table 1, where a is the antenna element pitch (spacing) and θ is the elevation angle of the beam to the boresight of the antenna as shown in FIG. 2.

TABLE 1

| a | a × sin θ |
|---|---|
| (a) θ = 30 deg. | |
| 2.0 λ | 1.0 λ |
| 4.0 λ | 2.0 λ |
| 6.0 λ | 3.0 λ |
| (b) θ = 45 deg. | |
| 1.414 λ | 1.0 λ |
| 2.828 λ | 2.0 λ |
| 4.243 λ | 3.0 λ |
| (b) θ = 60 deg. | |
| 1.155 λ | 1.0 λ |
| 2.309 λ | 2.0 λ |
| 3.464 λ | 3.0 λ |

*λ = wave length of radio wave in free space

Thus, in the beam directions of ϕ=0 degree, ±90 degrees, and 180 degrees with an angle θ to the boresight, when the antenna elements are excited in the same phase, a high gain can be obtained.

The rotation angle ϕ of each antenna element can be varied on the plane with an angle θ to the boresight by an electric means such as a phase shifter or an RF switch. Now, the way of electric scanning is explained as follows.

Figure 3:
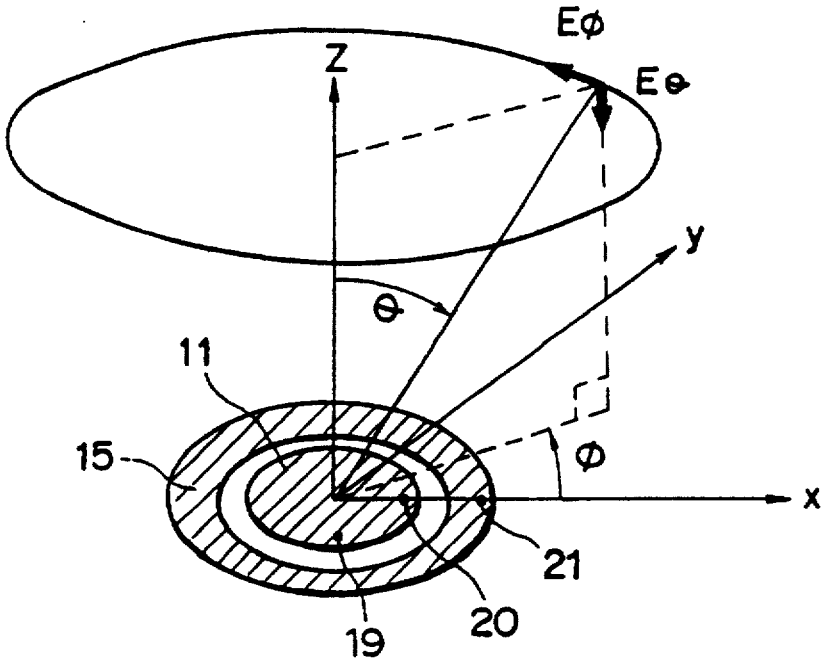
FIG. 3 is a schematic diagram showing the construction of the antenna element of the beam scanning antenna according to the first embodiment of the present invention.

FIG. 3 is a schematic diagram showing one antenna element of the beam scanning antenna shown in FIG. 1. The dominant mode exciting antenna member 11 is a circular microstrip antenna member, whereas the higher-order mode exciting antenna member 15 is a ring microstrip antenna. The dominant mode exciting antenna member 11 is excited at the feed points 19 and 20. The component excited at the feed point 19 is perpendicular to the component excited at the feed point 20. The higher-order mode exciting antenna member 15 is excited at the feed point 21. Now, assume that the dominant mode of the circular microstrip antenna member is TM 11 mode, whereas the higher-order mode of the ring microstrip antenna member is TM 21 mode. In these modes, the radiation field at each feed point is given by the following equations.

$$\text{Dominant mode (feed point 20):}\quad E\theta = A\theta(\theta)\cos\phi \tag{1}$$

$$E\phi = A\phi(\theta)\sin\phi \tag{2}$$

$$\text{Dominant mode (feed point 19):}\quad E\theta = -A\theta(\theta)\sin\phi \tag{3}$$

$$E\phi = A\phi(\theta)\cos\phi \tag{4}$$

$$\text{High-order mode (feed point 21):}\quad E\theta = B\theta(\theta)\cos 2\phi \tag{5}$$

$$E\phi = B\phi(\theta)\sin 2\phi \tag{6}$$

where Aθ, Aϕ, Bθ, and Bϕ depend on the elevation angle θ and the shape of the antenna element.

Figure 4:
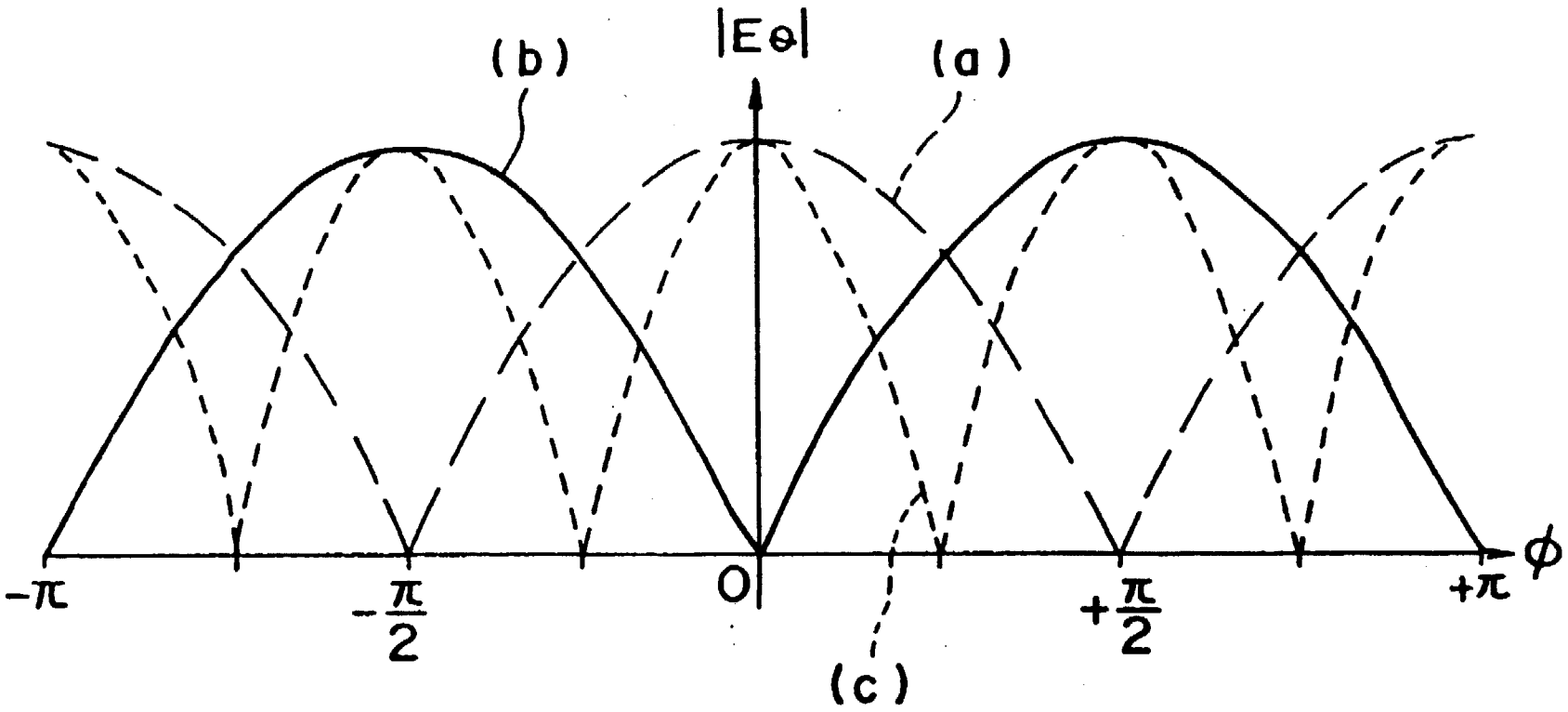
FIG. 4 is a graph showing the radiation directivity of the antenna element (which operates in dual-mode) of the beam scanning antenna according to the first embodiment of the present invention.

FIG. 4 is a graph showing the relation between the Eθ component of the radiation field and rotation angle ϕ in each mode. In the figure, (a), (b), and (c) represent the dominant mode (feed point 20), the dominant mode (feed point 19), and the higher-order mode (feed point 21), respectively. In this figure, the intensity of the radiation fields in these modes is normalized so that their maximum values match each other. As is clear from the figure, the dominant mode (feed point 20) has two peaks at ϕ=0 degree and 180 degrees. The dominant mode (feed point 19) has two peaks at ϕ=±90 degrees. The higher-order mode (feed point 21) has three peaks at ϕ=0 degree, ±90 degrees, and 180 degrees.

Thus, in the condition that the antenna element is tilted for a predetermined angle θ, at ϕ=0 degree and 180 degrees, when the dominant mode (feed point 20) and the higher-order mode (feed point 21) are combined with the same amplitude and same phase, radiation directivity with a high gain can be obtained. Likewise, at ϕ=±90 degrees, when the dominant mode (feed point 19) and the higher-order mode (feed point 21) are combined with the same amplitude and same phase, radiation directivity with a high gain can be obtained.

Figure 5:
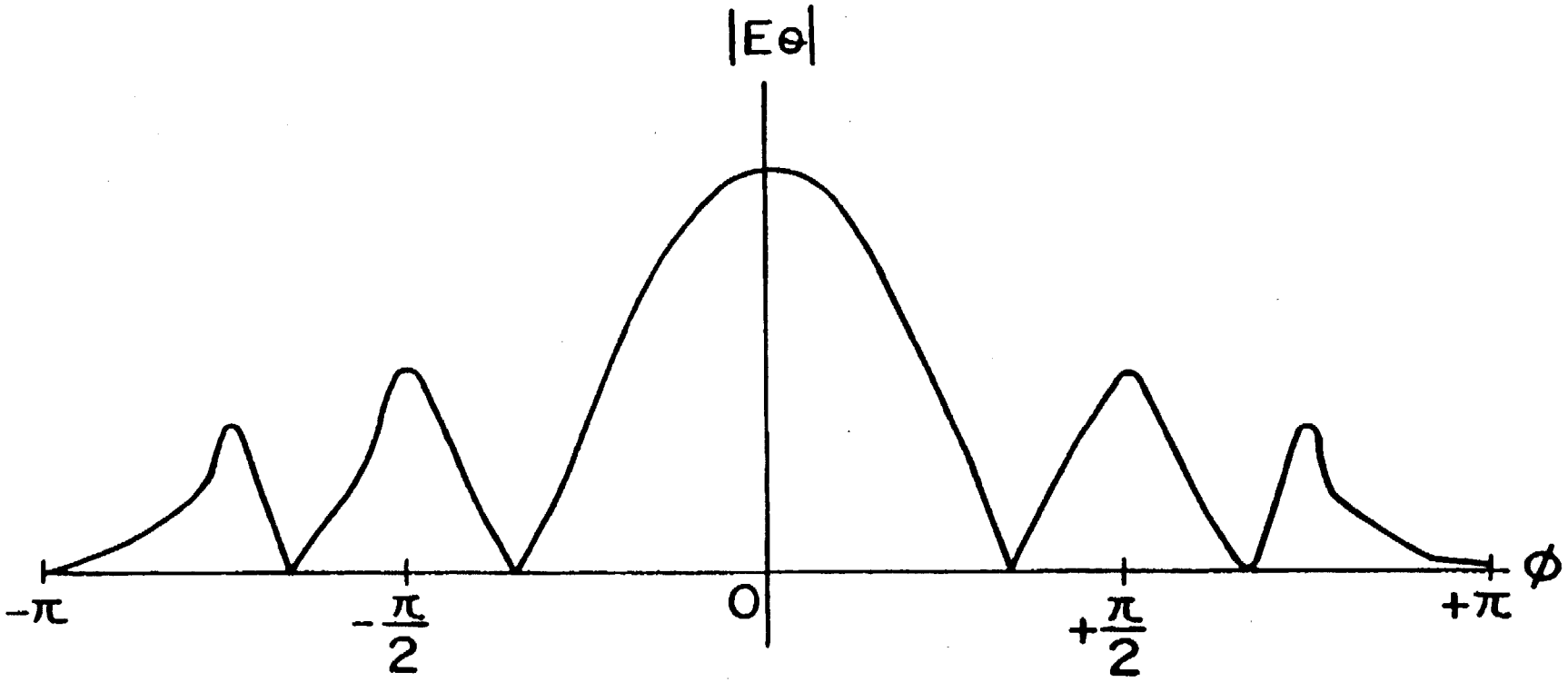
FIG. 5 is a graph showing the radiation directivity of the antenna element of the beam scanning antenna according to the first embodiment of the present invention.

FIG. 5 shows the composite directivity of the antenna element which scans a beam in the direction of ϕ=0 degree.

Figure 6:
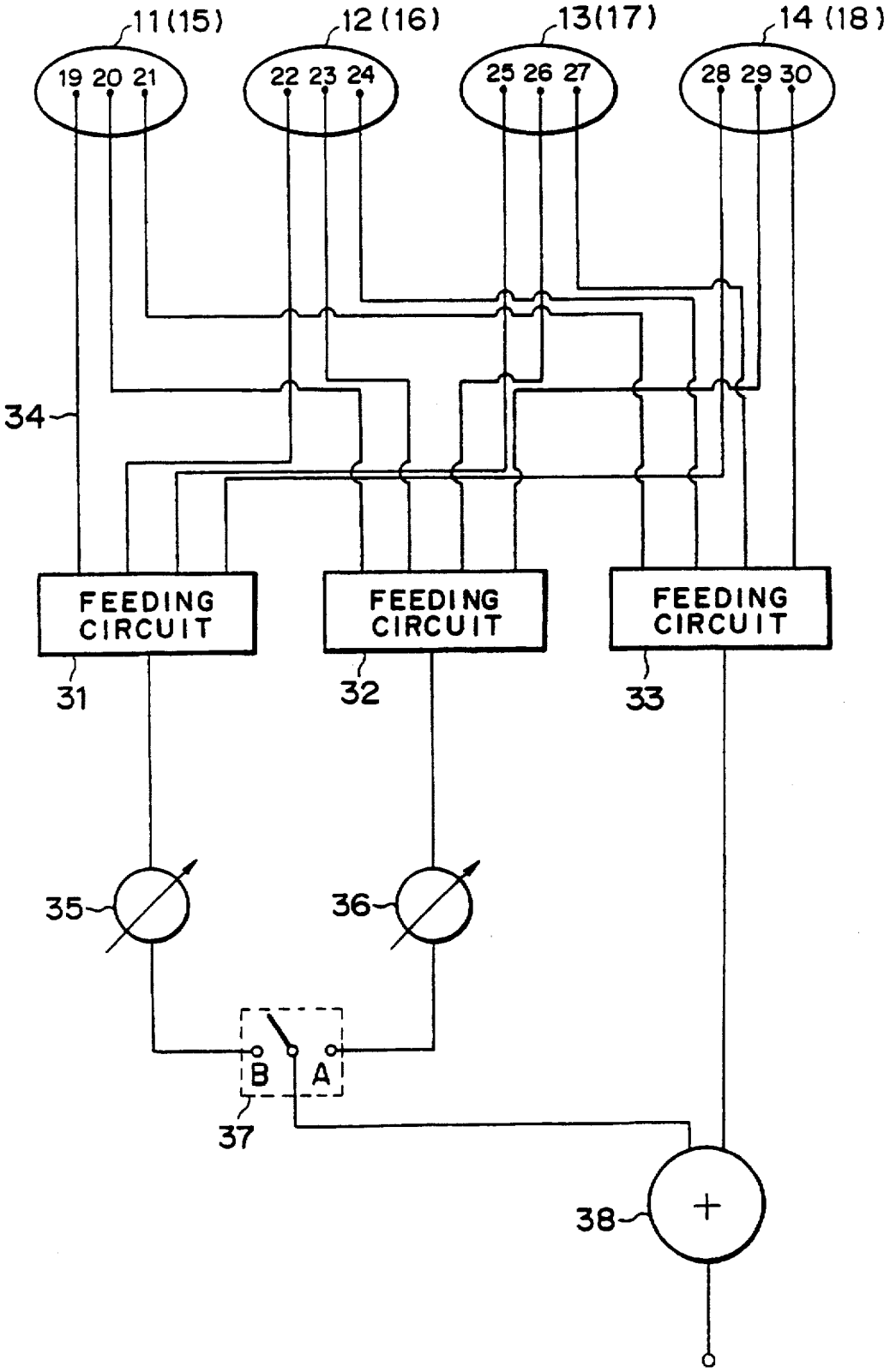
FIG. 6 is a circuit diagram showing the construction of a feeding system of the beam scanning antenna according to the first embodiment of the present invention.

Next, the construction of a feeding system of the beam scanning antenna shown in FIG. 1 will be described. Each antenna element which scans a beam may be independently controlled. However, since the control method for setting the rotation angle ϕ is in common with all the antenna elements, a feeding system shown in FIG. 6 may be used so as to simplify the construction of the beam scanning antenna.

Signals received from the dominant mode feed points and the higher-order feed points of the antenna elements 11 to 14 (which are reference numerals of dominant mode antenna members) are extracted through corresponding RF lines 34 such as microstrip lines or coaxial lines. The signals received from the dominant mode feed points 19, 22, 25, and 28 are combined by a feeding circuit 31. The signals received from the dominant mode feed points 20, 23, 26, and 29 are combined by a feeding circuit 32. The signals received from the higher-order mode feed points 21, 24, 27, and 30 are combined by a feeding circuit 33. The output signals of the feeding circuits 31 and 32 are sent to phase shifters 35 and 36 through corresponding RF lines, respectively. Since the phase shifters 35 and 36 each shift the phase of the input signal for either 0 degree or 180 degrees, their construction is simple. The output signals of the phase shifters 35 and 36 are sent to an RF switch 37 through an RF line. The RF switch 37 selects one of the two orthogonal components of the dominant mode. The output signals of the RF switch 37 and the feeding circuit 33 are sent to a combining device 38 through corresponding RF lines. The combining device 38 combines these signals. When a radio wave is received in the direction where the beam is scanned in the direction of the elevation angle θ and the rotation angle ϕ, the combining device 38 sets a combining ratio so that the two output signals received from the RF switch 37 and the feeding circuit 33 are combined with the same amplitude. This combining ratio depends on the angle θ to the boresight of the beam scanning antenna. In other words, when this combining ratio is properly set, the elevation angle θ of the beam to the boresight of the antenna can be adjusted.

Instead of setting the combining ratio, the combining device may be electrically connected to two amplifiers, each of which can set the amplitude of the input signal. By properly controlling the amplitude of these amplifiers, the amplitude of these input signals becomes the same. When a radio wave is received from the direction where the beam is scanned, the signals sent to the combining device are combined so that the phase of the output signal of the dominant mode feeing circuit becomes the same as that of the higher-order mode feeding circuit when the phases of the phase shifters are set to either 0 degree or 180 degrees. This operation can be easily performed by properly setting the length of the RF lines. The direction of the beam can be electrically changed by the the phase shifters and the RF switch.

For example, assume that when the RF switch 37 is placed in position A and the phase of the phase shifter 36 is set to 0 degree, the beam is scanned in the direction of ϕ=0 degree. In this case, when the phase of the phase shifter 36 is set to 180 degrees, the beam is scanned in the direction of ϕ=180 degrees. When the RF switch 37 is placed in position B, if the phase of the phase shifter is set to 0 degree, the beam is scanned in the direction of ϕ=+90 degrees. In this case, if the phase of the phase shifter is set to 180 degrees, the beam is scanned in the direction of ϕ=−90 degrees. The direction of the beam can be varied only by the two phase shifters and the RF switch. In this construction, when a phase shifter is disposed on the higher-order mode side, all of the phase shifters on the dominant mode side can be omitted.

Figure 7:
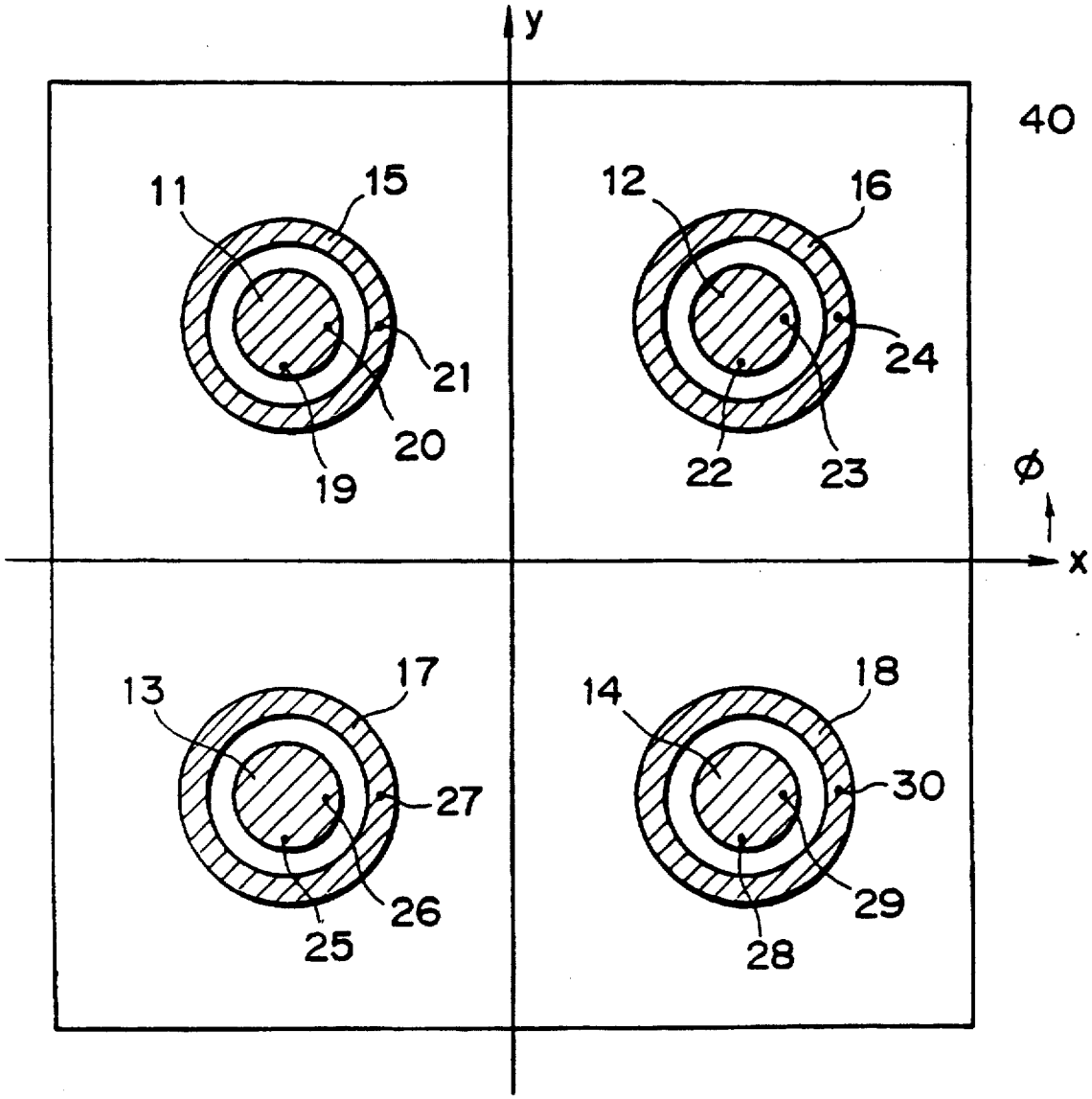
FIG. 7 is a top view showing the beam scanning antenna according to the first embodiment of the present invention.
Figure 8:
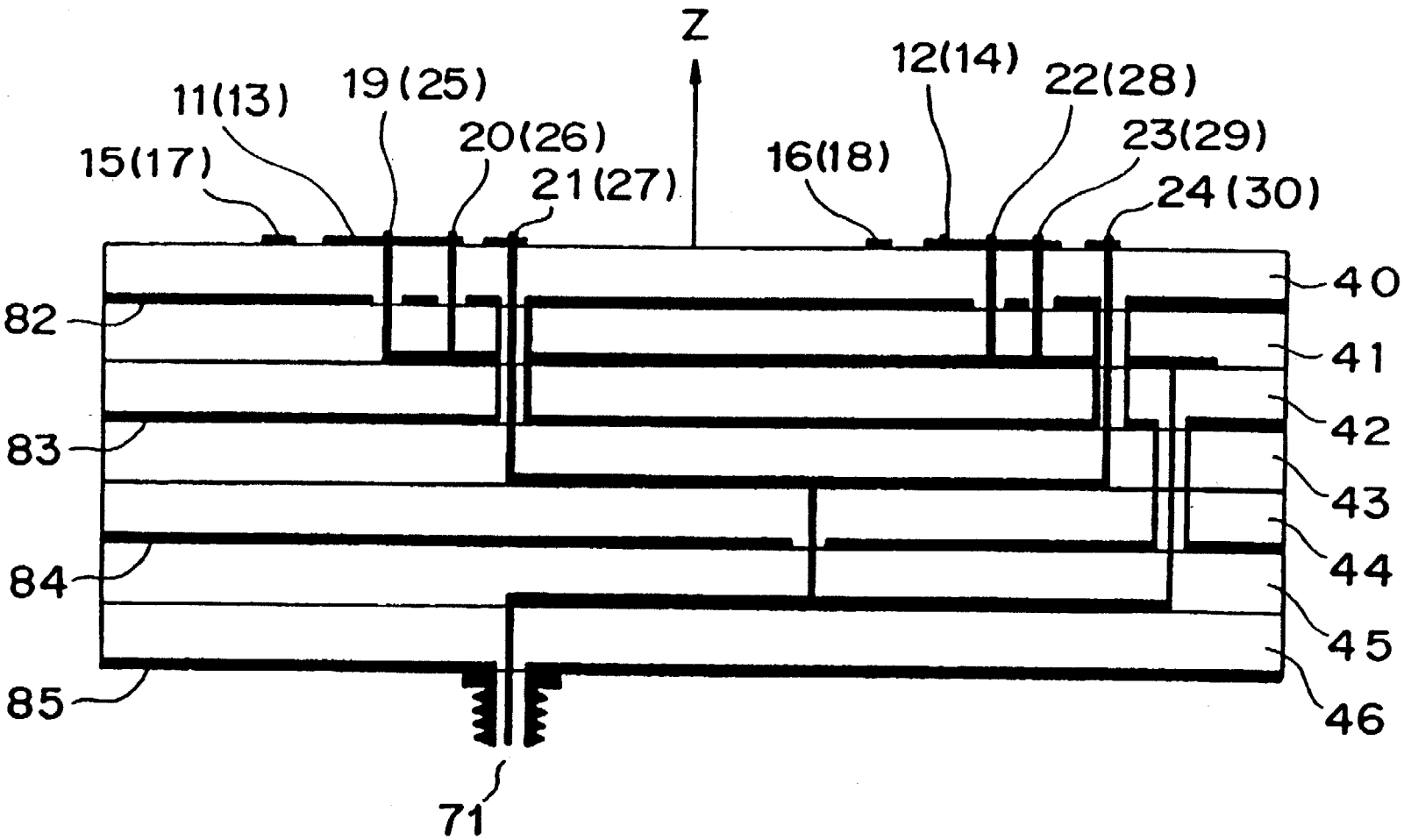
FIG. 8 is a sectional view showing the beam scanning antenna according to the first embodiment of the present invention.

Next, the construction of a practical example of the beam scanning antenna and the feeding circuit will be described. FIG. 7 is a top view showing the beam scanning antenna according to the first embodiment of the present invention. FIG. 8 shows a sectional view of FIG. 7. As shown in FIG. 8, the beam scanning antenna is constructed of seven dielectric substrates 40 to 46. On the upper surface of the dielectric substrate 40, circular microstrip antenna members 11 to 14, ring microstrip antenna members 15 to 18, and antenna feed points 19 to 30 are disposed, each of which is made of a conductor film. On the lower surface of the dielectric substrate 40, a ground conductor 82 is disposed. The ground conductor is made of a conductor film and functions as an antenna member. The dielectric substrates 41 and 42 form a first tri-plate line pattern for a dominant mode feeding circuit.

Figure 9:
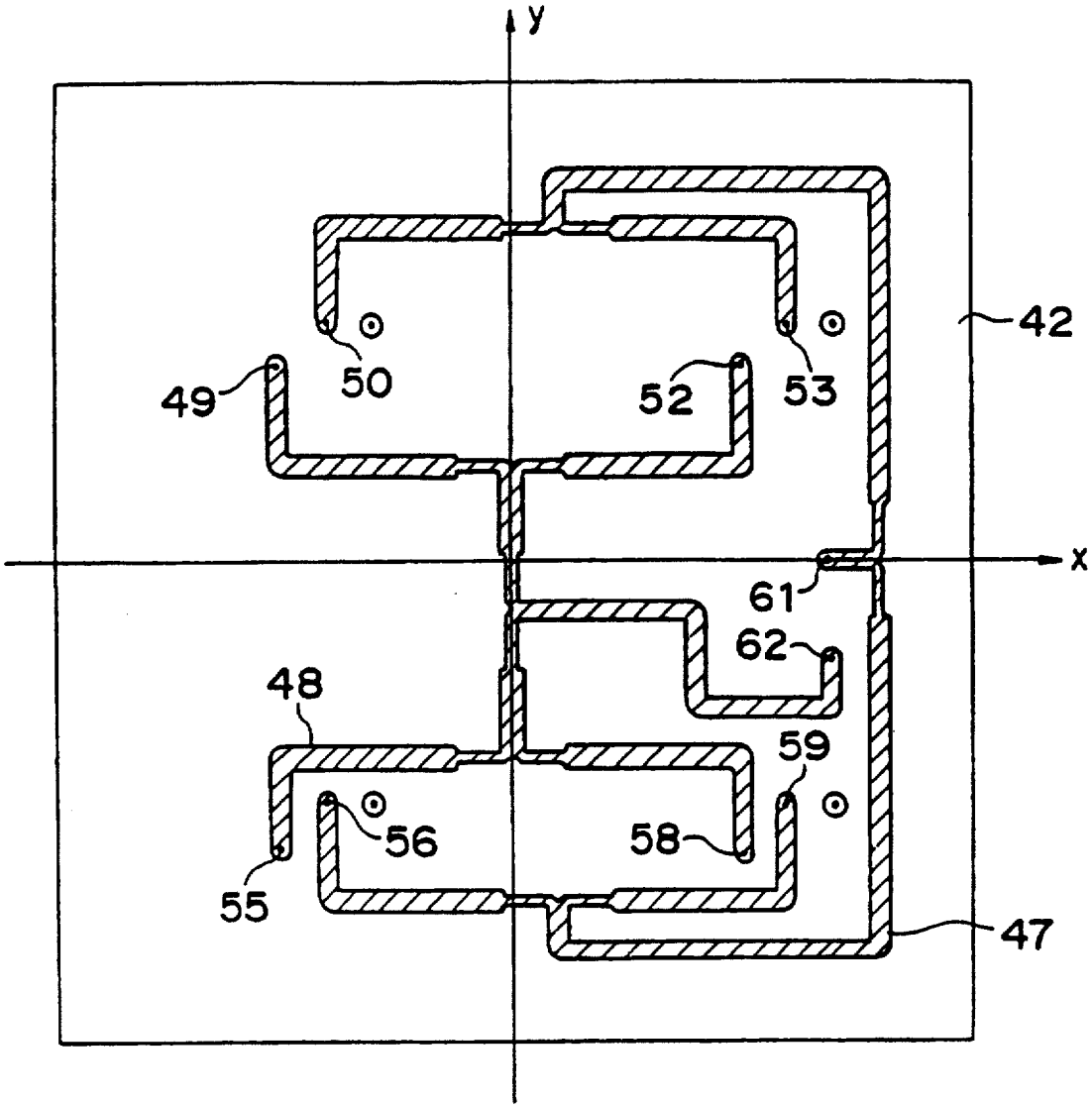
FIG. 9 is a schematic diagram showing a feeding circuit of the beam scanning antenna according to the first embodiment of the present invention.
Figure 10:
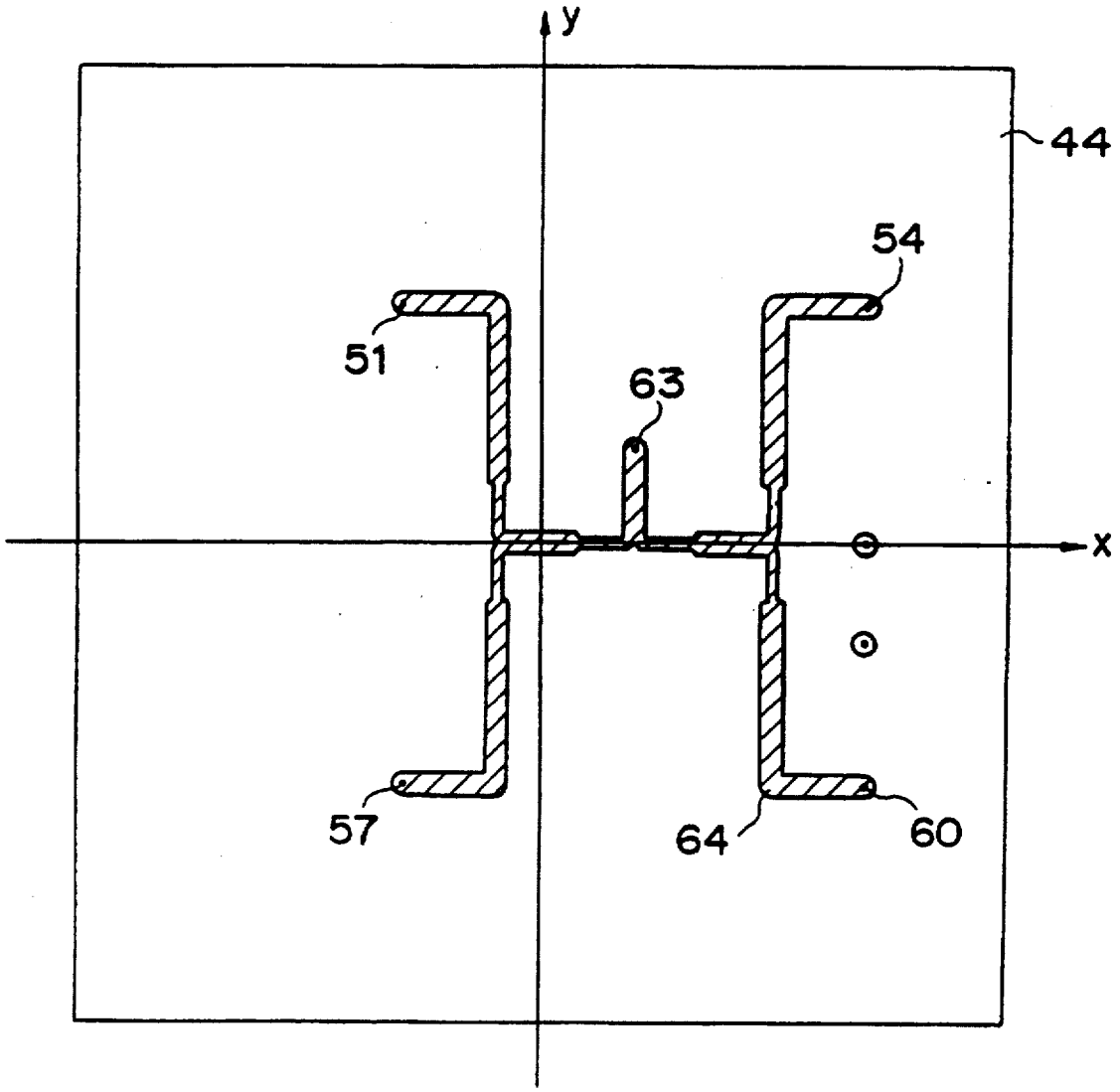
FIG. 10 is a circuit diagram showing a feeding circuit of the beam scanning antenna according to the first embodiment of the present invention.

The first tri-plate line pattern is formed of the ground conductors 82 and 83 and lines 47 and 48. The ground conductor 82 is made of a conductor film which is disposed on the upper surface of the dielectric substrate 41. The ground conductor 83 is made of a conductor film which is disposed on the lower surface of the dielectric substrate 42. The lines 47 and 48 are made of a conductor film which is disposed on the upper surface of the dielectric substrate 42. FIG. 9 shows the construction of an example of these lines. The lines 47 and 48 form feeding circuits for orthogonal components of the dominant mode. The feed points 19, 20, 22, 23, 25, 26, 28, and 29 of the dominant mode exciting antenna members are electrically connected to line input ports 49, 50, 52, 53, 55, 56, 58, and 59 by corresponding pins or the like, respectively. The feeding circuits combine the input signals of the dominant mode antenna members of each antenna element in the same phase. The feeding circuits output the orthogonal components of the dominant mode to output ports 61 and 62. As with the dominant mode feeding circuits, the dielectric substrates 43 and 44 forms a higher-order mode feeding circuit as a second tri-plate line pattern. The second tri-plate line pattern is formed of ground conductors 83 and 84 and a line 64. The ground conductor 83 is made of a conductor film which is disposed on the upper surface of the dielectric substrate 43. The ground conductor 84 is made of a conductor film which is disposed on the lower surface of the dielectric substrate 44. The line 64 is made of a conductor film which is disposed on the upper surface of the dielectric substrate 44. FIG. 10 shows the construction of this line. The feed points 21, 24, 27, and 30 of the high-order exciting antenna members are electrically connected to input ports 51, 54, 57, and 60 by pins, respectively. Vertical lines which pass through the dielectric substrates are coaxial lines which are through-holes. These lines are referred to as transverse electromagnetic mode (TEM) mode lines. As with the feeding circuits for the dominant mode, the feeding circuit for the higher-order mode combines the output signals of the higher-order mode exciting antenna members of each antenna element in the same phase. The feeding circuit outputs the composite signal to an output port 63.

Figure 11:
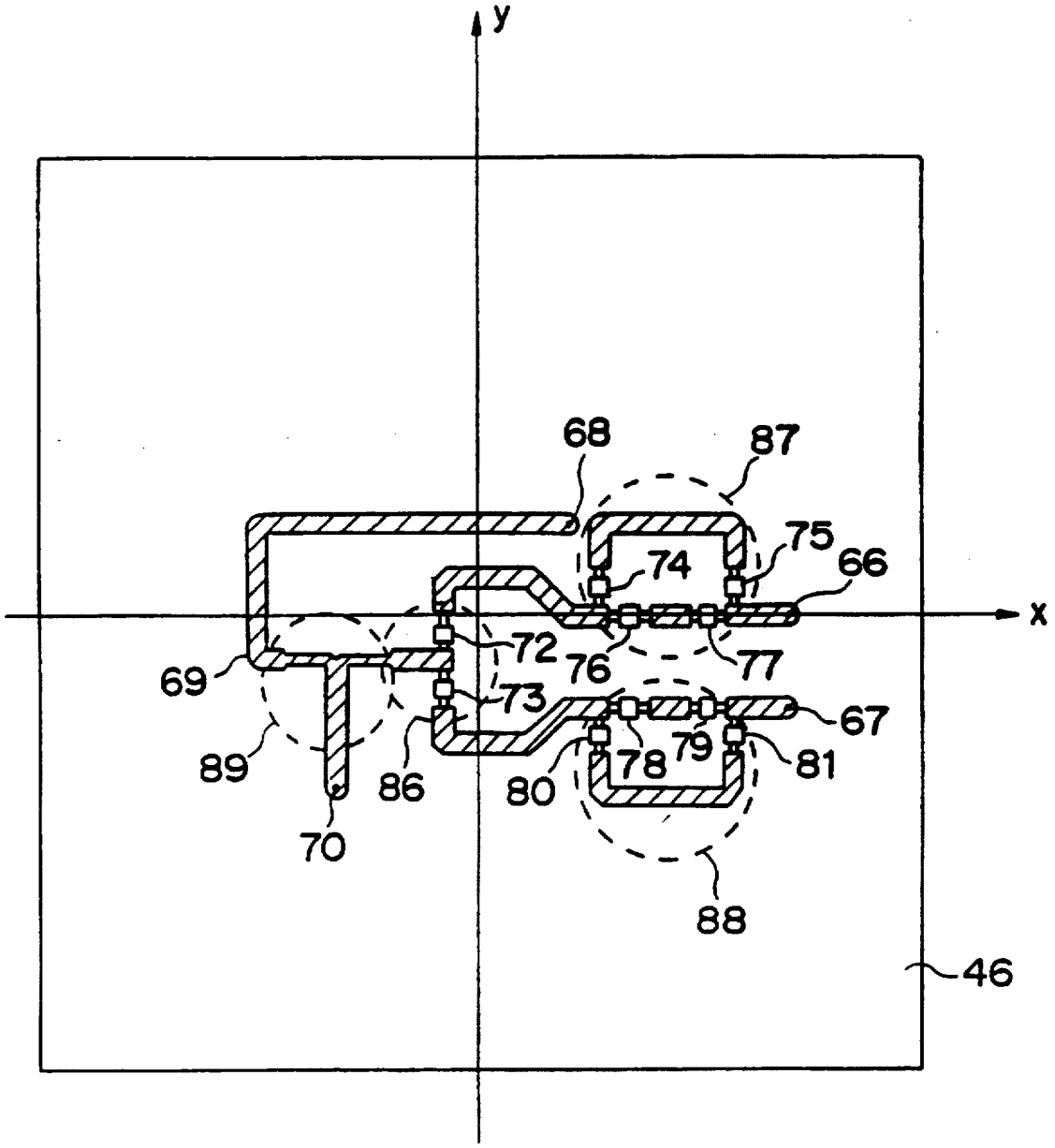
FIG. 11 is a circuit diagram showing a feeding circuit of the beam scanning antenna according to the first embodiment of the present invention.

The dielectric substrates 45 and 46 form the phase shifters, the RF switch, and so forth as a third tri-plate line pattern. The third tri-plate line pattern is formed of ground conductors 84 and 85, and a line 69. The ground conductor 84 is made of a conductor film which is disposed on the upper surface of the dielectric substrate 45. The ground conductor 85 is made of a conductor film which is disposed on the lower surface of the dielectric substrate 46. The line 69 is made of a conductor film which is disposed on the upper surface of the dielectric substrate 46. FIG. 11 shows the construction of the line 69. As shown in the figure, the output signals of the two feeding circuits for the dominant mode are sent to ports 66 and 67 via through-hole lines from the upper layer. The signals of the ports 66 and 67 are sent to the phase shifters 87 and 88 through lines, respectively. The phase shifters 87 and 88 shift the phase of the input signals for 0 degree or 180 degrees by changing the line length. To change the line length, the phase shifter 87 is constructed of PIN diodes 74, 75, 76, and 77, whereas the phase shifter 88 is constructed of PIN diodes 78, 79, 80, and 81. The output signals of the phase shifters 87 and 88 are sent to an RF switch 86 which selects one of these signals. The RF switch 86 is constructed of PIN diodes 72 and 73. The output signal of the RF switch 86 is sent to a combining device 89. The combining device 89 combines the signals received from the RF switch 86 and the port 68 with a predetermined combining ratio. The combining device 89 is constructed of a T-branch. The output of the combining device 89 is sent to a connector 71 through a port 70.

In FIG. 11, for the sake of simplicity, a bias circuit and a control circuit which are formed of PIN diodes are omitted. The bias circuit and the controlling circuit may be formed on the plane in any method. In this embodiment, instead of the PIN diodes, FETs may be used. The phase shifters and the combining device are not limited to those described above. In addition, to match signals among the feeding circuits, the lines, and so forth which are described above, a stub, a ¼λ transformer, or the like may be used.

In the above-described construction, a beam scanning antenna can be formed of dielectric substrates being layered. Thus, a thin type beam scanning antenna can be provided. Conductor films can be easily formed on dielectric substrates by etching process or the like. The substrates may be layered by machine screws, adhesive agent, adhesive films, or the like. The dielectric substrates each may have different composition and different permittivity each other. For example, to widen the band of the antenna, the uppermost dielectric substrate with a permittivity of nearly 1 may be used. Instead of the dielectric substrates, a honeycomb substance or the like may be used. In this embodiment, the feeding circuits for orthogonal components of the dominant mode are formed on the same layer. However, these feeding circuits may be formed on different layers. Likewise, the circular microstrip antenna members are formed on a layer different from the ring microstrip antenna members.

The beam scanning antenna in the above-described construction has the following effects and advantages.

First, the beam scanning antenna can be formed thinly and compactly. In addition, since the beam direction of a rotation angle $\phi$ of the antenna is electrically controlled on the plane with an angle $\theta$ to the boresight of the antenna, even if the antenna is installed at a high latitude place as in Japan, it is effectively used for an antenna for receiving and transmitting signals from and to communication and/or broadcasting satellites.

Moreover, since feeding circuits for respective modes are formed last and then the modes are selected and combined, the number of phase shifters can be remarkably reduced in comparison with the conventional antenna. Since the phase shifters, in particular, PIN diodes and FET used therein, are relatively expensive and the number thereof is decreased, the overall cost of the beam scanning antenna can be reduced.

Furthermore, since the number of PIN diodes is decreased, the bonding process using bonding wires or the like can be remarkably simplified. Thus, this is convenient for the production of the antenna. In the conventional electrically scanning antenna, as the number of antenna elements which construct the antenna increases, the number of phase shifters increases. However, according to the construction of this embodiment, even if the number of antenna elements increases, it is not necessary to proportionally increase the number of phase shifters. Thus, the more the number of antenna elements increases, the more the construction of the antenna is simplified in comparison with the conventional electrically scanning antenna. Thus, the overall cost of the antenna can be reduced.

In addition, according to the construction of this embodiment, since the antenna element spacing is larger than the of the conventional antenna, the size of each antenna element can be increased, thereby improving the gain thereof. Moreover, in comparison with the conventional electrically scanning antenna, due to a less restriction with respect to the antenna element pitch, the degree of freedom for the construction and type of each antenna element is high.

Furthermore, since the antenna element pitch can be increased, the electrical coupling between antenna elements decreases. Thus, the exciting distribution of the antenna does not deviate from a predetermined value. Therefore, the radiation directivity and the like are not adversely affected.

The embodiment of the present invention may be modified as follows.

In the first embodiment, a beam scanning antenna which receives a radio wave was described. However, because of the antenna's reciprocity theorem, the beam scanning antenna which transmits a radio wave can be formed almost in the same construction of the above-described embodiment. In the embodiment, as the antenna type, the dominant mode was excited by circular microstrip antenna members and the higher-order mode was excited by ring microstrip antenna member. However, the present invention is not limited to such construction. Instead, other antenna members having the different shape and different type may be used. With another mode, a beam with a angle $\theta$ to the boresight may be combined.

In addition, to widen the band width of the antenna, parasitic devices being stacked may be used. In this construction, the same effect as the present invention may be obtained. In the above-described embodiment, as a feeding method for microstrip antenna members, pin feeding was used. Instead, another feeding method such as electromagnetic coupling method using slots or the like, direct feeding method using microstrip lines, etc. may be used.

As the RF lines, besides the tri-plate line patterns, other lines (such as suspended lines, microstrip lines, coaxial lines) may be used. In the first embodiment, a vertically polarized wave was considered. However, the present invention can be applied for a horizontally polarized wave in the same construction. This also applies to a circularly polarized wave (which will be described in another embodiment).

In the first embodiment, the antenna where antenna elements are disposed in a square shape was described. However, the present invention does not require that the antenna elements should be disposed strictly in a square shape. Instead, when a beam is scanned in a predetermined direction, if the optical path difference between adjacent antenna elements is around 0.20 λ of a multiple of the wave length, the difference between the vertical length and the horizontal length of the antenna elements does not affect the characteristics of the antenna.

Next, a second embodiment of the present invention will be described. In the first embodiment, a beam can be scanned in the directions of the direction angles $\phi$ at every 90 degrees. According to the second embodiment of the present invention, a beam can be scanned in the directions of the direction angles $\phi$ at every 45 degrees. In this embodiment, as with the first embodiment, a beam scanning antenna which receives a vertically polarized wave will be described.

Figure 12:
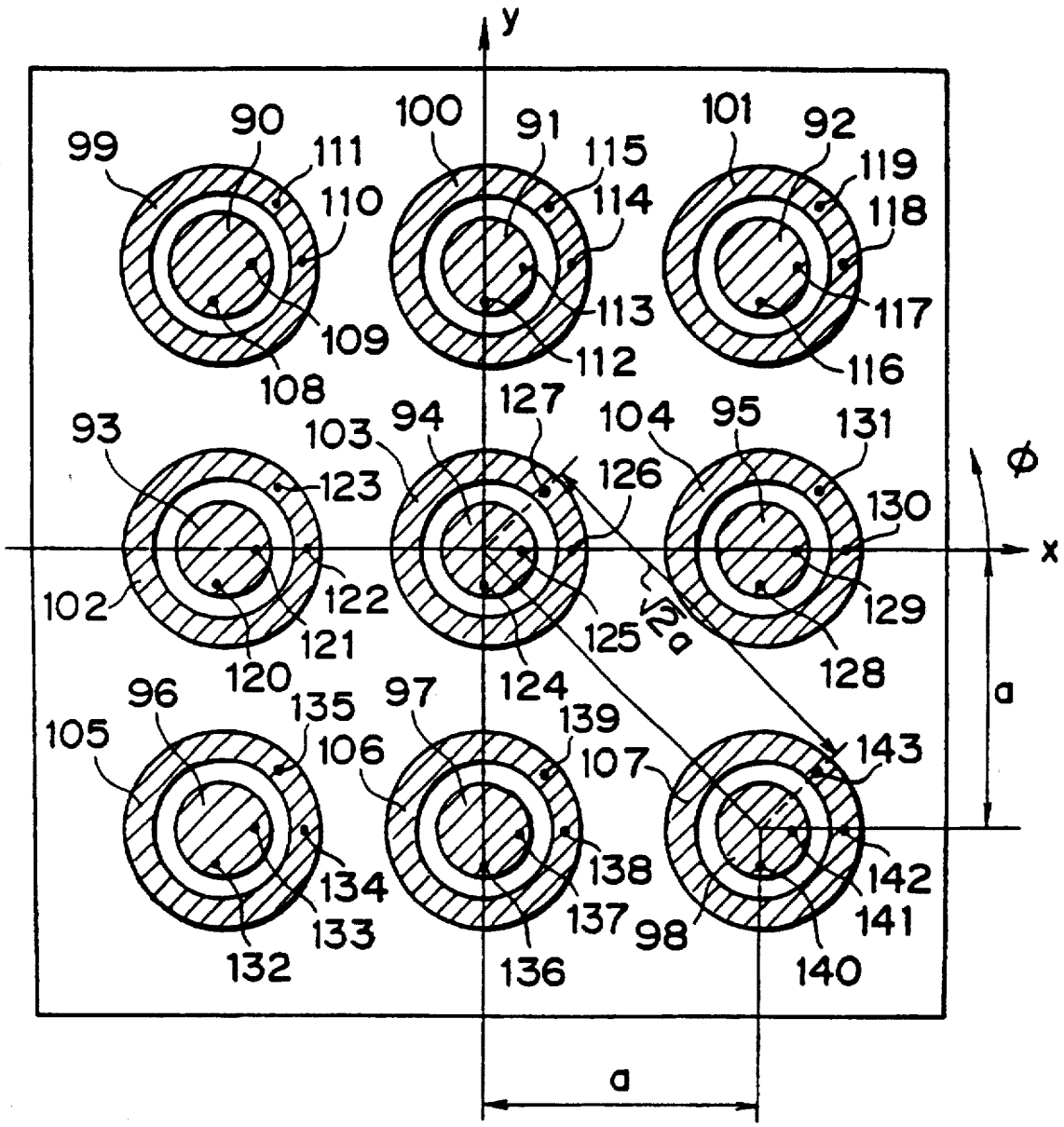
FIG. 12 is a top view showing a beam scanning antenna according to a second embodiment of the present invention.

FIG. 12 is a top view showing the beam scanning antenna according to the second embodiment of the present invention. In this embodiment, the beam scanning antenna has nine antenna elements. As with the first embodiment, the beam scanning antenna is formed of dominant mode exciting antenna members 90 to 98 and higher-order mode exciting antenna members 99 to 107. Each antenna element is constructed of one dominant mode exciting antenna member and one higher-order mode exciting antenna member.

Each antenna member is a pin-feed (coaxial feed) microstrip antenna member. For a first component of the first dominant mode (TE11 mode), there are feed points 108, 112, 116, 120, 124, 128, 132, 136, and 140. For a second component of the dominant mode which is orthogonal to the first component, there are feed points 109, 113, 117, 121, 125, 129, 133, 137, and 141. For a first component of the higher-order mode, which is TM 21 mode, there are feed points 110, 114, 118, 122, 126, 130, 134, 138, and 142. For a second component of the higher-order mode which is orthogonal to the first component of the higher-order mode, there are feed points 111, 115, 119, 123, 127, 131, 135, 139, and 143. As with the first embodiment, the antenna elements of the second embodiment can scan their beam in the direction of an angle θ to the boresight (z direction) of the antenna. The beam can be scanned in the directions of the direction angles ϕ=0 degree, ±45 degrees, ±90 degrees, ±135 degrees, and 180 degrees by an electric means such as phase shifters and an RF switch. Both the optical path difference (a×sin θ) (in the case of direction angles ϕ=0 degree, ±90 degrees, and 180 degrees) and $[(2^{1/2}/2)\times a\times \sin\theta]$ (in the case of direction angles ϕ=±45 degrees and ±90 degrees) of a radio wave received by adjacent antenna elements are set to nearly a multiple of the wave length of the radio wave in free space (where a is the antenna element pitch; and θ is the elevation angle of the beam to the boresight of the antenna.

Figure 13:
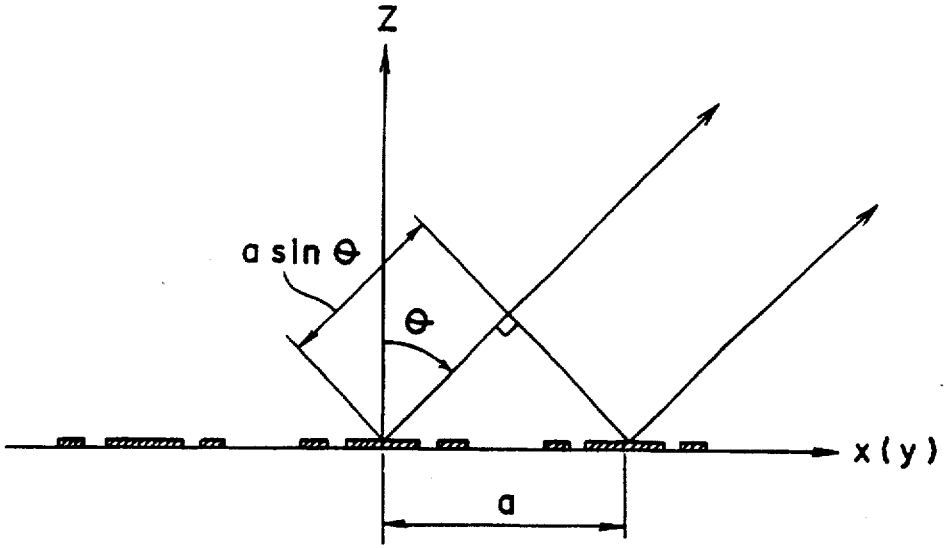
FIG. 13 is a schematic diagram showing the optical path difference between antenna elements of the beam scanning antenna according to the second embodiment of the present invention.
Figure 14:
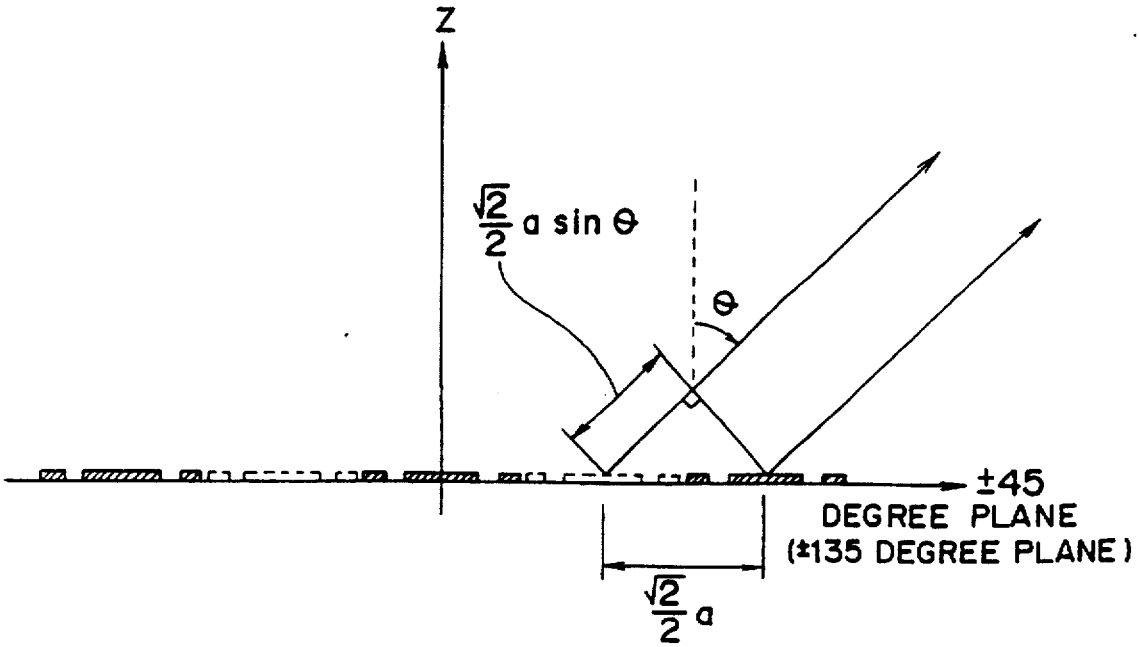
FIG. 14 is another schematic diagram showing the optical path difference between the antenna elements of the beam scanning antenna according to the second embodiment of the present invention.

FIGS. 13 and 14 shows the relation between optical path difference and rotation angle ϕ of adjacent antenna elements. Table 2 gives an example of antenna element pitch a.

TABLE 2

| a | a × sin θ | (√2/2) × a × sin θ |
|---|---|---|
| (a) θ = 30 deg. | | |
| 6.0 λ | 3.0 λ | 2.121 λ |
| 12.0 λ | 6.0 λ | 4.121 λ |
| (b) θ = 45 deg. | | |
| 4.243 λ | 3.0 λ | 2.121 λ |
| 8.445 λ | 6.0 λ | 4.121 λ |
| (c) θ = 60 deg. | | |
| 3.464 λ | 3.0 λ | 2.121 λ |
| 8.445 λ | 6.0 λ | 4.121 λ |

*λ = wave length in free space

The permissible optical path difference which is (a×sin θ) or $[(2^{1/2}/2)\times a\times \sin\theta]$ is around 0.20 λ of a multiple of wave length of the radio wave.

In the above-described construction, provided that the beam is scanned in the directions of the direction angles ϕ=0 degree, ±45 degrees, ±90 degrees, ±135 degrees, and 180 degrees on the plane tilted for the angle θ to the boresight of the antenna, when each antenna element is excited in the same phase, a high gain can be obtained.

The beam of each antenna element can be scanned in the direction of the rotation angle ϕ on the plane tilted for the angle θ to the boresight of the antenna by an electric means such as phase shifters and an RF switch. Next, this operation will be described.

In the following description, one antenna element is considered. The dominant mode exciting antenna member 90 is a circular microstrip antenna member, whereas the higher-order mode exciting antenna member 99 is a ring microstrip antenna. The dominant mode exciting antenna member 90 is excited at the feed points 108 and 109. A first component of the dominant mode excited at the feed point 108 is orthogonal to a second component of the dominant mode excited at the feed point 109. Likewise, the higher-order mode exciting antenna member 99 is excited at the feed points 110 and 111. A first component of the higher-order mode excited at the feed point 110 is orthogonal to a second component of the higher-order mode excited at the feed point 111.

Figure 15:
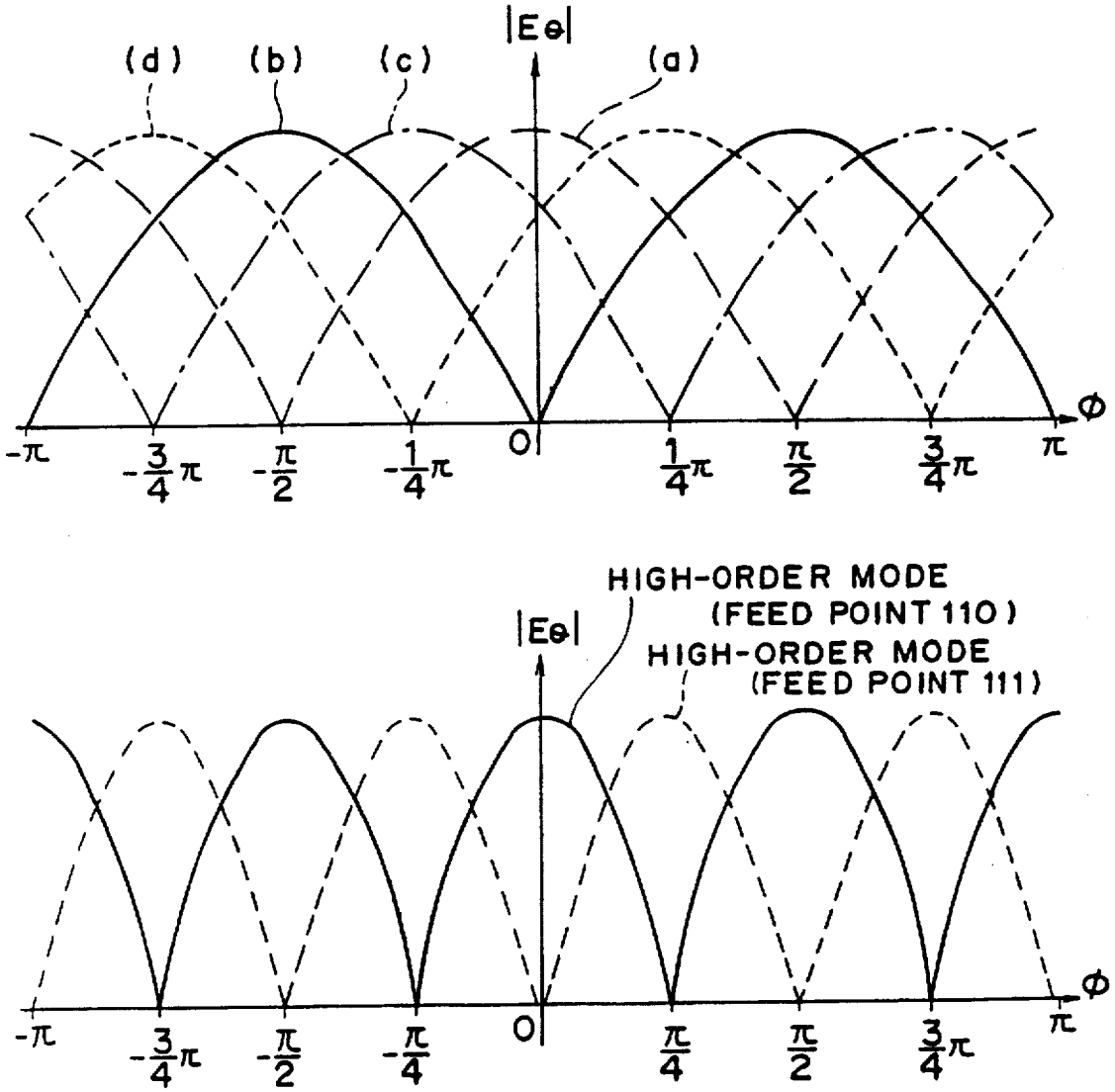
FIG. 15 is a graph showing the radiation directivity of the antenna element (which operates in dual mode) of the beam scanning antenna according to the second embodiment of the present invention.

Now, consider the TM 11 mode of the circular microstrip antenna member as the dominant mode and the TM 21 mode of the ring microstrip antenna member as the higher-order mode. As with the first embodiment, the variation of component $E_\theta$ of the radiation field in each mode is shown in FIG. 15. In the figure, (a) represents the second component of the dominant mode (feed point 109); (b) represents the first component of the dominant mode (feed point 108); (c) represents a mode where the two components of the dominant mode are combined with the same amplitude and the same phase; and (d) represents a mode where the two components of the dominant mode are combined with the same amplitude and the reverse phase. In this figure, the radiation fields of the components and composite modes of the dominant modes are normalized so that the maximum values thereof match each other. As shown in the figure, the second component of the dominant mode (feed point 109) has two peaks at ϕ=0 degree and 180 degrees. The first component of the dominant mode (feed point 108) has two peaks at ϕ=±90 degrees. When the two components of the dominant mode are combined with the same amplitude and the same phase, there are two peaks at ϕ=135 degrees and −45 degrees. When the two components of the dominant mode are combined with the same amplitude and the different phase, there are two peaks at ϕ=45 degrees and −135 degrees. The first component of the higher-order mode (feed point 110) has three peaks at ϕ=0 degree, ±90 degrees, and 180 degrees. The second component of the higher-order mode (feed point 111) has four peaks at ϕ=±45 degrees and ±135 degrees.

Thus, in the condition that the beam is tilted for an predetermined angle θ to the boresight, when one of the four dominant mode patterns and one of the two higher-order mode patterns are combined with the same amplitude and the same phase or different phases, radiation directivity with a high gain can be obtained at the directions of direction angles ϕ=0 degree, ±45 degrees, ±90 degrees, ±135 degrees, and 180 degrees.

Thus, unlike with the first embodiment where a beam is scanned at every 90 degrees, according to the second embodiment, a beam can be scanned at every 45 degrees. The second embodiment is convenient for a case where a beam should be accurately scanned when the gain of the antenna is high and the beam width is narrow.

Figure 16:
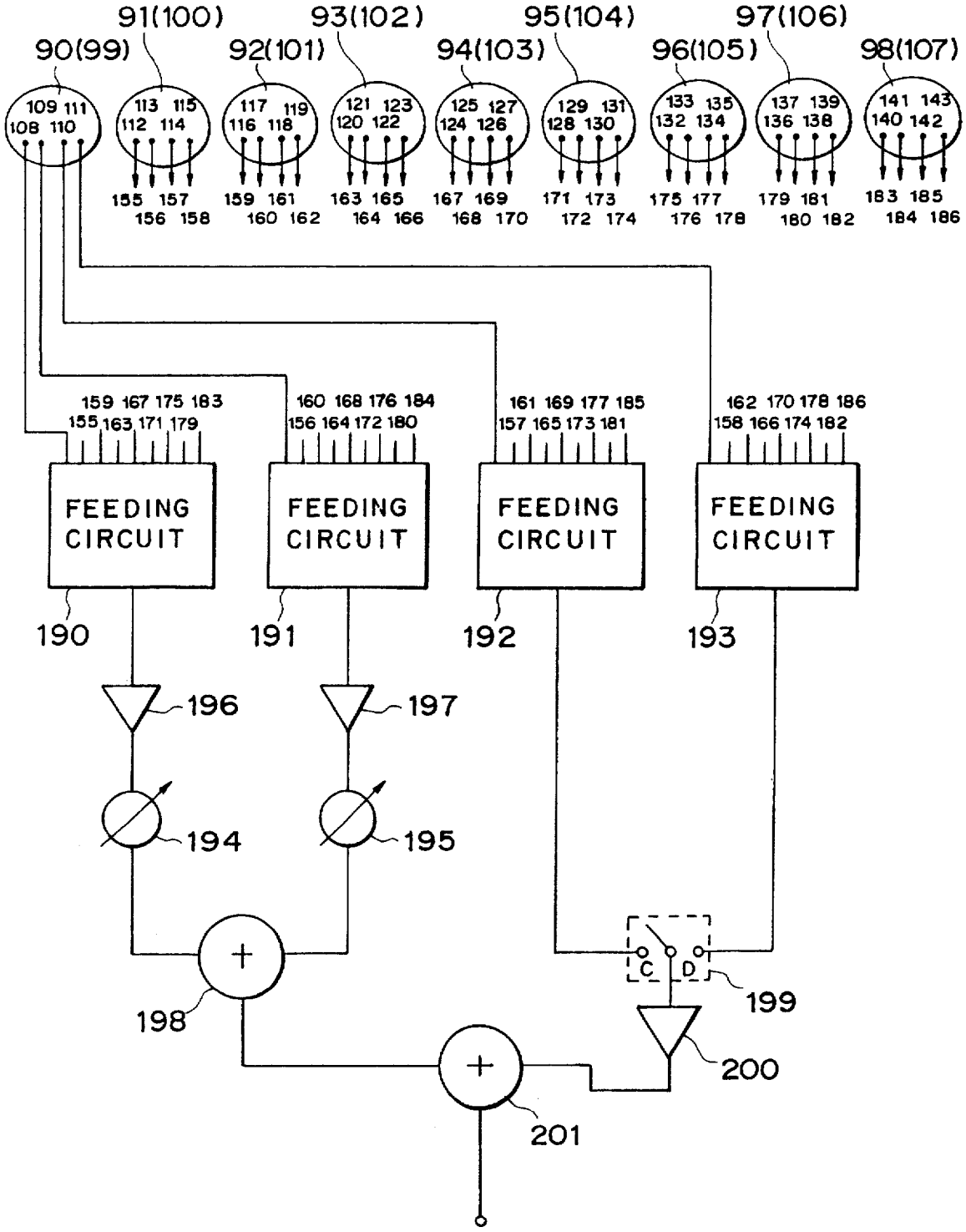
FIG. 16 is a circuit diagram showing the construction of a feeding system of the beam scanning antenna according to the second embodiment of the present invention.

FIG. 16 shows the construction of an example of a feeding system of the beam scanning antenna of FIG. 12. Signals are received from the dominant mode feed points and higher-order feed points of the antenna elements 90 to 98 (which are denoted by reference numerals of the dominant mode antenna members) through RF lines such as microstrip lines and coaxial lines. The signals received from the first feed points 108, 112, 116, 120, 124, 128, 132, 136, and 140 of the dominant mode antenna members are combined by a feeding circuit 190. The signals received from the second feed points 109, 113, 117, 121, 125, 129, 133, 137, and 141 of the dominant mode antenna elements are combined by a feeding circuit 191. The signals received from the first feed points 110, 114, 118, 122, 126, 130, 134, 138, and 142 of the higher-order mode antenna elements are combined by a feeding circuit 192. The signals received from the second feed points 111, 115, 119, 123, 127, 131, 135, 139, and 143 of the higher-order mode antenna elements are combined by a feeding circuit 193. In these feeding circuits, the signals received from all the antenna elements are combined in the same phase. The output signals of the feeding circuits 190 and 191 for the dominant mode are sent to phase shifters 194 and 195 through amplifiers 196 and 197, respectively.

In this embodiment, since the phase shifters 194 and 195 only shift the phases of the input signals for 0 degree or 180 degrees, the construction thereof is simple. The amplifiers only amplify the input signals so that the amplification factor of the two components of the dominant mode becomes one of 2:0, 1:1, and 0:2. The output signals of the phase shifters 194 and 196 are sent to a combining device 198 which combine these signals. The output signal of the combining device 198 is sent to a combining device 201. The output signals of the higher-order mode feeding circuits 192 and 193 are sent to an RF switch 199 which selects one of the two components of the higher-order mode. The output signal of the RF switch 199 is sent to an amplifier 200. The output signal of the amplifier 200 is sent to the combining device 201. The amplifier 200 amplifies the signal of the higher-order mode so that the amplitude of the dominant mode is equal to that of the higher-order mode. When the elevation angle θ to the boresight is predetermined, the amplitude of the amplifier 200 becomes constant. By adjusting the length of lines (namely, the phase shifters 194 and 195, the amplifiers 196 and 197, and the RF switch 199 as in Table 3), the beam can be scanned in the direction of the rotation angle ϕ.

TABLE 3

| Rotation Angle ϕ | Phase of phase shifter 194 | Phase of phase shifter 195 | Amplitude of amplifier 196 | Amplitude of amplifier 197 | RF switch |
|---|---|---|---|---|---|
| 180 deg. | — | 180 deg. | 0 | ×2 | C |
| 135 deg. | 180 deg. | 180 deg. | ×1 | ×1 | D |
| 90 deg. | 180 deg. | — | ×2 | 0 | C |
| 45 deg. | 180 deg. | 0 deg. | ×1 | ×1 | C |
| 0 deg. | — | 0 deg. | 0 | ×2 | C |
| −45 deg. | 0 deg. | 0 deg. | ×1 | ×1 | D |
| −90 deg. | 0 deg. | — | ×2 | 0 | C |
| −135 deg. | 0 deg. | 180 deg. | ×1 | ×1 | D |

In Table 3, for columns of phase shifter which do not represent phase, any degrees may be designated. In addition, ×n (where n is any positive integer) in columns of amplifiers represents that a predetermined reference value is amplified n times.

In the above-described construction, the feeding system of the beam scanning antenna which can scan a beam in the directions of the direction angles ϕ at every 45 degrees can be constructed of the above-described two phase shifters, three amplifiers (one of which is a fixed amplifier), and one RF switch. In this construction, instead of the amplifiers, attenuators may be used.

Figure 17:
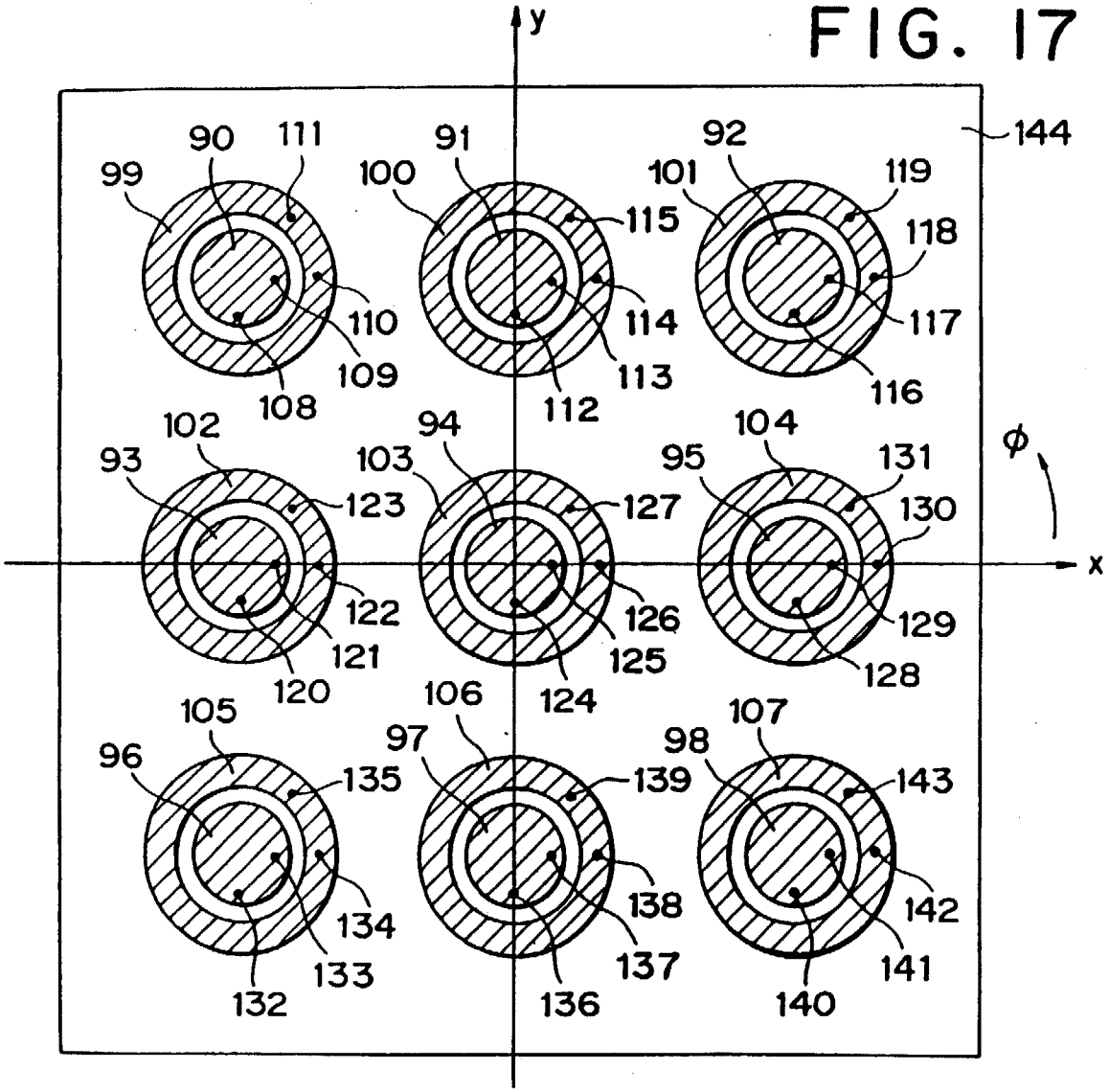
FIG. 17 is a top view showing the beam scanning antenna according to the second embodiment of the present invention.
Figure 18:
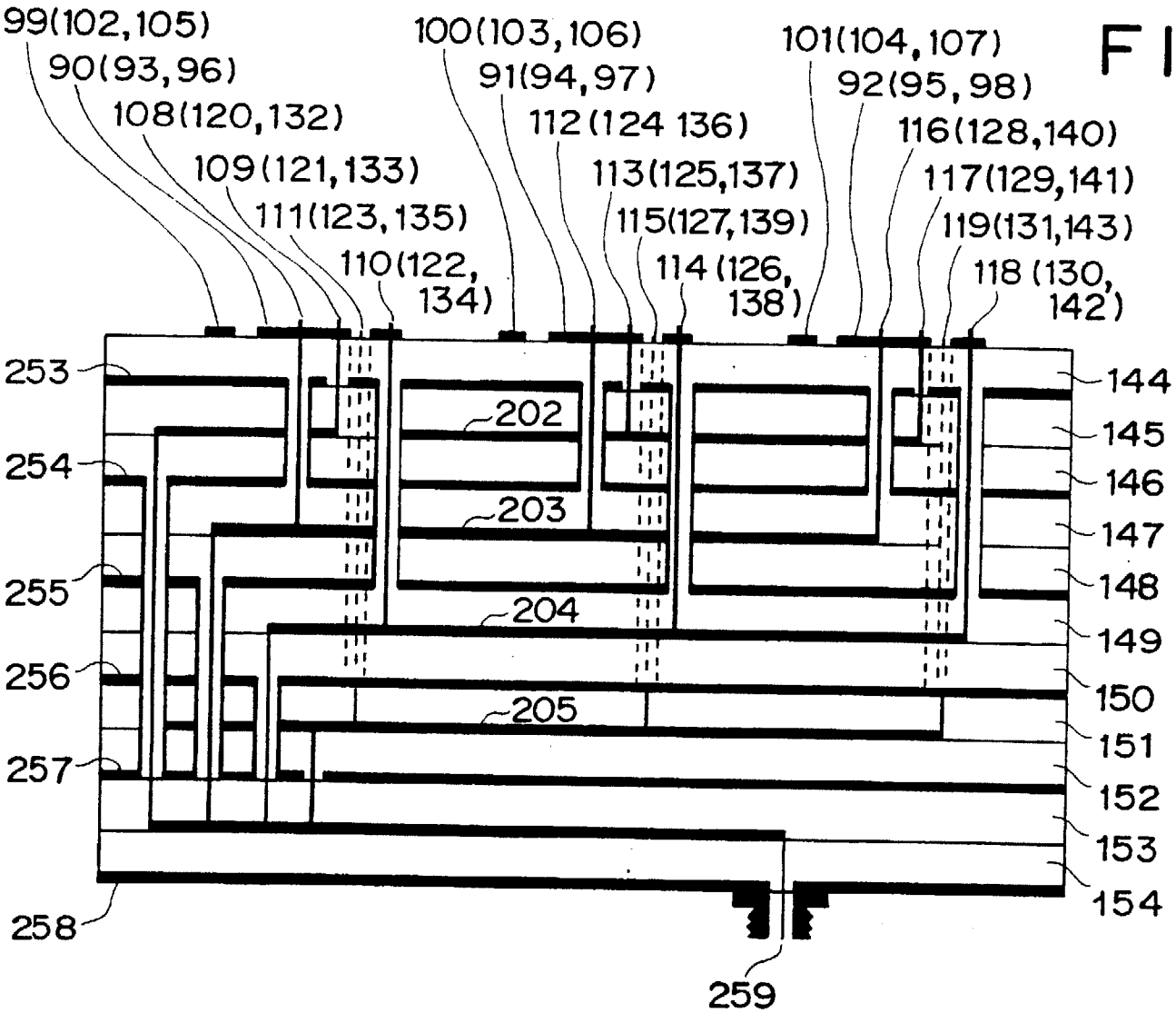
FIG. 18 is a sectional view showing the beam scanning antenna according to the second embodiment of the present invention.

Next, the construction of a practical example of the above described beam scanning antenna and the feeding circuits thereof will be described. FIG. 17 is a top view showing the beam scanning antenna according to the second embodiment of the present invention. FIG. 18 is a sectional view of FIG. 17.

As shown in FIG. 18, the beam scanning antenna according to the second embodiment is formed of 11 dielectric substrates 144 to 154 being layered. On the upper surface of the dielectric substrate 144, the circular microstrip antenna members 90 to 98, the ring microstrip antenna members 99 to 107, and the feed points 108 to 143 are formed, each of which is made of a conductor film. On the lower surface of the dielectric substrate 144, a ground conductor 253 is formed. The ground conductor 253 is made of a conductor film and functions as an antenna member. The dielectric substrates 145 and 146 forms a first dominant mode feeding circuit as a first tri-plate line pattern. The first tri-plate line pattern is formed of ground conductors 253 and 254, and a line pattern 202. The ground conductor 253 is made of a conductor film which is disposed on the upper surface of the dielectric substrate 145. The ground conductor 254 is made of a conductor film which is disposed on the lower surface of the dielectric substrate 14. The line pattern 202 is made of a conductor film disposed on the upper surface of the dielectric substrate 146.

Likewise, the dielectric substrates 147 and 148 form a second dominant mode feeding circuit as a second tri-plate line pattern. The second tri-plate line pattern is formed of the ground conductor 254, a ground conductor 255, and a line pattern 203. The ground conductor 254 is made of a conductor film which is disposed on the upper surface of the dielectric substrate 147. The ground conductor 255 is made of a conductor film which is disposed on the lower surface of the dielectric substrate 148. The line pattern 203 is made of a conductor film disposed on the upper surface of the dielectric substrate 148.

As with the dominant mode feeding circuits, the dielectric substrates 149 and 150 form a first higher-order mode feeding circuit as a third tri-plate line pattern. The third tri-plate line pattern is formed of the ground conductor 255, a ground conductor 256, and a line pattern 204. The ground conductor 255 is made of a conductor film which is disposed on the upper surface of the dielectric substrate 149. The ground conductor 256 is made of a conductor film which is disposed on the lower surface of the dielectric substrate 150. The line pattern 204 is made of a conductor film which is disposed on the upper surface of the dielectric substrate 150. The dielectric substrates 151 and 152 form a second higher-order mode feeding circuit as a fourth tri-plate line pattern. The fourth tri-plate line pattern is formed of the ground conductor 256, a ground conductor 257, and a line pattern 205. The ground conductor 256 is made of a conductor film which is disposed on the upper surface of the dielectric substrate 151. The ground conductor 257 is made of a conductor film which is disposed on the lower surface of the dielectric substrate 152. The line pattern 205 is made of a conductor film which is disposed on the upper surface of the dielectric substrate 152.

Figure 19:
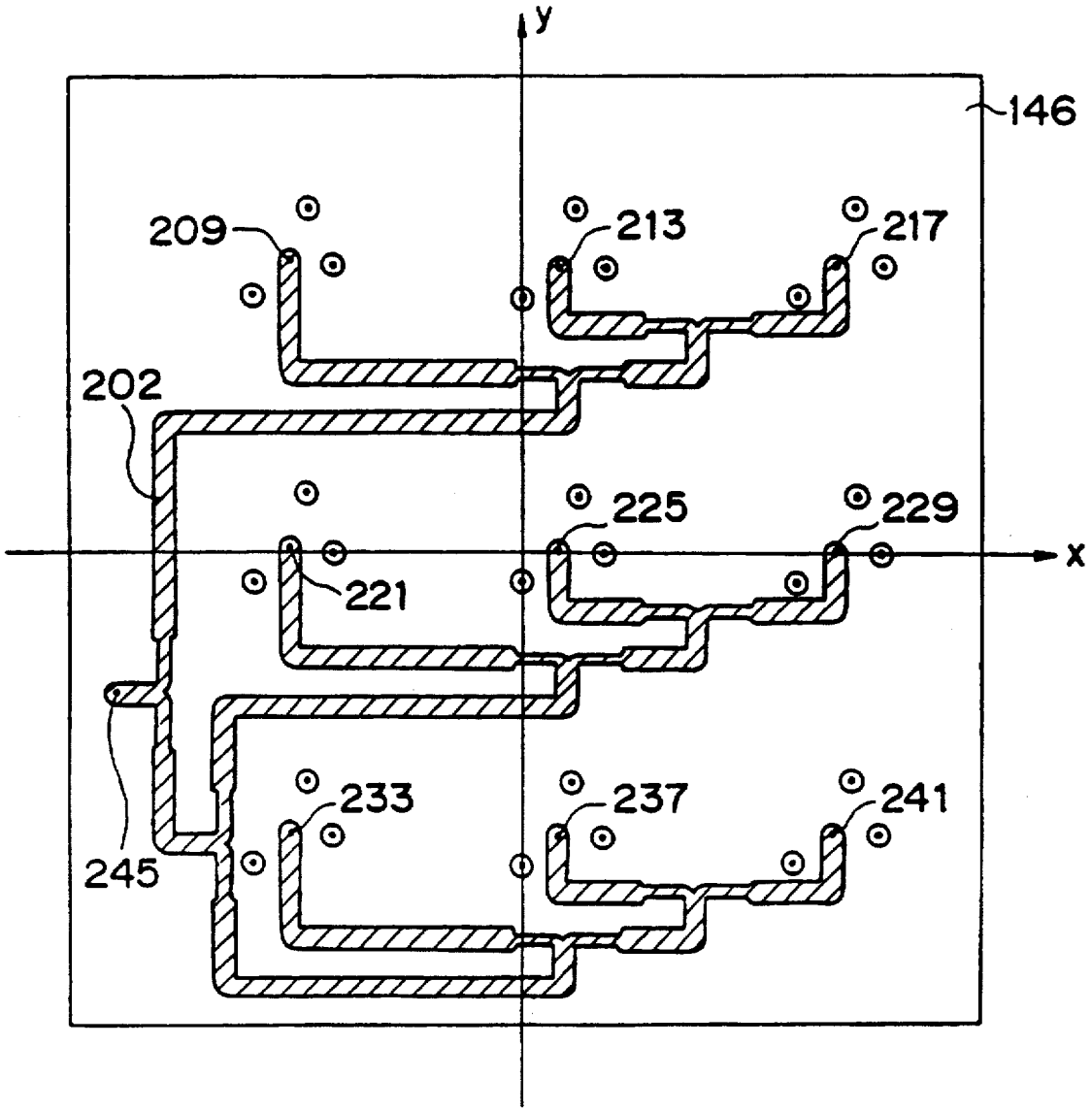
FIG. 19 is a schematic diagram showing a feeding circuit of the beam scanning antenna according to the second embodiment of the present invention.
Figure 20:
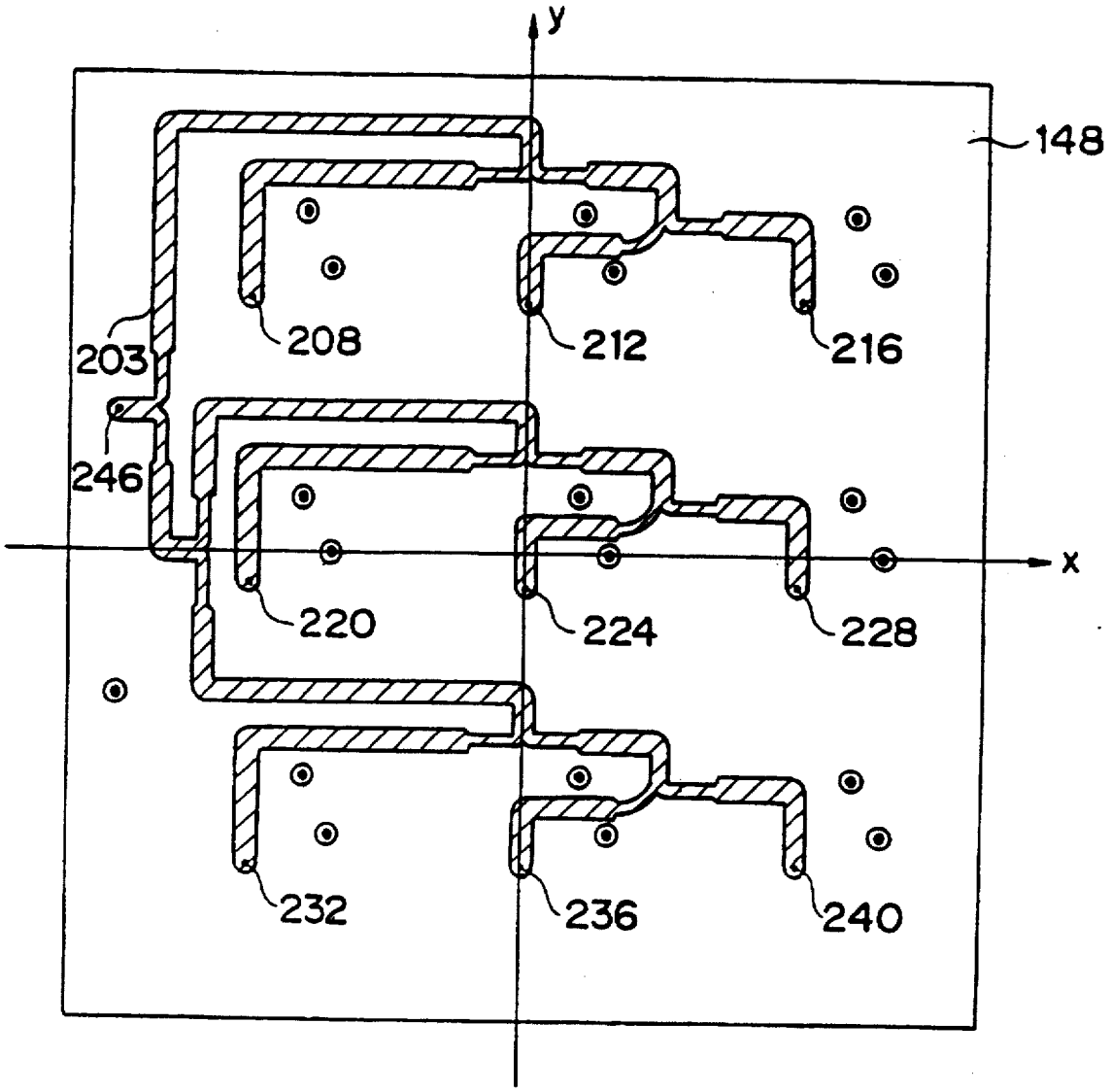
FIG. 20 is a schematic diagram showing a feeding circuit of the beam scanning antenna according to the second embodiment of the present invention.
Figure 21:
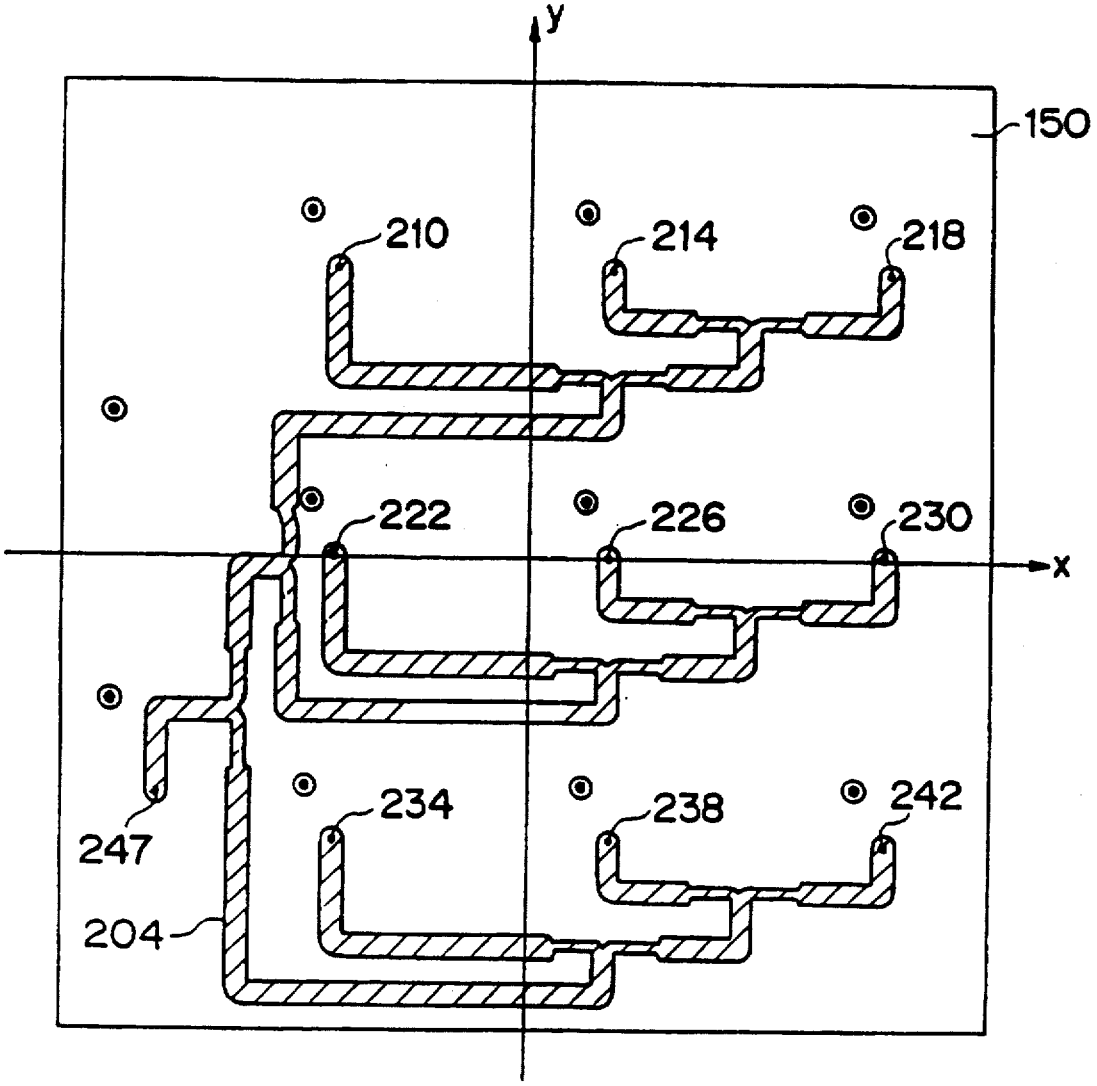
FIG. 21 is a schematic diagram showing a feeding circuit of the beam scanning antenna according to the second embodiment of the present invention.
Figure 22:
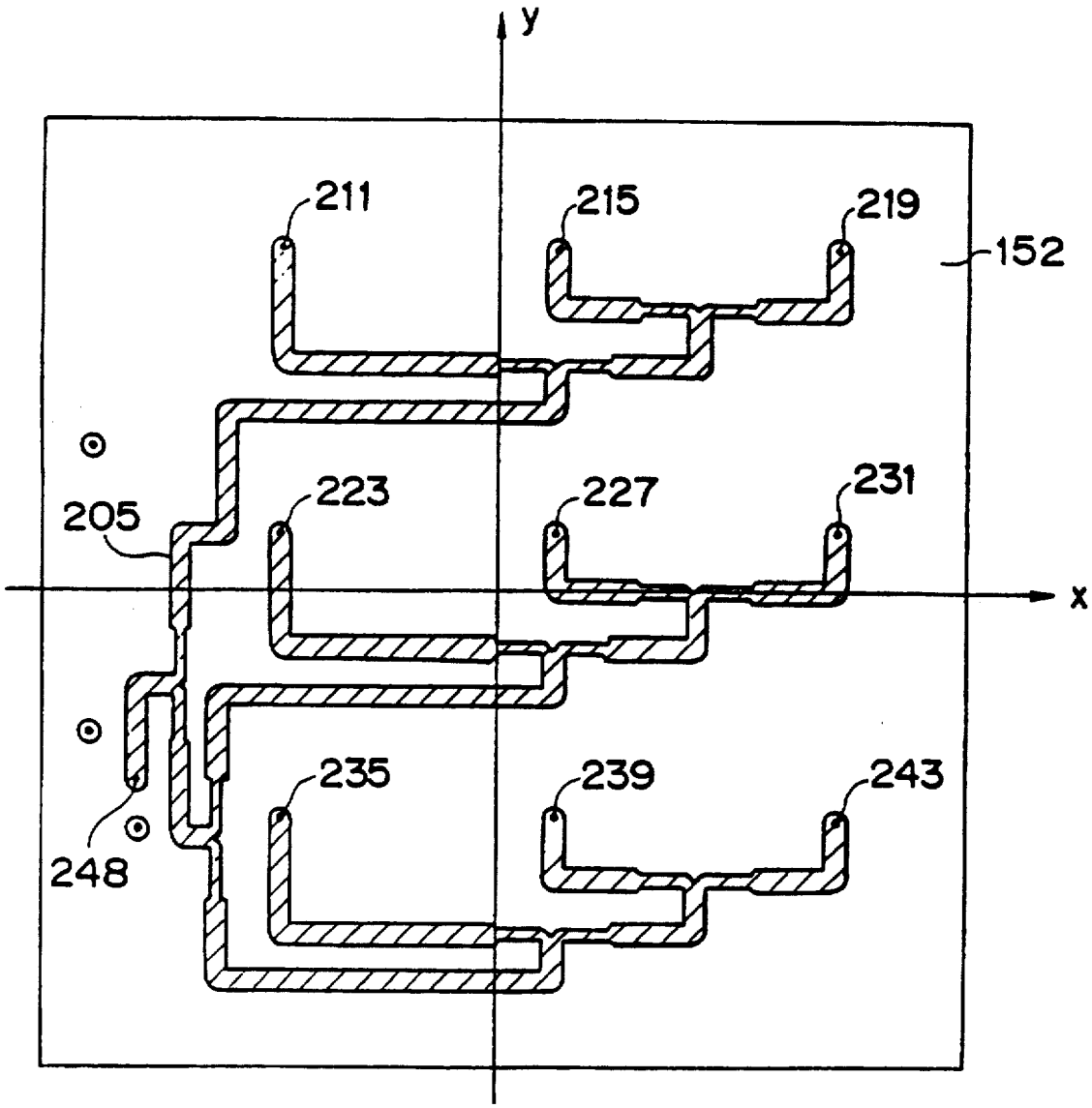
FIG. 22 is a schematic diagram showing a feeding circuit of the beam scanning antenna according to the second embodiment of the present invention.

FIG. 19 shows the line 202. FIG. 20 shows the line 203. FIG. 22 shows the line 205. In these feeding circuits, signals received from all antenna elements are combined in the same phase.

On the line 202, the antenna feed points 109, 113, 117, 121, 125, 129, 133, 137, and 141 are electrically connected to input ports 209, 213, 217, 221, 225, 229, 233, 237, and 241, respectively. On the line 203, the antenna feed points 108, 112, 116, 120, 124, 128, 132, 136, and 140 are electrically connected to input ports 208, 212, 216, 220, 224, 228, 232, 236, and 240, respectively. On the line 204, the antenna feed points 110, 114, 118, 122, 126, 130, 134, 138, and 142 are electrically connected to input ports 210, 214, 218, 222, 226, 230, 234, 238, and 242, respectively. On the line 205, the antenna feed points 111, 115, 119, 123, 127, 131, 135, 139, and 143 are electrically connected to input ports 211, 215, 219, 223, 227, 231, 235, 239, and 243, respectively. These connections are coaxial lines (TEM lines) which are through-holes or the like which vertically pass through the dielectric substrates.

Output ports 245, 246, 247, and 248 of the feeding circuits are connected to input ports 249, 250, 251, and 252 on the lowermost layer via lines which vertically pass through the dielectric substrates, respectively. On the lowermost layer, the dielectric substrates 153 and 154 form phase shifters, amplifiers, RF switch, and so forth as a fifth tri-plate line pattern. The fifth tri-plate line pattern is formed of the ground conductor 257, a ground conductor 258, and a line.

The ground conductor 257 is made of a conductor film which is disposed on the upper surface of the dielectric substrate 153. The ground conductor 258 is made of a conductor film which is disposed on the lower surface of the dielectric substrate 154. The line is made of a conductor film which is disposed on the upper surface of the dielectric substrate 154.

Figure 23:
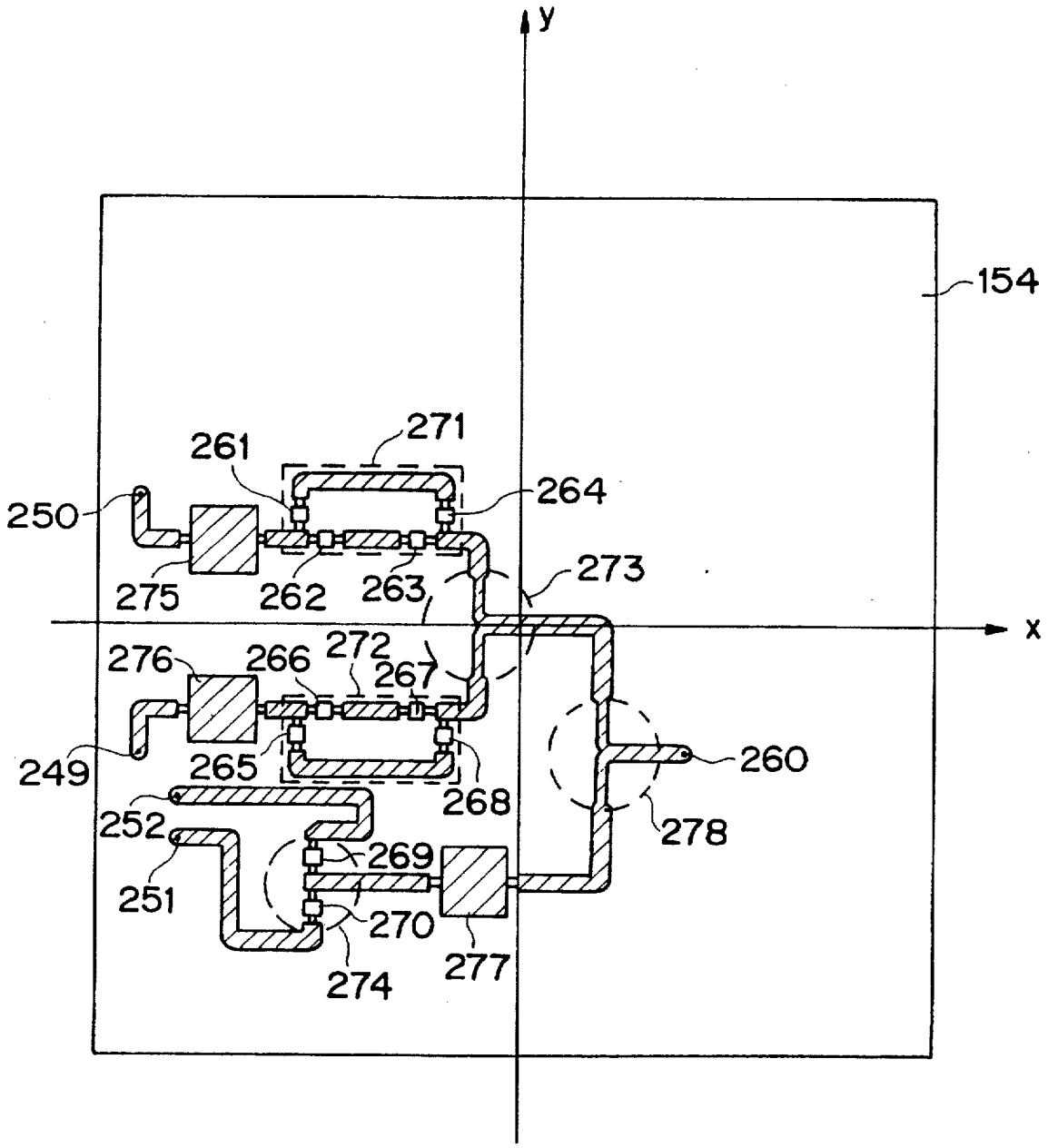
FIG. 23 is a schematic diagram showing a feeding circuit of the beam scanning antenna according to the second embodiment of the present invention.

FIG. 23 shows the line. Two signals of the dominant mode received from the ports 249 and 250 are sent to MMIC (monolithic microwave integrated circuit) modules 276 and 275, respectively. These modules each have an amplifier which selects one of three amplification factors as was described above. The output signals of the MMIC modules 276 and 275 are sent to phase shifters 272 and 271, respectively. The phase shifters 272 and 271 each shift the phase of the input signal for 0 degree or 180 degrees by changing the line length. To change the line length, the phase shifter 272 is constructed of PIN diodes 265, 266, 267, and 268, whereas the phase shifter 271 is constructed of PIN diodes 261, 262, 263, and 264. The output signals of the phase shifters 272 and 271 are sent to a combining device 273 which combines the two signals of the dominant mode with a predetermined amplitude and a predetermined phase difference.

Two signals of the higher-order mode received from the ports 251 and 252 are sent to an RF switch 274 which selects one of these signals of the higher-order mode. The RF switch 274 is constructed of PIN diodes 269 and 270. The output signal of the RF switch 274 is sent to an MMIC module 277.

The MMIC module 277 has an amplifier whose amplification factor is fixed. The MMIC module 277 amplifies the signal of the higher-order mode so that the amplitude ratio of the signal of the higher-order mode and the signal of the dominant mode becomes a predetermined value. The signals of the dominant mode and the higher-order mode are sent to a combining device 278 which combines these signals. The output signal of the combining device 278 is sent to a connector 259 through a port 260. In FIG. 23, for the sake of simplicity, a bias circuit and a control circuit for the PIN diodes are omitted.

In the above-described construction, a thin type beam scanning antenna which can scan a beam in the directions of the direction angles $\phi$ at every 45 degrees can be formed of a plurality of dielectric substrates being layered. Since the construction of the feeding system of this beam scanning antenna is simple, many advantages with respect to production and cost can be expected. This beam scanning antenna is particularly effective when high gain and narrow beam are required. The other effects and advantages of this embodiment are the same as those of the first embodiment.

Next, a third embodiment of the present invention will be described.

In the second embodiment, even if the elevation angle to the boresight of the antenna is 60 degrees (namely, $\theta$=60), the minimum value of the antenna element pitch is as large as 3.46 $\lambda$. Thus, the area of the antenna becomes large. To solve this problem, in the third embodiment, the feeding circuit for the same mode is divided into two portions. The phases of the output signals of these portions are shifted for predetermined degrees. Thus, the antenna element pitch is decreased, thereby reducing the size of the entire antenna.

The construction of the third embodiment will be described with reference to the beam scanning antenna according to the second embodiment. The top view of the antenna according to the third embodiment is the same as that of the second embodiment shown in FIG. 12. In the case of the direction angles $\phi=\pm45$ degrees and $\pm135$ degrees, the optical path difference $[(2^{1/2}/2)\times a\times\sin\theta]$ between adjacent antenna elements is set to around $(2n+1)\times\frac{1}{2}\lambda$ of the radio wave (where n is any positive integer) and the phases of the adjacent antenna elements are shifted for 180 degrees. In the case of the direction angles $\phi$=0 degree, $\pm90$ degrees, and $\pm180$ degrees, the optical path difference $[a\times\sin\theta]$ between adjacent antenna elements is set to around a multiple of $\lambda$ of the radio wave and the antenna elements are excited in the same phase. Table 4 gives an example of antenna element pitch a.

TABLE 4

| a | a × sin θ | (√2/2) × a × sin θ |
|---|---|---|
| (a) θ = 30 deg. | | |
| 4.0 λ | 2.0 λ | 1.414 λ |
| 10.0 λ | 5.0 λ | 3.536 λ |
| (b) θ = 45 deg. | | |
| 2.828 λ | 2.0 λ | 1.414 λ |
| 5.657 λ | 5.0 λ | 3.536 λ |
| (c) θ = 60 deg. | | |
| 2.309 λ | 2.0 λ | 1.414 λ |
| 4.619 λ | 5.0 λ | 3.536 λ |

In the case of the direction angles $\phi=\pm45$ and $\pm135$, the phases of only the antenna elements 91 (100), 93 (102), 95 (104), and 97 (106) are shifted for 180 degrees. The phases of these four antenna elements are shifted for the same angles. The other antenna elements are always excited in the same phase. Thus, a feeding circuit for the four antenna element and a feeding circuit for other antenna elements are independently provided. On the last stage, the phases of signals received from the four antenna elements are shifted to the phases of signals received from the other antenna elements. Thereafter, these signals are combined with the phase difference. Thus, the construction of the feeding system becomes simple. In this construction, when the antenna elements are disposed in such a way that the antenna element pitch a becomes minimum, the size (area) of the beam scanning antenna can be decreased. In particular, this advantage is particularly effective for an antenna installed in a mobile station or an antenna installed in a satellite.

Figure 24:
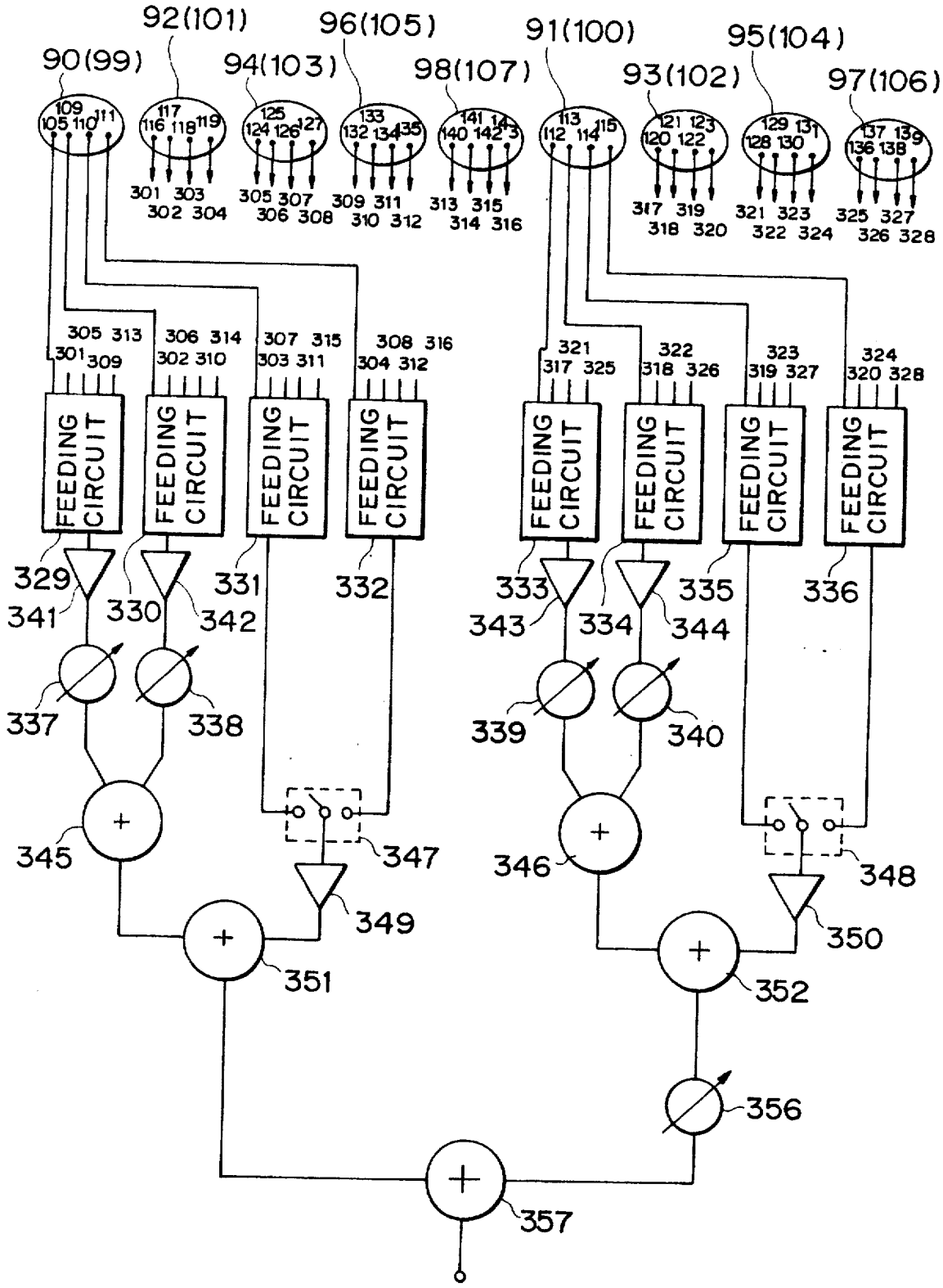
FIG. 24 is a circuit diagram showing the construction of a feeding system of a beam scanning antenna according to a third embodiment of the present invention.
Figure 24:
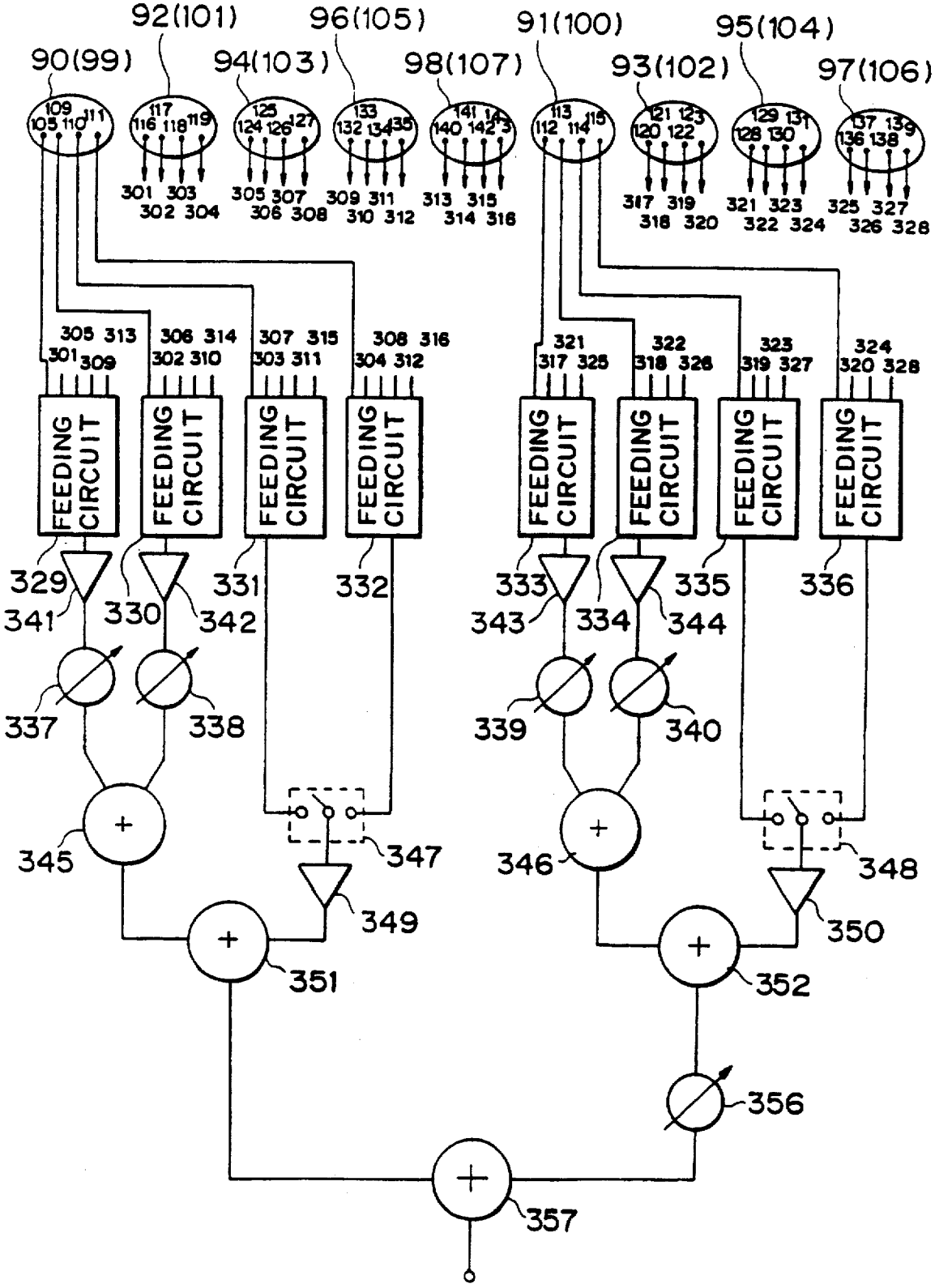

FIG. 24 shows the construction of an example of the feeding system of the third embodiment. The antenna elements 90 (99), 92 (101), 94 (103), 96 (105), and 98 (107) are electrically connected to a first dominant mode feeding circuit 329, a second dominant mode feeding circuit 330, a first higher-order mode feeding circuit 331, and a second higher-order mode feeding circuit 332. The first and second dominant mode feeding circuits 329 and 330 are electrically connected to amplifiers 341 and 342, respectively. The amplifiers 341 and 342 are electrically connected to phase shifters 337 and 338, respectively. The phase shifters 337 and 338 are electrically connected to a combining device 345 which combines dominant mode signals. The two higher-order mode feeding circuits 331 and 332 are electrically connected to an RF switch 347 which selects one of two higher-order mode signals. The output signal of the RF switch 347 is sent to an amplifier 349. The output signal of the amplifier 349 is sent to a combining device 351 which combines the output signals of the combining device 345 and the amplifier 349.

The antenna elements 91 (100), 93 (102), 95 (104), and 97 (106) are electrically connected to a first dominant mode feeding circuit 333, a second dominant mode feeding circuit 334, a first higher-order feeding circuit 335, and a second higher-order feeding circuit 336. The dominant mode feeding circuits 333 and 334 are electrically connected to amplifiers 343 and 344, respectively. The amplifiers 343 and 344 are electrically connected to phase shifters 339 and 340, respectively. The phase shifters 339 and 340 are electrically connected to a combining device 346 which combines dominant mode signals. The higher-order feeding circuits 335 and 336 are electrically connected to an RF switch 348 which selects one of two higher-order mode signals. The RF switch 348 is electrically connected to an amplifier 350. The amplifier 350 is electrically connected to a combining device 352 which combines the output signals of the combining device 346 and the the amplifier 350.

The operation of the feeding system of the third embodiment is the same as that of the second embodiment except that the nine antenna elements are divided into two groups, each of which has a dedicated feeding circuit block as described above.

The combining device 352 is electrically connected to a phase shifter 356 which shifts the phase of the input signal for 0 degree or 180 degrees. The output signal of the phase shifter 356 is sent to a combining device 357. In addition, the output signal of the combining device 351 is sent to the combining device 357. The combining device 357 combines these signals. When the beam is scanned in the direction of $\phi=0$ degree, $\pm 90$ degrees, or $\pm 180$ degrees, the phase of the phase shifter 356 is set to 0 degree. On the other hand, when the beam is scanned in the direction of $\phi=\pm 45$ degrees or $\pm 135$ degrees, the phase of the phase shifter 356 is set to 180 degrees.

Thus, with relatively smaller antenna elements, a beam scanning antenna which can scan the beam in the direction at every 90 degrees can be constructed. This beam scanning antenna is effective when high antenna gain and small beam width are required. With the number of devices such as phase shifters, amplifiers, and RF switch of the feeding system of the third embodiment which is around twice that of the above-described embodiments, the feeding system of the third embodiment can be provided. Thus, the construction of this feeding system is simple. In addition, each device is very simple. For example, in the feeding system of this embodiment, each phase shifter shifts the phase at every 180 degrees and each amplifier has a fixed amplification factor or three amplification factors. In addition, since the feeding circuit block for the five antenna elements can be controlled in the same manner as that for the remaining four antenna elements, the control circuit can be shared with these feeding circuit blocks. Thus, the feeding system can be simply constructed. Therefore, the beam scanning antenna can be produced in simple processes and at low cost.

In the three embodiments described before, a beam scanning antenna which receives a linearly polarized wave was described. However, the three embodiments can be applied to a beam scanning antenna which receives a circularly polarized wave. Next, an embodiment of a beam scanning antenna which receives a circularly polarized wave will be described as a fourth embodiment.

Figure 25:
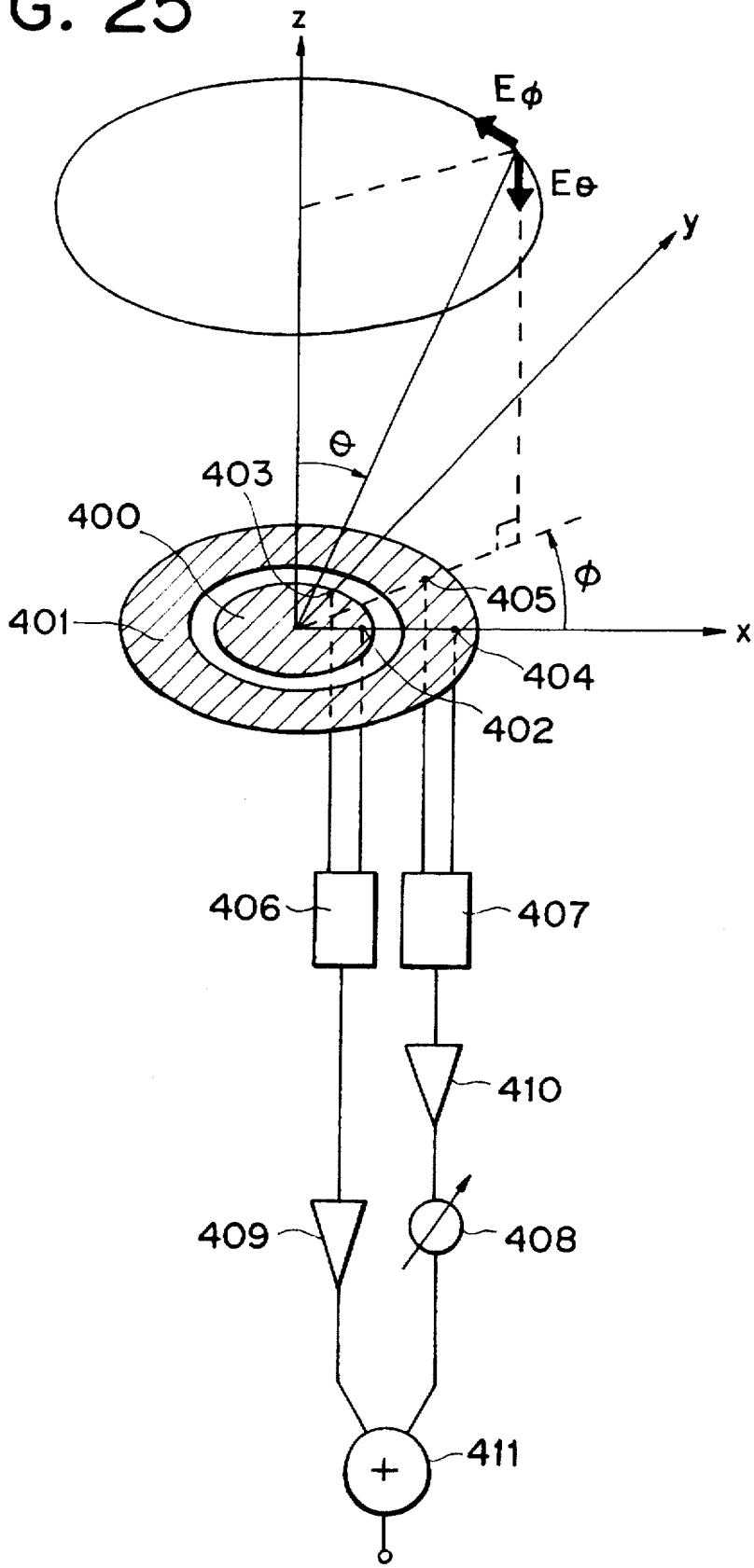
FIG. 25 is a schematic diagram showing the construction of a beam scanning antenna according to a fourth embodiment of the present invention.

FIG. 25 shows the operation of an antenna element of a beam scanning antenna which receives a circularly polarized wave according to the fourth embodiment of the present invention. The antenna element is constructed of a circular microstrip antenna member 400 and a ring microstrip antenna member 401. The circular microstrip antenna 400 excites a dominant mode, whereas the ring microstrip antenna 401 excites a higher-order mode. In this embodiment, the higher-order mode is TM 21 mode.

The circular microstrip antenna member has two feed points 402 and 403 which excite two orthogonal components of the dominant (TM 11) mode. The ring microstrip antenna member has two feed points 404 and 405 which excite two orthogonal components of the TM 21 mode. These feed points are pin-feed (coaxial feed) type. Radiation field components generated by the modes excited at the feed points are as follows.

Dominant mode (feed point 402): $E\theta = A(\theta)\cos\phi$ (7)

$E\phi = A\phi(\theta)\sin\phi$ (8)

Dominant mode (feed point 403): $E\theta = A\theta(\theta)\sin\phi$ (9)

$E\phi = -A\phi(\theta)\cos\phi$ (10)

Higher-order mode (feed point 404):

$E\theta = B\theta(\theta)\cos 2\phi$ (11)

$E\phi = B\phi(\theta)\sin 2\phi$ (12)

Higher-order mode (feed point 405):

$E\theta = B\theta(\theta)\sin 2\phi$ (13)

$E\phi = -B\phi(\theta)\cos 2\phi$ (14)

Since $A\theta$, $A\phi$, $B\theta$, and $B\phi$ of the above equations are functions with respect to $\theta$, they depend on the shape of the antenna. When two feed points are excited with a phase difference of 90 degrees, radiation field components of a circularly polarized wave are given by the following equations.

Dominant mode: $E\theta = A\theta(\theta)[\cos\phi + j\sin\phi]$ (15)

$E\phi = A\phi(\theta)[\sin\phi - j\cos\phi]$ (16)

Higher-order mode: $E\theta = B\theta(\theta)[\cos 2\phi + j\sin 2\phi]$ (17)

$E\phi = B\phi(\theta)[\sin 2\phi - j\cos 2\phi]$ (18)

The direction of a circularly polarized wave that the dominant mode generates is the same as the direction of a circularly polarized wave that the higher-order mode generates. In this case, $A\theta$ is approximated to $A\phi(\theta)$. In addition, $B\theta$ is approximated to $B\phi(\theta)$.

Thus, $A=A\theta(\theta)=A\phi(\theta)$ (19)

$A=B\theta(\theta)=B\phi(\theta)$ (20)

Therefore, the components of the circularly polarized waves of these modes can be given by the following formulas.

Dominant mode: $Ec=2A \exp(j\phi)$ (21)

Higher-order mode: $Ec=2B \exp(j2\phi)$ (21)

As clear from the equations (21) and (22), the intensity (absolute value) of the components of the circularly polarized wave does not depend on the rotation angle $\phi$. On the other hand, its phase depends on the angle $\phi$.

Figure 26:
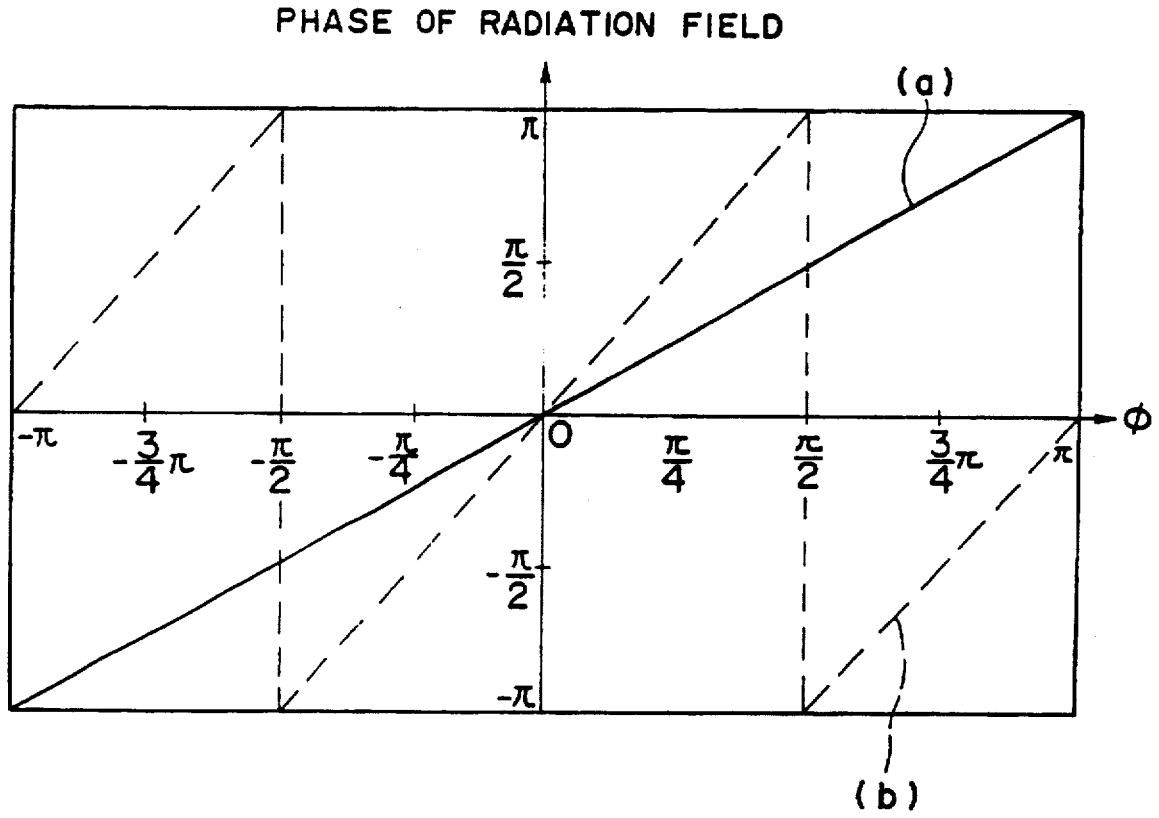
FIG. 26 is a graph showing phase variation of the radiation directivity of a dual-mode antenna element of the beam scanning antenna according to the fourth embodiment of the present invention.

FIG. 26 shows the variation of the phases of the components of the circularly polarized wave. In the figure, (a) represents the phase of the component Ec of the dominant mode; and (b) represents the phase of the component Ec of the higher-order mode. In this figure, the phases of A and B are assumed to be 0. In this case, only when $\phi=0$, the phase of the radiation field of the circularly polarized wave of the dominant mode matches the phase of that of the higher-order mode. Thus, the directivity of this direction becomes strong. Consequently, the beam of the antenna is scanned in this direction. To scan the beam in a desired direction, the corresponding proper phase difference should be given to A and B. For example, to scan the beam of the antenna in the direction of $\phi$=90 degrees, the relation of [arg (A)−arg (B)=90 degrees] should be satisfied. To scan the beam of the antenna in the direction of $\phi$=180 degrees, the relation of [arg (A)−arg (B)=180 degrees] should be satisfied. By controlling the phases of these modes with phase shifters and so forth, the beam can be scanned in any direction. FIG. 25 also shows the construction of an example of a feeding system for an antenna element which scans a beam. RF signals of two orthogonal components of the dominant mode are received from feed points 402 and 403 and sent to a circular polarizer 406 which generates (receives) a circularly polarized wave. Likewise, RF signals of two orthogonal components of the higher-order mode are received from feed points 404 and 405 and sent to a circular polarizer 407 which generates (receives) a circularly polarized wave. The output signal of the circular polarizer 407 is sent to a phase shifter 408 through an amplifier 410. By controlling the phase difference of the circular polarized waves of the dominant mode and the higher-order mode, the beam is scanned in the corresponding direction. The signals of the dominant mode and higher-order mode are sent to amplifiers 409 and 410, respectively. The output signal of the amplifier 409 is sent to a combining device. The output signal of the amplifier 410 is sent to the combining device 411 through a phase shifter 408. The amplifiers 409 and 410 adjust the amplitudes of the signals of the two modes so that the amplitude component of the radiation field in the beam direction of the dominant mode signal becomes the same as that of the higher-order mode signal. Thus, the directivity in the direction of the beam becomes strong, whereas the directivity in other directions becomes weak. Instead of the amplifiers, attenuators or combining devices which combine signals with a predetermined amplitude ratio may be used.

Figure 27:
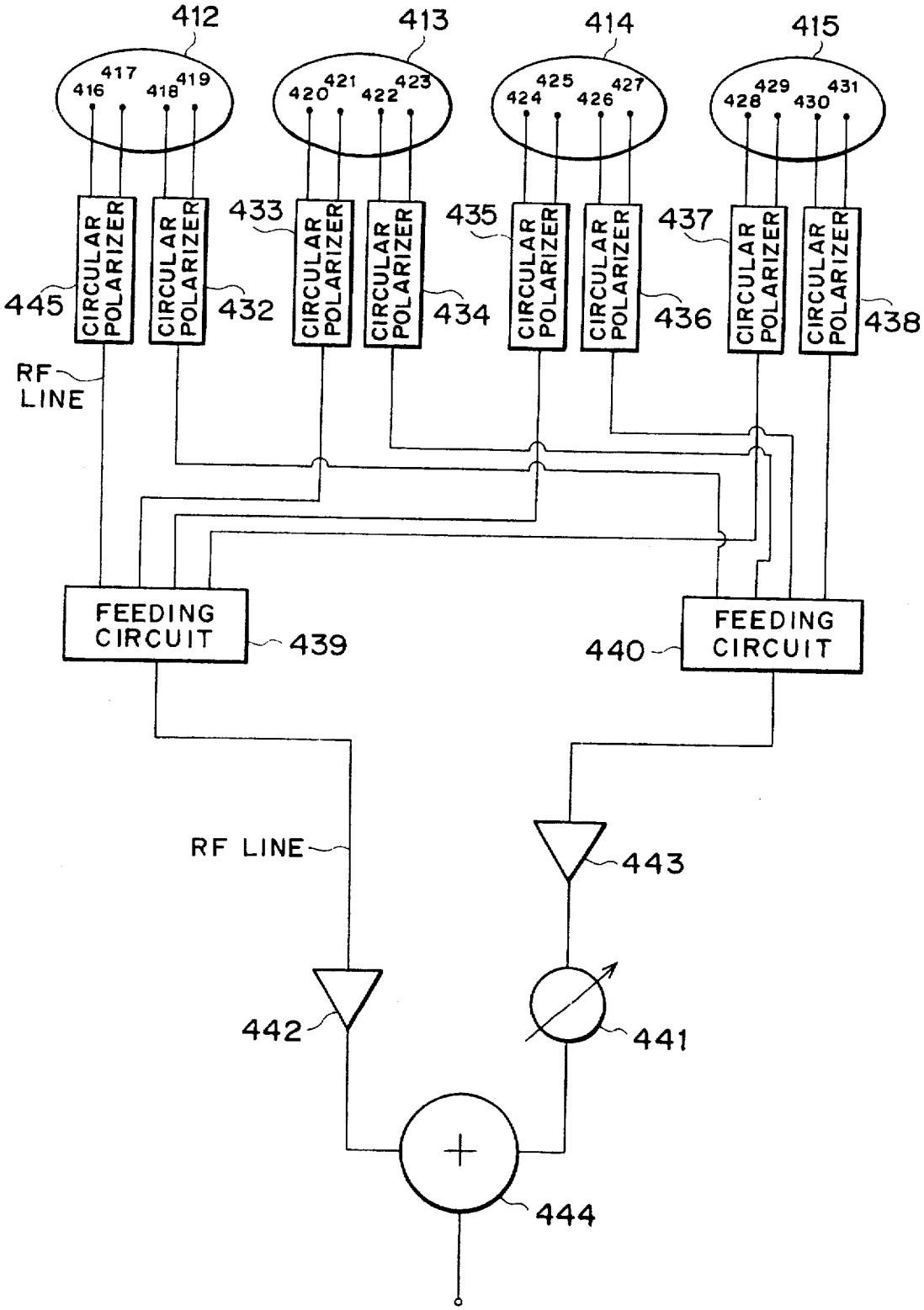
FIG. 27 is a circuit diagram showing the construction of a feeding system of the beam scanning antenna according to the fourth embodiment of the present invention.

FIG. 27 is a circuit diagram showing the construction of a beam scanning antenna according to a fourth embodiment of the present invention.

This beam scanning antenna has four antenna elements 412, 413, 414, and 415, each of which has four feed points for a first component of the dominant mode, a second component of the dominant mode, a first component of the higher-order mode, and a second component of the higher-order mode. Feed points for the first component of the dominant mode are 416, 420, 424, and 428. Feed points for the second component of the dominant mode are 417, 421, 425, and 429. Feed points for the first component for the higher-order mode are 418, 422, 426, and 430. Feed points for the second component of the higher-order mode are 419, 423, 427, and 431.

Signals received from the dominant mode feed points 416 and 417 are sent to a circular polarizer 445. Signals received from the dominant mode feed points 420 and 421 are sent to a circular polarizer 433. Signals received from the dominant mode feed points 424 and 425 are sent to a circular polarizer 435. Signals received from the dominant mode feed points 428 and 429 are sent to a circular polarizer 437. Signals received from the higher-order mode feed points 418 and 419 are sent to a circular polarizer 432. Signals received from the higher-order mode feed points 422 and 423 are sent to a circular polarizer 434. Signals received from the higher-order mode feed points 426 and 427 are sent to a circular polarizer 436. Signals received from the higher-order mode feed points 430 and 431 are sent to a circular polarizer 438. The output signals of the circular polarizer 445, 433, 435, and 437 are sent to a feeding circuit 439. The output signals of the circular polarizer 432, 434, 436, and 438 are sent to a feeding circuit 440. Thus, the circular polarizer 439 combines the dominant mode signals received from the antenna elements, whereas the circular polarizer 440 combines the higher-order mode signals received from the antenna elements. The output signal of the feeding circuit 439 is sent to an amplifier 442. The output signal of the amplifier 442 is sent to a combining device 444. The output signal of the feeding circuit 440 is sent to an amplifier 443. The output signal of the amplifier 443 is sent to a phase shifter 441. The output signal of the phase shifter 441 is sent to the combining device 444. Thus, the combining device 444 combines the dominant mode signal and the higher-order mode signal with a phase difference designated by the phase shifter 441.

In the above-descried construction, the beam scanning antenna which receives (transmits) circularly polarized waves can be provided. When the transmission path difference of a radio wave transmitted or received by adjacent antenna elements in the direction of a predetermined rotation angle $\phi$ to the boresight of the antenna is a multiple of the wave length and a proper phase difference between the dominant mode and higher-order mode is designated by the phase shifter 441, the antenna which scan the beam in the direction of the rotation angle $\phi$ can be constructed. Thus, by arraying the antenna elements in this manner, the gain in the beam direction can be increased.

Since the phase shifter which sets the phase difference between the dominant mode and the higher-order mode is disposed downstream of the feeding circuit, the number of phase shifters and amplifiers can be remarkably reduced in comparison with the conventional antenna. Thus, the production steps of the beam scanning antenna can be reduced and thereby lowering the cost thereof.

Figure 28:
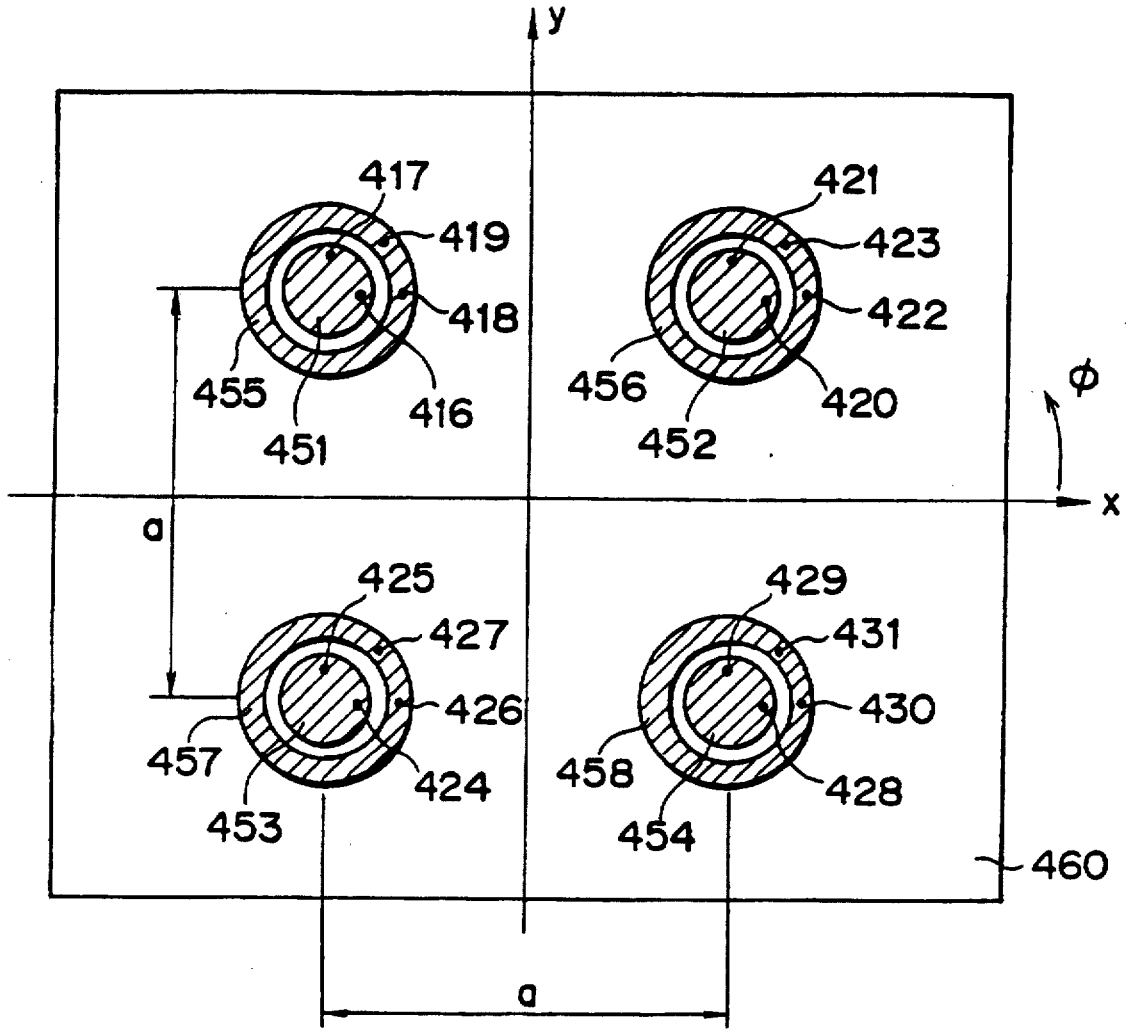
FIG. 28 is a top view showing the beam scanning antenna according to the fourth embodiment of the present invention.

FIG. 28 is a top view showing the construction of a practical example of the beam scanning antenna according to the fourth embodiment of the present invention. The beam scanning antenna has four antenna elements, each of which comprises a circular microstrip antenna member and a ring microstrip antenna member. The circular microstrip antenna member excites a dominant mode (TM11 mode), whereas the ring microstrip antenna member excites a TM 21 mode. The first to fourth antenna elements of the beam scanning antenna have the circular microstrip antenna members 451, 452, 453, and 454 and the ring microstrip antenna members 455, 456, 457, and 458, respectively. In this embodiment, the antenna elements are disposed in a square shape. The antenna element pitch is a.

Figure 29:
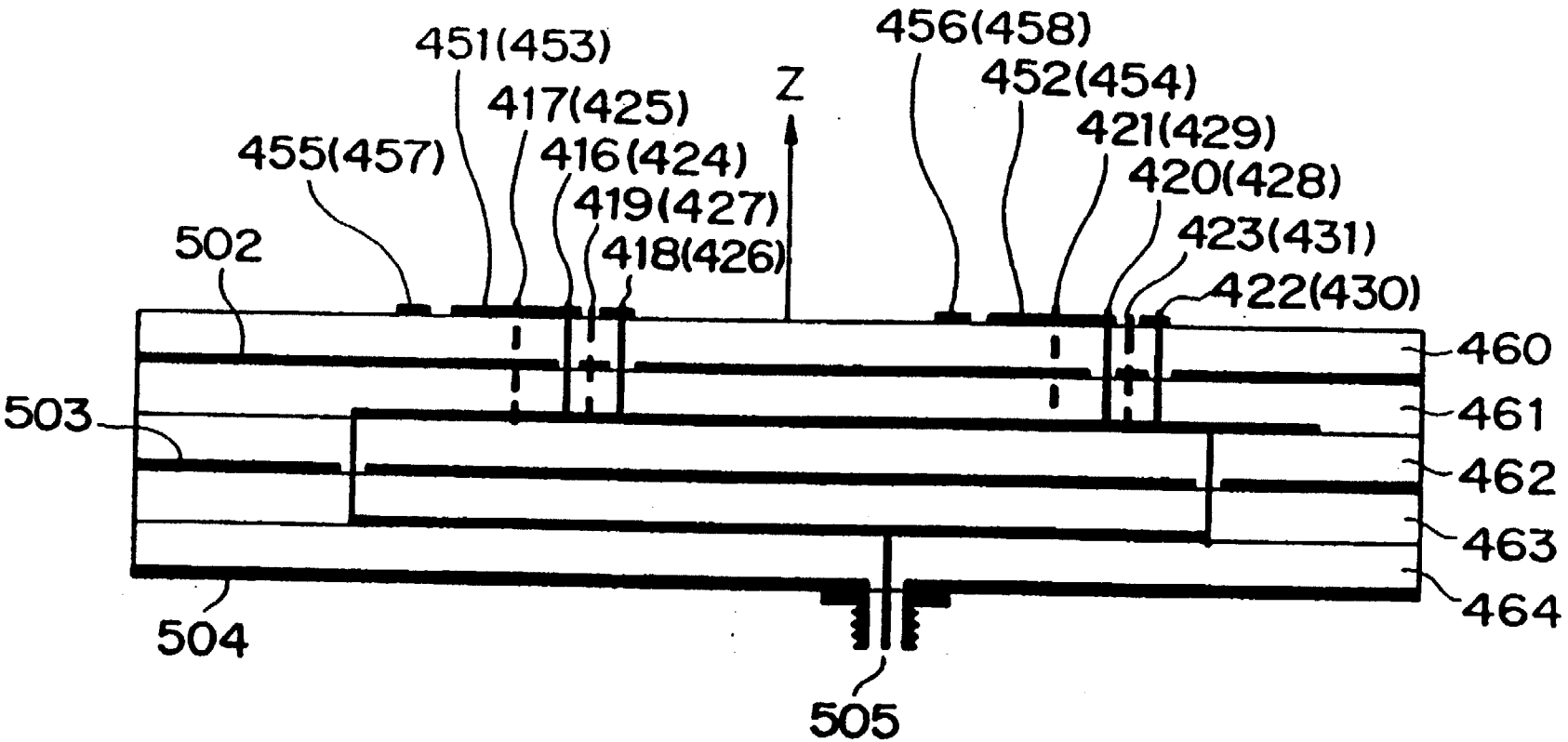
FIG. 29 is a sectional view showing the beam scanning antenna according to the fourth embodiment of the present invention.

FIG. 29 is a sectional view showing the beam scanning antenna according to the fourth embodiment. This antenna is formed of five dielectric substrates 460, 461, 462, 463, and 464 being layered. On the upper surface of the dielectric substrate 460, the circular microstrip antenna members and the ring microstrip antenna members which are made of a conductor film are formed. On the lower surface of the dielectric substrate 460, a ground conductor 502 is formed by etching or the like.

Figure 30:
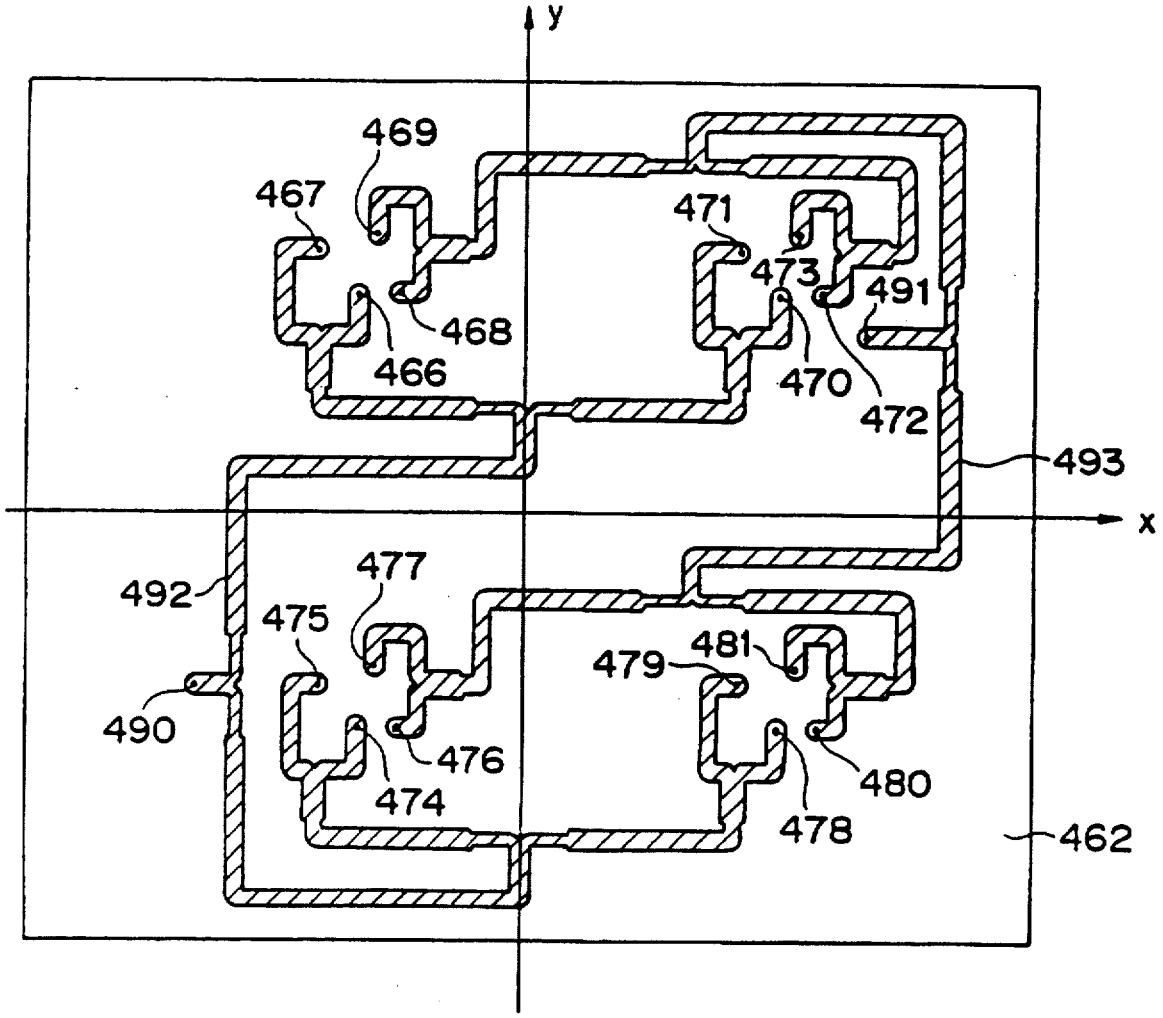
FIG. 30 is a schematic diagram showing a feeding circuit of the beam scanning antenna according to the fourth embodiment of the present invention.

The dielectric substrates 461 and 462 form circular polarizer and feeding circuits as a first tri-plate line pattern. The tri-plate line pattern is formed between a ground conductor 502 disposed on the upper surface of the dielectric substrate 461 and a ground conductor 503 disposed on the lower surface of the dielectric substrate 462. FIG. 30 shows the first tri-plate line pattern. In the figure, reference numeral 492 is a dominant mode feeding circuit 492. Reference numeral 493 is a higher-order mode feeding circuit 493. The dominant mode feeding circuit 492 and the higher-order mode feeding circuit 493 each have a T branch and a circular polarizer. The circular polarizer is made of an RF line and shifts the phase for 90 degrees. The circular polarizer may be formed of a hybrid circuit, Wilkinson type power distributer, or the like. The feeding circuits each combine (or distribute) the input signals excited at the antenna elements so that the phases of these signals become the same. Input ports 466 to 480 are electrically connected to the feed points 416 to 430, respectively. Output ports 490 and 491 of the feeding circuits are connected to ports 495 and 496 of the lower layer thereof, respectively.

Below the dielectric substrate 462, the dielectric substrates 463 and 464 are disposed. The dielectric substrates 463 and 464 form phase shifters, amplifiers, combining devices, and their control circuit as a second tri-plate line pattern. The control circuit for use in this embodiment may be any type control circuit. For the sake of simplicity, the construction of the control circuit is omitted.

Figure 31:
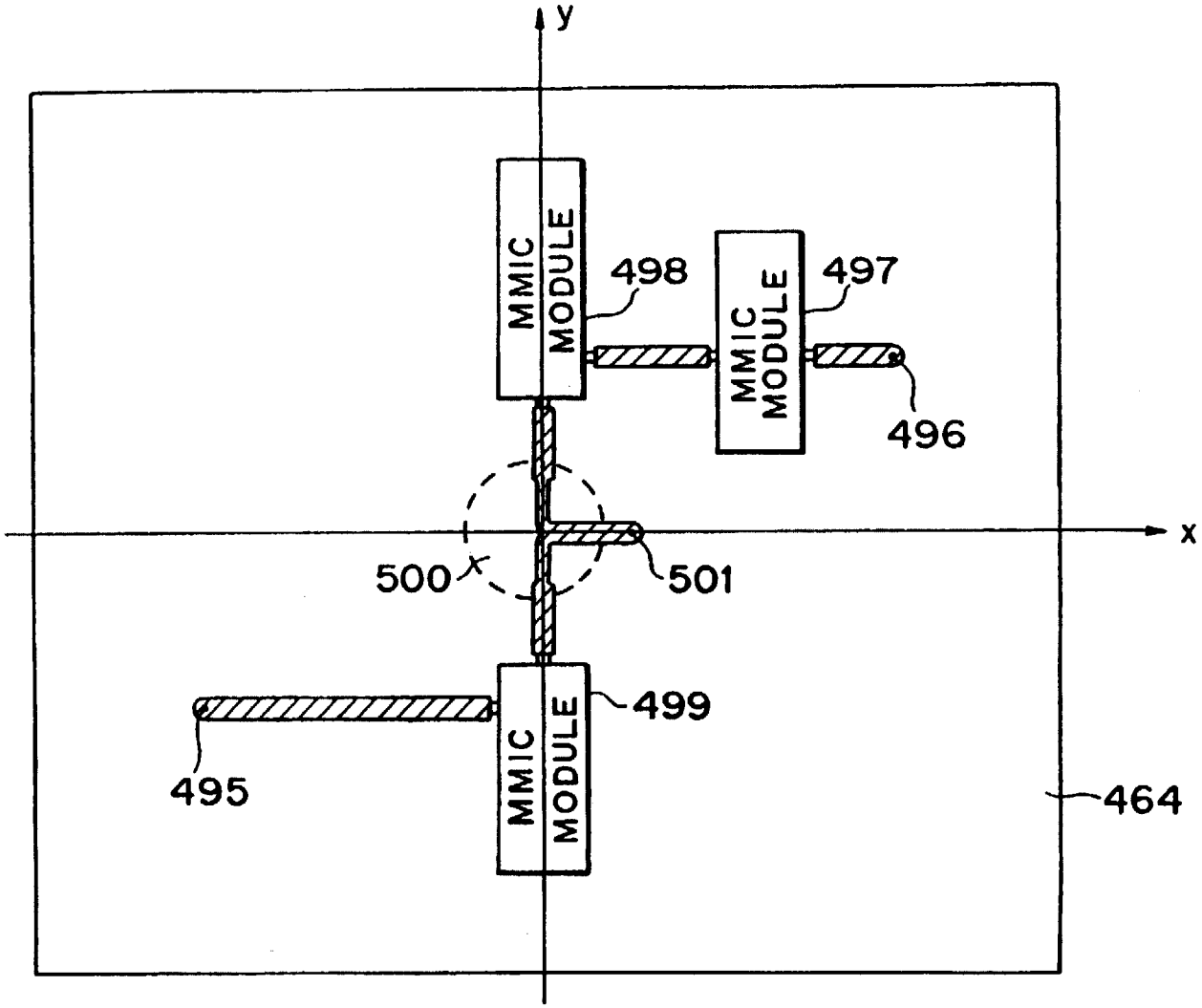
FIG. 31 is a schematic diagram showing a feeding circuit of the beam scanning antenna according to the fourth embodiment of the present invention.

The second tri-late line pattern is disposed between ground conductors 503 and 504. The ground conductor 503 is disposed on the upper surface of the dielectric substrate 463. The ground conductor 504 is disposed on the lower surface of the dielectric substrate 464. FIG. 31 shows the second tri-plate line pattern. In the figure, reference numerals 497, 498, and 499 are MMIC modules. A composite RF signal of the dominant mode is input to the MMIC module 499 which has an amplifier. The amplifier amplifiers the RF signal. A composite RF signal of the higher-order mode is input to the MMIC modules 497 and 498 in succession. The MMIC module 497 has a phase shifter which shifts the phase of the input signal for predetermined degrees, whereas the MMIC module 498 has an amplifier which amplifies the input signal. The MMIC modules 497 and 498 may be integrally formed as a single module. The output signals of the MMIC modules 499 and 498 are sent to a combining device 500 which combines these signals. The output signal of the combining device 500 is sent to a connector 505 through an output port 501. The amplification factor of the amplifier is set so that the intensity of the radiation field of the signal of the dominant mode is equal to that of the higher-order mode in the beam direction. In this construction, the amplification factor may be fixed.

The phase shifter shifts the phase of the input signal so as to scan the beam in the directions at intervals of predetermined degrees. When the antenna scans the beam in the directions of the direction angles $\phi$ at every 90 degrees, the antenna element pitch a is set so that $[a\times\sin\theta]$ becomes a multiple of the wave length of the radio wave. The phase shifter is a two-bit variable phase shifter which shifts the phase of the input signal for very 90 degrees. When the antenna scans the beam in the directions of the direction angles $\phi$ at every 45 degrees, the antenna element pitch a is set so that both $[a\times\sin\theta]$ and $[(2^{1/2})/2)\times a\times\sin\theta]$ become a multiple of the wave length of the radio wave. In this case, the phase shifter is a three-bit variable phase shifter which shifts the phase of the input signal for every 45 degrees. In addition, as was described in the third embodiment, when the phases of signals for a part of antenna elements are shifted for every 180 degrees, a beam scanning antenna with a narrower antenna element pitch may be formed.

In the above-described construction, since plane circuits and plane line patterns are used, a beam scanning antenna which electrically scan the beam in the direction of a predetermined rotation angle $\phi$ can be constructed thinly and compactly. This beam scanning antenna is effective in particular for an antenna installed in a mobile station which communicates with a communication satellite. In addition, the beam scanning antenna according to the fourth embodiment can transmit and receive a circularly polarized wave. Since this beam scanning antenna does not require the adjustment of the direction of a polarized wave unlike with an antenna which uses a linearly polarized wave, it can be simply constructed.

Even if the beam scanning antenna according to the fourth embodiment is modified as described in the above embodiments, the effects of the present invention are not lost. In addition, even if the beam scanning antenna according to the fourth embodiment is modified in the following manner, the effects of the present invention can be maintained.

Another polarized wave antenna type and another feeding method may be used. For example, even if a circularly polarized wave is generated by one-point feeding method so as to remove degeneration mode, the effects similar to those of the fourth embodiment may be obtained. Moreover, after signals of orthogonal components of each mode have been combined by a feeding circuit, a circularly polarized wave may be generated by a circular polarizer. In this case, the number of circular polarizer can be reduced.

In the above-mentioned embodiments, the square disposition of antenna elements was described. However, the present invention can be applied to a triangular disposition of antenna elements. Next, an embodiment with respect to a triangular disposition of antenna elements will be described as a fifth embodiment of the present invention.

Figure 32:
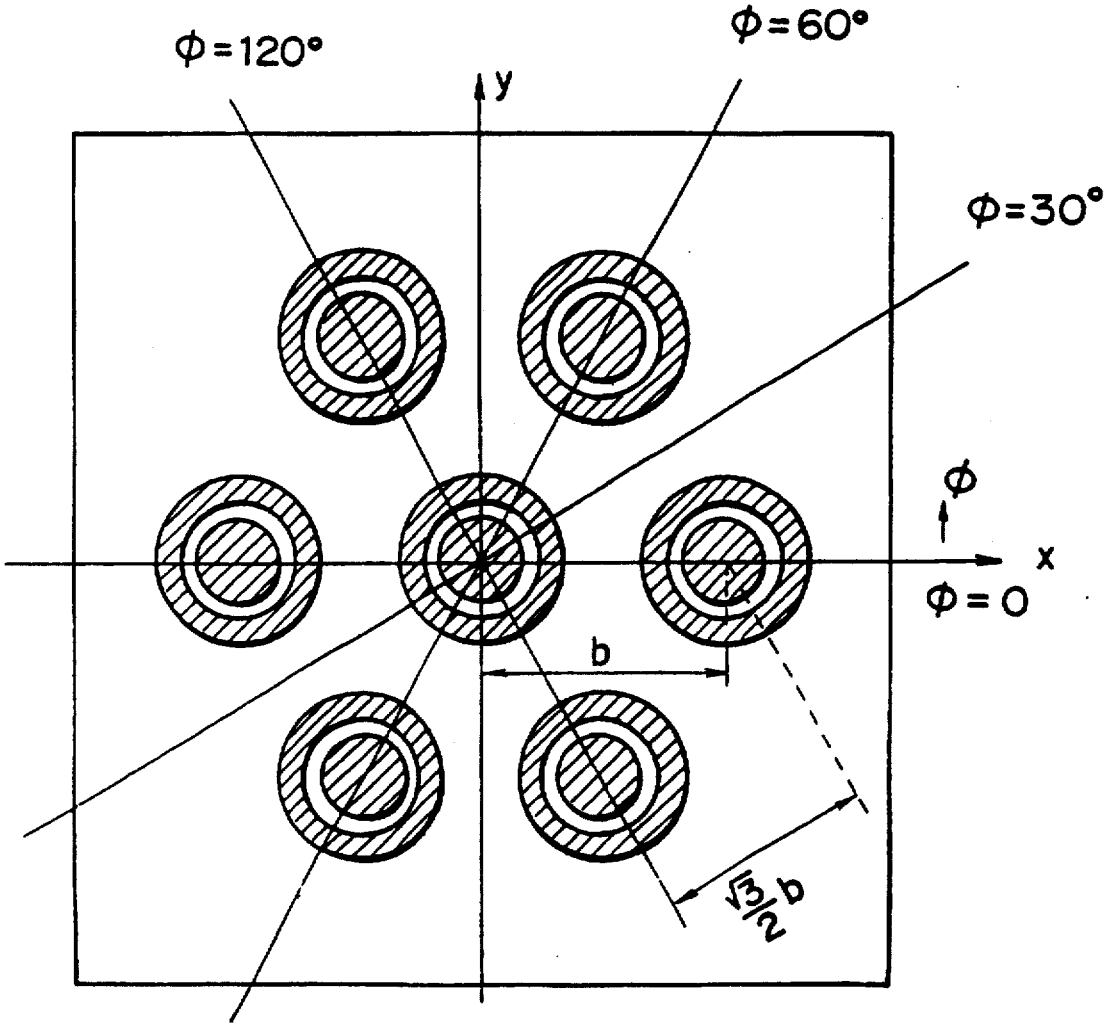
FIG. 32 is a top view showing a beam scanning antenna according to a fifth embodiment of the present invention.

FIG. 32 is a top view showing a beam scanning antenna according to the fifth embodiment of the present invention. As with the above-described embodiments, each antenna element of the beam scanning antenna is constructed of a dominant mode antenna member and a higher-order mode antenna member.

Figure 33:
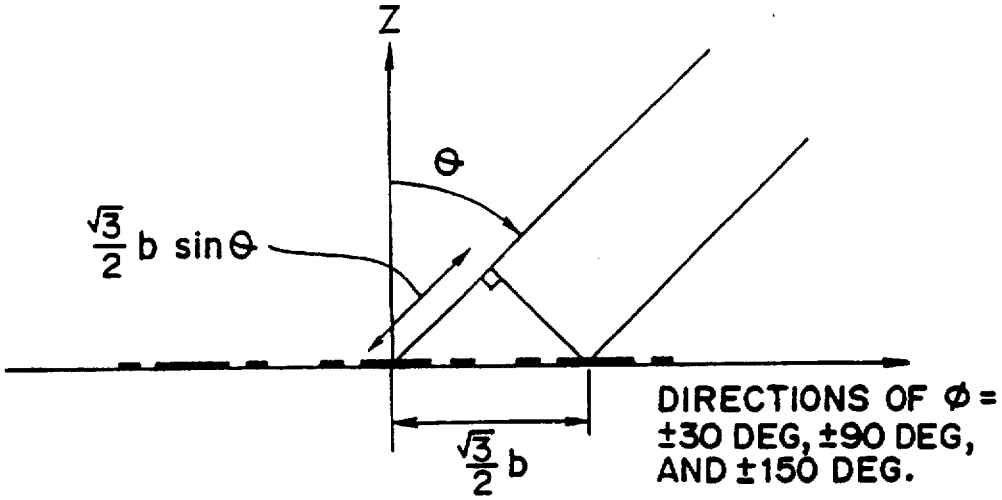
FIG. 33 is a schematic diagram showing the optical path difference between antenna elements of the beam scanning antenna according to the fifth embodiment of the present invention.

The antenna elements are disposed in a regular triangular shape. The antenna element pitch is b. When the antenna scans the beam in the directions of the direction angles $\phi=\pm30$ degrees, $\pm90$ degrees, and $\pm150$ degrees and each of the antenna elements thereof scans their beam in the same direction, the transmission path difference of radio waves between adjacent antenna elements in the directions of the direction angles $\phi=\pm30$ degrees, $\pm90$ degrees, and $\pm150$ degrees is set to a multiple of the wave length of the radio waves. In other words, as shown in FIG. 33, the antenna element pitch b is set so that $[(3^{1/2}/2)\times b\times\sin\theta]$ becomes a multiple of the wave length of the radio waves.

Figure 34:
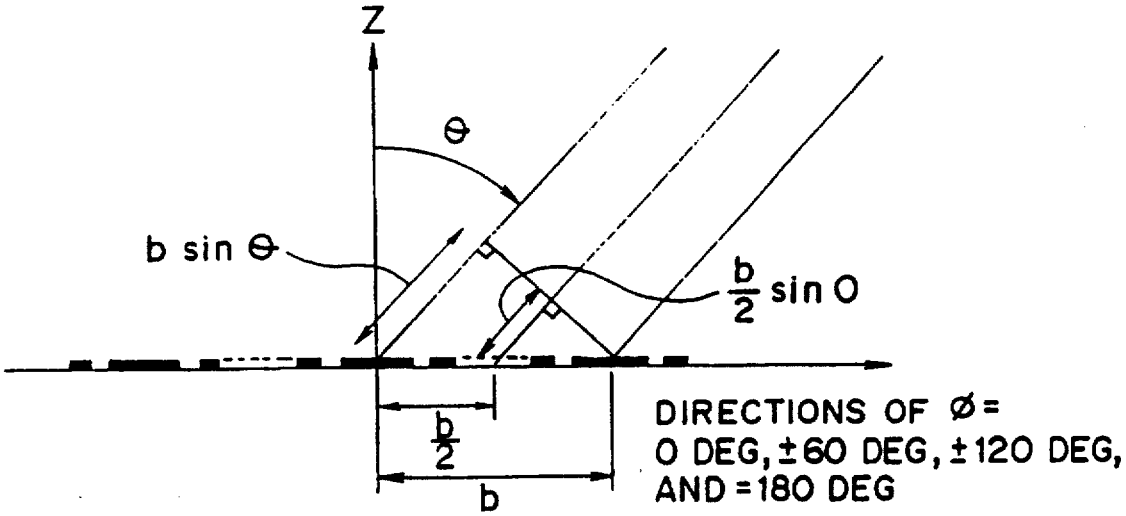
FIG. 34 a schematic diagram showing the optical path difference between the antenna elements of the beam scanning antenna according to the fifth embodiment of the present invention.

When the antenna scans the beam in the directions of the direction angles $\phi$ at every 30 degrees, as well as the above-mentioned direction angles, at the direction angles of $\phi=0$ degree, $\pm60$ degrees, $\pm120$ degrees, and 180 degrees, the antenna element pitch b should be selected so that the transmission path difference of radio waves between the adjacent antenna elements becomes a multiple of the wave length of the radio waves. In this case, as shown in FIG. 34, the antenna element pitch b should be selected so that both $[(3^{1/2}/2)\times b\times\sin\theta]$ and $[(1/2)\times b\times\sin\theta]$ become a multiple of the wave length of the radio waves. The construction of the feeding system for use in the beam scanning antenna according to the fifth embodiment may be similar to those for use in the above-described embodiments.

Next, an example of the antenna elements according to the fifth embodiment will be described. First, an antenna element for a circularly polarized wave will be described. The construction of the antenna element for a circularly polarized wave may be the same as the construction of the antenna element according to the fourth embodiment (see FIG. 25). Next, another example of the construction of the antenna element will be described.

Figure 35:
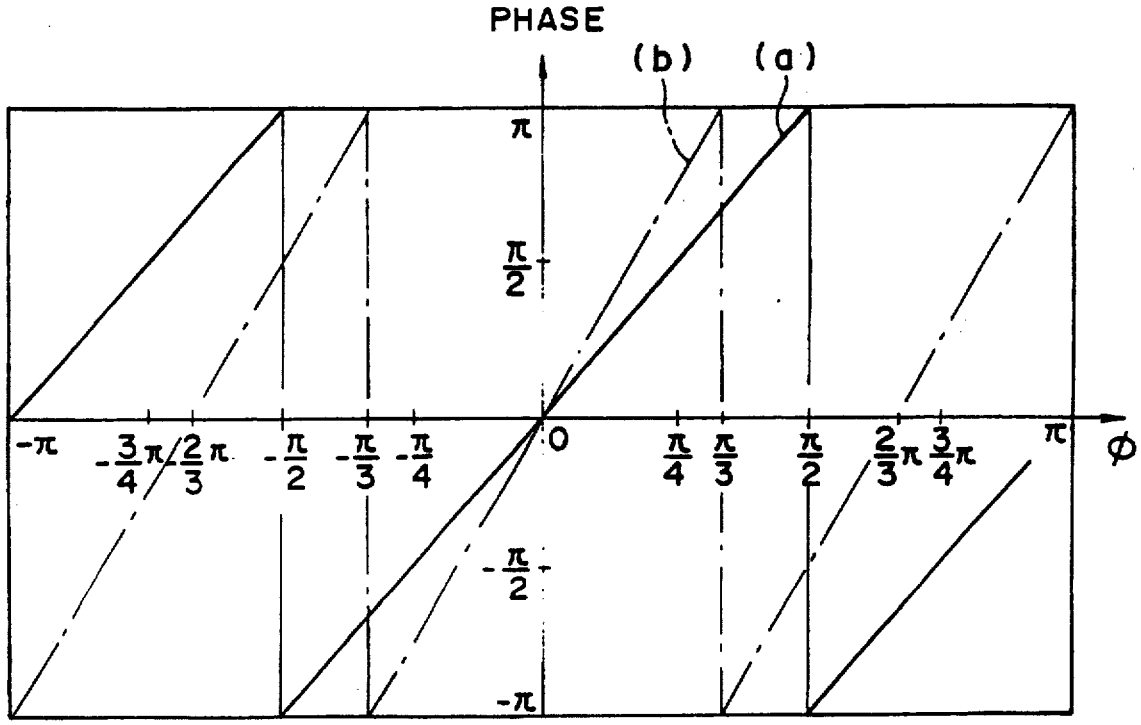
FIG. 35 is a graph showing the phase variation of the radiation directivity of the antenna element (which operates in dual mode) of the beam scanning antenna according to the fifth embodiment of the present invention.

The difference between the antenna element according to the fifth embodiment and the antenna element according to the fourth embodiment is in that two antenna members of the antenna element are excited in two higher-order modes. For example, one antenna member is excited in TM 21 mode, whereas the other antenna member is excited in TM 31 mode. Both the antenna members each radiate a circularly polarized wave with two feed points. The radiation directivity of these antenna members is constant in the direction of the direction angle as was descried earlier. FIG. 35 shows the relation between phase and rotation angle $\phi$. In the figure, (a) represents the phase of the directivity of the circularly polarizing antenna member for the TM 21 mode and (b) represents the phase of the directivity of the circularly polarizing antenna member for the TM 31 mode. In this case, when $\phi=0$, the phase of the radiation directivity of the first antenna member becomes the same as that of the second antenna member. In the direction of the rotation angle $\phi=0$, the intensity of the radiation becomes strong.

To scan the beam in any direction, the exciting phases of the two antenna members should be adjusted so that the phase of the radiation directivity in the direction of the first antenna member is equal to that of the second antenna member. To scan the beam in the directions of the direction angles $\phi$ at every 60 degrees, a phase shifter which shifts the phase of the input signal for every 60 degrees is required. To scan the beam in the directions of the direction angles $\phi$ at every 30 degrees, a phase shifter which shifts the phase of the input signal for every 30 degrees is required.

Figure 36:
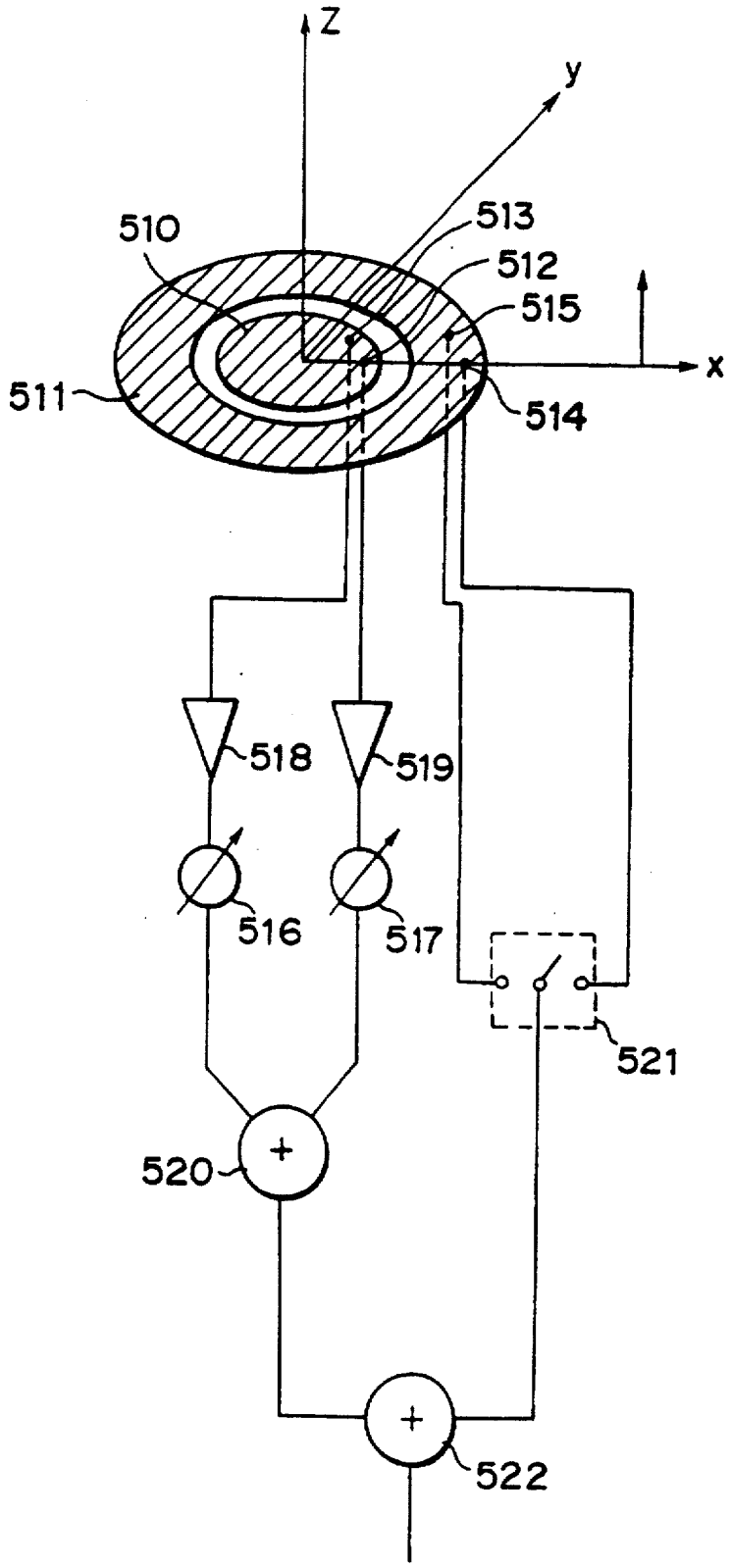
FIG. 36 is a schematic diagram showing the construction of a linear polarizing antenna element of the beam scanning antenna according to the fifth embodiment of the present invention.

Next, an example of the construction of the linear polarizing antenna according to the fifth embodiment will be described. FIG. 36 shows an example of the construction of the linear polarizing antenna according to the fifth embodiment of the present invention. The antenna can scan the beam at every 30 degrees. Each antenna element of the antenna is constructed of a TM 21 mode exciting antenna member 510 and a TM 31 mode exciting antenna member 511 as with the construction of the circular polarizing antenna.

Orthogonal components of the TM 21 mode are excited at feed points 512 and 513. Orthogonal components of the TM 31 mode are excited at feed points 514 and 515.

Figure 37:
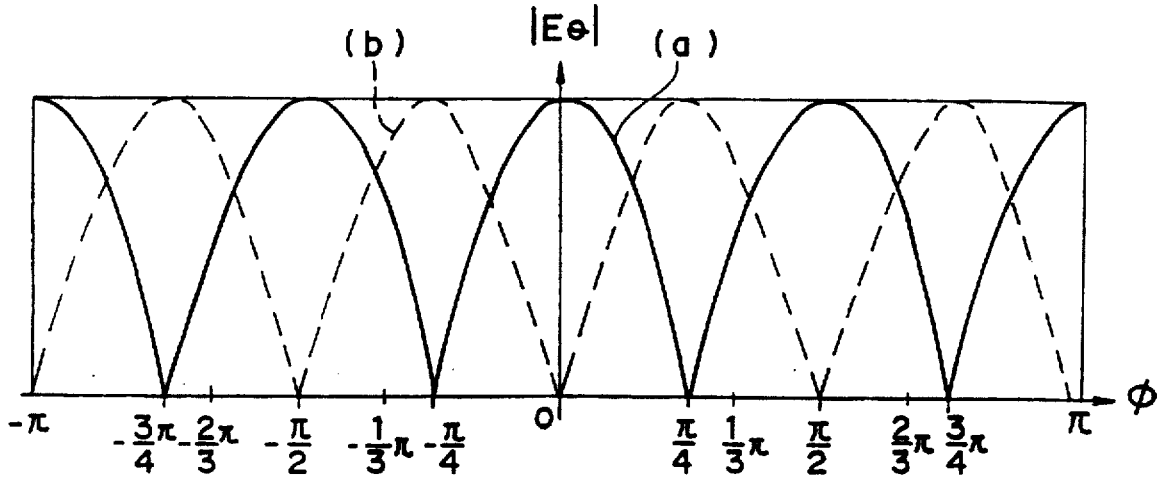
FIG. 37 is a graph showing the radiation directivity of the linear polarizing antenna element (which operates in dual mode) of the beam scanning antenna according to the fifth embodiment of the present invention.
Figure 37:
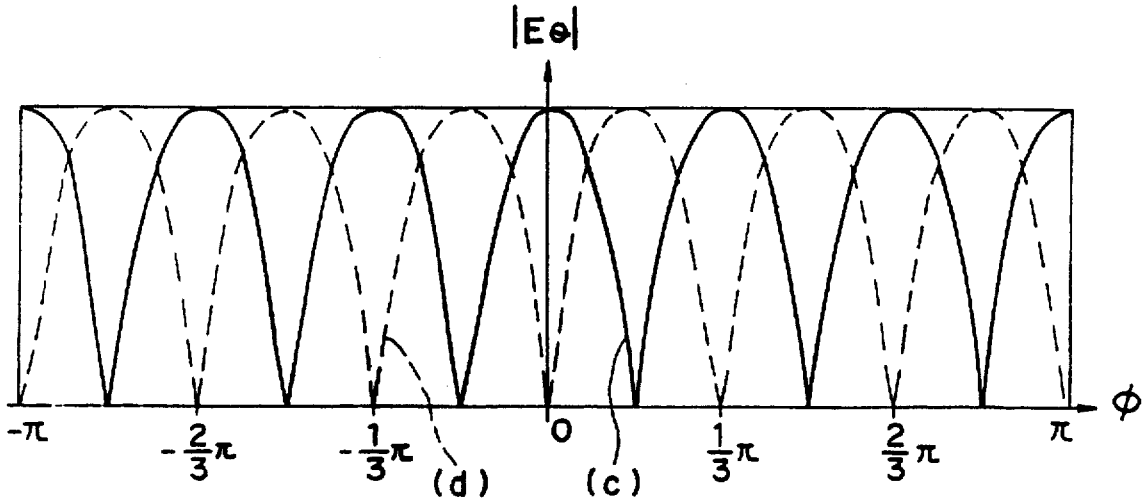

FIG. 37 shows the intensity of the radiation directivity of orthogonal components of each mode. In the figure, (a) represents the intensity of the radiation field at the feed point 512 for the TM 21 mode; (b) represents the intensity of the radiation field at the feed point 513 for the TM 21 mode; (c) represents the intensity of the radiation field at the feed point 514 for the TM 31 mode; and (d) represents the intensity of the ration field at the feed point 515 for the TM 31 mode.

As is clear from the figure, by selecting one of orthogonal components of the TM 31 mode, peaks of directivity appear at every 30 degrees. With respect to the TM 31 mode, by combining the two orthogonal components with the same phase or the reverse phase with a predetermined amplitude ratio in the direction of each rotation angle $\phi$, peaks of directivity appear at every 30 degrees. By combining the two modes, the antenna can scan the beam in predetermined directions. In this example, the TM 21 mode is used instead of the TM 11 mode. This is because the combination of the TM 11 mode and the TM 31 mode causes two peaks of directivity appear in two directions.

Next, the construction of the feeding system of this antenna will be described. Signals of orthogonal components of the TM 21 mode radiated at the feed points 512 and 513 are sent to amplifiers 519 and 518, respectively. The amplifiers 519 and 518 amplify their input signals with the above-described amplitude ratio. The output signals of the amplifiers 519 and 518 are sent to phase shifters 517 and 516, respectively. The phase shifters 517 and 516 shift the phases of their input signals for every 180 degrees. Signals of orthogonal components of the TM 31 mode excited at the feed points 514 and 515 are sent to an RF switch 521 which selects one of these signals. The output signal of the RF switch 521 is sent to a combining device 522 which combines the TM 21 mode signal and the TM 31 mode signal. The basic operation of this antenna is the same as that of the second embodiment. The construction of the antenna for a vertically polarized waves ($E\theta$ component) is the same as that for a horizontally polarized wave ($E\phi$ components).

When an amplifier is disposed downstream of the RF switch 521 or the composing device 522, the overall transmission and/or reception signal can be amplified. When the antenna elements are arrayed, each orthogonal component of each mode requires an independent feeding circuit. By combining these signals amplified with a phase difference, the feeding system can be simply constructed.

In this construction, the antenna can scan the beam in the directions of the direction angles $\phi$ at every 60 or 30 degrees for both a circularly polarized wave and a linearly polarized wave. This antenna can be constructed thinly and compactly. In addition, since the number of phase shifters and amplifiers of this antenna can be reduced, the antenna elements can be arrayed with simple production steps at low cost. Thus, this antenna is very useful for an antenna installed in a mobile station such as a car.

Next, typical examples of the antenna element pitch of each antenna disposition will be described.

In the case of square disposition, when the antenna element pitch a is set so that $[a\times\sin\theta]$ nearly becomes a multiple of the wave length of the radio waves, the antenna can scan the beam in the directions of the direction angles $\phi=0$ degree, $\pm90$ degrees, and 180 degrees on the plane tilted for the angle $\theta$ to the boresight of the antenna by the same phase feeding. In addition, when the antenna element pitch a is set so that $[(2^{1/2}/2)\times a\times\sin\theta]$ nearly becomes a multiple of the wave length of the radio waves, the antenna can scan the beam in the directions of the direction angles $\phi=\pm45$ degrees and $\pm135$ degrees on the plane tilted for the angle $\theta$ to the boresight of the antenna by the same phase feeding. Moreover, when the antenna element pitch a is set so that both $(a\times\sin\theta)$ and $[(2^{1/2}/2)\times a\times\sin\theta]$ nearly become a multiple of the wave length of the radio waves, the antenna can scan the beam in the directions of the direction angles $\phi=0$ degree, $\pm45$ degrees, $\pm90$ degrees, $\pm135$ degrees, and 180 degrees on the plane tilted for the angle $\theta$ to the boresight of the antenna by the same phase feeding.

In the case of triangular disposition, when the antenna element pitch b is set so that $[(1/2)\times b\times\sin\theta]$ nearly becomes a multiple of the wave length of the radio waves, the antenna can scan the beam in the directions of the direction angles $\phi=0$ degree, $\pm60$ degrees, $\pm120$ degrees, and 180 degrees on the plane tilted for the angle $\theta$ to the boresight of the antenna by the same phase feeding. In addition, when the antenna element pitch b is set so that $[(3^{1/2}/2)\times b\times\sin\theta]$ nearly becomes a multiple of the wave length of the radio waves, the antenna can scan the beam in the directions of the direction angles $\phi=\pm30$ degrees, $\pm90$ degrees, and $\pm160$ degrees on the plane tilted for the angle $\theta$ to the boresight of the antenna by the same phase feeding. Moreover, when the antenna element pitch b is set so that both $[(1/2)\times b\times\sin\theta]$ and $[(3^{1/2}/2)\times b\times \sin\theta]$ nearly become a multiple of the wave length of the radio waves, the antenna can scan the beam in the directions of the direction angles $\phi$ =0 degree, ±30 degrees, ±60 degrees, ±90 degrees, ±120 degrees, ±160 degrees, and 180 degrees on the plane tilted for the angle $\theta$ to the boresight of the antenna by the same phase feeding.

Furthermore, when the transmission path difference of radio waves transmitted or received by adjacent antenna elements nearly becomes a multiple of the wave length of the radio waves in the direction of a predetermined rotation angle $\phi$, the antenna can scan the beam on the plane tilted for angle $\theta$ to the boresight of the antenna. Thus, the antenna can scan the beam in the directions of the direction angles $\phi$ at intervals of more smaller degrees.

By the combination of the antenna in the square disposition and the antenna in the triangular disposition, the antenna can scan the beam in the directions of the direction angles $\phi$ at intervals of more smaller degrees.

By using a means which shifts the phase of a part of antenna elements in a predetermined rotation angle $\phi$, the antenna element pitch may be decreased. For example, in the case of the square disposition, the antenna element pitch a is set so that $[a\times\sin\theta]$ nearly becomes a multiple of the wave length of the radio waves and $[(2^{1/2})\times a\times\sin\theta]$ nearly becomes (2n+1) times the half wave length of the radio waves (where n is any positive integer). In addition, by reversing the phases of a part of the antenna elements at a predetermined direction angle, the antenna can scan the beam in the directions of the direction angles $\phi$=0 degree, ±45 degrees, ±90 degrees, ±135 degrees, and 180 degrees on the plane tilted for the angle $\theta$ to the boresight by using a simple feeding system. In this case, the size of the entire antenna can be reduced.

In the beam scanning antenna according to the fifth embodiment, the antenna element pitch is relatively large. With this feature, when a plurality of the beam scanning antennas according to the present invention are disposed, the antennas can scan their beams in the directions at intervals of more smaller degrees. Next, this antenna system will be described as a sixth embodiment.

Figure 38:
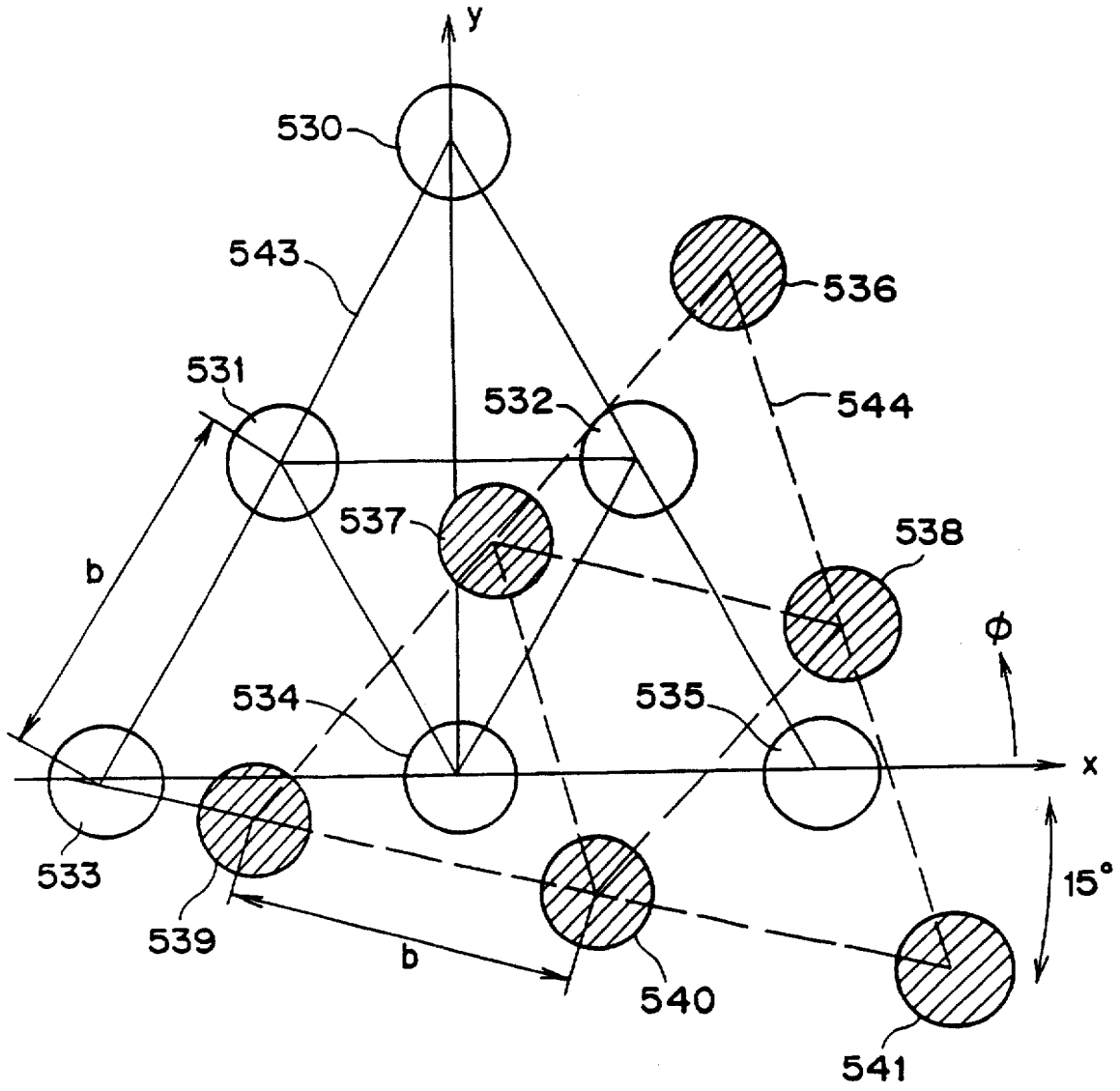
FIG. 38 is a top view showing a beam scanning antenna according to a sixth embodiment of the present invention.

FIG. 38 is a top view showing a beam scanning antenna system according to the sixth embodiment of the present invention. The antenna system is constructed of a first beam scanning antenna 543 and a second beam scanning antenna 544. The first beam scanning antenna 543 is constructed of antenna elements 530 to 535. The second beam scanning antenna 544 is constructed of antenna elements 536 to 541. These beam scanning antennas 543 and 544 share a part of the region of the antenna elements. The antenna elements of the beam scanning antennas 543 and 544 are disposed in a triangular shape. Each antenna element of these beam scanning antennas 543 and 544 can scan the beam in the directions of the direction angles $\phi$ at every 30 degrees. The practical construction of the antenna elements of the sixth embodiment is the same as that of the fifth embodiment.

Figure 39:
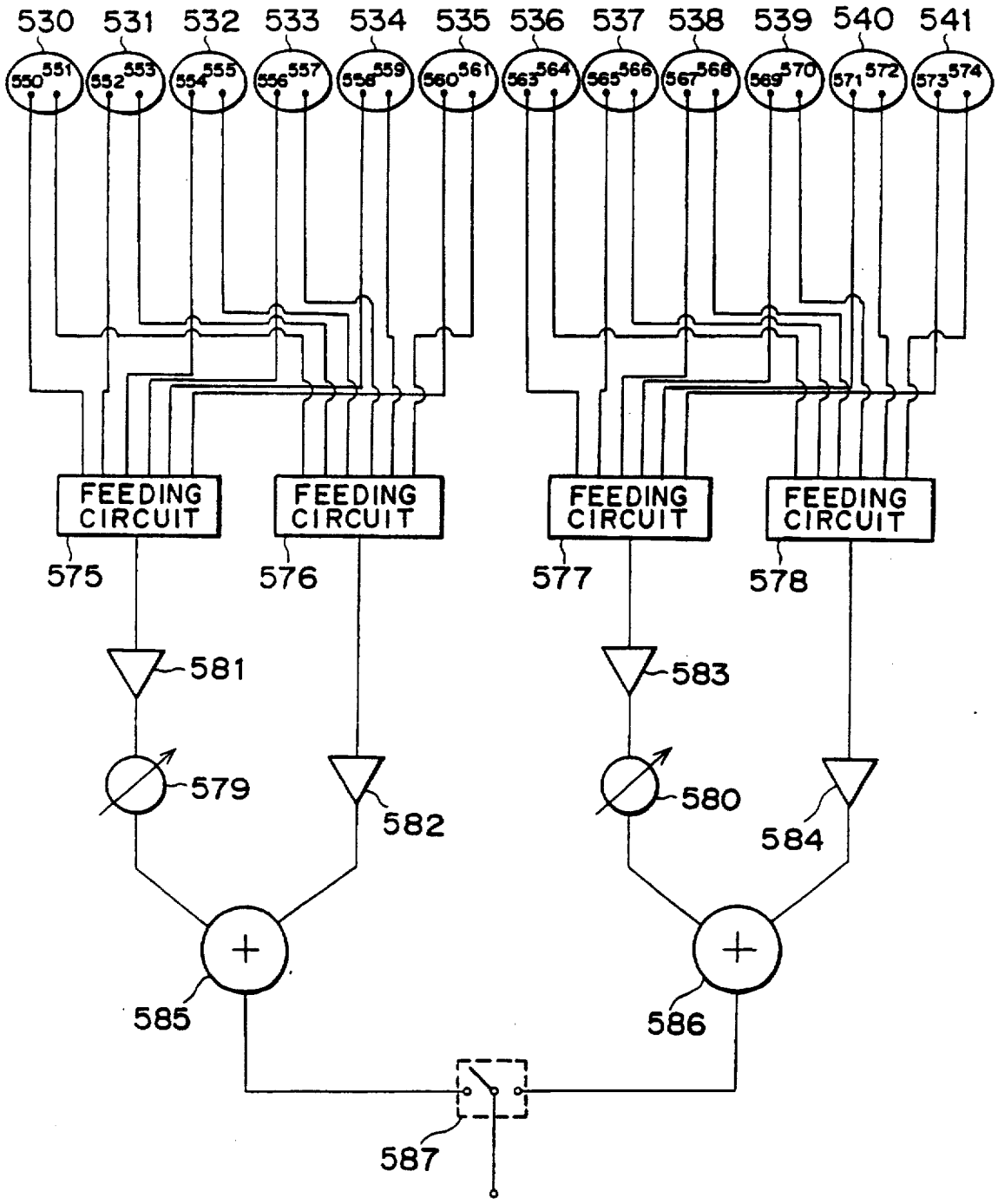
FIG. 39 a circuit diagram showing the construction of a feeding system of the beam scanning antenna according to the sixth embodiment of the present invention.

The first beam scanning antenna 543 is disposed so that it can scan the beam in the directions of the direction angles $\phi$=0 degree, ±30 degrees, ±60 degrees, ±90 degrees, ±120 degrees, ±150 degrees, and 180 degrees. On the other hand, the second beam scanning antenna 544 is disposed so that it can scan the beam in the directions of the direction angles $\phi$=±15 degrees, ±45 degrees, ±75 degrees, ±105 degrees, ±135 degrees, and ±165 degrees. Thus, when the direction angles (of the two beam scanning antennas 543 and 544 are properly selected, the antenna system can substantially scan the beam in the directions of the direction angles $\phi$ at every ±15 degrees. FIG. 39 is a circuit diagram showing the construction of an example of a feeding system according to the sixth embodiment. In this example, circularly polarized waves are received. In the antenna elements 530 to 541, feed points 550, 552, 554, 556, 558, 560, 563, 565, 567, 569, 571, and 573 output signals of one mode. In addition, feed points 551, 553, 555, 557, 559, 561, 564, 566, 568, 570, 572, and 574 output signals of the other mode. By combining these signals of the two modes with a proper amplitude ratio and a proper phase difference, the antenna system can scan the beam in the directions of the direction angles $\phi$ on the plane tilted for the angle $\theta$ to the boresight. This embodiment can be accomplished regardless of the antenna type, feeding method, and circularly polarized wave generating method. In this construction, each beam scanning antenna has an independent feeding system. The output signals of the first mode of the first beam scanning antenna 543 are sent to a feeding circuit 575 which combines these signals. The output signals of the second mode of the first beam scanning antenna 543 are sent to a feeding circuit 576 which combines these signals. The output signals of the first mode of the second beam scanning antenna 544 are sent to a feeding circuit 577 which combines these signals. The output signals of the second mode of the second beam scanning antenna 544 are sent to a feeding circuit 578 which combines these signals. The output signal of the feeding circuit 575 is sent to an amplifier 581. The output signal of the amplifier 581 is sent to a phase shifter 579. The output signal of the phase shifter 579 is sent to a combining device 585. The output signal of the feeding circuit 576 is sent to an amplifier 582. The output signal of the amplifier 582 is sent to the combining device 585. The combining device 585 combines the output signals of the phase shifter 579 and the amplifier 582. The output signal of the combining device 585 is sent to an RF switch 587. The output signal of the feeding circuit 577 is sent to an amplifier 583. The output signal of the amplifier 583 is sent to a phase shifter 580. The output signal of the phase shifter 580 is sent to a combining device 586. The output signal of the feeding circuit 578 is sent to an amplifier 584. The output signal of the amplifier 584 is sent to the combining device 586. The output signal of the combining device 586 is sent to the RF switch 587 which selects one of the two signals received from the combining devices 585 and 586 corresponding to the rotation angle $\phi$ of the beam. Thus, the antenna system can scan the beam in the directions of the direction angles $\phi$ at every 15 degrees.

In the above-described construction, the antenna system can scan the beam in the directions of the rotation angle $\phi$ at intervals of smaller degrees. In the sixth embodiment, an example of an antenna system where antenna elements are disposed in a triangular shape and which scan the beam in the directions of the direction angles $\phi$ at intervals of 15 degrees was described. However, when a number of beam scanning antennas are disposed in the same area and these beam scanning antennas are selected by an RF switch, a beam scanning antenna system which scans the beam in the directions of the direction angles at intervals of much smaller degrees can be constructed without an increase of the overall size thereof.

In addition to the RF switch which selects one of two beam scanning antennas, when a means which excites the beam scanning antennas in the same phase is provided, the antenna system can have radiation directivity so that the composite beam thereof is scanned at the center of two directions in which the two beam scanning antennas scan their beams. Thus, in this case, the intervals of degrees of the direction angles $\phi$ can be halved. This construction can apply to an antenna system where antenna elements are disposed in a square shape.

Thus, the intervals of degrees of the direction angles of the beam can be decreased. This antenna system is effectively used for a beam scanning antenna system with a gain of 30 dB or more and a very small beam width as in an antenna which receives signals from satellites. In addition, since the antenna system can be constructed lightly and compactly, it can be used for an antenna installed in a mobile station.

Next, another construction of an antenna element will be described.

In the above-mentioned embodiments, as antenna elements, microstrip antenna members were used. The radiation directivity was combined by different two modes. Thus, the beam was scanned in the directions of predetermined direction angles. However, even if the antenna elements are modified in the following manner, the effects of the present invention are not lost. For example, even if the antenna elements are constructed by using another antenna type, feeding method, circular polarizing method, and/or line pattern method, the effects of the present invention are not changed.

In addition, when antenna elements which combine radiation directivity with two different modes is used, another combination of modes not mentioned in the above-described embodiments may be used. For example, when signals of antenna elements are combined with TMmn mode and TMpq mode which are modes for circular microstrip antenna members and ring microstrip antenna members, if signals of two orthogonal modes are combined with a proper amplitude ratio and a proper phase difference, the beam can be scanned in the direction of any direction angle regardless of a circularly polarized wave and a linearly polarized wave.

In particular, when $|m-p|=1$, since a peak of radiation directivity combined with the two modes appears in one direction. Thus, good sidelobe characteristics can be obtained. The lower the values of m, n, p, and q, the more the Q value of resonance decreases. Thus, the frequency band can be widened. On the other hand, the more the values of m and p increase, the more the angle θ tilted to the boresight increases. The modes can be optimally selected corresponding to design values such as the frequency band and the angle θ to the boresight.

Moreover, with three or more different modes, antenna elements may be constructed. For example, with TM 11 mode, TM 21 mode, and TM 31 mode which are modes for circular microstrip antenna members or ring microstrip antenna members, the radiation directivity of antenna elements can be combined. In this construction, sidelobe levels of other than beam direction can be reduced in comparison with the construction using two modes. Thus, when three or more different modes are used, injection of disturbing radio waves can be effectively prevented. In the case that the antenna elements with three or more different modes are arrayed, when a feeding system is provided for each mode and signals of all the modes are combined with a predetermined amplitude ratio and a predetermined phase difference, the number of phase shifters and amplifiers can be minimized. Thus, the beam scanning antenna system can be constructed at low cost.

Figure 40:
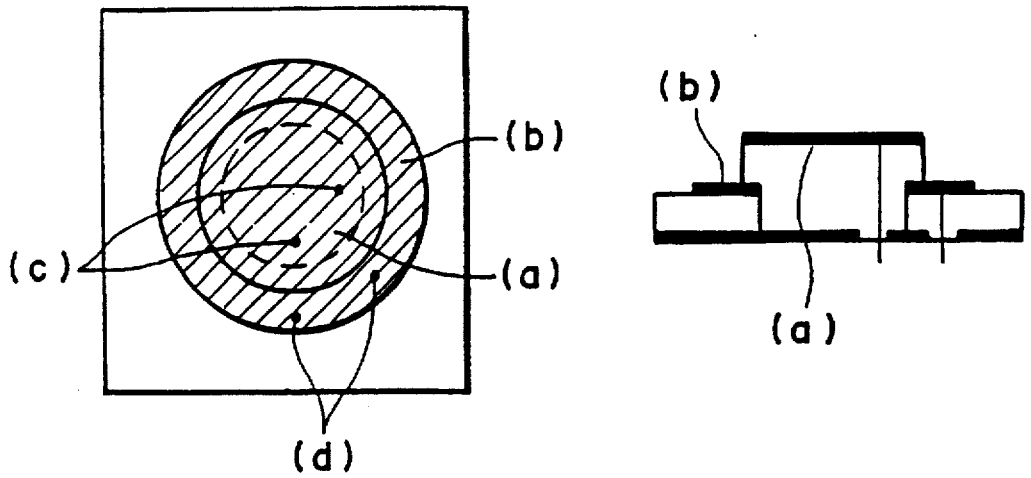
FIG. 40 is a top view and a sectional view showing the construction of another example of the beam scanning antenna according to the sixth embodiment of the present invention.
Figure 41:
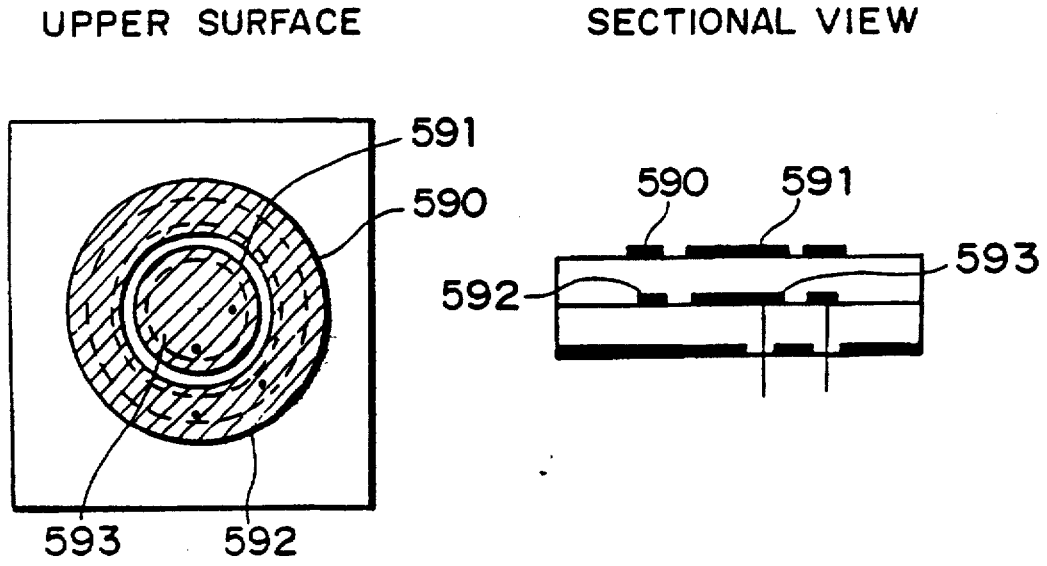
FIG. 41 is a top view and a sectional view showing the construction of a further example of the beam scanning antenna according to the sixth embodiment of the present invention.

In the above-mentioned embodiments, antenna members which are excited with two modes were formed on the same plane. However, as shown in FIG. 40, two antenna members may be disposed in two different layers as in a combination of a circular antenna member and a patch antenna member. In the figure, a top view of the antenna is shown in the left, whereas a sectional view thereof is shown in the right. In the figure, (a) is a patch antenna; (b) is a circular antenna; (c) is a feed point of the patch antenna; and (d) is a feed point of the circular antenna. In addition, as shown in FIG. 41, parasitic elements may be stacked so as to widen the frequency band. In the figure, reference numeral 593 is a circular microstrip antenna member 593. Reference numeral 592 is a ring microstrip antenna member. The microstrip antenna member and the ring microstrip antenna member 593 are directly fed by feed pins. The parasitic elements are a circular patch 591 and a ring patch 590.

Next, an embodiment of an antenna element using a horn antenna member will be described as a seventh embodiment.

Figure 42:
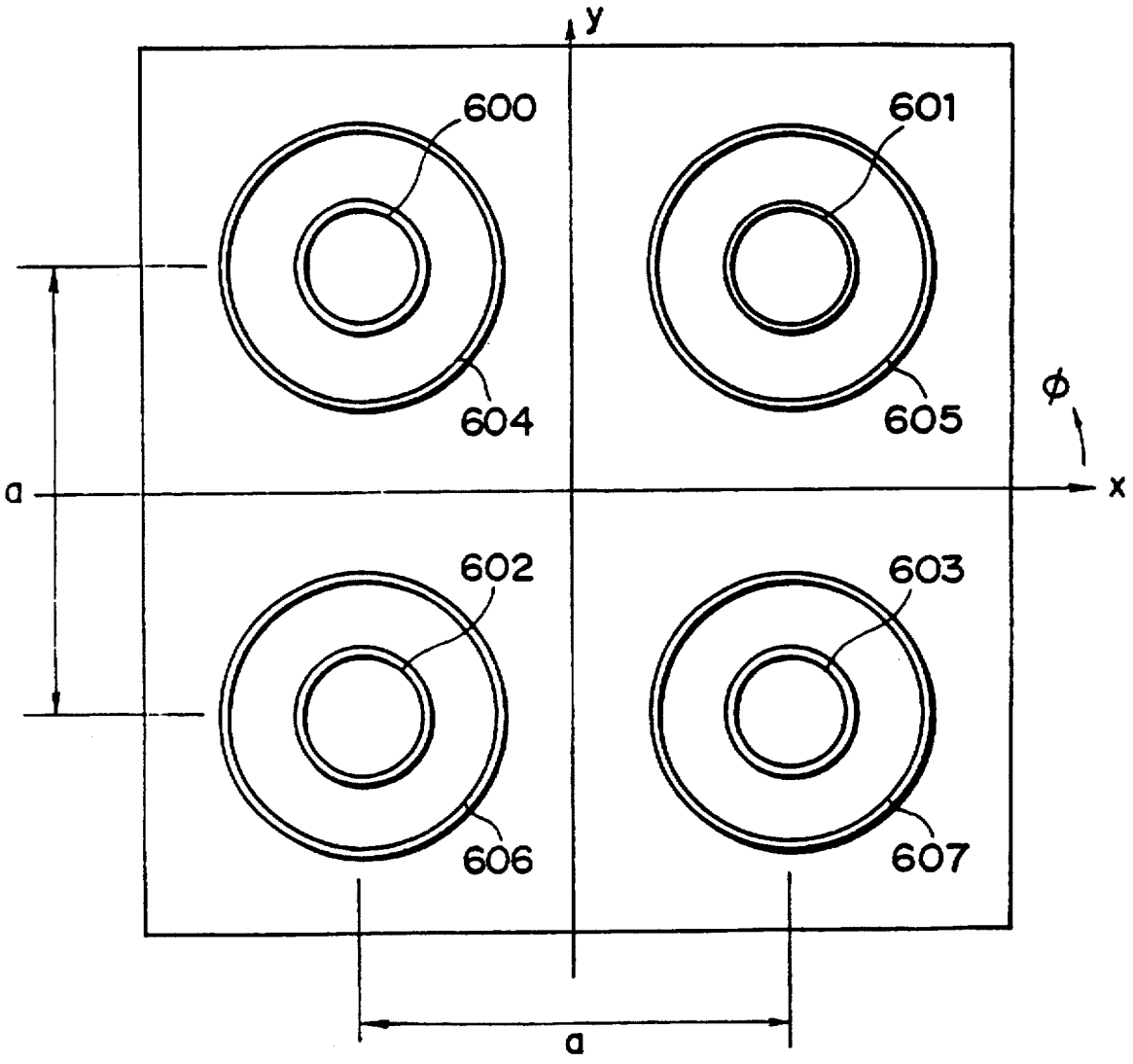
FIG. 42 is a top view showing a beam scanning antenna according to a seventh embodiment of the present invention.

FIG. 42 is a top view showing a beam scanning antenna according to the seventh embodiment of the present invention. This beam scanning antenna has four antenna elements which are disposed in a square shape where the antenna element pitch is a.

Figure 43:
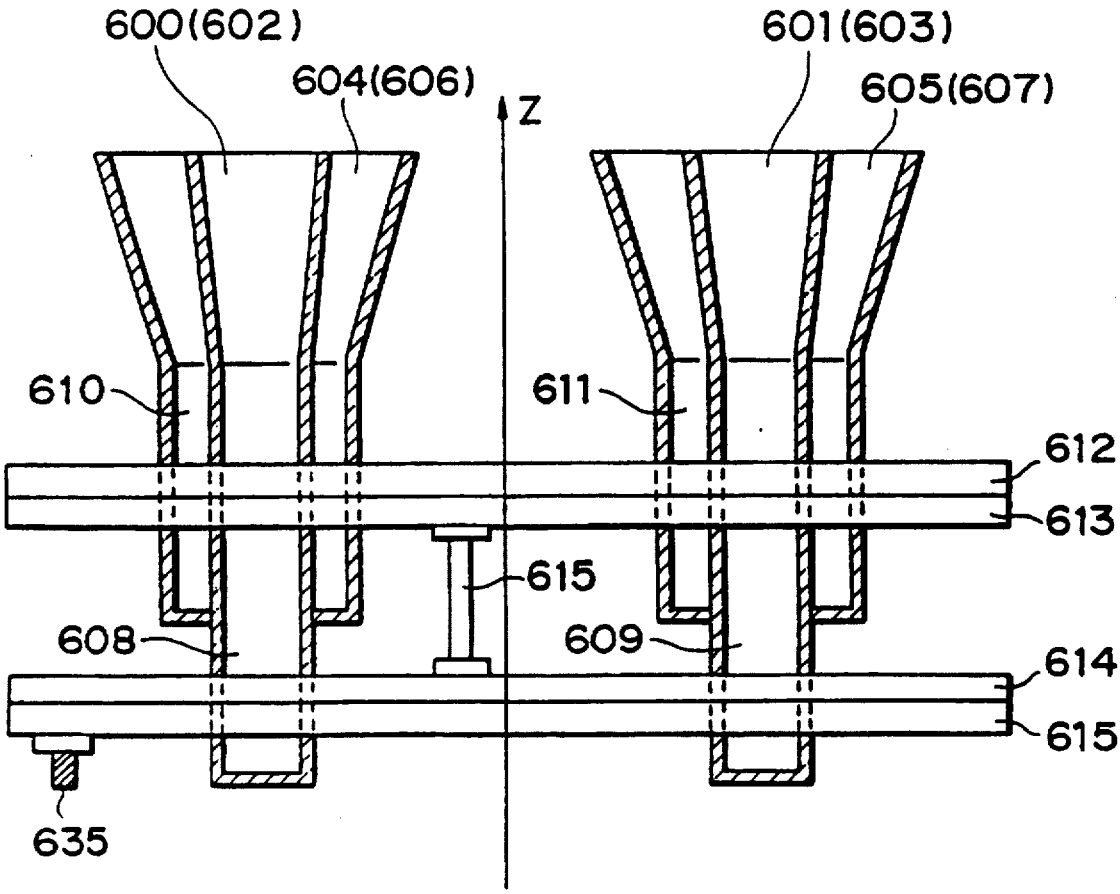
FIG. 43 is a sectional side view showing the beam scanning antenna according to the seventh embodiment of the present invention.

The beam scanning antenna shown in FIG. 42 are constructed of circular horn antenna members 600, 601, 602, and 603 and coaxial horn antenna members 604, 605, 606, and 607. FIG. 43 is a sectional view of the beam scanning antenna. The circular horn antenna member 600 and 601 are connected to circular waveguides 608 and 609, respectively. The coaxial horn antenna members 604 and 605 are connected to coaxial waveguides 610 and 611, respectively. The circular horn antenna members excite circular polarized waves in a dominant mode (TE 11 mode), whereas the coaxial horn antenna members excite circularly polarized waves in a higher-order mode (for example, TE 21 mode). The radiation fields of these two modes are the same as those of the microstrip antenna members. When signals are combined with a proper amplitude ratio and a proper phase difference, each antenna element can scan the beam in the direction of a predetermined direction angle. Although an exciting circuit and a feeding circuit for each antenna element may be integrally constructed in a waveguide system component, this beam scanning antenna according to this embodiment use a plane circuit.

Each coaxial horn antenna member is excited by a plane circuit which has an exciting probe protruding to the corresponding coaxial waveguide. The dielectric substrates 612 and 613 form the plane circuit as a first tri-plate line pattern. The first tri-plate line pattern is disposed between upper and lower ground conductors formed of the dielectric substrates 612 and 613. Likewise, each circular horn antenna is excited by a plane circuit which protrudes to the corresponding circular waveguide. The dielectric substrates 614 and 615 form the plane circuit as a second tri-plate line pattern. The second tri-plate line pattern is disposed between upper and lower ground conductors formed of the dielectric substrates 614 and 615.

Figure 44:
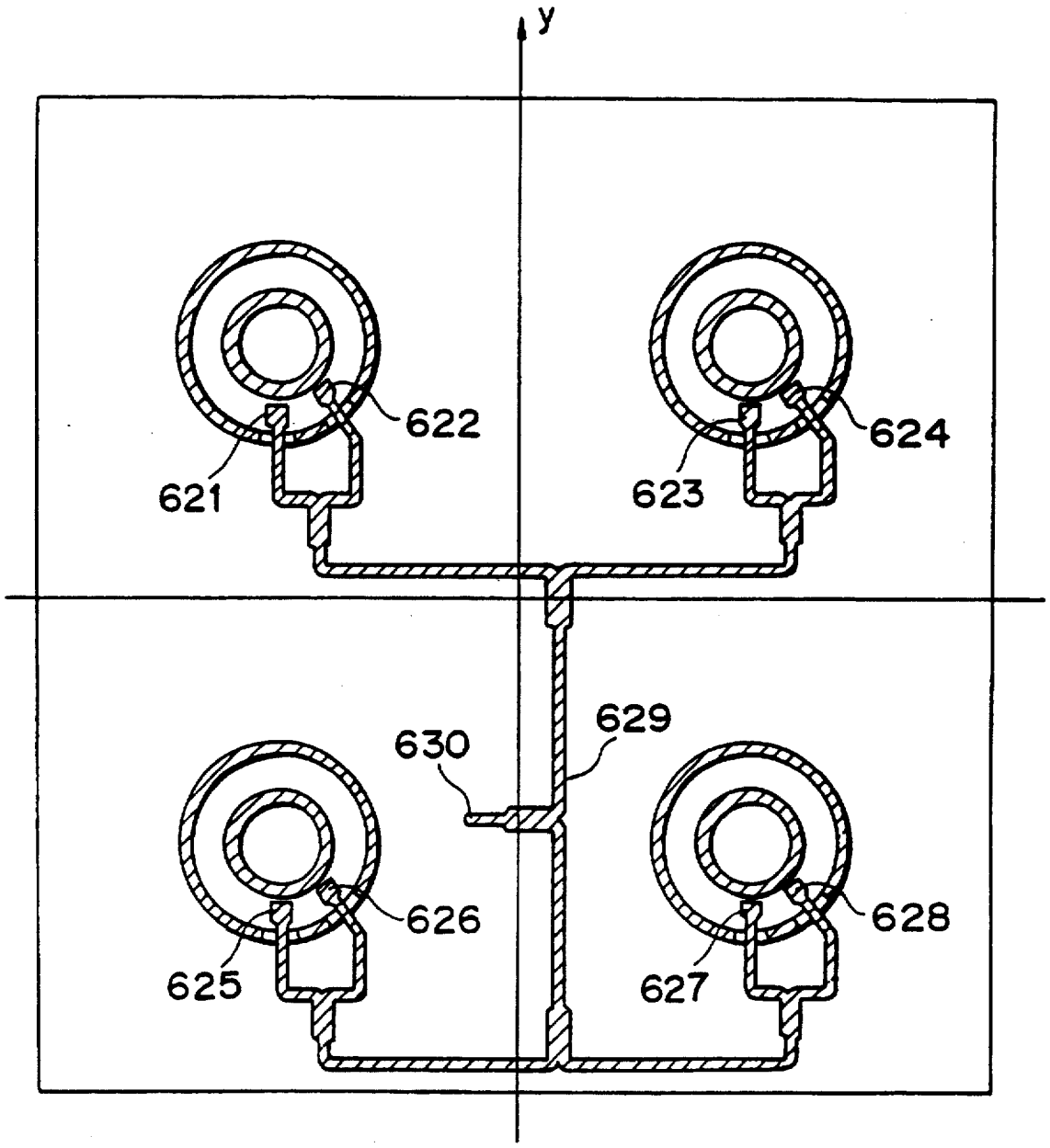
FIG. 44 is a schematic diagram showing a feeding circuit of the beam scanning antenna according to the seventh embodiment of the present invention.
Figure 45:
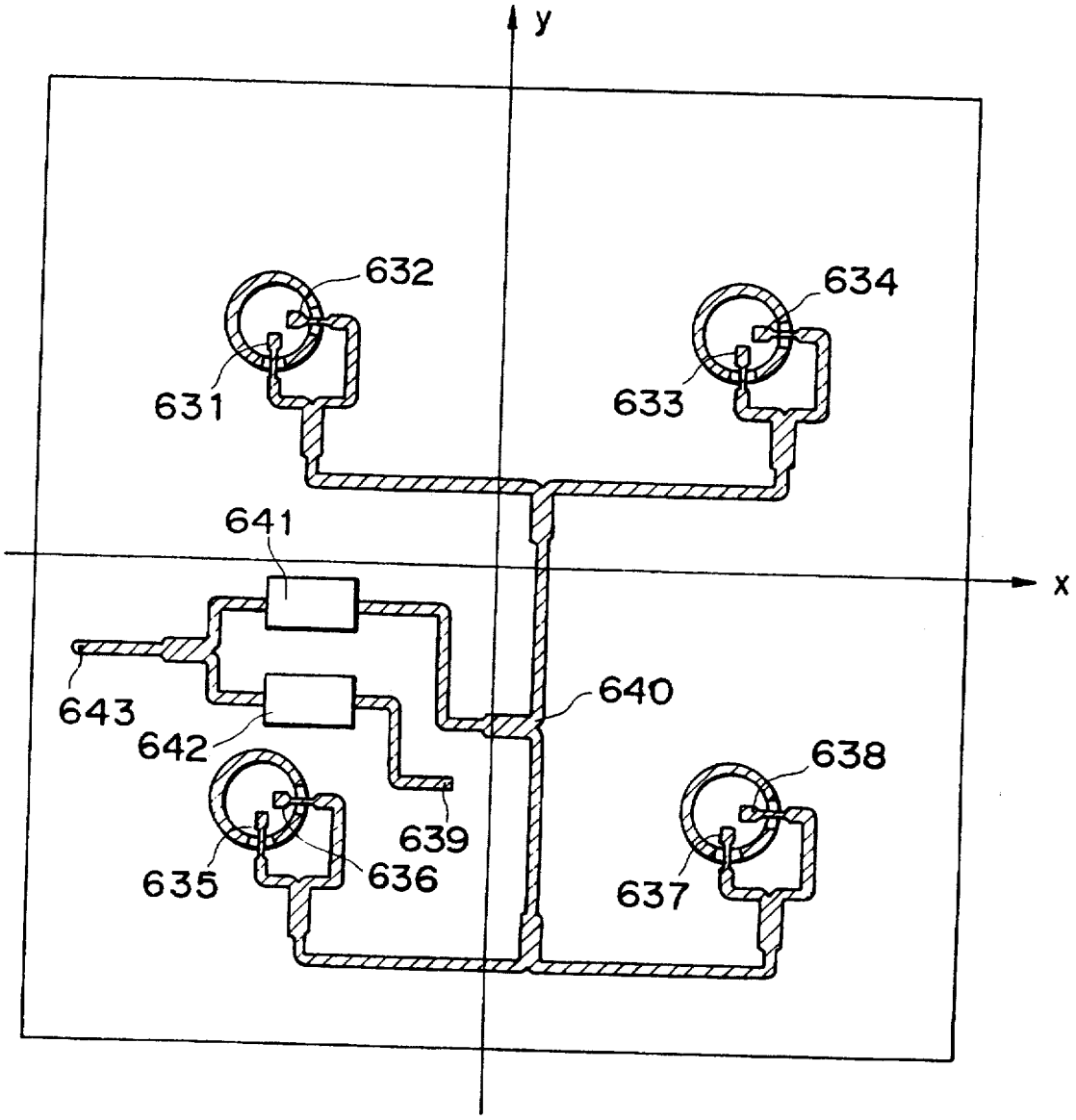
FIG. 45 is a schematic diagram showing a feeding circuit of the beam scanning antenna according to the seventh embodiment of the present invention.

FIG. 44 shows the construction of an example of a higher-order mode feeding circuit. Probes 621 to 628 which excite signals of the higher-order mode electrically protrude to the corresponding coaxial waveguides. The output signals of the probes 621 to 628 are sent to corresponding circular polarizer each of which is formed of a T branch and a line with a phase difference of 90 degrees thereto. The circular polarizer output signals of circularly polarized waves to a feeding circuit 629. The feeding circuit 629 combines the signals of all the antenna elements in the same phase. The output signal of the feeding circuit 629 is sent to the immediately lower layer through a port 630 and a coaxial line 615. A module which combines the signals of the dominant mode and the higher-order mode is formed of the plane circuit formed of the dielectric substrates 614 and 615. FIG. 45 shows this plane circuit.

In FIG. 45, probes 631 to 638 which excite signals of the dominant mode electrically protrude to the corresponding waveguides. The output signals of the probes 631 to 638 are sent to the corresponding circular polarizer. The output signals of the circular polarizer are sent to a feeding circuit 640 which combines the signals of all the antenna elements in the same phase. The composite signal of the dominant mode is sent to an MMIC module 641. The composite signal of the higher-order mode received from the port 639 is sent to an MMIC module 641. These MMIC modules each have a phase shifter and an amplifier (or amplifier only). Thus, the MMIC modules each amplify the RF signal and shift the phase thereof. The output signals of the MMIC modules are combined and output from a port 643 through a connector 635.

When the antenna element pitch a, the phase difference, and amplitude ratio are set to the above-described values, respectively, a beam scanning antenna which scans the beam in the directions of a plurality of direction angles $\phi$ can be constructed.

Since the beam scanning antenna according to the sixth embodiment has waveguide type horn antenna members, it can provide high gain and wide band. In this embodiment, instead of tri-plate line patterns, suspended line patterns or the like may be used. Moreover, instead of dielectric substrates, honeycomb substances may be used. In this construction, since the feeding circuits may be formed of line patterns with low loss property, the loss of the horn antenna members can be reduced. Thus, the entire power loss of the beam scanning antenna can be decreased. This beam scanning antenna is very effective for a space antenna such as an antenna installed in a satellite which should reduces the generation of heat.

In addition, when the feeding circuits are formed of plane circuits, the beam scanning antenna can be constructed compactly and lightly. Thus, this feature becomes a very important advantage of a space antenna.

Next, an embodiment which has a plurality of sub arrays instead of antenna elements will be described as an eighth embodiment of the present invention.

Figure 46:
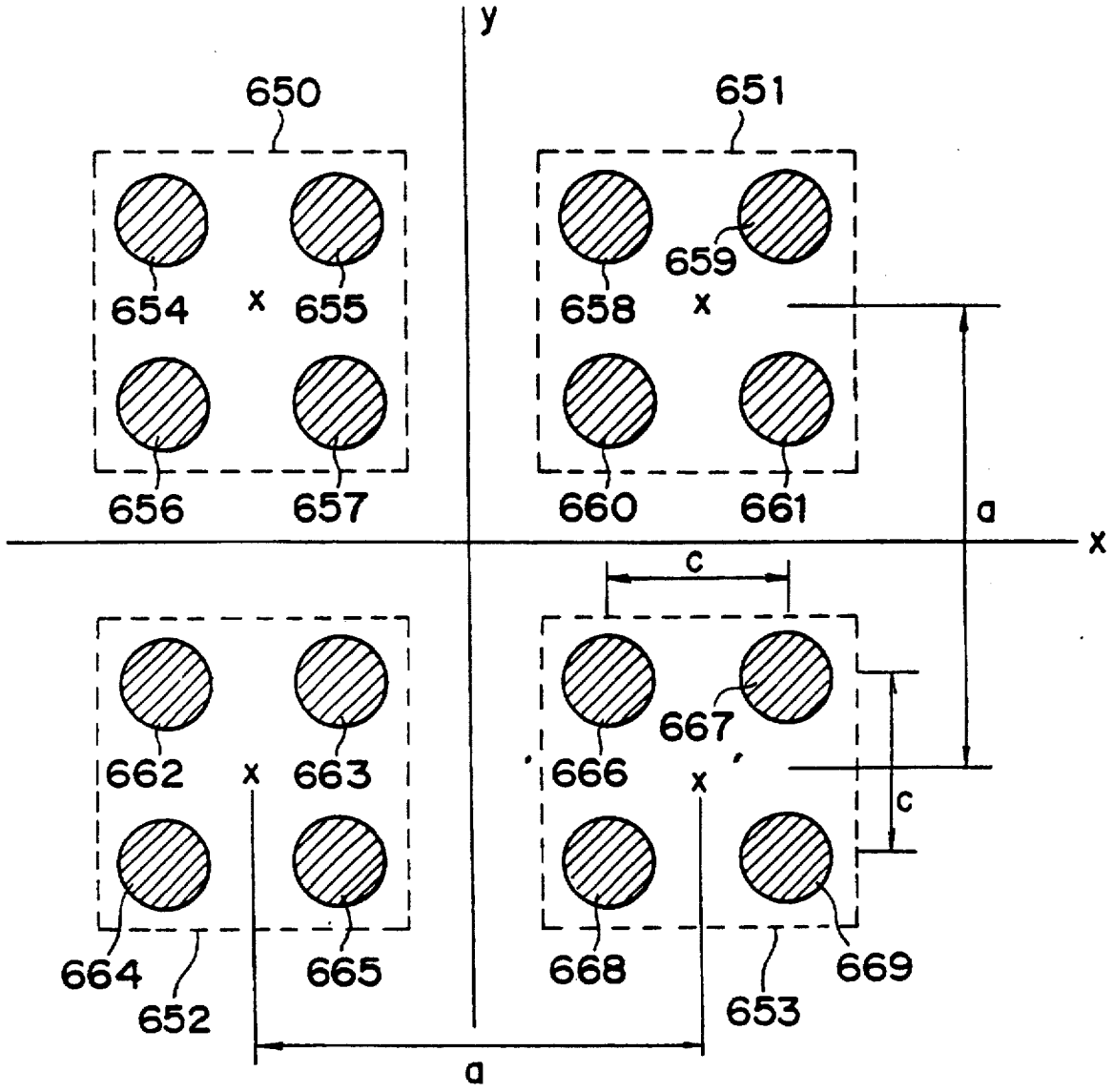
FIG. 46 is a top view showing a beam scanning antenna according to an eighth embodiment of the present invention.

FIG. 46 is a top view showing the construction of a beam scanning antenna according to the eighth embodiment of the present invention. In the figure, reference numerals 650, 651, 652, and 653 are sub arrays according to the above-described antenna elements. In this embodiment, the sub arrays are disposed in a square shape where the sub array pitch is a. Each sub array scans the beam in the directions of the rotation angle $\phi$ at intervals of predetermined degrees on the plane tilted for the angle $\theta$ to the boresight of the antenna.

Each sub array is constructed of four antenna elements.

The sub array 650 is constructed of four antenna elements 654, 655, 656, and 657. The sub array 651 is constructed of four antenna elements 658, 659, 660, and 661. The sub array 652 is constructed of four antenna elements 662, 663, 664, and 665. The sub array 653 is constructed of four antenna elements 666, 667, 668, and 669. Since the phase of a signal of each antenna element is shifted by a phase shifter or the like, the beam of the sub array can be scanned in a predetermined direction. The sub array pitch a can be set in the same manner as that of the above-described embodiments. In other words, the sub array pitch a is set so that the optical (transmission) path difference of radio waves entered or radiated to or from adjacent sub arrays nearly becomes a multiple of the wave length of the radio waves.

Figure 47:
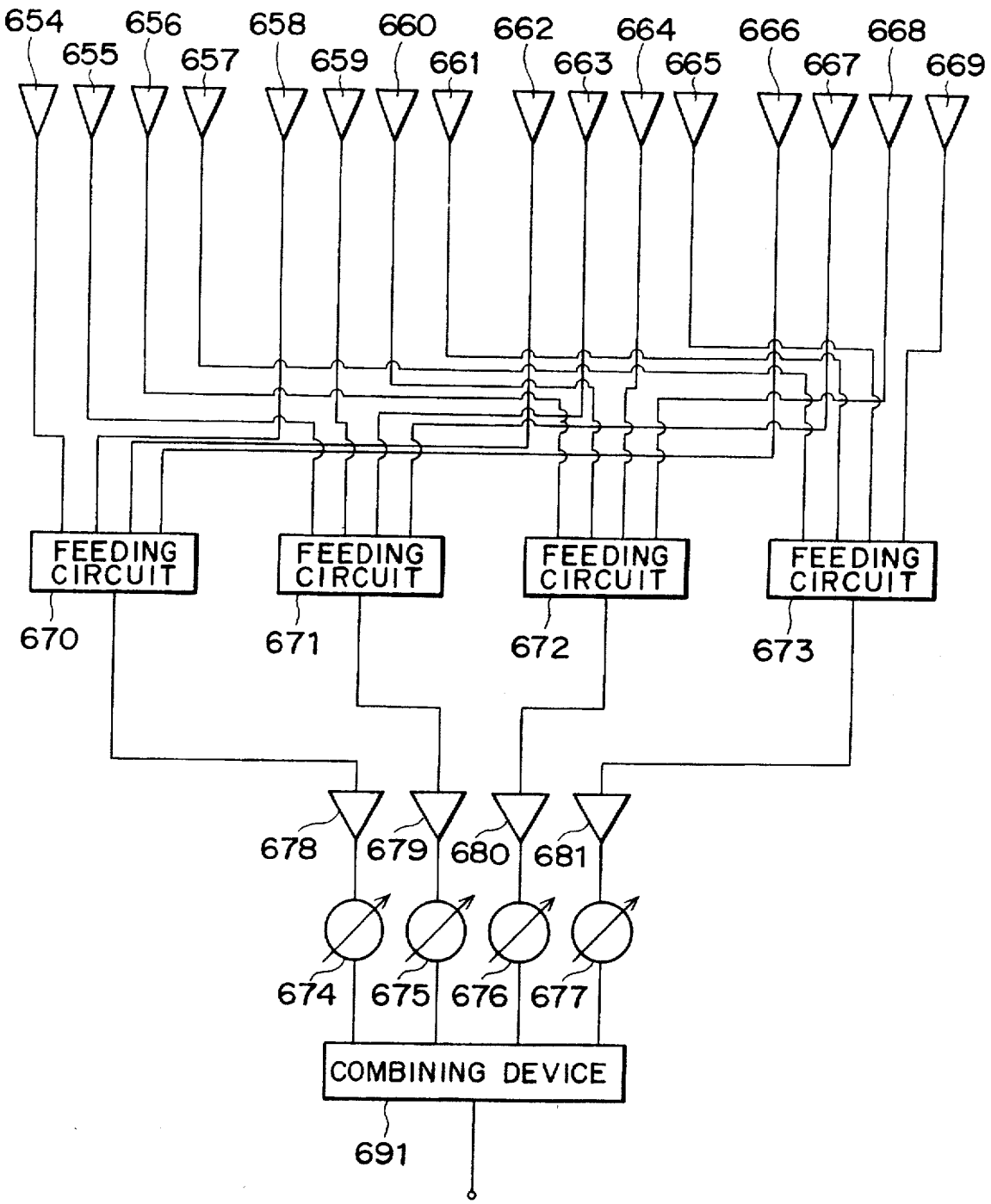
FIG. 47 is a circuit diagram showing the construction of a feeding system of the beam scanning antenna according to the eighth embodiment of the present invention.

FIG. 47 is a circuit diagram showing a feeding system of the beam scanning antenna according to the eighth embodiment of the present invention. Signals of corresponding antenna elements of the sub arrays (with the same phases) are combined (or distributed) by a shared feeding circuit. The output signals of the antenna elements 654, 658, 662, and 666 are sent to a feeding circuit 670 which combines these signals. The output signals of the antenna elements 655, 659, 663, and 667 are sent to a feeding circuit 671 which combines these signals. The output signals of the antenna elements 656, 660, 664, and 668 are sent to a feeding circuit 672 which combines these signals. The output signals of the antenna elements 657, 661, 665, and 669 are sent to a feeding circuit 673 which combines these signals. The output signals of the feeding circuits 670, 671, 672, and 673 are sent to amplifiers 678, 679, 680, and 681, respectively. The output signals of the amplifiers 678, 679, 680, and 681 are sent to phase shifters 674, 675, 676, and 677, respectively. The output signals of the phase shifters 674, 675, 676, and 677 are sent to a combining device 691.

As opposed to the conventional beam scanning antenna which requires phase shifters corresponding to antenna elements for use, according to the eighth embodiment of the present invention, the number of phase shifters can be remarkably reduced. Thus, the production steps can be reduced, thereby lowering the production cost. Moreover, in the sub array method, since the conventional microstrip antenna members which excite only in a dominant mode can be used, the sub array antenna can be easily designed and produced.

Figure 48:
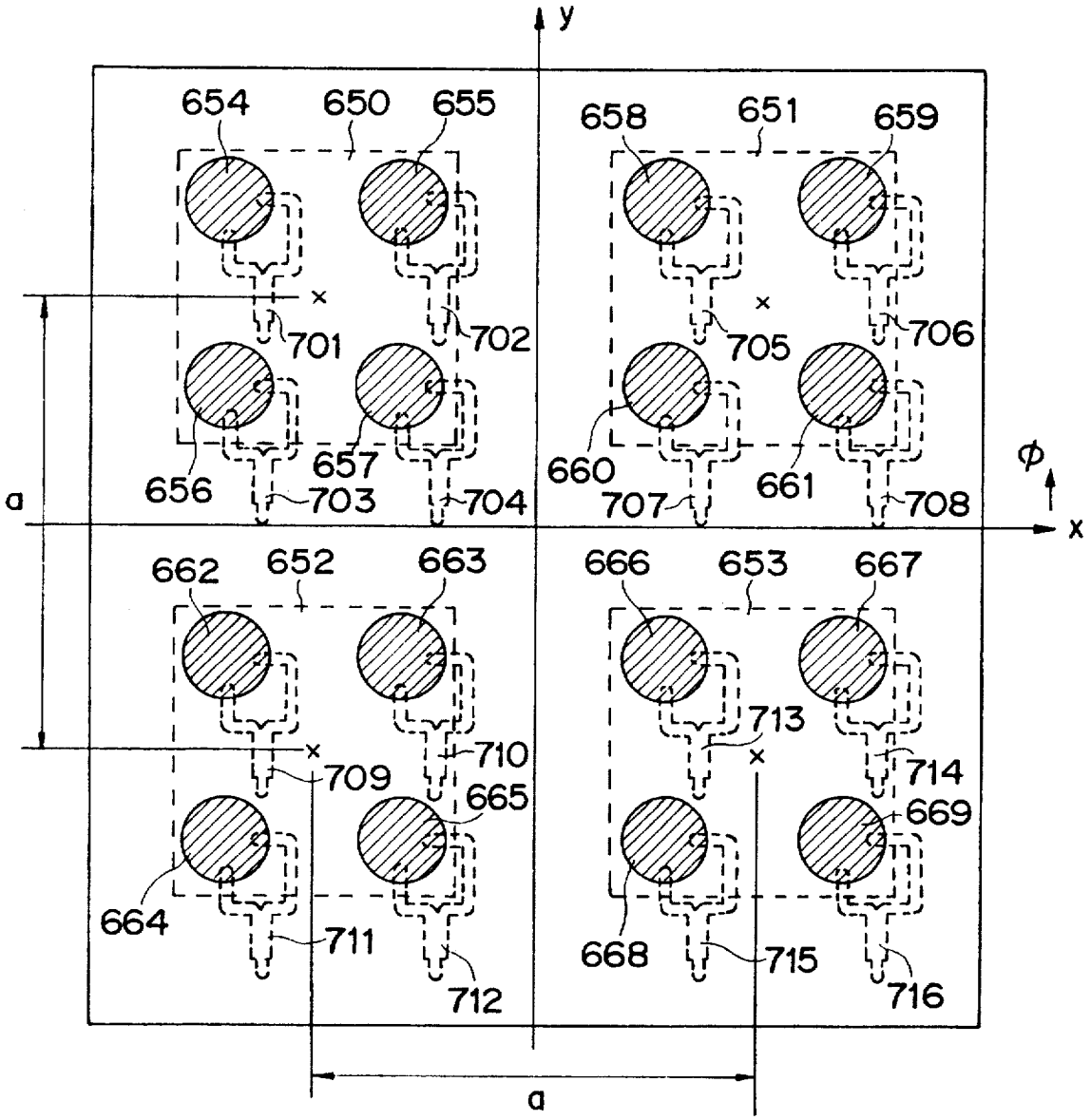
FIG. 48 is a top view showing the beam scanning antenna according to the eighth embodiment of the present invention.

FIG. 48 is a top view showing the construction of a practical example of the eighth embodiment of the present invention. In this example, each sub array is constructed of four antenna elements which are disposed in a square shape where the antenna element pitch is a. In this example, circular microstrip antenna members and electromagnetic coupling type feeding method are used. Thus, electrical connections between layers can be omitted. Consequently, the production steps can be remarkably reduced. However, in this example, any antenna elements and any feeding method may be used.

Feed lines 701 to 716 are disposed below the layer of the antenna elements 654 to 669. Each feed line which has a T branch and a line with a phase difference for 90 degrees thereto forms a circular polarizer.

Figure 49:
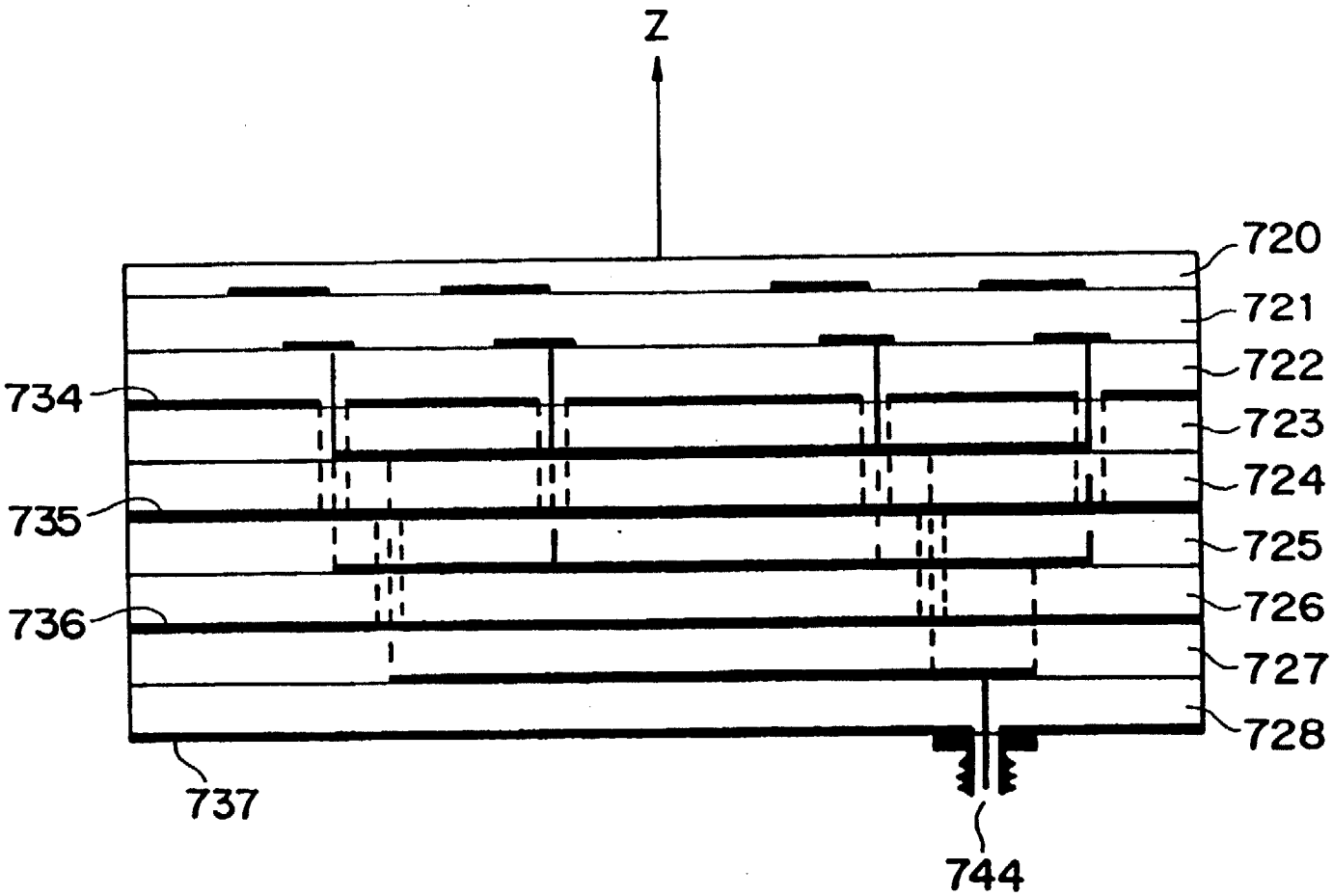
FIG. 49 is a sectional view showing the beam scanning antenna according to the eighth embodiment of the present invention.

FIG. 49 is a sectional view showing the beam scanning antenna according to the eighth embodiment of the present invention. This antenna is formed of nine dielectric substrates 720 to 728 being layered. The dielectric substrate 720, which is the uppermost layer, is a radome layer which prevents the antenna elements from being corroded and damaged. On the upper surface of the dielectric substrate 721, microstrip antenna members are formed. On the upper surface of the dielectric substrate 722, feed lines including circular polarizer are formed. These microstrip antenna members and the circular polarizer operate as lines and radiating devices along with a base conductor 734 disposed on the lower surface of the dielectric substrate 722. The conductor surface of each dielectric layer is formed by etching method or the like. The dielectric substrates 723 and 724 form a feeding circuit for the half the antenna elements as a first tri-plate line pattern.

Figure 50:
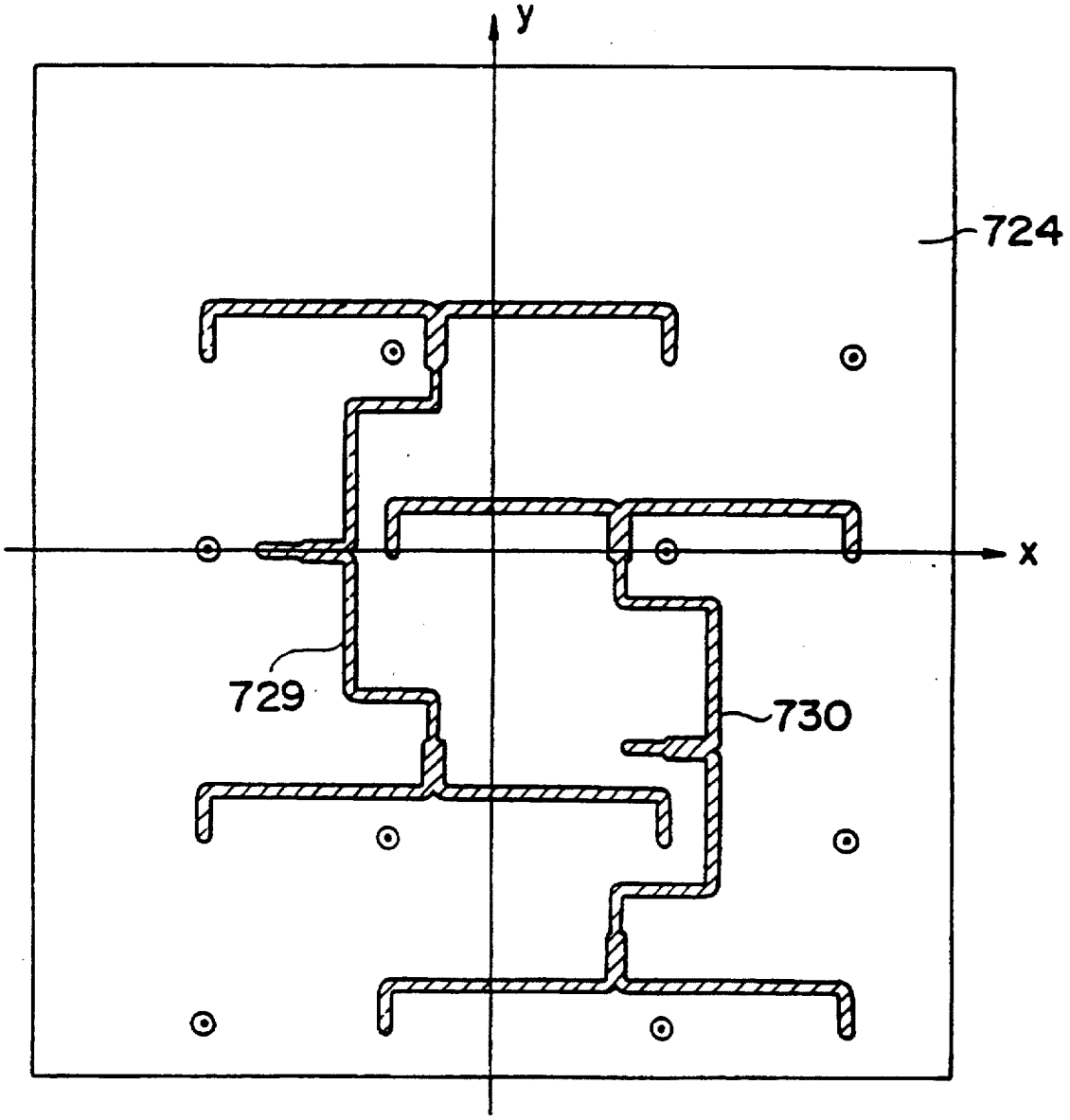
FIG. 50 is a schematic diagram showing a feeding circuit of the beam scanning antenna according to the eighth embodiment of the present invention.

The tri-plate line pattern is formed between ground conductors 734 and 735. The base conductor 734 is disposed on the upper surface of the dielectric substrate 723. The ground conductor 735 is disposed on the lower surface of the dielectric substrate 724. FIG. 50 shows the first tri-plate line pattern. On the first tri-plate line pattern, two feeding circuits 729 and 730 are formed. These feeding circuits 729 and 730 combine (or distribute) signals so that each antenna element is excited in the same phase. An input port of each feeding circuit is connected to a feeding line on the above layer with an RF line (coaxial line formed of a through-hole) which passes through the layers. Likewise, the dielectric substrates 725 and 726 form a feeding circuit for the remaining antenna elements as a second trip-plate line pattern.

Figure 51:
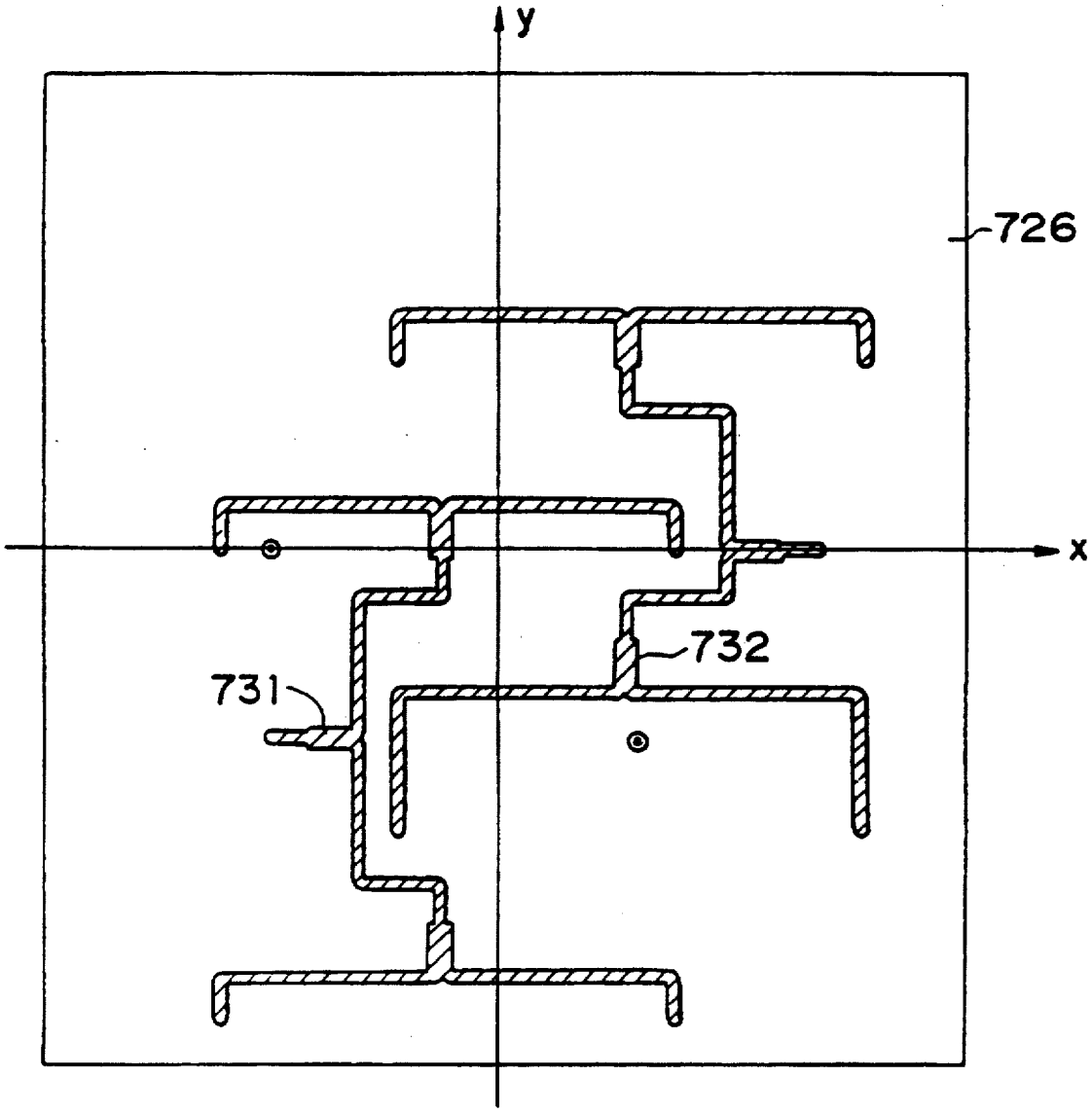
FIG. 51 is a schematic diagram showing a feeding circuit of the beam scanning antenna according to the eighth embodiment of the present invention.

The second tri-plate line is formed between ground conductors 735 and 736. FIG. 51 shows the second tri-plate line pattern which forms feed lines 731 and 732. Below the second tri-plate line pattern, the dielectric substrates 727 and 728 are disposed. The dielectric substrates 727 and 728 form phase shifters, amplifiers, combining devices, and their control circuit as a third tri-plate line pattern. In this example, any control circuit may be used. For the sake of simplicity, the description of the control circuit is omitted.

Figure 52:
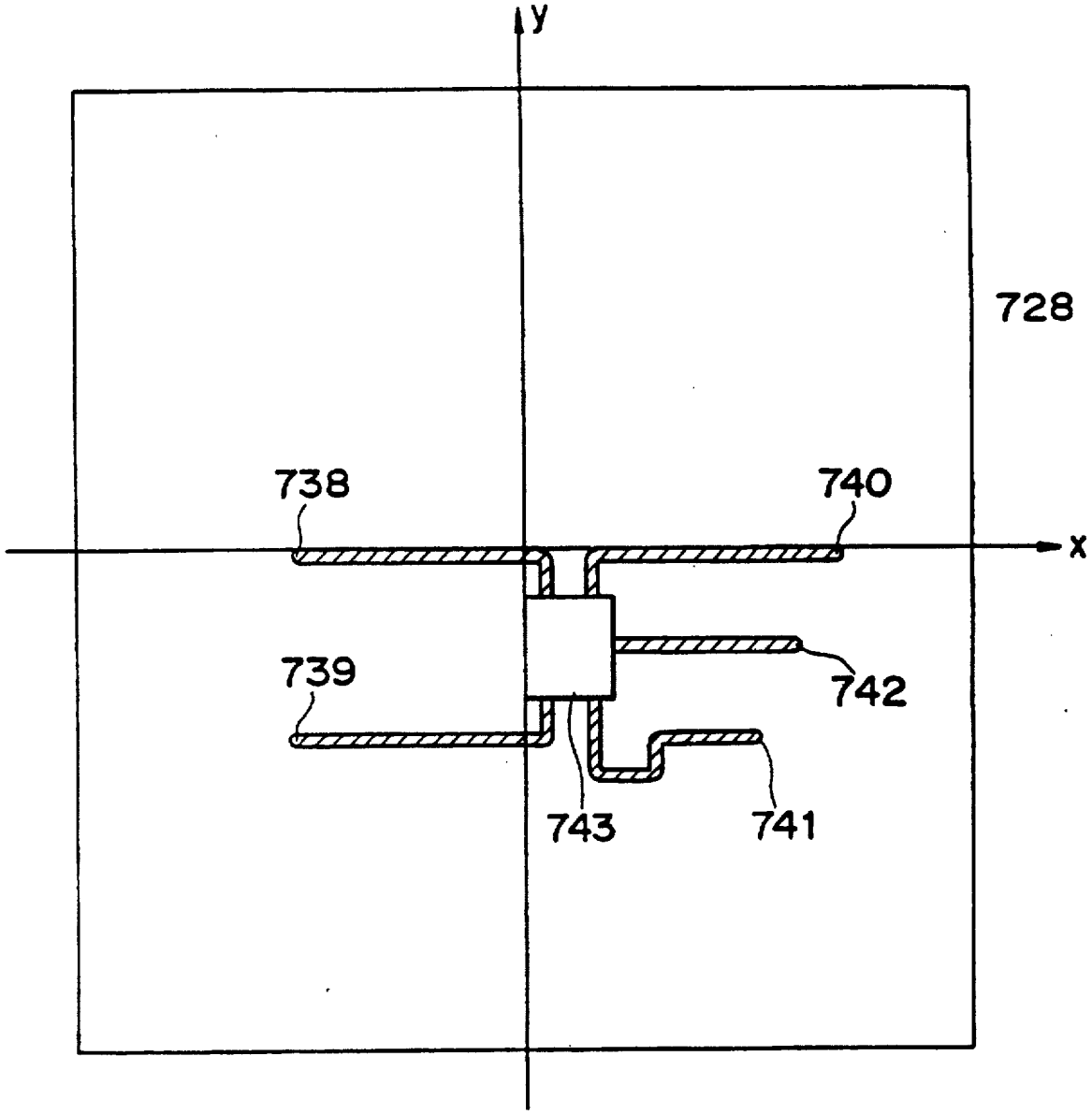
FIG. 52 is a schematic diagram showing a feeding circuit of the beam scanning antenna according to the eighth embodiment of the present invention.

The third tri-plate line pattern is formed between ground conductors 736 and 737. FIG. 52 shows the third tri-plate line pattern which forms lines and modules. The output signals of the sub arrays are sent to an MMIC module 743 through ports 738, 739, 740, and 741.

The MMIC module 743 has the phase shifters 674, 675, 676, and 677, the amplifiers 678, 679, 680, and 681, the combining device 691, the RF lines, the control circuit, and so forth as shown in FIG. 47. These circuits are formed on a substrate made of gallium arsenide or silicone. The MMIC module 734 sets a predetermined amplitude and phase so as to scan the beam in the corresponding direction. The output signal of the MMIC module 743 is sent to an external transmitter or receiver to or from a connector 744 through a port 740.

In the above-described construction, the beam scanning antenna which scans the beam in the directions of a plurality of direction angles $\phi$ on the plane tilted for the angle $\theta$ to the boresight can be formed. For example, when the beam is scanned in the directions of the direction angles $\phi$ at intervals of 45 degrees, the sub array pitch a is set so that both $[a\times\sin\theta]$ and $[(2^{1/2}/2)\times a\times\sin\theta]$ become a multiple of the wave length of the radio waves. In addition, the phase of each phase shifter is is set so that the corresponding sub array can scan the beam in the directions of the direction angles $\phi$ at every 45 degrees. In this embodiment, since each phase shifter only shifts the phase of the input signal in at most five levels, its construction is simple. The phase of each phase shifter depends on the antenna element pitch c and the angle $\theta$ to the antenna's boresight.

According to the eighth embodiment of the present invention, the number of phase shifters can be reduced. Thus, the beam scanning antenna can be produced with simple steps and at low cost. In addition, the antenna elements can be also simply constructed of any conventional antenna member and method. The antenna elements of the beam scanning antenna according to this embodiment can be used for other purposes (for example, an antenna with a wide band, an antenna with a high gain, an antenna for multi-types of polarized waves, a receiving/transmitting antenna, an antenna with high isolation of polarized waves and of transmission and reception) with high degree of freedom. Since the beam scanning antenna according to the eighth embodiment uses plane circuits and lines, it can be constructed thinly and compactly. Thus, this antenna is effectively used for an antenna installed in a mobile station which communicates with communication satellites.

According to the eighth embodiment, when the construction of each sub array is the same, the antenna element pitch a is set so that the optical path difference of radio waves received or transmitted by adjacent antenna elements becomes a multiple of the wave length of the radio waves.

In the eighth embodiment, regardless of whether the antenna elements are disposed on a plane or any curved surface such as a spherical surface, the same effects can be obtained. In addition, according to this embodiment, a mechanical driving system which precisely adjusts the beam direction may be added to the beam scanning antenna so as to more precisely control the beam direction. In this case, since the mechanical driving range accords with the minimum electrical scanning angle, the mechanism can be formed in a relatively simple construction.

In the eighth embodiment of the present invention, it is not necessary to form all the antenna elements in the same construction. For example, even if a part of antenna elements scan beams in the TM 11 mode and TM 21 mode and the remaining antenna elements scan beams in the TM 31 mode and TM 21 mode, the effects of the present invention are not lost at all. In this case, sidelobe levels in other than the beam direction can be lowered, thereby preventing disturbing waves from being injected into the antenna.

In addition, when a plurality of beam scanning antennas according to this embodiment are disposed as a system in such a manner that they are tiled for the angle $\theta$ to their boresight, the beam can be scanned in the direction of the angle $\theta$ by switching among these antennas with an RF switch or the like. Since a mobile station is often running on a slop or the like, the antenna installed therein is correspondingly tilted. Thus, the adjustment function of the elevation angle $\theta$ of the beam is very useful.

In the eighth embodiment of the present invention, when signals of two modes are combined, if the amplitude ratios of these signals are varied by a variable amplifier or a variable attenuator, the slop angle $\theta$ to the boresight can be precisely adjusted. As with the above-described example, this effect is remarkably useful for an antenna installed in a mobile station.

In this embodiment, the operation which causes the antenna to scan the beam in the direction of the boresight can be easily performed by slightly modifying the construction thereof. For example, in the case that antenna elements have a dominant mode and a higher-order mode, when signals of the higher-order mode are suppressed by an RF switch or the like, the antenna can scan the beam in the forward direction (namely, $\theta=0$). In the case that sub arrays are used, when the phases of all antenna elements are matched, the antenna can scan the beam in the forward direction. These antennas can be effectively used for a mono-pulse sensor or a tracking antenna.

Figure 53:
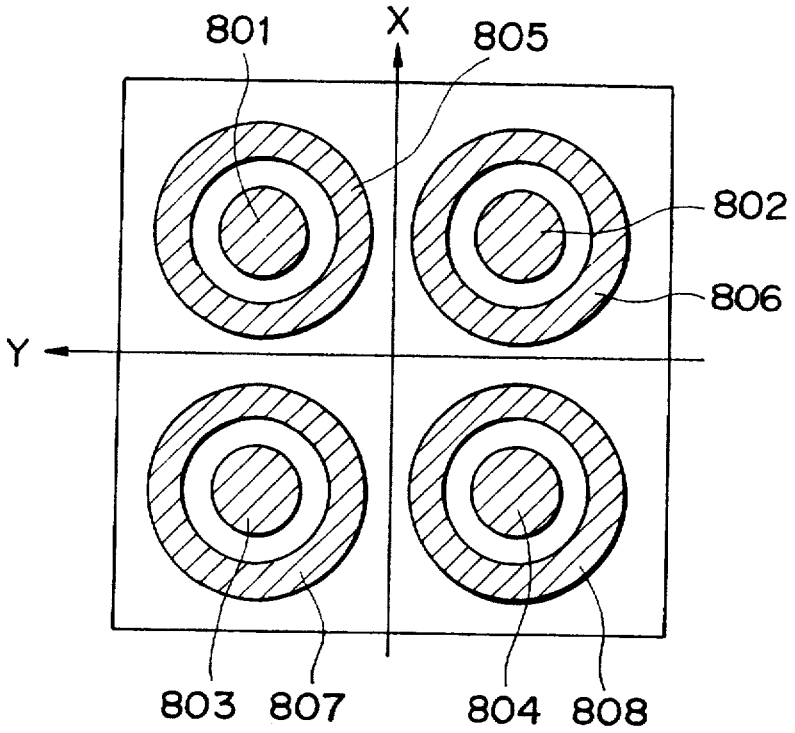
FIG. 53 is a top view showing a beam scanning antenna according to a ninth embodiment of the present invention.
Figure 54:
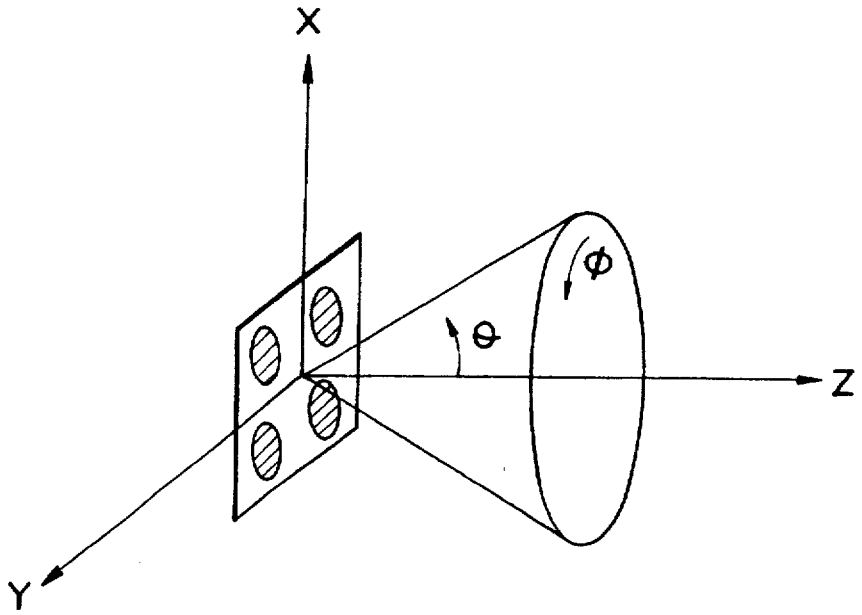
FIG. 54 is a schematic diagram showing the relation of two coordinate systems.

FIG. 53 is a top view showing a beam scanning antenna according to a ninth embodiment of the present invention. This beam scanning antenna has four antenna elements which are formed of circular microstrip antenna members 801, 802, 803, and 804 and ring microstrip antenna members 805, 806, 807, and 808. Now, assume that the exciting mode of the circular microstrip antenna members is TM mn mode, whereas the exciting mode of the ring microstrip antenna members is TM pq mode. When the relation of $|m-p|=1$ is satisfied and the exciting phases of the signals of these modes are adjusted, the antenna can scan the beam in the direction of any rotation angle $\phi$ as shown in FIG. 54. When the phase difference between the signals of these modes is adjusted by a variable phase shifter, the beam direction can be electrically varied.

Figure 55:
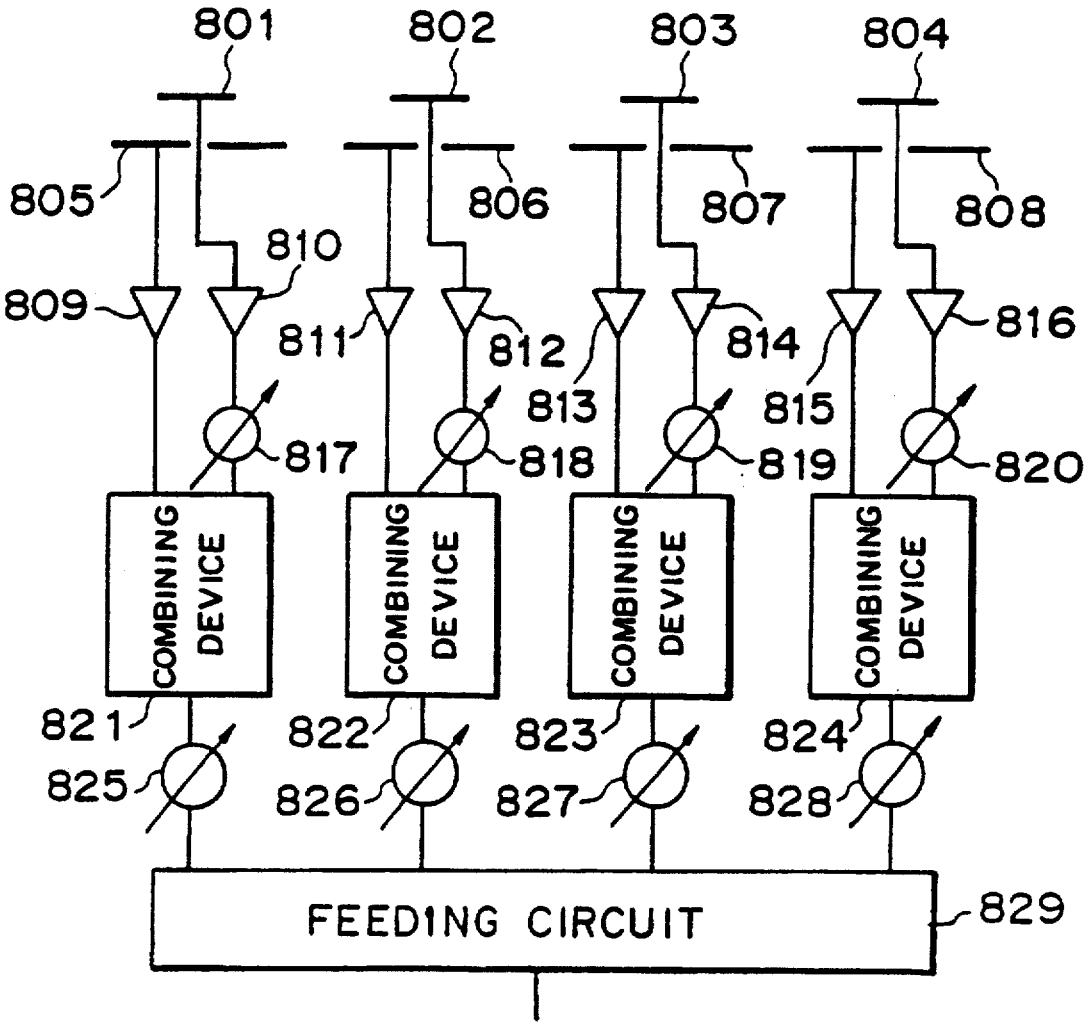
FIG. 55 is a circuit diagram showing the construction of a beam generating circuit of the beam scanning antenna according to the ninth embodiment of the present invention.

FIG. 55 is a circuit diagram showing a feeding system of the beam scanning antenna according to the ninth embodiment of the present invention. In this antenna, since the receiving operation is performed in the reverse order of the transmitting operation and the construction for the receiving operation is the same as that for the transmitting operation, only the construction for the receiving operation will be described.

In the figure, the circular microstrip antenna members 801, 802, 803, 804, and 805 receive radio waves. The output signals of the circular microstrip antenna members 801, 802, 803, 804, and 805 are sent to low noise amplifiers 810, 812, 814, and 816 which amplify the input signals, respectively. The output signals of the amplifiers 810, 812, 814, and 816 are sent to phase shifters 817, 818, 819, and 820 which shift the phases of the input signals for predetermined degrees, respectively.

On the other hand, the ring microstrip antenna members 805, 806, 807, and 808 receive radio waves. The output signals of the ring microstrip antenna members 805, 806, 807, and 808 are sent to low noise amplifiers 809, 811, 813, and 815 which amplify the received signals, respectively. The output signals of the amplifier 809 and the phase shifter 817 are sent to a combining device 821 which combines these signals. The output signals of the amplifier 811 and the phase shifter 818 are sent to a combining device 822 which combines these signals. The output signals of the amplifier 813 and the phase shifter 819 are sent to a combining device 823 which combines these signals. The output signals of the amplifier 815 and the phase shifter 820 are sent to a combining device 824 which combines these signals.

Since the phase shifters 817, 818, 819, and 820 shift the phases of the input signals of these phases for predetermined degrees, each antenna element can scan the beam in the corresponding direction. The phases of the phase shifters 817, 818, 819, and 820 for all the antenna elements are set to the same degrees. Thus, all these phase shifters can be controlled in the same manner. In other words, a control circuit and a power supply circuit can be shared with these phase shifters.

The output signals of the combining devices 821, 822, 823, and 824 are sent to low-bit phase shifters 825, 826, 827, and 828, respectively. When the bit number of these phase shifters 825, 826, 827, and 828 is one, the phase of the output signal for each antenna element can be adjusted at every 180 degrees.

In the beam scanning antenna according to the ninth embodiment, since the beam direction is precisely controlled for each antenna element, the beam direction may be roughly set as an array factor. The output signals of the phase shifters 825, 826, 827, and 828 are sent to a feeding circuit 829 which combines these signals. Thus, the final output is obtained.

In this embodiment, since plane antenna members such as microstrip antenna members are used, the beam scanning antenna can be thinly constructed. In addition, the phase shifters and the amplifiers can be easily formed thinly and compactly by using an MMIC. The feeding circuits, the combining devices, and the lines can be formed of a plane line pattern such as a microstrip line pattern, and a tri-plate line pattern. Thus, the beam scanning antenna which can electrically scan the beam can be constructed thinly and compactly.

Next, the effects and advantages of the beam scanning antenna according to the ninth embodiment will be described. A beam scanning antenna can be constructed thinly and compactly.

The beam direction of the antenna can be electrically controlled in the direction of the rotation angle $\phi$ on the plane tilted for the angle $\theta$ to the boresight. Thus, this beam scanning antenna is effectively used for transmitting and receiving data and programs for satellite communication and satellite broadcasting at a high altitude region as in Japan.

Since phase shifters which shift the phases of the signals of the antenna elements are controlled in the same manner, the control circuit thereof can be shared therewith. In addition, since the remaining phase shifter is a low-bit (one-bit) phase shifter, the construction thereof is very simple. Thus, the beam scanning circuit can be very simply constructed.

Next, a tenth embodiment of the present invention will be described.

Figure 56:
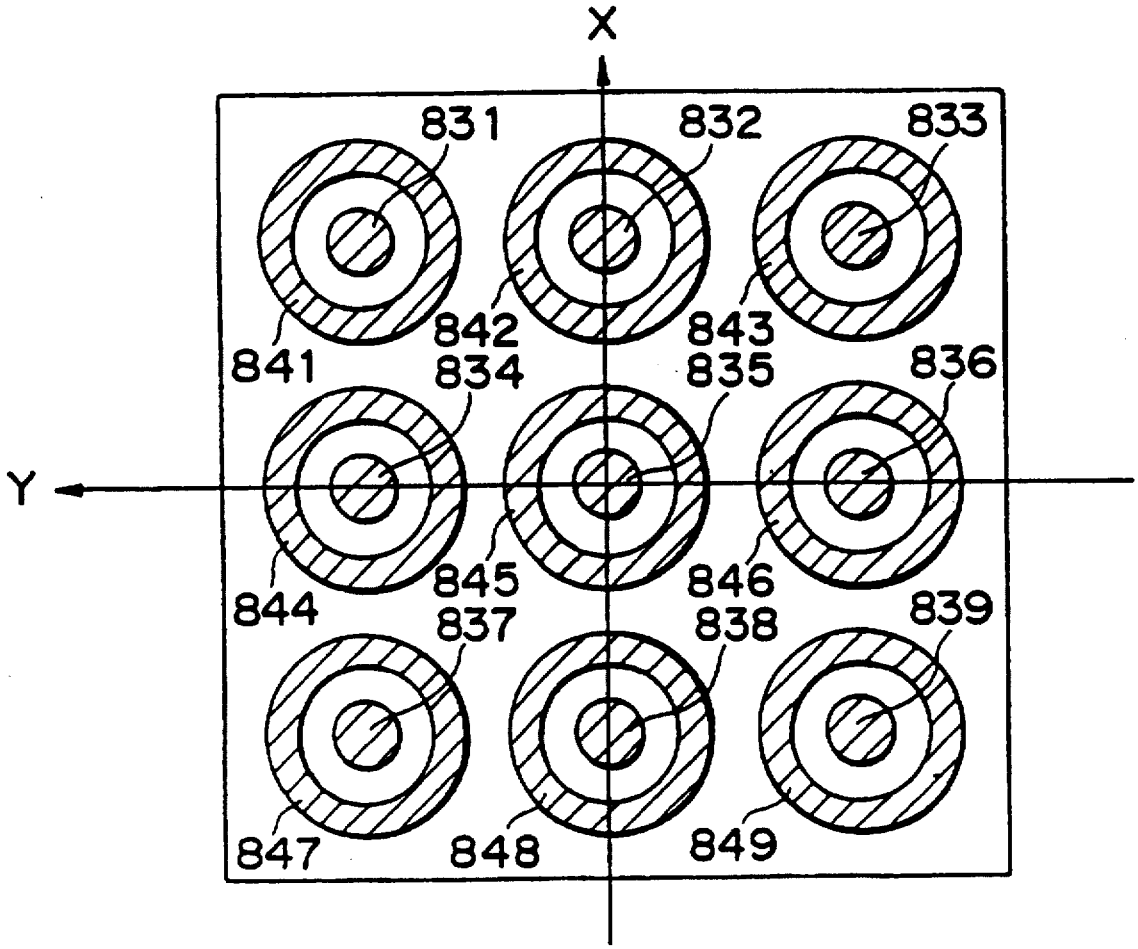
FIG. 56 is a top view showing a beam scanning antenna according to a tenth embodiment of the present invention.

FIG. 56 is a top view showing a beam scanning antenna according to the tenth embodiment of the present invention. The construction of the beam scanning antenna according to this embodiment is basically the same as that according to the ninth embodiment. In the tenth embodiment, the beam scanning antenna has nine antenna elements which are disposed in a square shape. The nine antenna elements are formed of circular microstrip antenna members 831 to 839 and ring microstrip antenna members 841 to 849. As with the beam scanning antenna according to the ninth embodiment, signals of two different exciting modes are combined so as to cause each antenna element to scan the beam in a predetermined direction. The difference between the beam scanning antennas according to the ninth and tenth embodiment is the construction of the beam forming circuits. Next, the beam forming circuit according to the tenth embodiment will be described.

Figure 57:
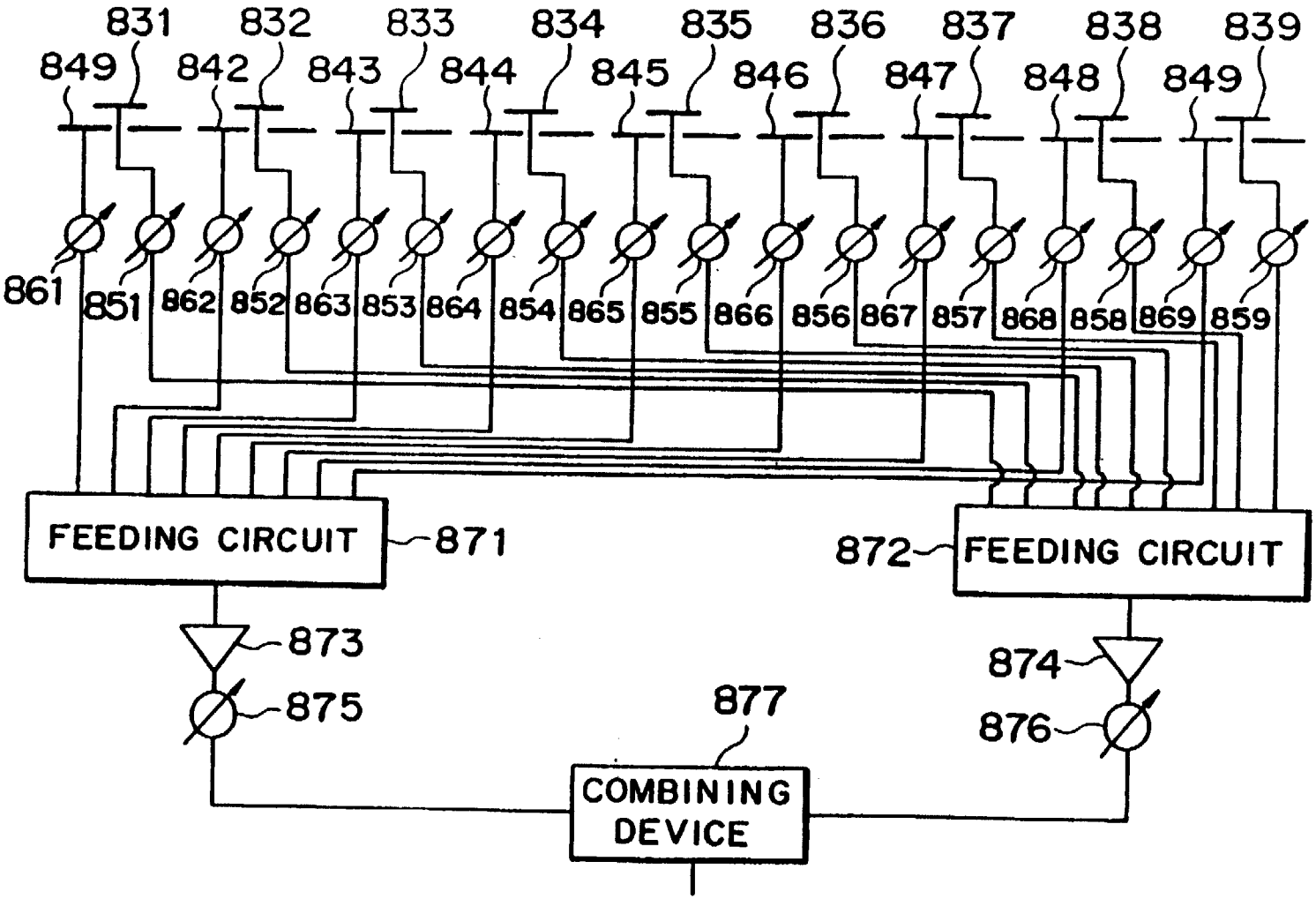
FIG. 57 is a circuit diagram showing the construction of a beam forming circuit of the beam scanning antenna according to the tenth embodiment of the present invention.

FIG. 57 is a circuit diagram showing the beam forming circuit of the beam scanning antenna according to the tenth embodiment of the present invention. The circular microstrip antenna members 831 to 839 are electrically connected to one-bit phase shifters 851 to 859, respectively. The ring microstrip antennas 841 to 849 are electrically connected to one-bit phase shifters 861 to 869, respectively. These phase sifters shift the phases of the signals of the antenna elements at every 180 degrees. When the antenna elements are arrayed, these phase shifters cause the beam to be roughly scanned. Thus, for example, the degrees of the phase which is shifted by the phase shifter 851 is the same as those by the phase shifter 861. Since these phase shifters are controlled in the same manner, the control circuit and the power supply circuit can be shared with these phase shifters. In addition, the one-bit phase shifters can be very simply constructed.

The output signals of the phase shifters 861 to 869 are sent to a feeding circuit 871 which combines these signals. Thus, the feeding circuit 871 combines the signals of the mode received from the ring microstrip antenna members. On the other hand, the output signals of the phase shifters 851 to 859 are sent to a combining device 872 which combines these signals. Thus, the feeding circuit 872 combines the signals of the mode received from the circular microstrip antenna members. The output signal of the feeding circuit 871 is sent to an amplifier 873 which amplifies the signal. The output signal of the amplifier 873 is sent to a phase shifter 875 which shifts the phase of the input signal for predetermined degrees. The output signal of the phase shifter 875 is sent to a combining device 877. The output signal of the feeding circuit 872 is sent to an amplifier 874 which amplifies the signal. The output signal of the amplifier 874 is sent to a phase shifter 876 which shifts the phase of the input signal for predetermined degrees. Thus, the phase shifters 875 and 876 control the beam direction of each antenna element. The output signal of the phase shifter 876 is sent to a combining device 877 which combines the signals received from the phase shifters 875 and 876. Thus, the beam scanning antenna can scan the beam in the predetermined direction.

In the construction shown in FIG. 57, the phase of each mode can be shifted. However, in the tenth embodiment, since a phase difference between the modes is merely required, one of the phase shifters 875 and 876 can be omitted.

Figure 58:
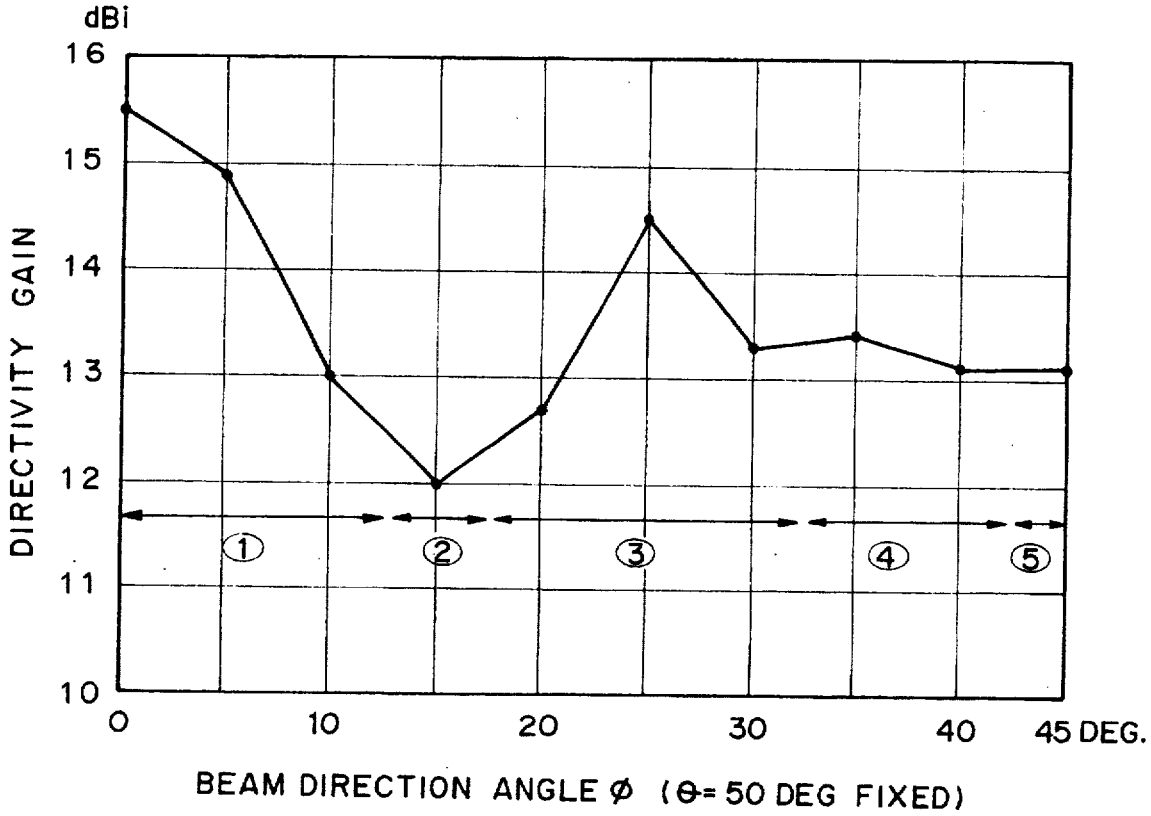
FIG. 58 is a graph showing beam scanning characteristics of the beam scanning antenna according to the tenth embodiment of the present invention.
Figure 58:
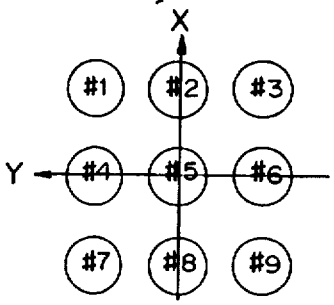

FIG. 58 shows an example of beam scanning characteristics in the case that a beam is scanned in the direction of the rotation angle $\phi$. As is clear from the figure, when the phases of one-bit phase shifters are properly set, a good scanning gain can be obtained.

In addition to the effects described in the paragraph of the ninth embodiment, according to the tenth embodiment, the following effects can be also obtained.

The connection method of low-bit variable phase shifters and high-bit variable phase shifters differ between the tenth embodiment and the ninth embodiment. Although the number of phase shifters used in the tenth embodiment is slightly larger than that of the ninth embodiment, most of the phase shifters used in the tenth embodiment are low-bit phase shifters. Thus, the construction of the beam forming circuit according to the tenth embodiment is much simpler than that according to the ninth embodiment. In addition, since the low-bit phase shifters are controlled in the same manner, one control circuit can be shared therewith. Thus, the construction of the beam forming circuit can be simplified.

Since the beam forming circuit can be simply constructed, the production steps of the beam scanning antenna can be simplified, thereby remarkably decreasing the production cost thereof.

In the receiving operation, received signals are amplified by low-noise amplifiers so as to prevent C/N ratio from degrading due to power loss by phase shifters. However, in the construction of the tenth embodiment, since the phase shifters on the first stage are low-bit type and less consume power, these low-noise amplifiers can be omitted. Low-noise amplifiers are required only for compensating the deterioration of C/N ratio by variable phase shifters disposed on the last stage. The number of low-noise amplifiers required is at most two. Thus, the construction of the beam forming circuit can be further simplified.

Next, an eleventh embodiment of the present invention will be described.

Figure 59:
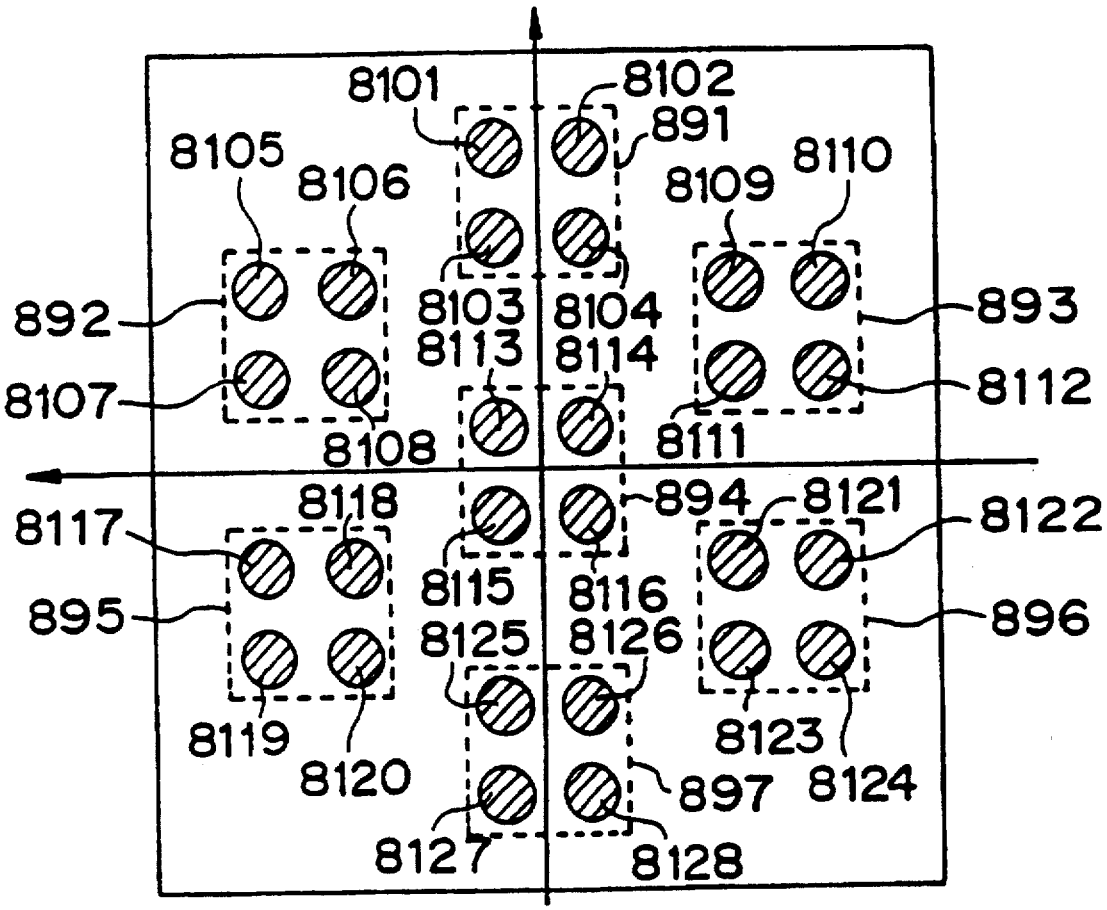
FIG. 59 is a top view showing a beam scanning antenna according to an eleventh embodiment of the present invention.

FIG. 59 is a top view showing a beam scanning antenna according the eleventh embodiment of the present invention. The beam scanning antenna has seven sub arrays 891 to 897 which are disposed in a triangular shape. Each sub array has four antenna elements (namely, circular microstrip antenna members). The antenna elements, antenna element pitch, antenna element disposition, and the like of each sub array are the same. The basic operation of the beam scanning antenna according to the eleventh embodiment is the same as those according to the ninth and tenth embodiments. In the ninth and tenth embodiments, each antenna element scans the beam. In the eleventh embodiment, each sub array scans the beam. As with the beam scanning antennas according to the ninth and tenth embodiments, the phases of signals are adjusted by low-bit phase shifters for each sub array. Thus, in the eleventh embodiment, with a simple beam forming circuit, excellent beam scanning characteristics can be obtained.

Figure 60:
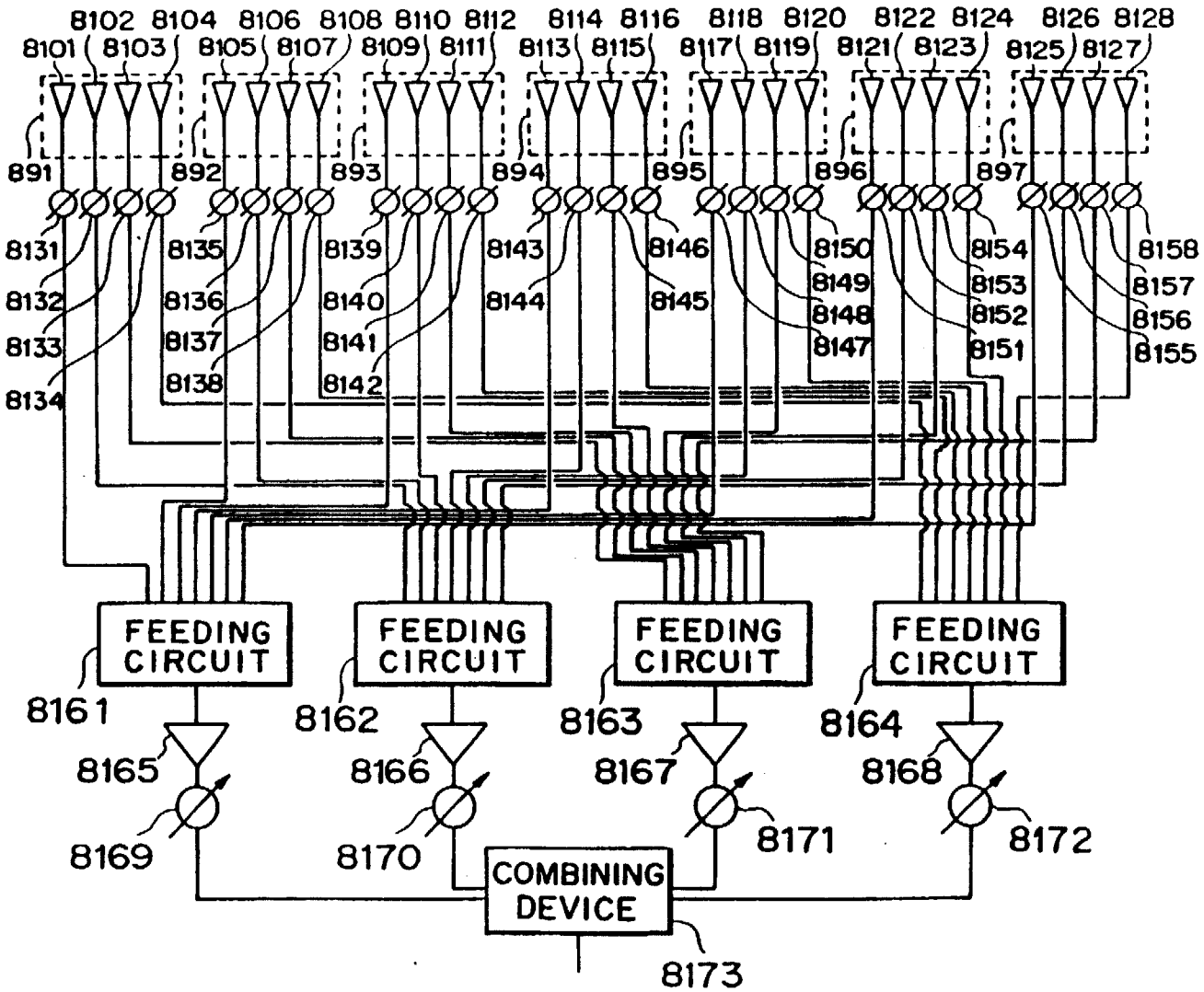
FIG. 60 is a circuit diagram showing a beam forming circuit of the beam scanning antenna according to the eleventh embodiment of the present invention.

FIG. 60 is a circuit diagram showing a beam forming circuit of the beam scanning antenna according to the eleventh embodiment of the present invention. As with the tenth embodiment, in the eleventh embodiment, low-bit phase shifters which control the phases of signals for each sub array are disposed on the first stage. In addition, high-bit phase sifters which precisely control the phases of signals of the antenna elements are disposed on the last stage.

Figure 61:
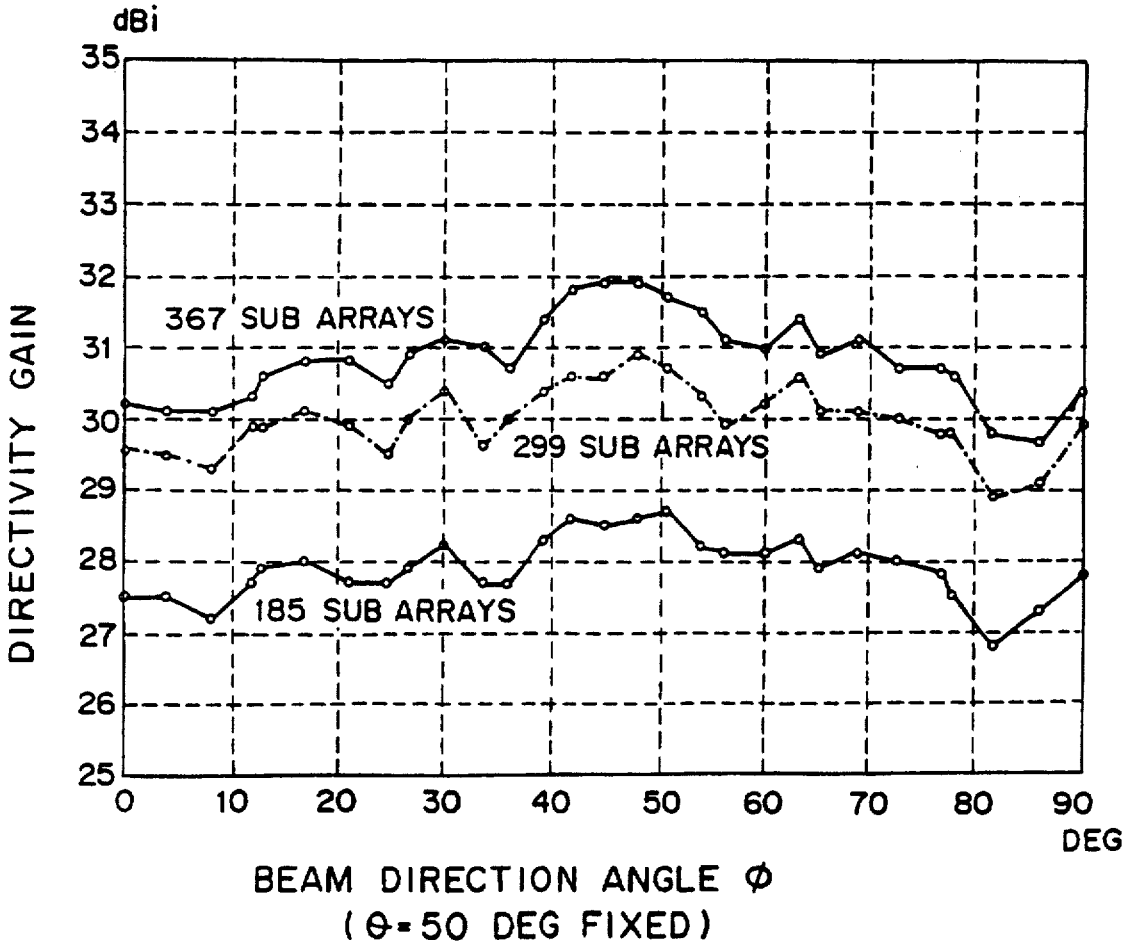
FIG. 61 is a graph showing beam scanning characteristics of the beam scanning antenna according to the eleventh embodiment of the present invention.

The output signals of antenna elements 8101 to 8128 are sent to one-bit phase shifters 8131 to 8158, respectively. These phase shifters 8131 to 8158 shift the phases of the signals of each sub array for the same degrees (0 degree or 180 degrees). Thus, the four one-bit phase shifters for each sub array are controlled in the same manner. Thus, one control circuit is shared with these phase shifters. Therefore, the construction of the phase shifters can be simplified. The output signals of the antenna elements in the corresponding positions of the sub arrays are sent to feeding circuits 8161, 8162, 8163, and 8164 which combine these signals. For example, the output signals of the antenna elements 8101, 8105, 8109, 8103, 8117, 8121, and 8125 are sent to the feeding circuit 8161. The output signals of the feeding circuits 8161, 8162, 8163, and 8164 are sent to low-noise amplifiers 8165, 8166, 8167, and 8168, respectively. The low-noise amplifiers 8165, 8166, 8167, and 8168 amplify the input signals. The output signals of the amplifiers 8165, 8166, 8167, and 8168 are sent to high-bit variable phase shifters 8169, 8170, 8171, and 8172, respectively. The high-bit variable phase shifters 8169, 8170, 8171, and 8172 shift the phases of the received signals for predetermined degrees. The angles of the phases which are shifted by the phase shifters 8169, 8170, 8171, and 8172 are angles at which the beam of each sub array is scanned. The output signals of the phase shifters 8169, 8170, 8171, and 8172 are sent to a combining device 8173 which combines these signals. Thus, the received output of the beam scanning antenna is obtained. FIG. 61 is a graph showing an example of beam scanning characteristics where a beam is scanned in the direction of the rotation angle $\phi$. As is clear from this figure, since the phases of the signals of each sub array are adjusted at every 180 degrees by the one-bit phase shifters, a good scanning gain can be obtained.

The beam scanning antenna according to the eleventh embodiment can provide the same effects as those according to the ninth and tenth embodiments do. In addition, the beam scanning antenna according to the eleventh embodiment provides the following effects.

A beam scanning antenna having sub arrays each of which scans the beam corresponding to the composition of a plurality of modes has high degree of freedom in design. In this construction, a high gain can be obtained. In addition, since the beam width of each antenna element can be narrowed, the occurrence of grating lobes can be suppressed. Thus, the array gain can be increased.

Most of phase shifters used in this embodiment are one-bit phase shifters. In addition, one control circuit and one power supply circuit can be shared with the one-bit phase shifters which are disposed on the first stage. Thus, the construction of the beam forming circuit can be very simplified.

Since the beam direction of each sub array is varied, the beam can be scanned in the direction of the elevation angle $\theta$ as well as in the direction of the rotation angle $\phi$. When a mobile station which communicates with a communication satellite or a broadcasting satellite is running on a slope, the antenna installed therein is correspondingly tilted. In this case, according to this embodiment, the beam of the antenna can be scanned in the direction of the satellite. When the mobile station communicates with a stationary satellite, the elevation angle of the beam varies corresponding to the latitude of the position at which the antenna is installed. However, according to the eleventh embodiment, the beam scanning antenna can be use anywhere on the earth. Thus, from view points of production steps and cost, this antenna is very convenient. In addition to the communication with the stationary satellite, the beam scanning antenna according to this embodiment can be used for communications with an orbiting satellite which orbits around the earth.

In the above-mentioned ninth to eleventh embodiments, one-bit phase shifters were used as low-bit phase shifters.

However, instead of the one-bit phase shifters, even if two-bit phase shifters are used, as an effect of the present invention, the beam forming circuit can be simply constructed. In this case, the phases of signals for each array can be more precisely set than those of the above-described ninth to eleventh embodiments. Thus, beam scanning characteristics and gain can be improved.

Figure 62:
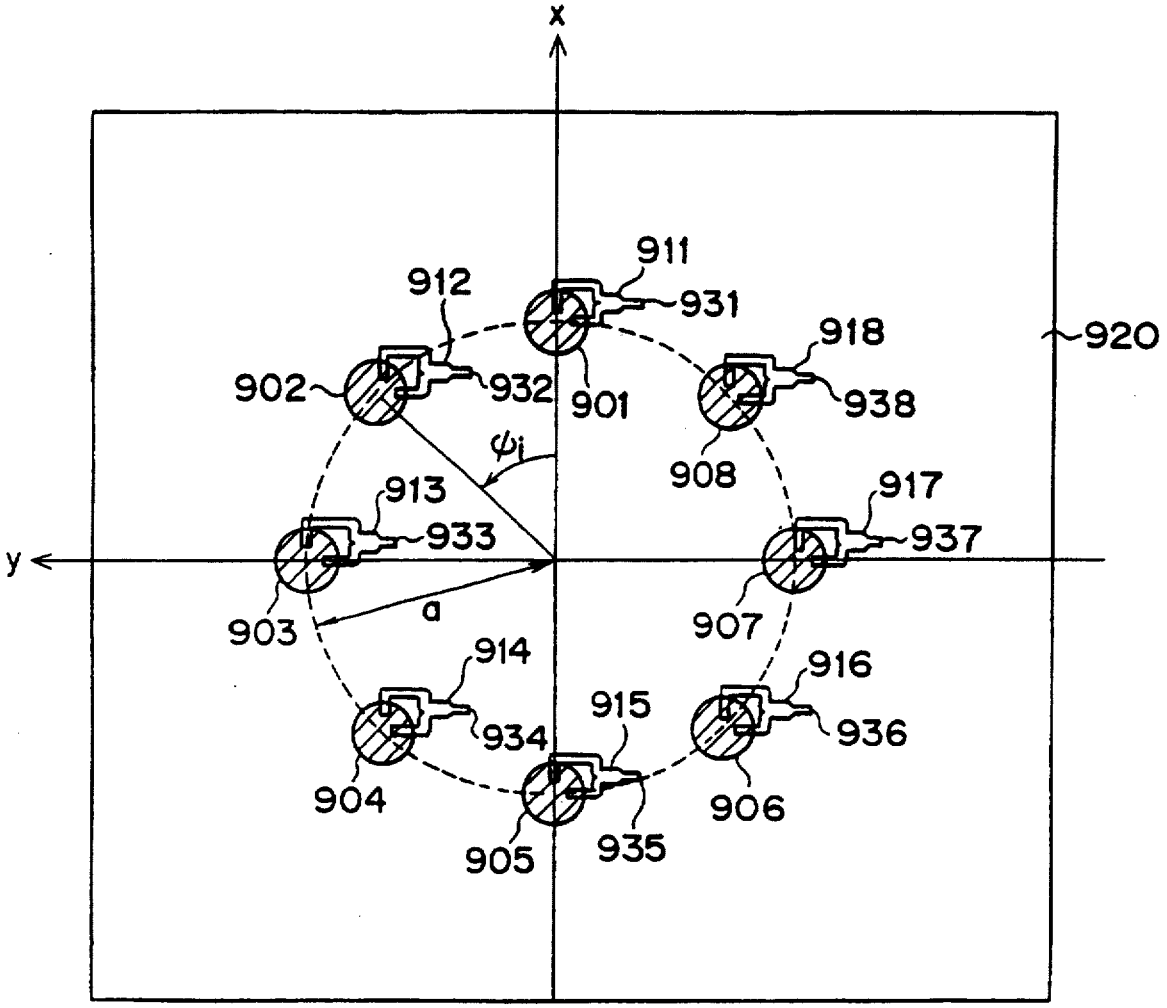
FIG. 62 is a top view showing an array antenna according to a twelfth embodiment of the present invention.
Figure 63:
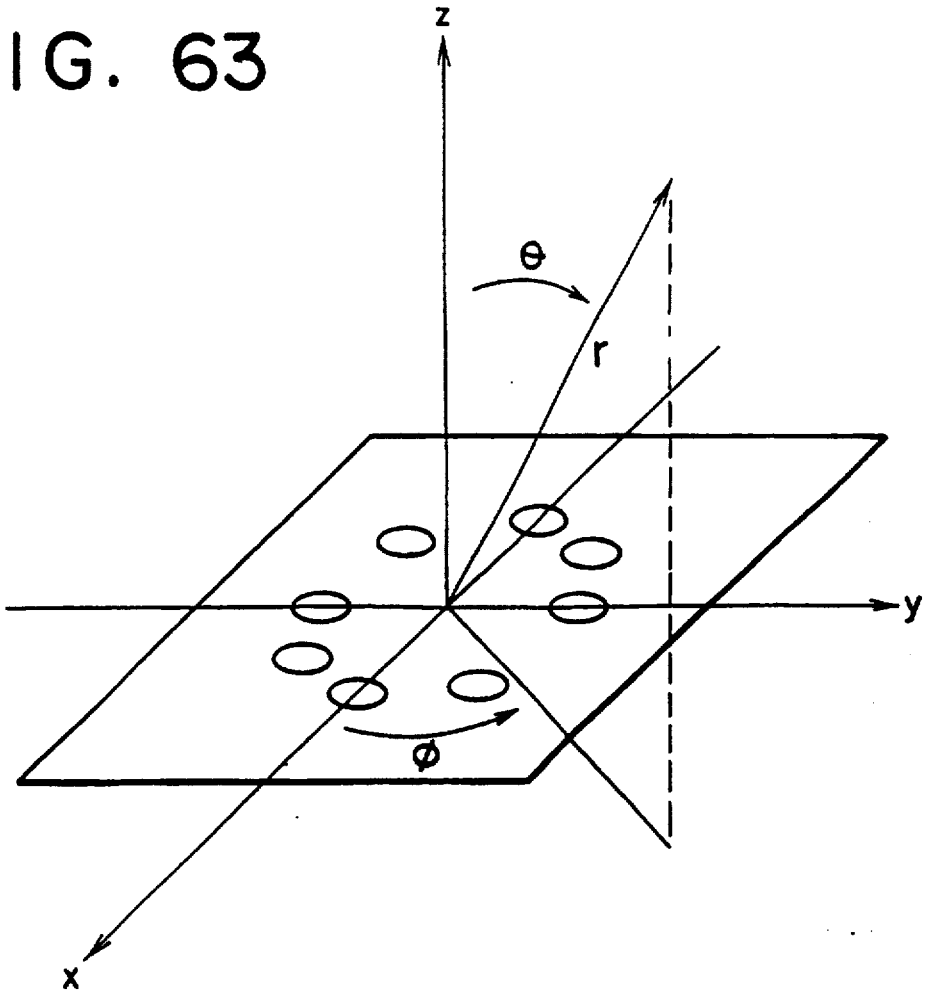
FIG. 63 is a schematic diagram showing the relation of two coordinate systems.

FIG. 62 is a top view showing an array antenna according to a twelfth embodiment of the present invention. FIG. 63 gives the relation between orthogonal coordinates system (x, y, z) and polar coordinates system (r, θ, ϕ) with respect to an antenna.

The array antenna according to the twelfth embodiment of the present invention, shown in FIG. 62, has antenna elements 901 to 908 which are disposed on a periphery of a circle with a radius a. The position of each antenna element is represented position angle ψ as well as the radius a. The position angle ψ which represents the position of a i-th antenna element is ψi, as shown in FIG. 62. The antenna elements are disposed symmetrically with respect to the center point of the circle. In this embodiment, the antenna elements are circular microstrip antenna members.

In this embodiment, electromagnetic coupling feeding method is used. Below the antenna elements 901 to 908, feeding circuits 911 to 918 are disposed, respectively. The feeding circuits 911 to 918 are made of a microstrip line pattern. In this embodiment, the feeding circuits 911 to 918 are excited by circular polarized waves. Each feeding circuit has a T branch which causes the phases of signals at two orthogonal feed points to be shifted for 90 degrees. The signals of the feeding circuits 911 to 918 are supplied from feed points 931 to 938, respectively. Each feeding point is electrically connected to a beam forming circuit. In the receiving operation, the beam forming circuit combines signals received from the antenna elements. In the transmitting operation, the beam forming circuit distributes signals to the antenna elements.

Figure 64:
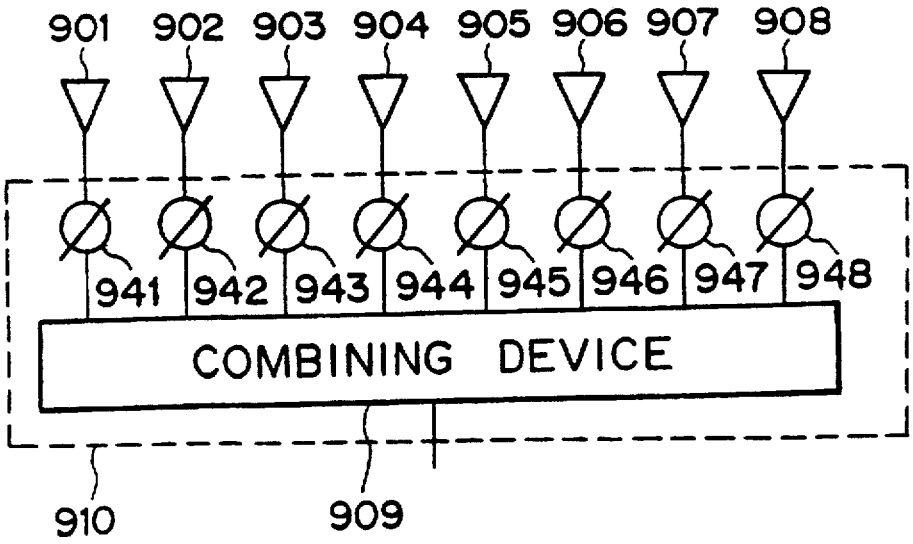
FIG. 64 is a circuit diagram showing a beam forming circuit of the array antenna according to the twelfth embodiment of the present invention.

FIG. 64 is a circuit diagram showing the beam forming circuit of the array antenna according to the twelfth embodiment. The phases of signals of the antenna elements 901 to 908 are shifted by phase shifters or phase shifting means 941 to 948, respectively. The phase shifting means is formed of a feed line with different line length. The phase of the signal of the i-th antenna element is denoted by $\alpha_i$. In the case of the transmitting operation, a signal of each antenna element is sent to a distributer. In the case of the receiving operation, a signal of each antenna element is sent to a combining device 909. The beam forming circuit 910 has the distributor (or combining device) and the phase shifters (or phase shifting means).

A feature of the array antenna according to the twelfth embodiment is in that the radiation field of each antenna element has a phase difference mψi where the phase $\alpha_i$ of the signal of each antenna element is equal to position angle ψi times m (where m is any positive integer except for 0). Next, the operation of the array antenna according to the twelfth embodiment will be described.

When the number of antenna elements is 2 m or more, the radiation field in the boresight direction (z axis) of each antenna element is offset each other. Thus, a conical beam is formed where the composite radiation field in the boresight direction of the array antenna becomes null. This can be mathematically explained by the following equations.

The radiation field of a circularly polarized wave in a dominant mode (TM11 mode) of a microstrip antenna member is given by the following equations.

$$E_R = A_R(\theta)\exp(\pm j\phi) \tag{23}$$

$$E_L = A_L(\theta)\exp(\pm j\phi) \tag{24}$$

where $E_R$ and $E_L$ represent right- and left-hand cercularly polarized wave components, respectively. The + sign and − sign of the function jϕ represent right-hand circular polarization excitation and left-hand circular polarization excitation of the microstrip antenna member, respectively. Thus, the sign of the function jϕ depends on the exciting direction of the circularly polarized wave.

Now, consider that a right-hand circular polarized wave is excited and the left-circularly polarized wave component is null. The composite radiation directivity of the array antenna shown in FIG. 62 can be given by the following equation.

$$E_{ARRAY}(\theta,\phi) = \sum_{i}^{N} A(\theta)\exp(j\phi)\exp(jm\psi_i)\exp(jka\sin\theta(\cos\phi\cos m\psi_i + \sin\phi\sin m\psi_i)) \tag{25}$$

where k is the wave number (2π/λ). When an infinitude of antenna elements are disposed on the same periphery of a circle, the equation (25) can be expressed by the equation (26).

$$E_{ARRAY}(\theta,\phi) = \int_0^{2\lambda} A(\theta)\exp(j\phi)\exp(jm\psi)\exp(jka\sin\theta(\cos\phi\cos m\psi + \sin\phi\sin m\psi))\, d\psi = jA(\theta)\exp(j(m+i)\phi)Jm(ka\sin\theta) \tag{26}$$

As is clear from the equation (26), when m is not equal to 0, the composite radiation field in the boresight direction (θ=0) becomes null, thereby forming a conical beam. In addition, the direction of maximum radiation is given by the following equation.

$$\frac{\partial}{\partial\theta} \times E_{ARRAY}(\theta,\phi) = 0 \tag{27}$$

thus, $$\frac{\partial}{\partial\theta} \times [A(\theta)J_m(ka\sin\theta)] = 0 \tag{28}$$

In other words, to form a conical beam antenna with a peak of the radiation directivity in the direction of the angle θ, the radius a of the antenna should be set so that the equations (27) and (28) are satisfied. In particular, when the antenna elements do not have directivity (A (θ)=constant), the radiation directivity has a peak in the direction of the angle θ which satisfies the following equation.

$$\frac{\partial}{\partial\theta} \times J_m(ka\sin\theta)\Big] = 0 \tag{29}$$

When the number of antenna elements disposed on a periphery of a circle is more than around eight and the phase difference of the radiation field between adjacent antenna elements is 90 degrees or less, a conical beam which is similar to the case of an infinitude of antenna elements is radiated. In the above-mentioned equations, $J_m$ is a m-th order Bessel function. There are a plurality of zero points as the result of the differentiation of the Bessel function which satisfies the equation (28). From these, [ka sin θ] should be minimized as in the following.

when m=±1, ka×sin θ=1.841
when m=±2, ka×sin θ=3.054
when m=±3, ka×sin θ=4.201
when m=±4, ka×sin θ=5.317
when m=±5, ka×sin θ=6.416

When a zero point where [ka×sin θ] is not minimum is selected, a another maximal point in radiation intensity takes place at a smaller angle e than the desired angle θ. This also applies to the equation (27). To cause a peak of radiation directivity to take place only in a desired direction, the minimum radius a which satisfies the equation (27) should be set.

Next, the construction of a practical example of the twelfth embodiment of the present invention will be described. For the sake of the simplicity, only the receiving operation will be described. However, the transmitting operation is performed by the same construction.

Figure 65:
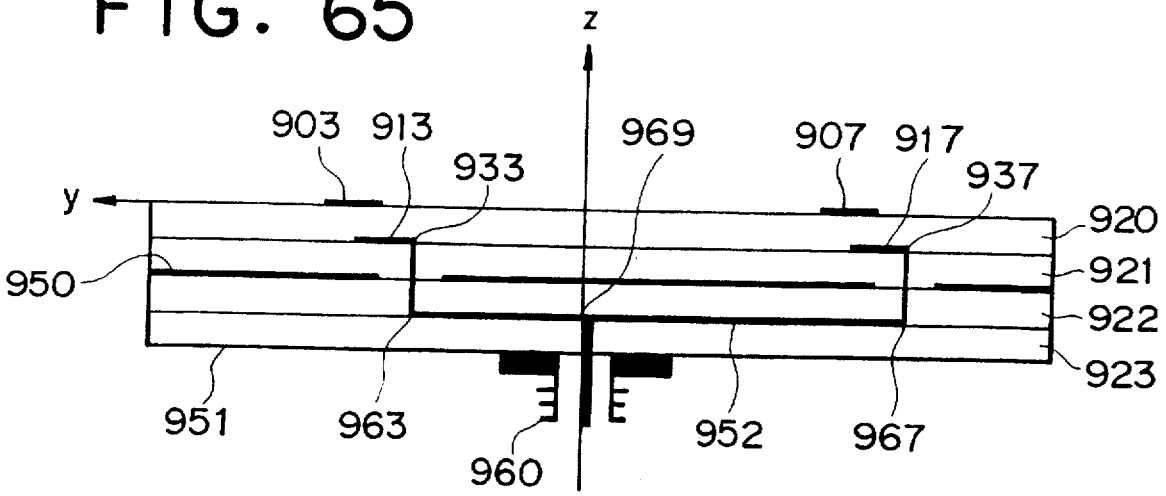
FIG. 65 is a sectional view showing the array antenna according to the twelfth embodiment of the present invention.

FIG. 65 is a sectional view showing the array antenna according to the twelfth embodiment of the present invention. This figure is a sectional view taken along x-z plane of FIG. 62. This array antenna is formed of four dielectric substrates 920, 921, 922, and 923 being layered. On the upper surface of the dielectric substrate 920, which is the uppermost layer, circular microstrip antenna members 903 and 907 which are made of a conductor film are formed. On the upper surface of the dielectric substrate 921, feeding circuits 913 and 917 which receive signals of circularly polarized waves from the circular microstrip antenna portions are formed. These feeding circuits 913 and 917 are made of a conductor film. The dielectric substrates 922 and 923 form a tri-plate line pattern. On the upper surface of the tri-plate line pattern, a beam forming circuit 952 is formed. On the upper surface of the dielectric substrate 922, an outer conductor 950 of the tri-plate line pattern is formed. The outer conductor 950 is made of a conductor film. On the lower surface of the dielectric substrate 923, an outer conductor 951 of the tri-plate line pattern is formed. The outer conductor 951 is made of a conductor film. The output signal of the beam forming circuit is sent from an output point 969 to a connector 960 through a through-hole of the substrates.

The microstrip antenna members and line pattern according to this twelfth embodiment can be easily formed by etching process or the like. The dielectric substrates may be layered by fasteners such as machine screws or dielectric adhesive films.

Figure 66:
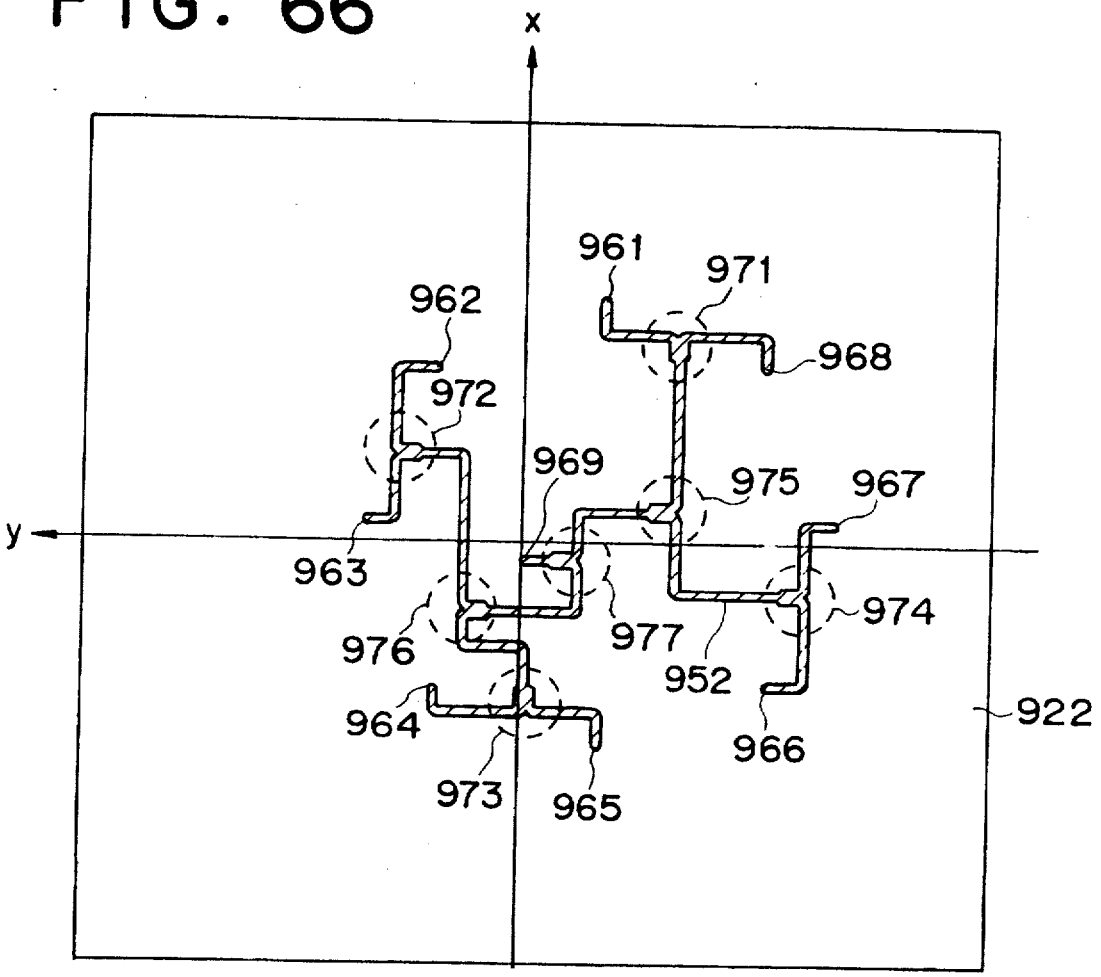
FIG. 66 is a top view showing a beam forming circuit of the array antenna according to the twelfth embodiment of the present invention.

FIG. 66 is a circuit pattern of the beam forming circuit 952 formed on the upper surface of the dielectric substrate 922. Output points 931 to 938 of the feeding circuit of the antenna elements are electrically connected to input points 961 to 968 of the beam forming circuit through vertical lines, respectively. Signals of the input points are combined by power combining devices 971 to 977 each of which is formed of a T branch. The composite output signal is sent from an output point 969 to an outer connector 960. In the beam forming circuit 952, to shift the phase of the signal received from each antenna element for $\alpha_i=m\psi_i$ (where m is any positive integer except for 0), the line length is varied corresponding to the wave length of the radio wave. Thus, the above-described conical beam is formed.

In this construction, the following effects can be obtained.

The antenna which forms a conical beam can be thinly constructed. When an antenna is installed in a mobile station, the volume and weight thereof should be as small as possible. Thus, the array antenna according the twelfth embodiment of the present invention is effectively used for an antenna installed in a mobile station.

In addition, the array antenna according to this embodiment is effectively used for an antenna which is installed at a relatively high latitude region as in Japan and which receives and transmits signals from and to communication satellites and broadcasting satellites. Moreover, when this antenna is used for an antenna installed in a mobile station, even if the mobile station is running and thereby the orientation of the antenna varies time by time, the antenna can properly transmit and receive signals to and from such satellites.

Furthermore, according to the twelfth embodiment, since the degree of freedom in design is high, a practical antenna can be conveniently formed. For example, by applying the equations (27) and (28), an array antenna can be optimally designed so as to obtain the maximum radiation in a desired direction. On the other hand, in a conventional antenna using a higher-order mode, it is necessary to decide a resonance mode where the maximum radiation takes place in a desired direction. Moreover, in the conventional array antennas, by a very limited means which adjusts the permittivity of the substrates, the maximum radiation was obtained. However, the adjustable range was very narrow. Thus, the degree of freedom in design of the array antenna according to the twelfth embodiment is much higher than that of the conventional array antenna.

In addition, as described above, the increase of the gain of the array antenna can be easily designed. In this case, the the radius a should be increased so as to optimize the value of m.

Moreover, in the conventional antenna using a higher-order mode which forms a conical beam, the value of Q increases, thereby narrowing the frequency band. However, according to the twelfth embodiment, since antenna members for the dominant mode can be used, the frequency band can be widened.

Even if the array antenna according to the twelfth embodiment of the present invention is modified as follows, the same effects as those of this embodiment can be obtained.

In the twelfth embodiment, circular microstrip antenna members were used as antenna elements. However, even if other antenna elements such as horn antenna members, spiral antenna members, helical antenna members, cross dipole antenna members, and slot antenna members are used, the same effects as those of the twelfth embodiment may be obtained. As the microstrip antenna members, square microstrip antenna members, ring strip antenna members, or the like may be used.

In the twelfth embodiment, electromagnetic coupling method for feeding signals to circular microstrip antenna members was used. However, another feeding method such as pin feeding method, coplanar feeding method, slot coupling feeding method, or the like may be used.

In the twelfth embodiment, as feeding line patterns, microstrip line patterns and tri-plate line patterns were used. However, other line patterns such as suspended line patterns may be used.

Moreover, in the twelfth embodiment, circular microstrip antenna members were used in dominant mode. However, the antenna elements may be used in a higher-order mode. In this case, since each antenna element has radiation directivity of a conical beam, an array antenna thereof can effectively form a conical beam. In practice, when each antenna element is used in a higher-order mode, an array antenna thereof can conveniently form a conical beam having a low elevation angle (namely, the direction of maximum radiation is close to the horizontal line).

In the twelfth embodiment, circularly polarizing method using two-point feeding was described. However, instead, a circular polarizing method using one-point feeding may be used.

The array antenna according to the twelfth embodiment shown in FIG. 62 had a total of eight antenna elements. However, the number of antenna elements is not limited to eight. The more the radiation intensity of a conical beam is stable in the direction of the rotation angle $\phi$, the more antenna elements are required. When m=1, even if the number of antenna elements is four or six, a conical beam may be formed. In this case, the stability of intensity of radiation directivity with respect to the rotation angle $\phi$ may be deteriorated to some extend. In addition, the optimum radius may deviate from the results of the equations (27) to (29).

Moreover, in the twelfth embodiment, honeycomb substance may be used instead of dielectric substrates.

According to the twelfth embodiment, in the beam forming circuit, feeding lines whose line length was varied was used as a phase shifting means for each antenna element. Instead, phase shifters may be used. In the twelfth embodiment, the power combining devices (power dividers) which were formed of T branches which combined (diveded) signals of radio waves were used. Instead of the T branches, even if hybrid couplers and Wilkinson type power divider are used, the same effects as those of the twelfth embodiment may be obtained.

When linear polarizing antenna elements are used instead of circular polarizing antenna elements, a conical beam can be formed as linear polarizing antenna elements in higher-order mode do.

Next, a thirteenth embodiment of the present invention will be described.

For the sake of simplicity, in the description of the thirteenth embodiment, the portions which are similar to those of the twelfth embodiment are omitted. Only the differences between these embodiments will be described.

Figure 67:
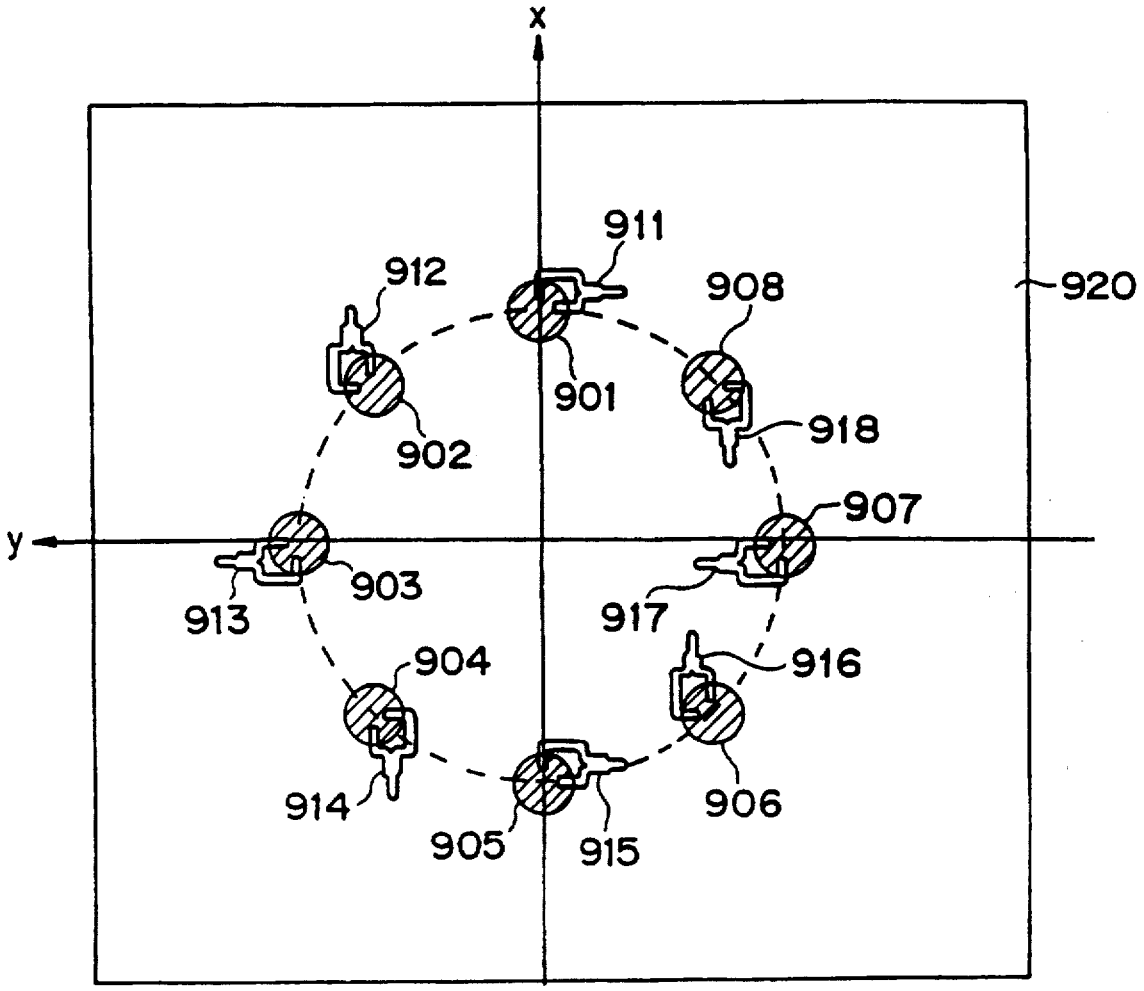
FIG. 67 is a top view showing the array antenna according to a thirteenth embodiment of the present invention.
Figure 68:
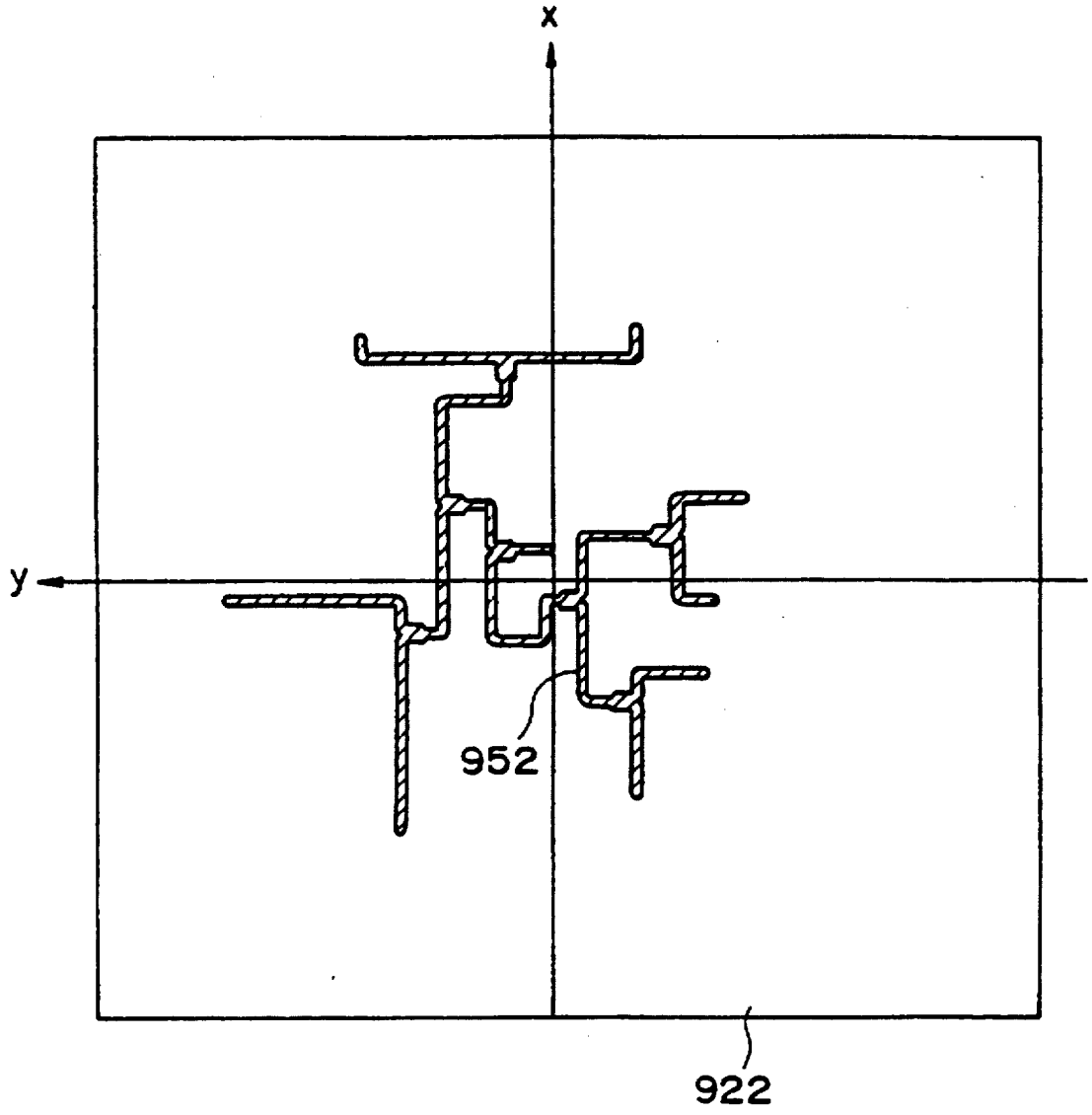
FIG. 68 is a top view showing a beam forming circuit of the array antenna according to the thirteenth embodiment of the present invention.

FIG. 67 is a top view showing an array antenna according to the thirteenth embodiment of the present invention. This figure corresponds to FIG. 62 which shows the top view of the array antenna of the twelfth embodiment. In the twelfth embodiment, the beam forming circuit shifted the phase of the radiation directivity of each antenna element for $\alpha_i$. On the other hand, in the thirteenth embodiment, each antenna element is rotated for $\alpha_i$ so as to shift the phase of the radiation directivity of each antenna element for $\alpha_i$. Thus, the array antenna according to the thirteenth embodiment can form a conical beam similar to that the array antenna according to the twelfth embodiment does. The radius a of a circle is optimized so as to cause a peak of the beam to take place in a desired direction of the elevation angle $\theta$ as with the method used in the twelfth embodiment. In this case, as shown in FIG. 68, which corresponds to FIG. 66 with respect to the twelfth embodiment, signals of the antenna elements are combined (divided) in the same phase by a beam forming circuit 952.

As described above, the phase of the radiation directivity of each antenna element is shifted for $\alpha_i$ by one of the two methods described above (namely, in one method the phase is shifted by the feeding circuit, whereas in the other method the phase is shifted by rotating the antenna element itself). Of course, the phase of the radiation directivity of each antenna element may be shifted by a combination of these two methods.

Next, a fourteenth embodiment of the present invention will be described.

Figure 69:
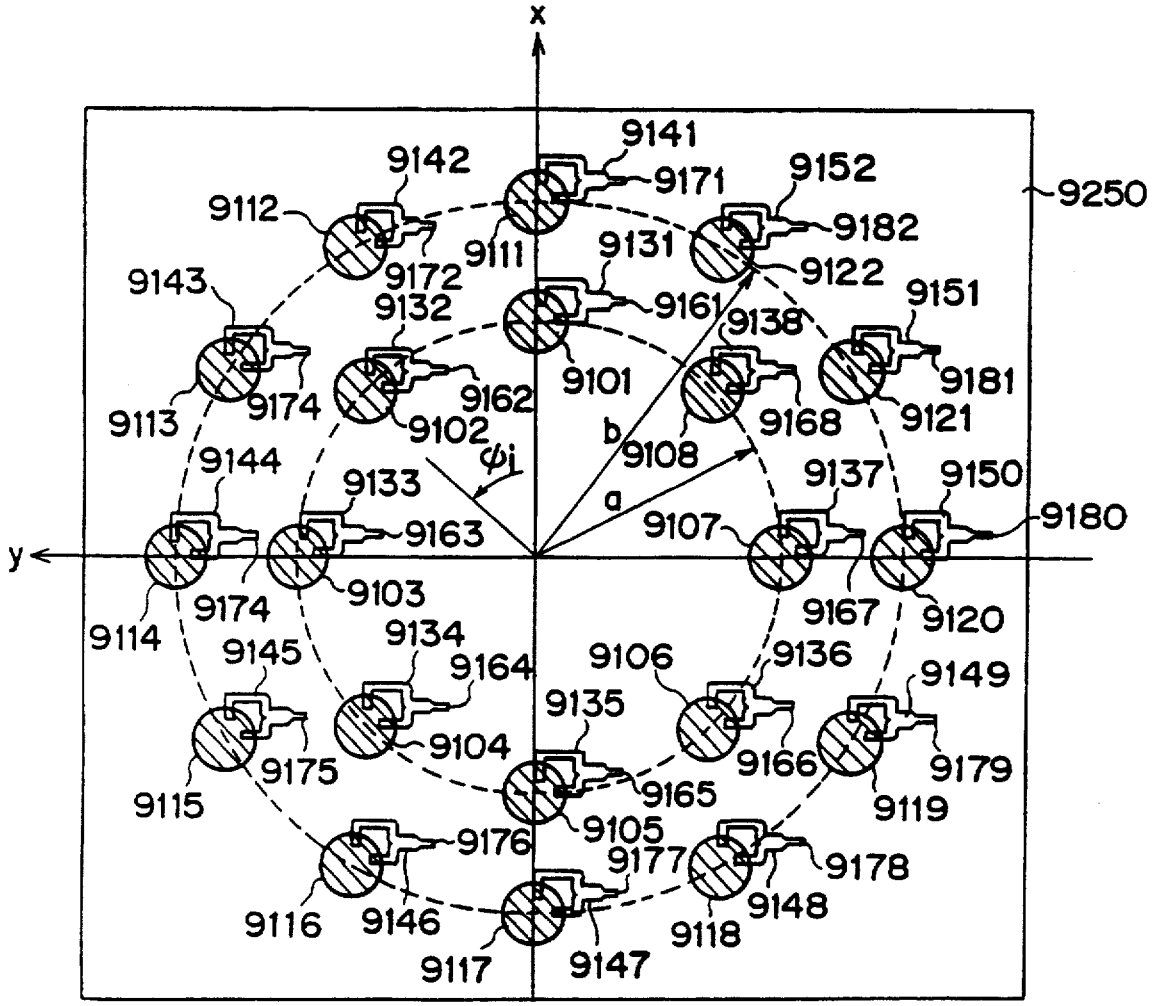
FIG. 69 is a top view showing an array antenna according to a fourteenth embodiment of the present invention.

FIG. 69 shows a top view showing an array antenna according to the fourteenth embodiment of the present invention. As shown in the figure, antenna elements 9101 to 9108 are disposed on a periphery of a circle with a radius a. These antenna elements 9101 to 9108 are referred to as a first antenna array. In addition, antenna elements 9111 to 9122 are disposed on a periphery of a circle with a radius b. These antenna elements 9111 to 9122 are referred to as a second antenna array. The circles with radiuses a and b are concentric circles. The position of each antenna element is defined by the direction angle $\psi$ with respect to the center of the circle along with the radius. Now, the direction angle which represents the position of the i-th antenna element disposed on the periphery of the circle with the radius a (namely, of the first antenna array) is referred to as $\psi_{ai}$, whereas the direction angle which represents the position of the i-th antenna element disposed on the periphery of the circle with the radius b (namely, of the second antenna array) is referred to as $\psi_{bi}$. The antenna elements are symmetrically disposed with respect to the center point of these concentric circles. In this embodiment, the antenna elements are circular microstrip antenna members.

In this embodiment, an electromagnetic coupling feeding method is used. Below the antenna elements 9101 to 9108, feeding circuits 9131 to 9138 which are formed as a microstrip line pattern are disposed, respectively. Below the antenna elements 9111 to 9123, feeding circuits 9141 to 9152 which are formed as a microstrip line pattern are disposed, respectively. The feeding circuits each have a T branch which shifts the phases of signals of orthogonal feed points so that the phase difference therebetween becomes 90 degrees.

The feeding circuits receives signals from feed points 9161 to 9168, and 9171 to 9182. The feeding circuits are electrically connected to a beam forming circuit. In the receiving operation, the beam forming circuit combines signals received from the antenna elements. In the transmitting operation, the beam forming circuit distributes a signal to the antenna elements.

Figure 70:
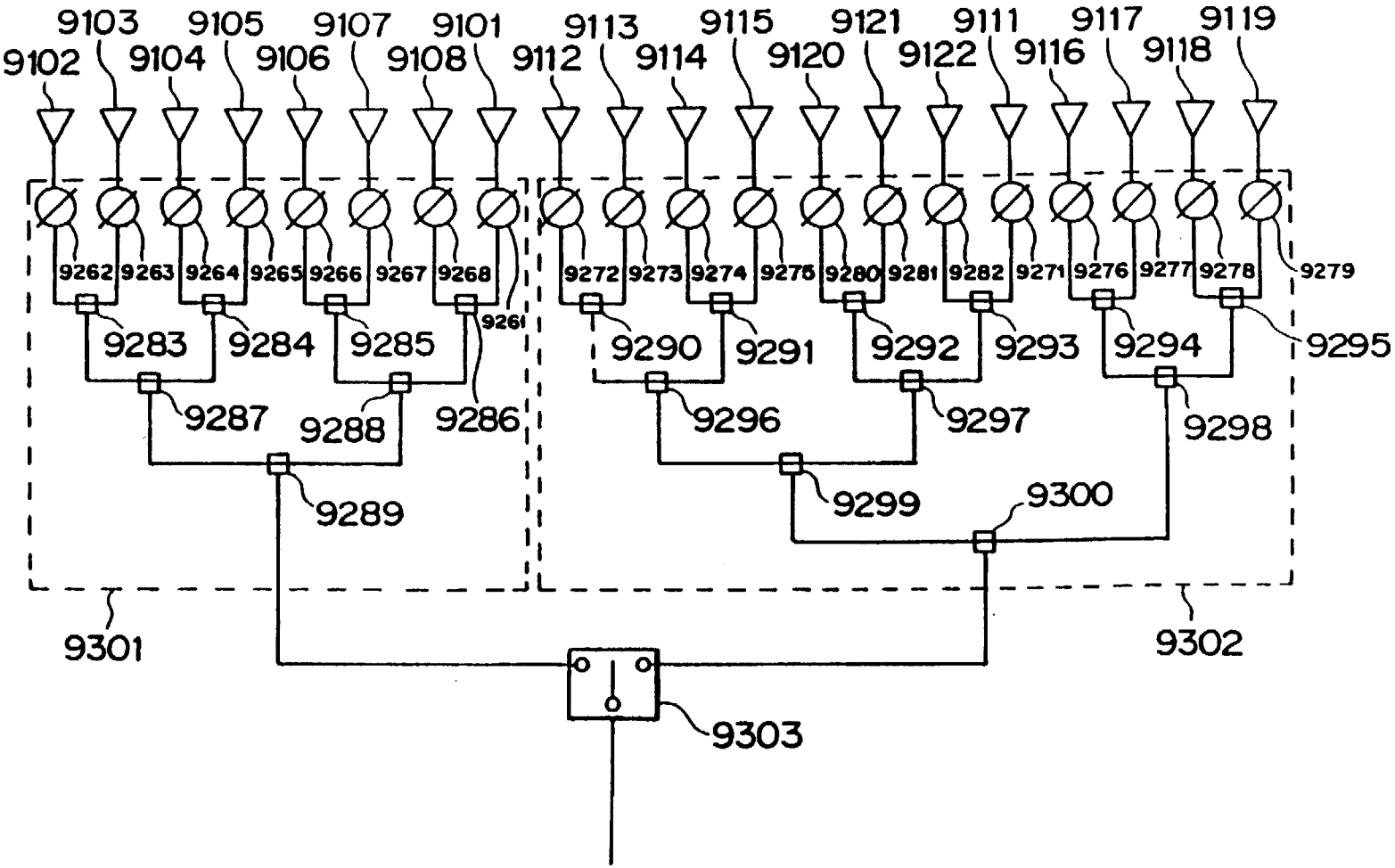
FIG. 70 is a circuit diagram showing the construction of a beam forming circuit of the array antenna according to the fourteenth embodiment of the present invention.

FIG. 70 shows a circuit diagram of the beam forming circuit of the array antenna according to the fourteenth embodiment. In this beam forming circuit, there are two beam forming circuits 9301 and 9302 which are used for the antenna elements disposed on the first and second antenna arrays, respectively. The output signals of the beam forming circuits 9301 and 9302 are sent to an RF switch 9303 which selects one of these signals.

In the beam forming circuit 9301, the output signals of the antenna elements 9101 to 9108 are sent to phase shifters or phase shifting means each of which shifts the phase of the input signal by varying the length of the feed line 9261 to 9268, respectively. Each phase shifter shifts the phase of the signal for predetermined degrees. In the beam forming circuit 9302, output signals of the antenna elements 9111 to 9122 are sent to phase shifters or (phase shifting means) 9271 to 9282, respectively. Each phase shifter shifts the phase of the signal for predetermined degrees.

Now, the shifted phase of the i-th antenna element disposed on the first antenna array is represented by $\alpha_{ai}$, whereas the shifted phase of the i-th antenna element disposed on the second antenna array is represented by $\alpha_{bi}$. The radiuses a and b are optimally set so that a peak of each array antenna takes place in the direction of a desired elevation angle $\theta$ according to the above-mentioned equation (27) or (28). In the receiving operation, signals are combined by a combining device of each of the beam forming circuits. In the transmitting operation, a signal is distributed by a distributing device of each of the beam forming circuits. In this embodiment, two-way distributing (combining) devices 9283 to 9300 are used. In each antenna element, assume that the exciting phase $\alpha_{ai}$ is the position angle $\psi_{ai}$ times m (where m is any positive integer except for 0) and that the exciting phase $\alpha_{bi}$ is the position angle $\psi_{bi}$ times n (where n is any positive integer except for 0). Thus, the radiation field of each antenna element has the phase difference $m\psi_{ai}$ or $n\psi_{bi}$. The operations of the antenna element disposed on the first and second antenna arrays are the same as that of the array antenna according to the twelfth embodiment.

A feature of the array antenna according to the fourteenth embodiment of the present invention is in that one of two antenna arrays is selected by an RF switch. With the two antenna arrays, each of which has a different elevation angle, the array antenna can form two conical beams with different elevation angles θ with maximum radiation. Thus, an array antenna which can select one of the two beams depending on the situation can be formed. In particular, in the case of an antenna installed in a mobile station, if the mobile station is running at a slope (as with a car), taking off or landing (as with an airplane), the orientation of the antenna is correspondingly tilted. In these situations, since one of conical beams can be selected, this array antenna is very useful. In this embodiment, a construction for selecting one of two conical beams was described. However, a construction for forming three or more conical beams and selecting one of them can be easily formed.

Next, the construction of a practical example of the array antenna according to the fourteenth embodiment of the present invention will be described. With respect to this construction, only the receiving operation will be described. However, the construction of the receiving operation can apply to that of the transmitting operation.

Figure 71:
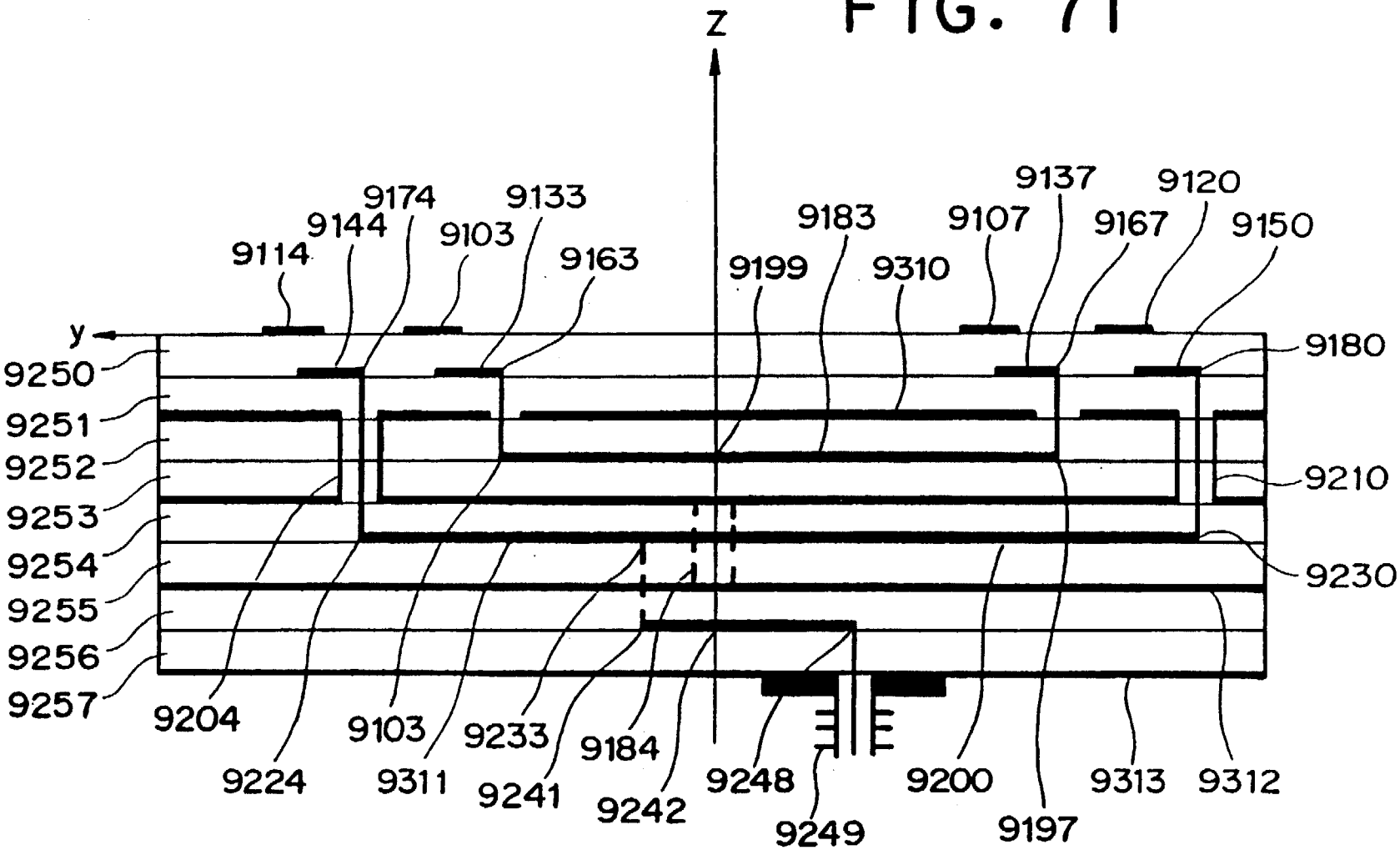
FIG. 71 is a sectional view showing the array antenna according to the fourteenth embodiment of the present invention.

FIG. 71 is a sectional view showing the array antenna according to the fourteenth embodiment of the present invention. This figure shows a view taken along x-z plane of FIG. 69. The array antenna is formed of eight dielectric substrates 9250 to 9257 being layered. On the upper surface of the dielectric substrate 9250, which is the uppermost layer, circular microstrip antenna members 9114, 9103, 9107, and 9120 which are made of a conductor film are formed. On the upper surface of the dielectric substrate 9251, feeding circuits 9144, 9133, 9137, and 9150 which receive signals of circularly polarized waves received from the circular microstrip antenna members are formed. The feeding circuits 9144, 9133, 9137, and 9150 are made of a conductor film. A first tri-plate line pattern is formed of the dielectric substrates 9252 and 9253. On the upper surface of the first tri-plate pattern, a beam forming circuit 9183 is formed. On the upper surface of the dielectric substrate 9252 and on the lower surface of the dielectric substrate 9253, outer conductors 9310 and 9311 of the first tri-plate line pattern are formed, respectively. The outer conductors 9310 and 9311 are made of a conductor film. A second tri-plate line pattern is formed of the dielectric substrates 9254 and 9255. On the upper surface of the second tri-plate line pattern, a beam forming circuit 9200 is formed. On the upper surface of the dielectric substrate 9254 and on the lower surface of the dielectric substrate 9255, outer conductors 9311 and 9312 of the second tri-plate line pattern are formed, respectively. The outer conductors 9311 and 9312 are made of a conductor film. The outer conductor 9311 of the second tri-plate line pattern is shared with the outer conductor of the first tri-plate line pattern. A third tri-plate line pattern is formed of the dielectric substrates 9256 and 9257. On the upper surface of the third tri-plate line pattern, an RF switch is formed.

On the upper surface of the dielectric substrate 9256 and on the lower surface of the dielectric substrate 9257, outer conductors 9312 and 9313 of the third tri-plate line pattern are formed, respectively. The outer conductors 9312 and 9313 are made of a conductor film. The outer conductor 9312 of the third tri-plate line pattern is shared with the outer conductor of the second tri-plate line pattern. Output points 9199 and 9233 of the beam forming circuits 9183 and 9200 are electrically connected to output points 9242 and 9241 of a circuit having the RF switch through vertical lines, respectively. A line 9241 which electrically connects an output point 9199 to an input point 9242 passes through the substrates which form the tri-plate line patterns is a coaxial line so as to improve matching characteristics. The coaxial line and other vertical lines can be easily formed of through-holes or the like. The output signal of the RF switch circuit is sent from an output point 9248 to a connector 9249 through a vertical through-hole of the substrates.

Figure 72:
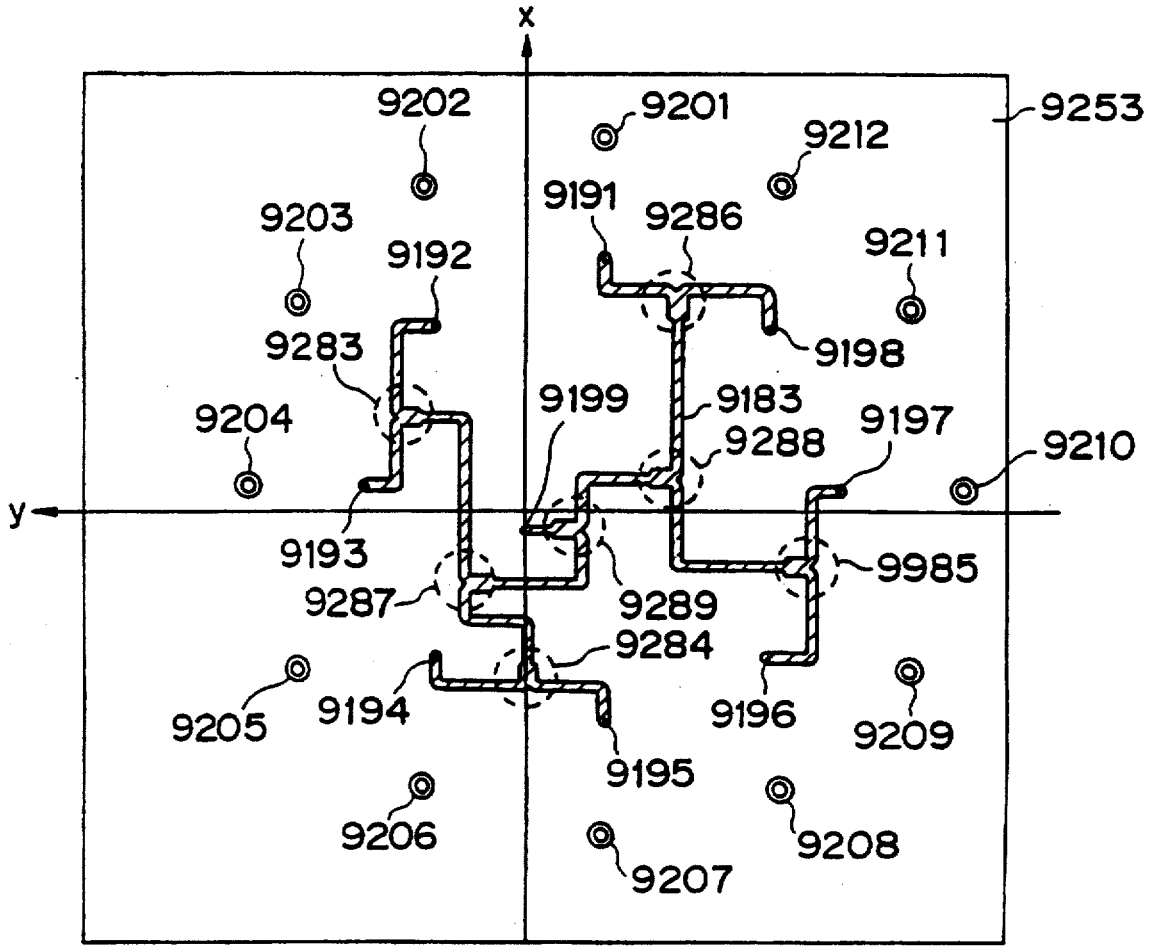
FIG. 72 is a top view showing the beam forming circuit of the array antenna according to the fourteenth embodiment of the present invention.

FIG. 72 is a top view showing the beam forming circuit 9283 formed on the dielectric substrate 9253. The output points 9161 to 9168 of the feeding circuit for the first antenna array are electrically connected to the input points 9191 to 9198 of the beam forming circuit 9183 through vertical lines, respectively.

The output signals of the input points 9192 and 9193 are sent to a power combining device 9283. The output signals of the input points 9194 and 9195 are sent to a power combining device 9284. The output signals of the input points 9196 and 9197 are sent to a power combining device 9285. The output signals of the input points 9198 and 9191 are sent to a power combining device 9286. The output signals of the power combining devices 9283 and 9284 are sent to a power combining device 9287. The output signals of the power combining devices 9286 and 9285 are sent to a power combining device 9288. The output signals of the power combining devices 9287 and 9288 are sent to a power combining device 9289. The output signal of the power combining device 9199 is sent to the circuit having the RF switch. The beam forming circuit 9183 shifts the phase of the signal received from each antenna element for $\alpha_{ai}=m\psi_{ai}$ (where m is any positive integer except for 0) by varying the length of the line thereof. Thus, the first antenna array forms the above-mentioned conical beam.

Figure 73:
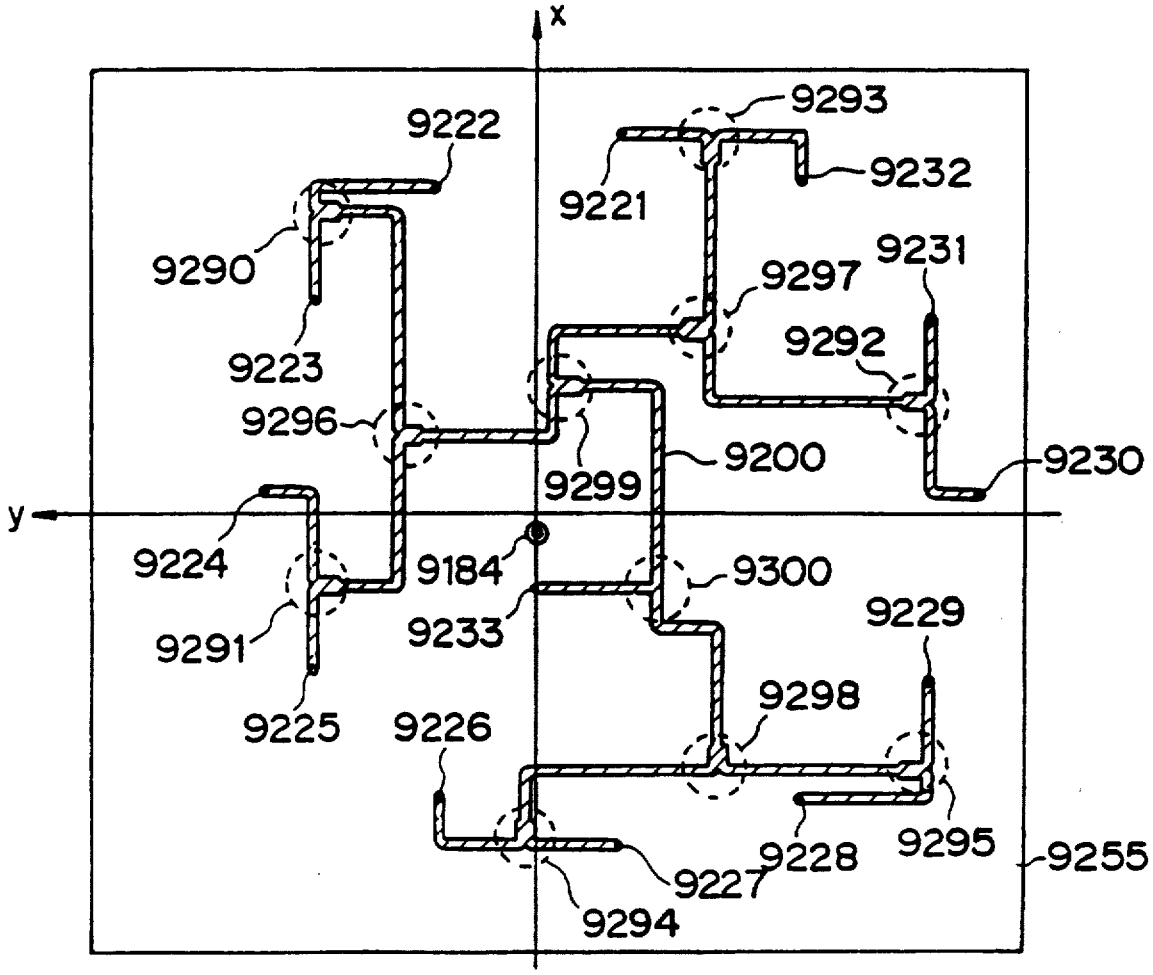
FIG. 73 is a top view showing the beam forming circuit of the array antenna according to the fourteenth embodiment of the present invention.

FIG. 73 is a top view showing the beam forming circuit 9200 formed on the dielectric substrate 9253. The output points 9171 to 9178 of the feeding circuit for the second antenna array are electrically connected to the input points 9221 to 9232 through vertical coaxial lines 9201 to 9212, respectively. The output signals of the input points 9223 and 9222 are sent to a power combining device 9290. The output signals of the input points 9224 and 9225 are sent to a power combining device 9291. The output signals of the input points 9226 and 9227 are sent to a power combining device 9294. The output signals of the input points 9228 and 9229 are sent to a power combining device 9295. The output signals of the input points 9230 and 9231 are sent to a power combining device 9292. The output signals of the input points 9221 and 9232 are sent to a power combining device 9293. The output signals of the power combining devices 9290 and 9291 are sent to a power combining device 9296. The output signals of the power combining devices 9294 and 9295 are sent to a power combining device 9298. The output signals of the power combining devices 9292 and 9293 are sent to a power combining device 9297. The output signals of the power combining devices 9296 and 9297 are sent to a power combining device 9299. The output signals of the power combining devices 9299 and 9298 are sent to a power combining device 9300. The power combining devices 9290 to 9300 are T branches. The output signal of the power combining device 9300 is sent from the output point 9233 to the circuit having the RF switch. The beam forming circuit 9200 shifts the phase of the signal received from each antenna element for $\alpha_{bi}=n\psi_{bi}$ (where n is any positive integer except for 0) by varying the length of the line thereof. Thus, the second antenna array can form the above-described conical beam.

Figure 74:
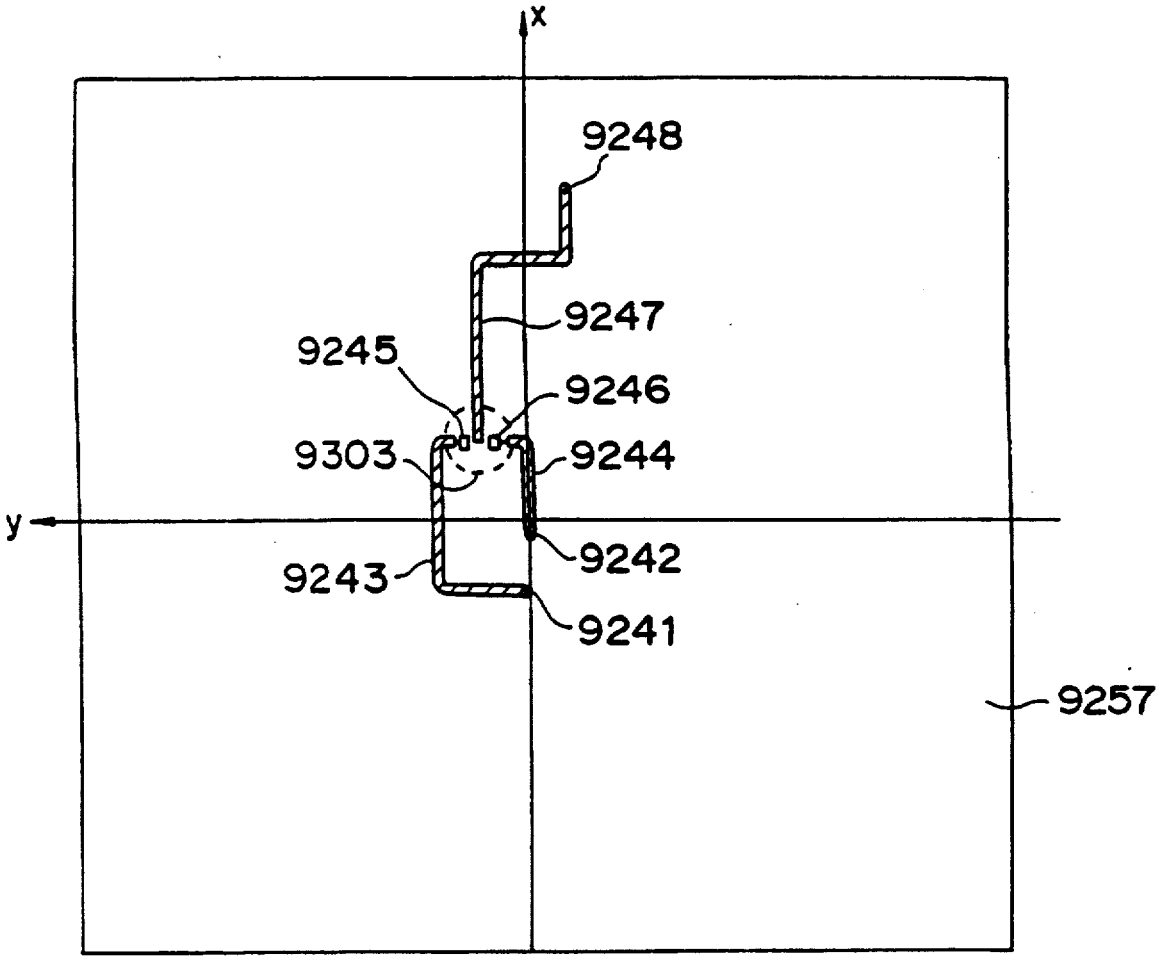
FIG. 74 is a top view showing a circuit having an RF switch of the array antenna according to the fourteenth embodiment of the present invention.

FIG. 74 is a top view showing the circuit having the RF switch 9303 formed on the dielectric substrate 9257. The output signal of the beam forming circuit 9183 is sent to the input point 9242. The output signal of the input point 9242 is sent to the RF switch 9303 through a microstrip line 9244. The output of the beam forming circuit 9200 is electrically connected to the input point 9241. The input point 9241 is electrically connected to the RF switch 9303 through a microstrip line 9243. The RF switch 9303 selects one of two signals of the beam forming circuits 9183 and 9200. The output signal of the RF switch 9303 is sent to the output point 9248 through a microstrip line 9247. The output point 9248 is electrically connected to the connector 9249. The RF switch 9303 is constructed of PIN diodes (or FETs) 9345 and 9346 which select one of signals corresponding to a DC bias. In this embodiment, for the sake of simplicity, the DC bias circuit and control circuit are omitted.

The array antenna according to the fourteenth embodiment has the following features in addition to those of the twelfth embodiment.

According to the fourteenth embodiment, one of a plurality of conical beams can be selected. Thus, when an array antenna is designed to form a plurality of conical beams in the directions of different elevation angles with maximum radiation, the antenna can scan the beam in the directions of these elevation angles. Thus, even if a mobile station which has the array antenna according to the fourteenth embodiment is present at an inclined position, the antenna can receive and transmit radio waves for communication and broadcasting. As a modification of the fourteenth embodiment, in addition to the antenna arrays disposed on the peripheries of concentric circles, an antenna element which is excited in a dominant mode may be disposed at the center of the concentric circles. In this construction, the beam can be scanned in the zenith direction or to the direction of a predetermined elevation angle by the operation of a switch. This construction is effectively used in tracking a low-altitude orbiting satellite whose elevation angle varies time by time.

When two conical beams with different polarized waves are used, an array antenna which selects one of these polarized waves can be formed.

When a plurality of conical beams with different frequencies are used, an array antenna which receives and transmits radio wave with a plurality of frequencies can be formed.

In the array antenna according to the fourteenth embodiment, the construction which selects one of a plurality of conical beams was described. However, when the radiation field in each direction is combined in the same phase, a conical beam antenna with a wide beam in the direction of the elevation angle can be formed, thereby widening the area to and from which the antenna receives and transmits radio waves.

In the fourteenth embodiment, the construction which selects one of a plurality of conical beams was described. Instead, when a plurality of conical beams are directly connected to corresponding transmitters and/or receivers, a system which transmits and receives a plurality of conical beams at a time can be formed. Thus, systems using multiple conical beams, wide beam, and simultaneous conical beam transmitting and receiving function can be formed. These features are practically very useful. In these systems, since the construction of the transmitting antenna is completely different from that of the receiving antenna, reception signals can be much isolated from transmission signals. Thus, the construction of a filter which prevents leakage of a radio wave from a transmitter to a receiver can be simplified.

Next, a fifteenth embodiment of the present invention will be described. The construction of the fifteenth embodiment of the present invention is similar to that of the fourteenth embodiment. For the sake of simplicity, only differences between these embodiments will be described.

The top view of the array antenna according to the fifteenth embodiment of the present invention is similar to that shown in FIG. 69. The array antenna according to the fifteenth embodiment has two beam forming circuits corresponding to two antenna arrays. The construction and operation of these beam forming circuits are the same as those of the fourteenth embodiment shown in FIGS. 72 and 73. However, in the fourteenth embodiment, the output signals of the antenna arrays are combined with a predetermined weight.

Figure 75:
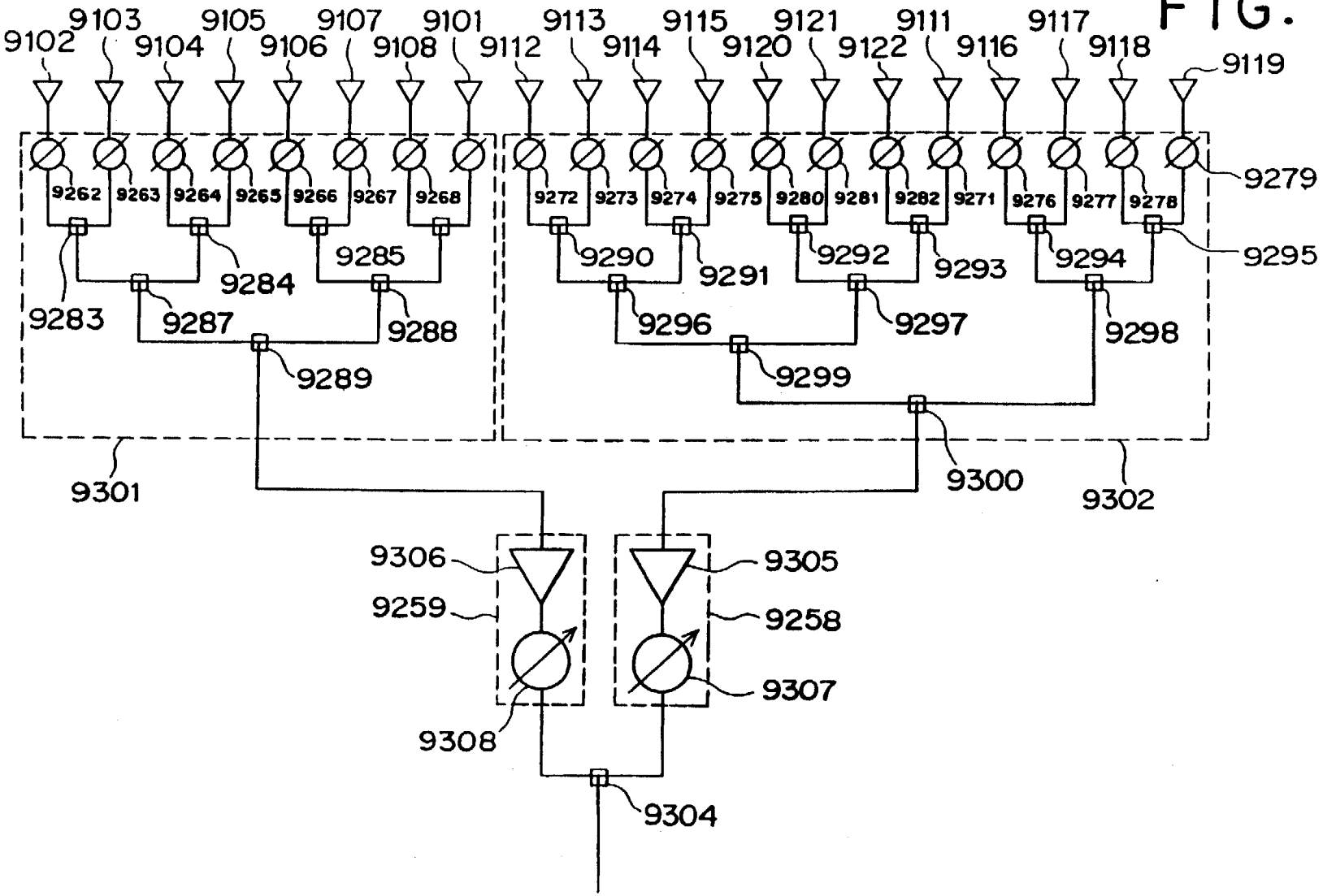
FIG. 75 is a circuit diagram showing an array antenna according to a fifteenth embodiment of the present invention.

FIG. 75 is a circuit diagram showing a feeding system of an array antenna according to the fifteenth embodiment of the present invention. The array antenna has two beam forming circuits 9301 and 9302 corresponding to the first and second antenna arrays, respectively. The first and second antenna arrays are disposed on the peripheries of the concentric circles with the radiuses a and b, respectively. The output signal of the first antenna array is sent to an amplifier 9306. The output signal of the amplifier 9306 is sent to a phase shifter 9308. The output sinal of the phase shifter 9308 is sent to a combining device 9304. The output signal of the second antenna array is sent to an amplifier 9305. The output signal of the amplifier 9305 is sent to a phase shifter 9307. The output sinal of the phase shifter 9307 is sent to the combining device 9304. Thus, the combining device 9304 combines the signals received from the phase shifters 9308 and 9307. The amplifier 9306 and the phase shifter 9308 can be integrally formed as an MMIC module 9259. Likewise, the amplifier 9305 and the phase shifter 9258 can be integrally formed as an MMIC module 9259.

Next, the operation of the array antenna according to the fifteenth embodiment of the present invention will be described. When the exciting phase $\alpha_{ai}$ of each antenna element is the direction angle $\psi_{ai}$ times m (where m is any positive integer except for 0), by applying the equation(26), the radiation directivity of the first antenna array disposed on the periphery of the circle with the radius a is given by the following equation.

$$E_a(\theta, \phi)=P(a, \theta) \exp(j(m\pm k)\phi) \quad (30)$$

where k represents the variation of the phase of the radiation field of each antenna element corresponding to the rotation angle $\phi$. In this embodiment, microstrip antenna members are used. In dominant mode (TM 11 mode), k=1. In higher-order mode(TM pq mode), k=p. The sign of k depends on whether each antenna element is excited with a left-hand circular polarized wave or right-hand circular polarized wave. When there are a proper number of antenna elements (for example, the number of antenna elements is eight or more), P (a, $\theta$) is approximately given by the following equation.

$$P(a, \theta)=jA(\theta)J_m(ka\times\sin\theta) \quad (31)$$

where A ($\theta$) is the radiation directivity with respect to each antenna element. Likewise, when the exciting phase $\alpha_{bi}$ of each antenna element is the direction angle $\psi_{bi}$ times n (where n is any positive integer except for 0), the radiation directivity of the second antenna array disposed on the periphery of the circle with the radius b is given by the following equation.

$$E_b(\theta, \phi)=P(b, \theta) \exp(j(n\pm k)\phi) \quad (32)$$

where all the antenna elements which construct the two antenna arrays are excited in the same mode and with the same rotation of polarized waves. By applying the equations (30) and (32), it is revealed that the two antenna arrays each form a conical beam having a constant intensity of radiation directivity in the direction of the rotation angle $\phi$. When P (a, $\theta$) and P (b, $\theta$) are set so that the positions of peaks of the conical beams match in the direction of the elevation angle e (namely, these radiuses are optimally set), the conical beams each have a peak of radiation directivity in the same direction of the elevation angle $\theta$.

Figure 76:
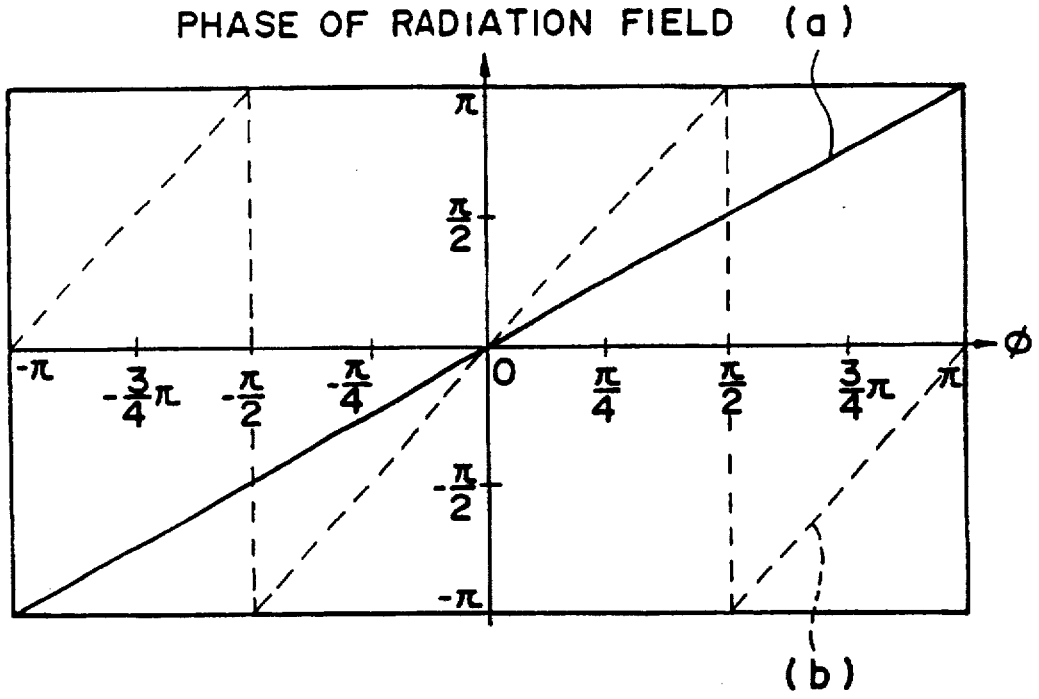
FIG. 76 is a graph showing phase variation of the antenna radiation field of the array antenna according to the fifteenth embodiment of the present invention.
Figure 77:
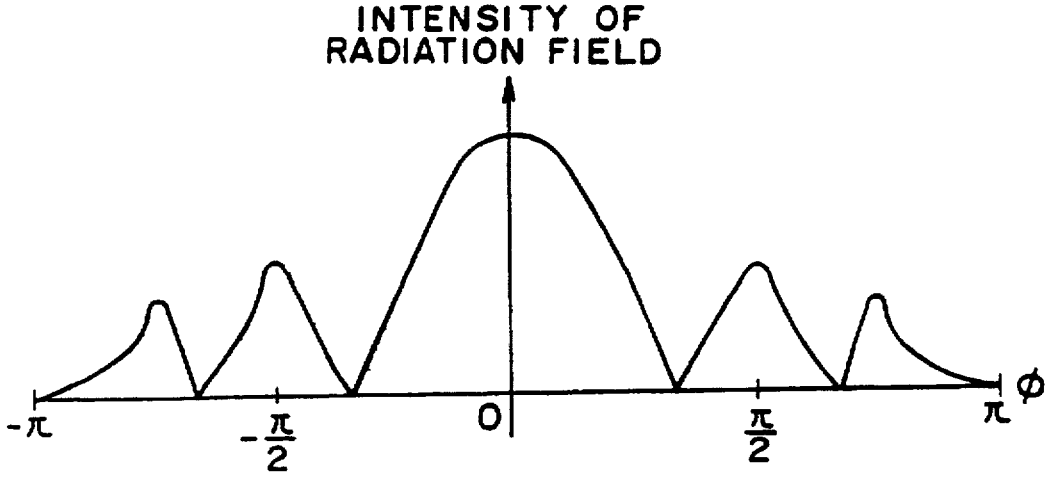
FIG. 77 is a graph showing the composite radiation directivity of the array antenna according to the fifteenth embodiment of the present invention.

The radiation directivity of two conical beams differs in the variation of the phase with respect to the rotation angle $\phi$. When $m\pm k=1$ and $n\pm k=2$, the phases of the radiation fields of the two antenna arrays vary as shown in FIG. 76. In the figure, (a) represents the phase of the radiation field of the first antenna array disposed on the periphery of the circle with the radius a, whereas (b) represents the phase of the radiation field of the second antenna array disposed on the periphery of the circle with the radius b. For example, when the phase shifters and the amplifiers are set so that the signals of the two antenna arrays are combined with the same amplitude and the same phase in the direction of the rotation angle $\phi=0$, the radiation directivity with a peak in the direction of the rotation angle $\phi=0$ can be obtained. By varying the phases of the signals with the phase shifters, the beam can be scanned in the direction of any rotation angle $\phi$. To prevent the beam from being scanned in other than desired direction, m and n should be set in the following conditions.

$$|(m\pm k)-(n\pm k)|=1 \quad (33)$$

$$|m-n|=1$$

When m, n, and k are set as given by the equation (33), one peak of the radiation directivity can be formed only in the desired direction.

In the construction of a practical example according to the fifteenth embodiment of the present invention is the same as that of the fourteenth embodiment except that a circuit which amplifies, phase-shifts, and combines (divides) RF signals of two antenna arrays is formed instead of an RF switch.

Figure 78:
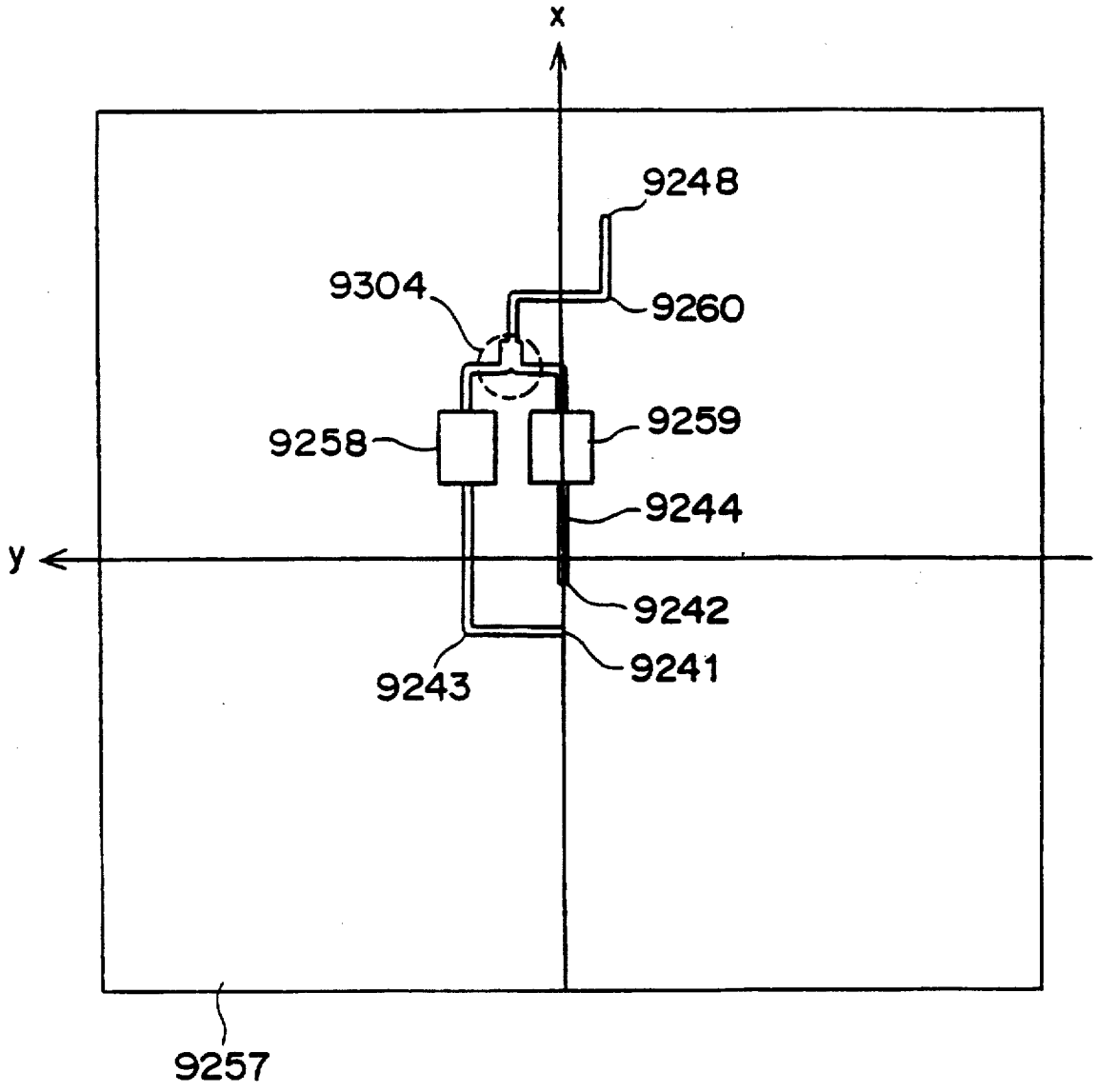
FIG. 78 is a top view showing an RF sinal composing (distributing) circuit for two antenna arrays according to the fifteenth embodiment of the present invention.

In this construction, a circuit as shown in FIG. 78 is formed on the upper surface of the dielectric substrate 9257, which is the lowermost layer. The output points 9199 and 9233 of the beam forming circuits 9183 and 9200 of the first and second antenna arrays are electrically connected to the input points 9242 and 9241 through vertical lines, respectively. The RF signal of the beam forming circuit 9200 is sent from the input point 9241 to the MMIC module 9258 through the line 9243. The RF signal of the beam forming circuit 9183 is sent from the input point 9242 to the MMIC module 9259 through the line 9244. Each of the MMIC modules 9258 and 9259 is constructed of a phase shifter and an amplifier. The phase shifter shifts the phase of the RF signal of the corresponding beam forming circuit. The amplifier amplifies the output signal of the corresponding beam forming circuit. The output signals which have been amplified and phase-shifted are combined by a combining device 9304. The output signal of the combining device 9304 is sent to the output point 9248 through a line 9260. The output point 9248 is electrically connected to a connector. In this example, the combining device 9304 has a T branch.

The effects of the array antenna according to the fifteenth embodiment of the present invention are as follows.

When a plurality of conical beams have the same amplitude but phase differences, these beams can be scanned in the direction of a predetermined rotation angle $\phi$. Since these beams can be narrowed, a higher gain can be obtained than a simple conical beam. Thus, the array antenna according to the fifteenth embodiment is effectively used for an antenna for communications requiring high bit rate (as in pictures) and high C/N ratio.

With these phase shifters, the beam can be easily scanned in the direction of the rotation angle $\phi$. Since this construction requires a phase difference between two RF signals, only one phase shifter may be required. Thus, unlike with the conventional array antenna which requires a number of phase shifters, the construction of the array antenna according to the fifteenth embodiment is simple, thereby reducing the production steps and lowering production cost. In addition, since the beam of the array antenna can be easily scanned in the direction of the rotation angle $\phi$, this array antenna is very effective for an antenna installed in a mobile station.

Moreover, since the degree of freedom in design of the array antenna according to the fifteenth embodiment is high, the antenna can be optimally designed. For example, with two microstrip antenna members which are excited in a higher-order mode, two beams can be scanned in the similar manner. However, two conical beams cannot be easily scanned so that their peaks are matched in the direction of a predetermined elevation angle $\theta$. Thus, the gain of the composite pattern may decrease. In the conventional method, since a higher-order mode is used, the frequency band is narrow. However, in the array antenna according to the fifteenth embodiment, since the dominant mode is used, a wide frequency band can be obtained.

Furthermore, with the MMIC modules which contain an amplifier and a phase shifter, the array antenna can be formed thinly and compactly.

Even if the array antenna according to the fifteenth embodiment of the present invention is modified in the same manner as the modification of the twelfth embodiment, the same effects of the fifteenth embodiment can be obtained. In addition, the following modifications do not affect the effects of the fifteenth embodiment.

When a combining device which combines two RF signals with the same amplitude is used instead of an amplifier, the same effects of the fifteenth embodiment can be obtained.

In the fifteenth embodiment, two antenna arrays were disposed on peripheries of two concentric circles. However, the number of antenna arrays is not limited to two. Instead, three or more antenna arrays may be used. In this case, a higher gain can be obtained than the fifteenth embodiment. In addition, sidelobes in other than a predetermined $\phi$ direction can be reduced. When signals of three or more antenna arrays are combined, the exciting weight (namely, amplitude and phase) may be set as follows.

Now, assume that N-th antenna array forms a conical beam with radiation field $e_N$ in the direction ($\theta$, $\phi$). The exciting weight of each antenna array which scans the composite pattern in the direction (θ, φ) is denoted by $W_N$. In these conditions, the composite radiation field $e_{ARRAY}$ is given by the following equation.

$$e_{ARRAY}=\Sigma e_N w_N=EW \tag{34}$$

where $$E=[\ \ldots\ e_N\ \ldots\ ] \tag{35}$$

$$W=\begin{bmatrix} \cdot \\ w_N \\ \cdot \end{bmatrix} \tag{36}$$

The power $P_{ARRAY}$ of the composite radiation field is given by te following equation.

$$P_{ARRAY}=W^T R_{xx} W \tag{37}$$

where $$R_{xx}=E^T E \tag{38}$$

In these equations, T is complex conjugate transpose of a matrix. Under the condition of normarization of the exiting weight given by $W^T W=1$, $P_{ARRAY}$ is maximized by the following eigensystim equation.

$$R_{xx}W=\lambda W(\text{where } \lambda \text{ is an eigenvalue}) \tag{39}$$

When W is set using the eigenvector which gives the maximum λ, $P_{ARRAY}$ is maximized. Each antenna array is excited so that the absolute value and the phase of the exciting weight $w_N$ become the exciting amplitude and the exciting phase, respectively. Thus, the beam can be scanned in the direction of the desired rotation angle φ with the maximum radiation power.

Next, a sixteenth embodiment of the present invention will be described.

Figure 79:
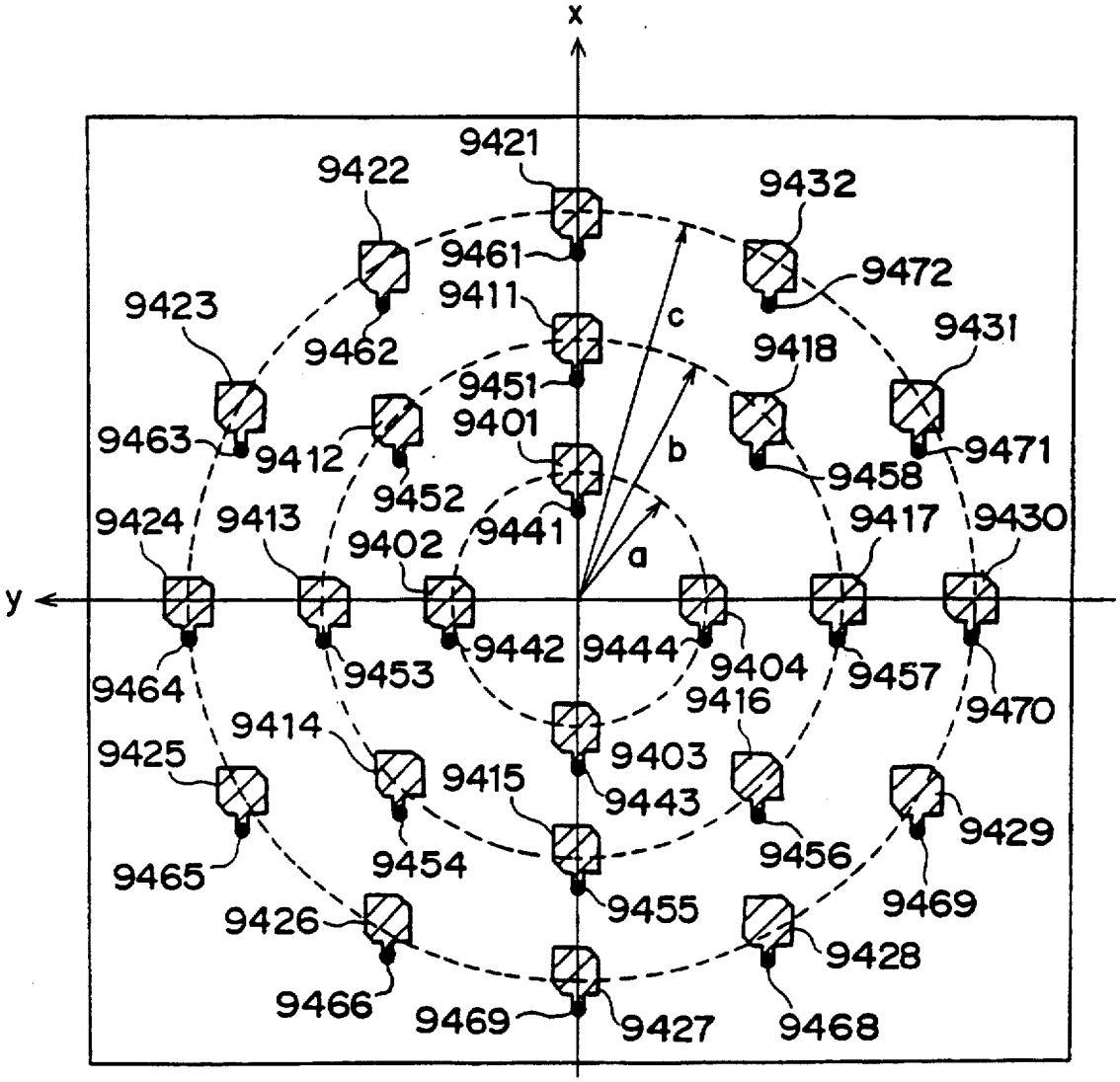
FIG. 79 is a top view showing an array antenna according to a sixteenth embodiment of the present invention.

FIG. 79 is a top view showing an array antenna according to the sixteenth embodiment of the present invention. In the sixteenth embodiment, the array antenna has three antenna arrays disposed on peripheries of concentric circles with radiuses a, b, and c which are referred to as a first antenna array, a second antenna array, and a third antenna array, respectively. The first antenna array is constructed of antenna elements 9401 to 9404. The second antenna array is constructed of 9411 to 9418. The third antenna array is constructed of 9421 to 9432. These antenna elements 9401 to 9432 are circular polarizing antenna members which are fed from feed points 9441 to 9472, respectively. Thus, each feed point is disposed on the same plane of the corresponding antenna element.

Figure 80:
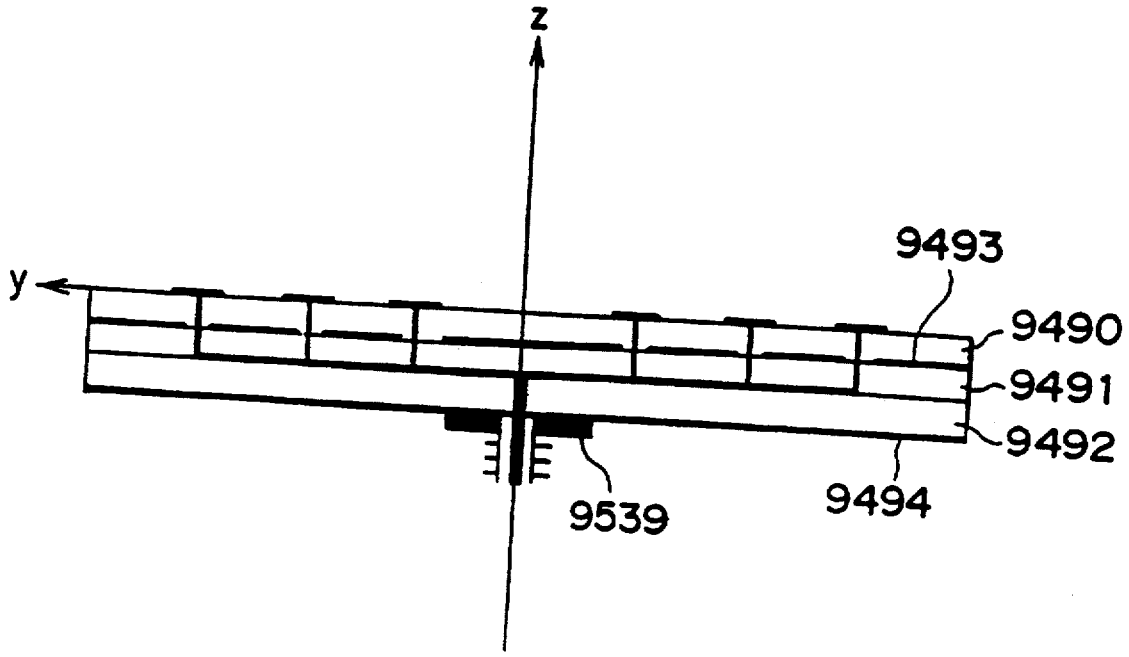
FIG. 80 is a sectional view showing the array antenna according to the sixteenth embodiment of the present invention.

FIG. 80 is a sectional view showing the array antenna according to the sixteenth embodiment of the present invention. As shown in the figure, this array antenna is formed of three dielectric substrates 9491, 9492, and 9493 being layered. On the upper surface of the dielectric substrate 9490, which is the uppermost layer, the above-described microstrip antenna members and microstrip lines which are made of a conductor film are formed. Below the dielectric substrate 9490, a tri-plate line pattern which is formed of the dielectric substrates 9491 and 9492 is disposed. On the upper surface of the dielectric substrate 9491 and on the lower surface of the dielectric substrate 9492, outer conductors 9493 and 9494 which are made of a conductor film are formed, respectively. The outer conductor 9493 also functions as a base conductor for the microstrip antenna members and the microstrip lines. The feed points of the antenna elements are electrically connected to the tri-plate line pattern through corresponding vertical lines. On the tri-plate line pattern, beam forming circuits and RF signal combining (dividing) circuits for the antenna arrays are formed.

Figure 81:
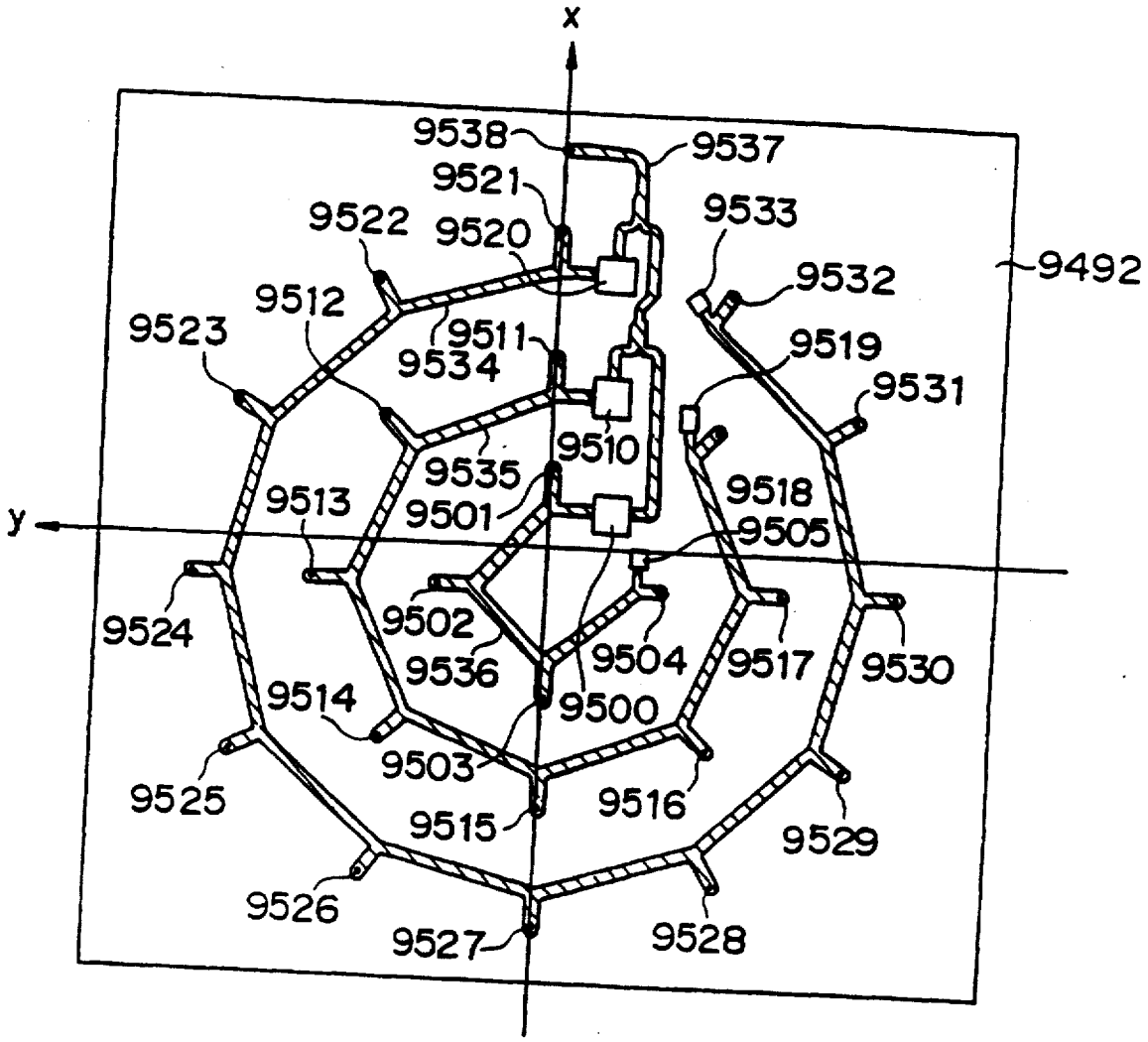
FIG. 81 is a top view showing a beam forming circuit of the array antenna according to the sixteenth embodiment of the present invention.

FIG. 81 is a top view showing the tri-plate line pattern disposed on the upper surface of the dielectric substrate 9492. The feed points 9441 to 9472 of the antenna elements are electrically connected to input points 9501 to 9532 through vertical lines which pass through the dielectric substrates, respectively. Thus, RF signals received from the antenna elements of each antenna array are sent in series. The signals of the first antenna array are received from a feed line 9536. The signals of the second antenna array are received from a feed line 9535. The signals of the third antenna array are received from a feed line 9534. At one end of the feed line 9536, a non-reflection terminating resister 9505 is connected. At one end of the feed line 9535, a non-reflection terminating resister 9519 is connected. At one end of the feed line 9534, a non-reflection terminating resister 9533 is connected. These non-reflection terminating resisters 9505, 9519, and 9534 each absorb unnecessary reflection waves. The non-reflection terminating resisters 9505, 9519, and 9534 can be easily and thinly farmed by connecting a chip resister or a resister film to a microstrip line. Since the antenna elements of each antenna array are connected in series, they can be excited with the same amplitude and proper phase difference.

The relation between the exciting phase $\alpha_i$ of each antenna element and the position angle $\psi_i$, which represents the position of the antenna element with respect to the center point of the concentric circles is given as follows.

Antenna element of first antenna array (on the periphery of the circle with the radius a): $\alpha_{ai}=m\psi_{ai}$ (where m is any positive integer except for 0)

Antenna element of second antenna array (on the periphery of the circle with the radius b): $\alpha_{bi}=n\psi_{bi}$ (where n is any positive integer except for 0)

Antenna element of third antenna array (on the periphery of the circle with the radius c): $\alpha_{ci}=l\psi_{ci}$ (where l is any positive integer except for 0)

Thus, each antenna array can form a conical beam. When the phase which varies corresponding to the rotation angle φ of each antenna element is denoted by exp(jkφ), the phase which varies corresponding to each antenna array is given as follows.

First antenna array: exp(j(k+m)φ)

Second antenna array: exp(j(k+n)φ)

Third antenna array: exp(j(k+l)φ)

When the signals of the three antenna arrays are combined with a proper exciting weight, the beam of the array antenna can be scanned in the direction of a desired rotation angle φ. By using the exciting weight setting method described in the fifteenth embodiment, the gain in the rotation angle φ can be maximized. To reduce the occurrence of sidelobes, the values of m, n, and l should be unique integers each other. When the values of m, n, and l are unique integers which successively increment by one (as in m=1, n=2, and l=3), the occurrence of sidelobes can be more effectively reduced. Moreover, in this embodiment, due to the relation of line length of serial feeding, the feeding circuits can be effectively formed when m+2=n+1=l.

The composite output signals of the first, second, and third antenna arrays are sent to MMIC modules 9500, 9510, and 9520, respectively. Each of the MMIC modules 9500, 9510, and 9520 is constructed of a phase shifter and an amplifier which set a predetermined exciting weight. The output signals of the MMIC modules 9500, 9510, and 9520 are sent to a line 9537 which combines these signals. The output signal of the line 9537 is sent to an outer connector 9539 through an output point 9538. In this embodiment, the line 9537 has two T branches which combine the three signals. In this construction, an array antenna which scans the beam in the direction of any rotation angle $\phi$ can be formed. The basic operation and effects of the array antenna according to the sixteenth embodiment are the same as those of the array antenna according to the fifteenth embodiment.

The feature of the sixteenth embodiment of the present invention is in that signals of antenna elements are fed in series. In this construction, feeding circuits for the antenna arrays can be formed on the same plane. In addition, the combining (dividing) circuits for the antenna arrays can be formed on the same plane. The array antenna according to the sixteenth embodiment was formed of three layers. However, all the antenna elements and the feeding circuits may be disposed on the same plane (layer). In this case, with only one layer, an array antenna which scans a beam can be formed. Thus, the number of layers which construct an array antenna can be remarkably reduced, thereby decreasing the thickness thereof, reducing the production cost, and simplifying the production steps.

In the sixteenth embodiment of the present invention, series feeding method was used. However, when the series feeding method is used, any feeding method for circularly polarized waves, any antenna element type, any line type, and the like may be used. For example, an array antenna having slot antenna members and dipole antenna members, a circular polarizing antenna of slot coupling feeding method, or the like may be used.

Next, a seventeenth embodiment of the present invention will be described.

Figure 82:
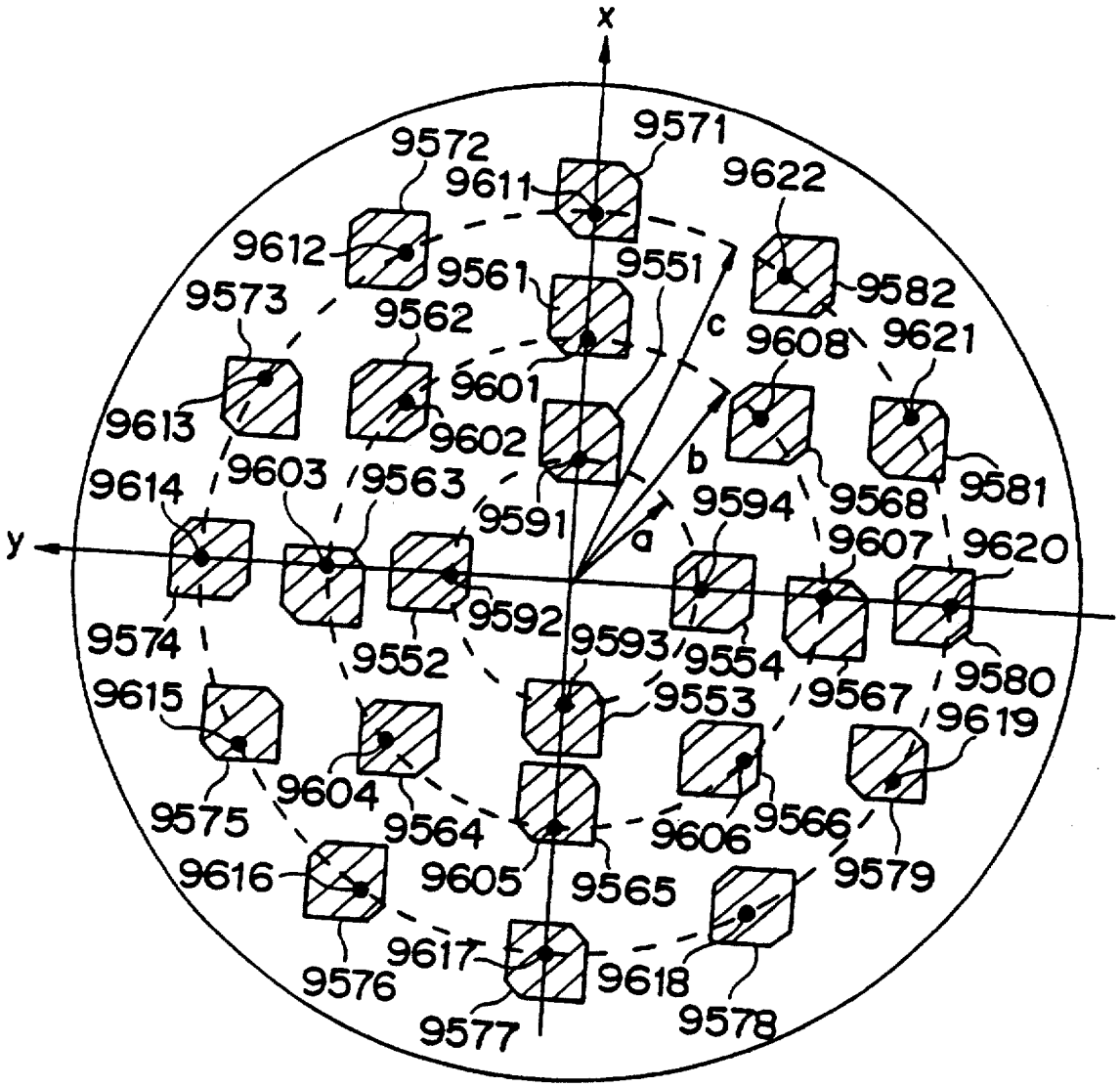
FIG. 82 is a top view showing an array antenna according to a seventeenth embodiment of the present invention.

FIG. 82 is a top view showing an array antenna according to the seventeenth embodiment of the present invention. The array antenna according to the seventeenth embodiment has three antenna arrays disposed on peripheries of concentric circles with radiuses a, b, and c which are referred to as a first antenna array, a second antenna array, and a third antenna array, respectively. The first antenna array is constructed of antenna elements 9551 to 9554. The second antenna array is constructed of antenna elements 9561 to 9568. The third antenna array is constructed of antenna elements 9571 to 9581. Feed points 9591 to 9594 are disposed on the antenna elements 9551 to 9554, respectively. Feed points 9601 to 9608 are disposed on the antenna elements 9561 to 9568, respectively. Feed points 9611 to 9622 are disposed on the antenna elements 9571 to 9582, respectively. This array antenna is a one-point-feeding type circular polarizing microstrip antenna where a signal is directly fed from a feeding point to the corresponding antenna element.

Figure 83:
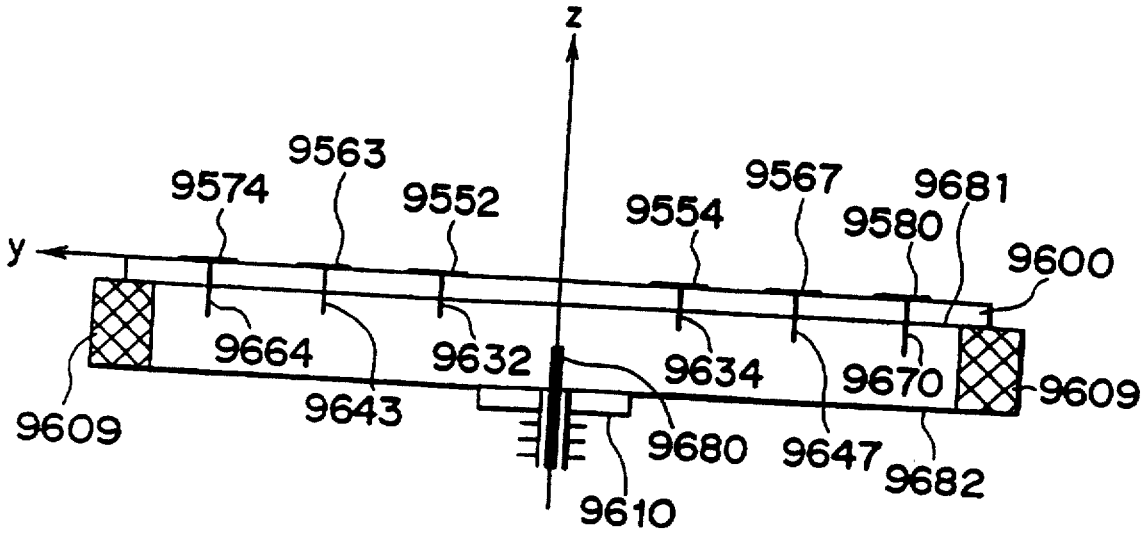
FIG. 83 is a sectional view showing the array antenna according to the seventeenth embodiment of the present invention.

FIG. 83 is a sectional view showing the array antenna according to the seventeenth embodiment of the present invention. The antenna elements are made of a conductor film and formed on the upper surface of a dielectric substrate 9600. This array antenna uses a radial waveguide. The radial waveguide is defined by conductor plates 9681 and 9682. A signal is fed from a center conductor 9680 of a connector 9610 disposed at the center of the array antenna. On the lower surface of the dielectric substrate 9600, metal pins 9631, 9634, 9643, 9647, and 9670 which are electrically connected to the feed points of the antenna elements protrude to the radial waveguide so as to exchange radio waves between the radial waveguide and the antenna elements. The transmitting ratio of the power of each antenna element is adjusted by the length of the corresponding pin which protrudes to the radial waveguide. Due to the characteristics of the radial waveguide, the antenna elements of each antenna array (namely disposed on each periphery) are fed with signals in the same phase. To remove unnecessary reflection waves, a radio wave absorber 9609 is disposed on the outer periphery of the radial waveguide.

As shown in FIG. 82, the antenna elements are rotated on the dielectric substrate 9600 so as to vary the phases of their radiation fields. The relation between the exciting phase $\alpha_i$ of each antenna element and the position angle $\psi_i$ which represents the position of the antenna element with respect to the center point of the array antenna is given as follows.

Antenna element of first antenna array: $\alpha_{ai}=m\psi_{ai}$ (where m=1)

Antenna element of second antenna array: $\alpha_{bi}=n\psi_{bi}$ (where n=2)

Antenna element of third antenna array: $\alpha_{ci}=l\psi_{ci}$ (where l=3)

Thus, each antenna array can form a conical beam. Although each antenna element is not exactly disposed on the corresponding periphery, the formation of a conical beam is not affected. When the variation of the phase corresponding to the rotation angle (of each antenna element is $\exp(jk\phi)$, the variation of the phase corresponding to the rotation angle $\phi$ for each antenna array is given as follows.

First antenna array: $\exp(j(k+1)\phi)$

Second antenna array: $\exp(j(k+2)\phi)$

Third antenna array: $\exp(j(k+3)\phi)$

As was described in the sixteenth embodiment, when the signals of the three antenna arrays are combined with a proper exciting weight, the array antenna can scan the beam in the direction of a desired rotation angle $\phi$. The amplitude of the exciting weight is set by adjusting the length of the pins connected to the microstrip antenna members. The phase of the exciting weight is set by applying a proper bias to the rotation angle of each antenna element.

The effects of the seventeenth embodiment of the present invention are as follows.

Even if the shape of the array antenna according to the seventeenth embodiment is flat, the array antenna can scan the beam in the direction of a predetermined elevation angle. Thus, even if the array antenna is brought into contact with a wall of a house, the antenna can scan the beam in any direction so as to receive radio waves from broadcasting satellites. In this case, since the antenna is mounted on the wall, it can be prevented from being deteriorated and damaged by wind, rain, and so forth.

In addition, since the array antenna according to the seventeenth embodiment uses a radial waveguide, the feeding circuit for the antenna elements can be formed of one layer, thereby simplifying the construction thereof. Thus, the array antenna according to the seventeenth embodiment is effectively used for an antenna which receives radio waves from broadcasting satellites, which require high gain and a number of antenna elements.

Moreover, since the radial waveguide is filled with air, feeding loss is low. Thus, when the number of antenna elements is large, the feeding loss is very reduced in comparison with an array antenna having dielectric substrates.

In the seventeenth embodiment of the present invention, a microstrip line pattern was used as antenna elements. However, with another antenna members such as helical antenna members, spiral antenna members, slot antenna members, and slot coupling feed antenna members, the effects similar to those of the seventeenth embodiment can be expected. In this embodiment, a radial waveguide formed of one layer was explained. However, with a radial waveguide formed of two layers, the same effects can be obtained.

Next, an eighteenth embodiment of the present invention will be described.

Figure 84:
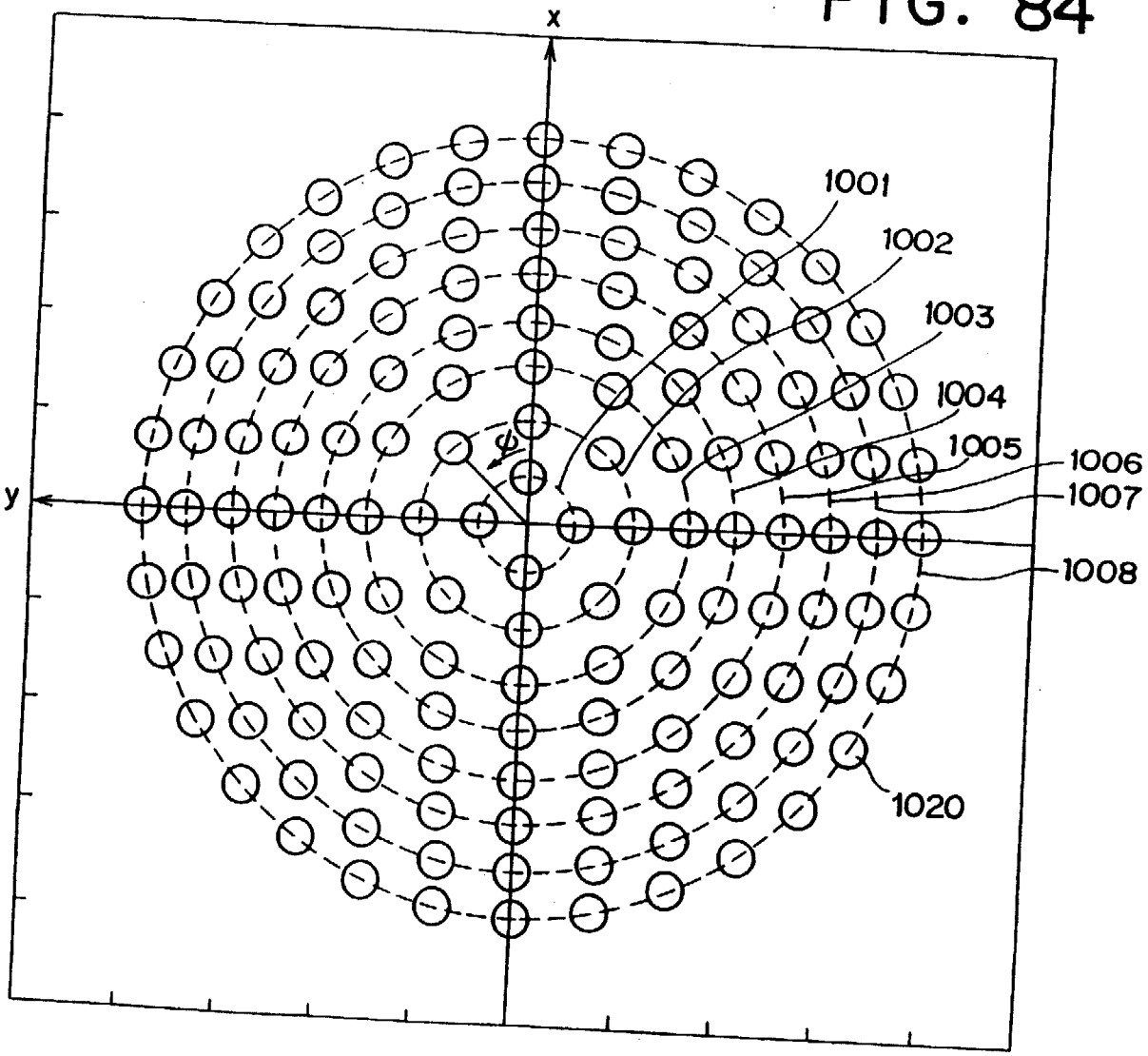
FIG. 84 is a top view showing the construction of an array antenna according to an eighteenth embodiment of the present invention.

FIG. 84 is a top view showing an array antenna according to the eighteenth embodiment of the present embodiment. In this embodiment, the array antenna has eight circular antenna arrays disposed on peripheries of concentric circles with different radiuses. These antenna arrays are circular arrays 1001 to 1008. An antenna element 1020 radiates a circularly polarized wave. In this embodiment, any antenna element type and any feeding method may be be used. Each antenna element 1020 of the circular antenna arrays 1001 to 1008 excites a radio wave with a proper phase. The relation between the exciting phase a of each antenna element 1020 and the position angle $\psi$ which represents the position of the antenna element 1020 with respect to the center point of the array antenna is given by the following equation.

$$\alpha=m\psi \text{(where m is any positive integer except for 0)} \quad (40)$$

Each of the circular antenna arrays 1001 to 1008 has a unique value of m. With respect to the value of m, the circular antenna arrays 1001 to 1008 are designated m=1 to 8, respectively. When each antenna element 1020 is excited with the exciting phase given by the equation (40), a conical beam is formed where a maximum intensity is obtained in the direction of a predetermined elevation angle $\theta$ and the intensity of the rotation angle $\phi$ is constant. To scan the beam in the direction of a predetermined elevation angle $\theta$, the radiuses of the circular antenna arrays 1001 to 1008 should be properly set. Since the value of m for each circular antenna array is unique, the optimum value thereof is also unique. Thus, the circular antenna arrays 1001 to 1008 can be disposed on corresponding peripheries of concentric circles with different radiuses.

When the antenna element 1020 is excited with a left-circularly polarized wave and the variation of the phase of the radiation field with respect to the rotation angle $\phi$ is denoted by $\exp(j\phi)$, the variation of phase of the radiation field for each of the circular antenna arrays 1001 to 1008 with respect to the rotation angle $\phi$ is denoted by $\exp(j(m+1)\phi)$.

Figure 85:
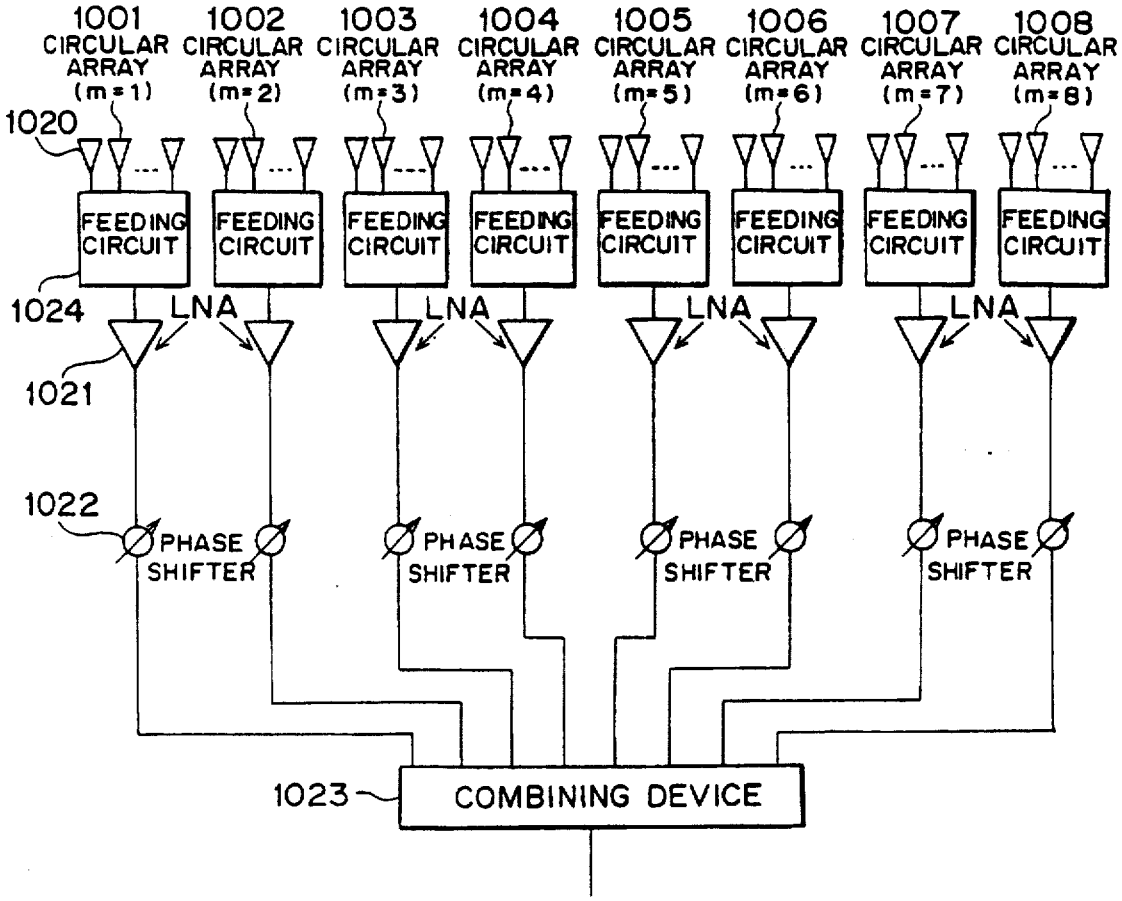
FIG. 85 is a circuit diagram showing a feeding g system of the array antenna according to the eighteenth embodiment of the present invention.

FIG. 85 is a circuit diagram showing a feeding system of the array antenna according to the eighteenth embodiment of the present invention. The output signals of each of the circular antenna arrays 1001 to 1008 are sent to a feeding circuit 1024. The output signal of the feeding circuit 1024 is sent to a low- noise amplifier (LNA) 1021 which amplifies the input signal. The output signal of the LNA 1021 is sent to a phase shifter 1022 which shifts the phase of the input signal for predetermined degrees. The output signal of the phase shifter 1022 is sent to a combining device 1023. Thus, the combining device 1023 combines all the signals received from the antenna elements of the circular antenna arrays 1001 to 1002 through the feeding circuits 1024, the LNAs 1021, and the phase shifters 1022.

In this embodiment, only the construction for the receiving operation of the array antenna is described.

However, the basic construction for the transmitting operation is the same as that for the receiving operation except that the signal flow is reversed and high output amplifiers (HPAs) are used instead of the LNAs 1021.

In this embodiment, the feeding circuit 1024 combines signals received from the antenna elements which construct the corresponding circular antenna array by shifting the exciting phase for predetermined degrees (fixed degrees). The feeding circuits 1024 may be formed of a plane line pattern such as a microstrip line pattern, a tri-plate line pattern, or a suspended line pattern. In addition, the feeding method may be tournament feeding method, series feeding method, or the like. When the series feeding method is used, all the feeding circuits for the circular antenna arrays can be formed on the same plane. Thus, the array antenna can be thinly and simply constructed at low cost. When the LNAs 1021 and the phase shifters 1022 are integrally formed as MICs or MMICs, the size thereof can be further reduced. As with the feeding circuits 1024 for the circular antenna arrays 1001 to 1008, the combining device 1023 which combines signals received from the circular antenna arrays 1001 to 1008 can be formed as a microstrip line pattern. Thus, in this case, the construction of the array antenna can be formed thinly and compactly.

The output signals of the circular antenna arrays 1001 to 1008 are combined with proper combining ratio so that the gain in the direction of a predetermined rotation angle $\phi$ becomes maximum. This combining ratio can be easily obtained by adjusting the power combining ratio and/or the amplitude of each amplifier.

Figure 86:
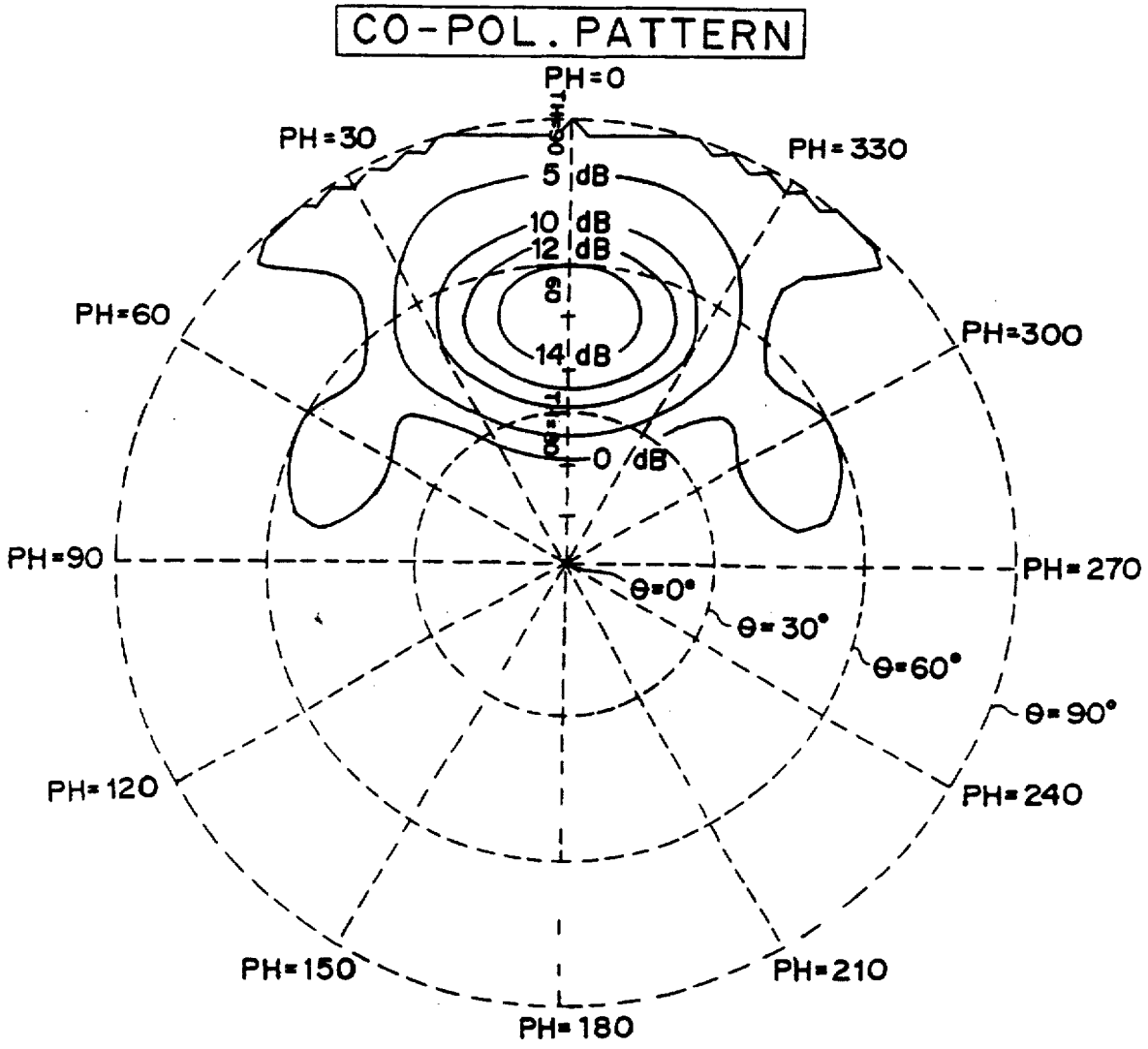
FIG. 86 is a graph showing radiation directivity of the array antenna according to the eighteenth embodiment of the present invention.

FIG. 86 is a graph showing an example of radiation directivity of the array antenna according to the eighteenth embodiment of the present invention. In this embodiment, the array antenna scans the beam in the direction of direction angles $\theta$=50 degrees and $\phi$=0 degree. By combining signals received from the eight circular antenna arrays 1001 to 1008 with the phase direction coefficient m=1 to 8, a gain of 15 dBi or more can be obtained.

Figure 87:
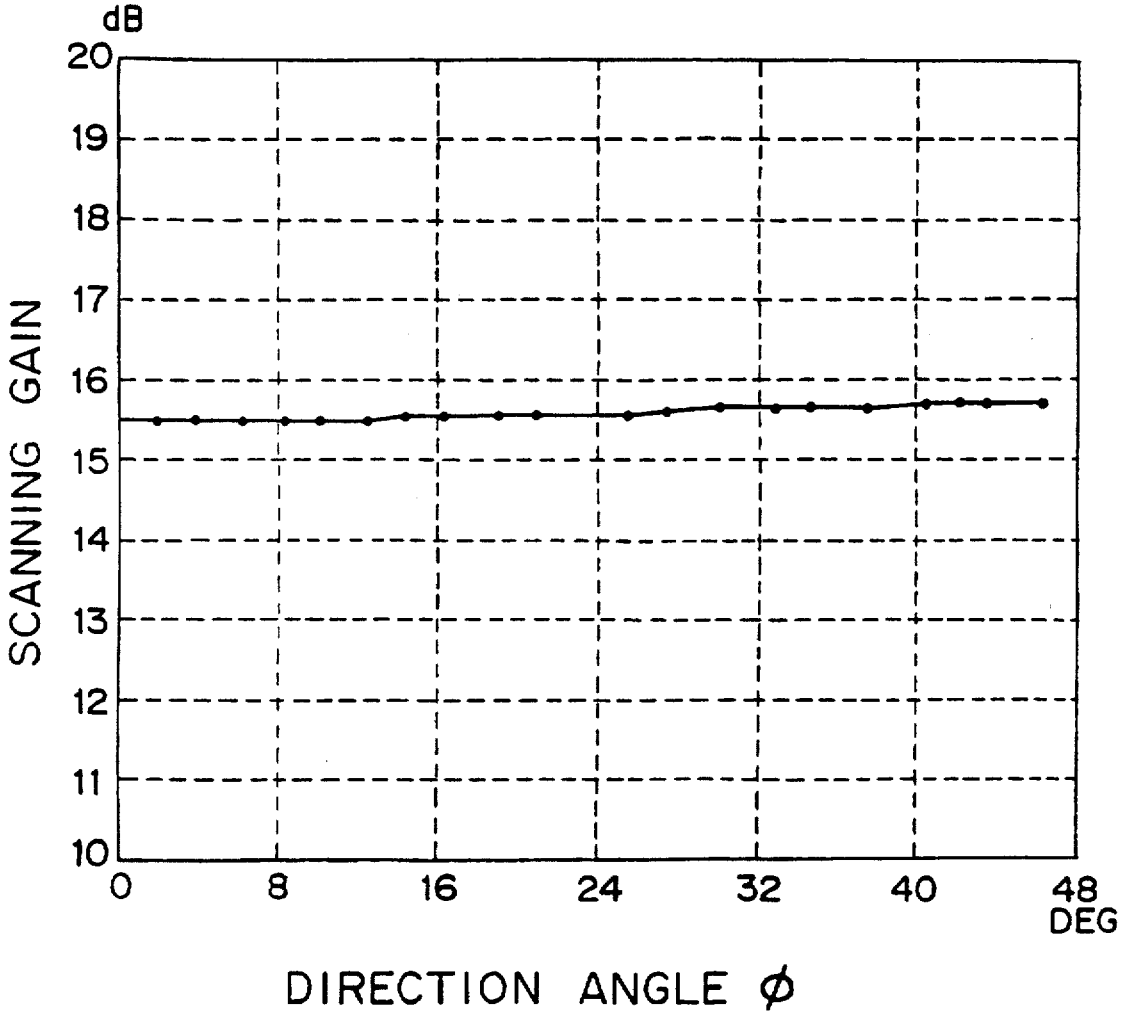
FIG. 87 is a graph showing beam scanning characteristics of the array antenna according to the eighteenth embodiment of the present invention.
Figures 88, 89:
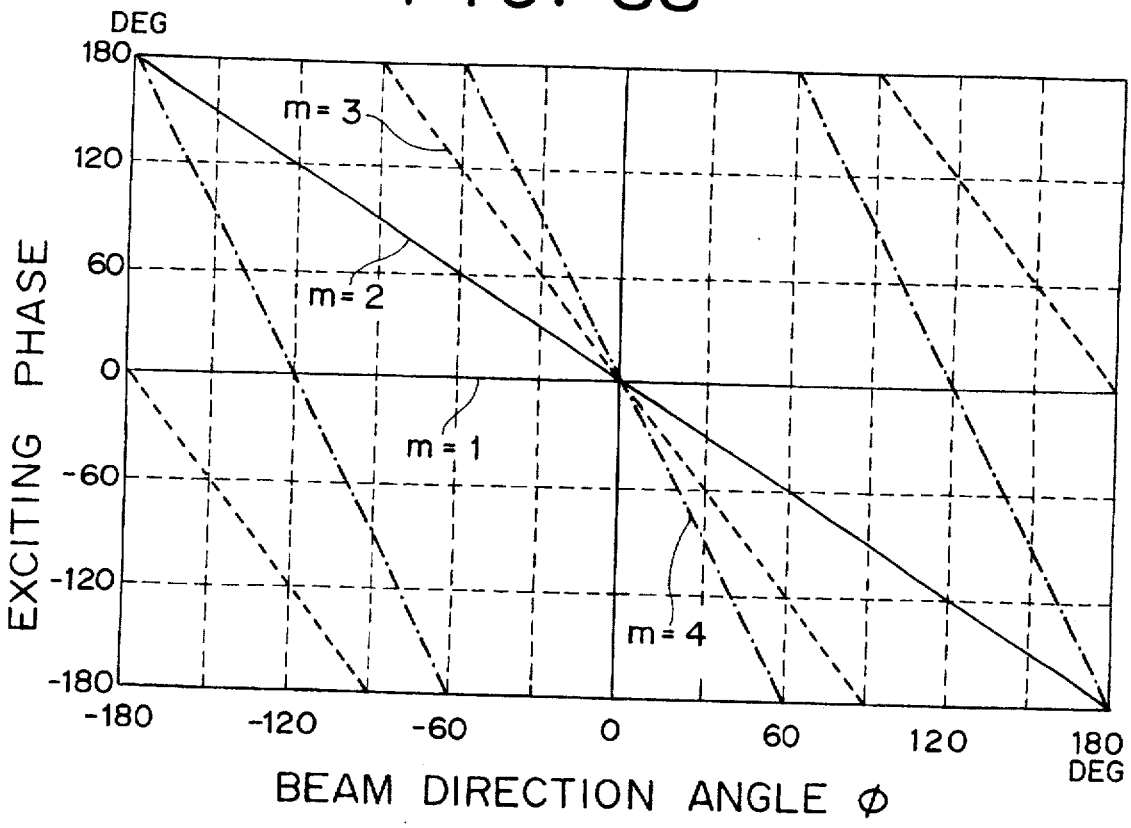
FIG. 88 is a graph showing the relation between beam scanning angles and exciting phases of circular antenna arrays according to the eighteenth embodiment of the present invention.
FIG. 89 is a table showing the phases of phase shifters of the array antenna according to the eighteenth embodiment of the present invention.

FIG. 87 is a graph showing gain characteristics where the array antenna scans the beam in the direction of the rotation angle $\phi$. As is clear from the figure, the array antenna according to this embodiment provides good scanning characteristics. When the beam is scanned in the direction of the rotation angle $\phi$, the exciting phase for the antenna elements of each circular antenna array is properly adjusted by the corresponding phase shifter 1022. FIG. 88 shows a practical setting example of exciting phases for the circular antenna arrays. When the variation of the phase of each circular antenna array with the phase direction coefficient m is denoted by $\exp(j(m+1)\phi)$ (namely, the variation of the phase of the radiation field of each antenna element is denoted by $\exp(j\phi)$), the phase shifted by the phase shifter for each circular antenna array is given by the table shown in FIG. 89. FIG. 89 shows the relation between exciting phases and beam direction angles $\phi$ (−180 degrees to +180 degrees). In this figure, the line length of the feeding circuits 1024 for the circular antenna arrays 1001 to 1008 are adjusted so that the beam is scanned in the direction of $\phi$=0 when the phase shifted by each phase shifter 1022 is 0. The phase of each circular antenna array is set based on the phase of the circular antenna array 1001 with the phase direction coefficient m=1. Since the the exciting phase of the circular array with the reference phase (as in the circular array 1001) is always 0, the circular antenna array with the phase direction coefficient m=1 does not require the phase shifter.

As described above, in the eighteenth embodiment, a plurality of conical beams with nearly same amplitude and different phases are formed. With the nature of different phases, a composite pattern is formed so that these beams are scanned in the direction of a predetermined rotation angle $\phi$. The beams can be scanned in the directions of direction angles $\phi$ by setting the phases. In this construction, the beams can be scanned in the directions of the direction angles $\phi$ by using at most several phase shifters corresponding to the circular antenna arrays. Thus, in comparison with the conventional beam scanning method of an array antenna having phase shifters which are connected to all antenna elements, the number of phase shifters of the array antenna according to this embodiment can be remarkably reduced. Consequently, the production cost of the array antenna according to this embodiment can be effectively reduced. In the eighteenth embodiment, the construction of an antenna which can scan the beam in the direction of the direction angle with the fixed elevation angle can be formed thinly and compactly. Since an antenna installed in a mobile station should be as small and light as possible, the array antenna according to the eighteenth embodiment is effectively used for an antenna installed in a mobile station. In addition, since a plurality of circular antenna arrays with different direction numbers are disposed, a high gain can be obtained. In particular, the array antenna according to the eighteenth embodiment is effective for narrowing the beam width in the direction of the rotation angle $\phi$. Moreover, the array antenna according to this embodiment has a high degree of freedom in design. In other words, the array antenna can be designed to have a maximum gain in a predetermined beam direction or a wide frequency band. These features of this embodiment are superior to those of a beam scanning antenna which scans a beam with a combination of higher-order modes of microstrip antenna members.

Even if the array antenna according to the eighteenth embodiment is modified as follows, the same effects of the embodiment can be obtained.

A part of circular antenna arrays may be substituted with microstrip antenna members. For example, the variation of the phase of the microstrip antenna member excited in TM mn mode (circularly polarized wave) with respect to the rotation angle $\phi$ of the radiation field is denoted by exp $(\pm jm\phi)$ (the sign depends on the rotating direction of the circularly polarized wave), the circular antenna array may be substituted with one antenna element. In this case, no feeding system is required. Thus, the array antenna can be compactly formed.

Next, nineteenth and twentieth embodiment of the present invention will be described.

The construction of the nineteenth and twentieth embodiments is the same as that of the eighteenth embodiment except for the value of phase direction coefficient m for each circular antenna array.

Figure 90:
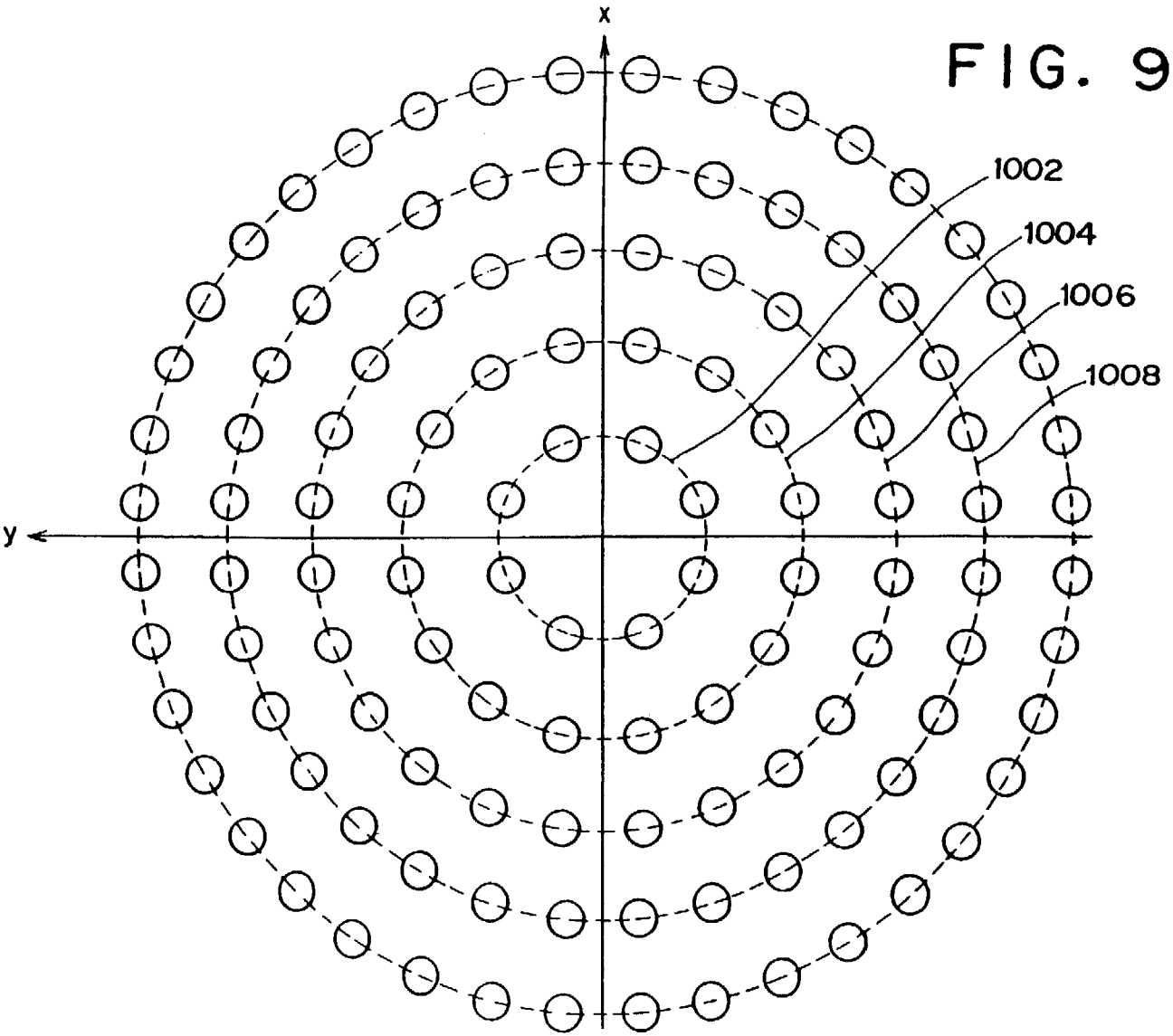
FIG. 90 is a top view showing an array antenna according to a nineteenth embodiment of the present invention.
Figure 91:
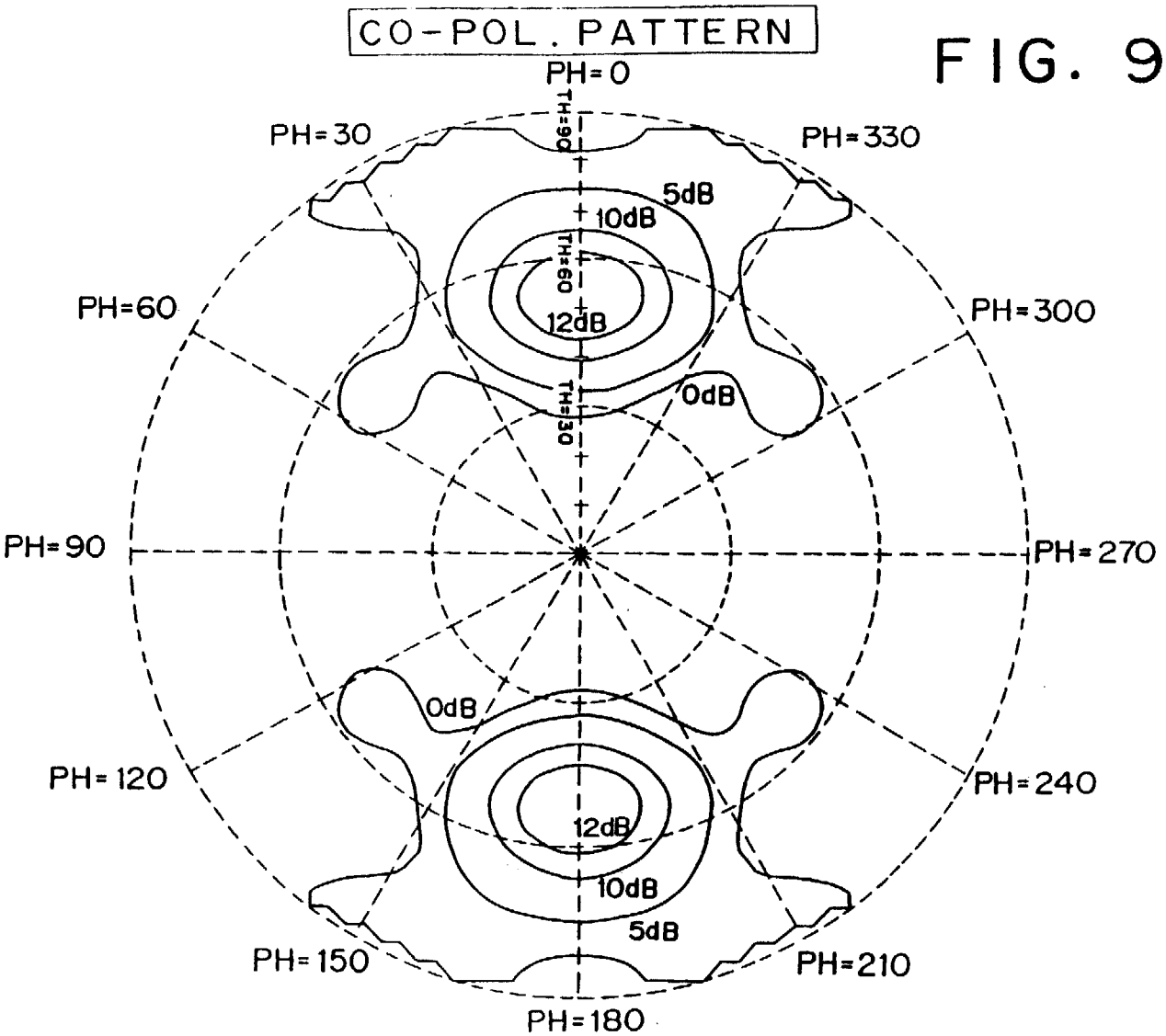
FIG. 91 is a graph showing radiation directivity of the array antenna according to the nineteenth embodiment of the present invention.

FIG. 90 is a top view showing an array antenna according to the nineteenth embodiment of the present invention. The array antenna has five circular antenna arrays 1002, 1004, 1006, 1008, and 1010 disposed on peripheries of concentric circles with different diameters. Each of the circular antenna arrays 1002, 1004, 1006, 1008, and 1010 is constructed of antenna elements. The direction numbers m of the circular antenna arrays 1002, 1004, 1006, 1008, and 1010 are 2, 4, 6, 8, and 10, respectively. As with the array antenna according to the eighteenth embodiment, the phase of a phase shifter for each of the circular antenna arrays 1002, 1004, 1006, 1008, and 1010 is set so that the composite beam of the radiation field of the antenna elements of the corresponding circular antenna array is scanned in the direction of a predetermined rotation angle $\phi$. In the nineteenth embodiment, since the direction numbers m of the circular antenna arrays 1002, 1004, 1006, 1008, and 1010 are set so that they increment by 4 one after the other, two beams take place in the direction of the rotation angle $\phi$ and the opposite direction thereof. FIG. 91 shows an example of radiation directivity in this case. As is clear from the figure, two beams which are the same take place in the directions of $\phi$=0 and 180 degrees. Likewise, when the direction numbers m are set so that they increment by 3 one after the other, three beams take place in the directions at every 120 degrees. When the direction numbers m are set so that they increment by 3 one after the other, four beams take place in the directions at every 90 degrees. In this construction, a multi-beam array antenna which scans beams in the directions of a plurality of direction angles $\phi$ can be easily formed. This array antenna is effectively used for a transmitting antenna which forms beams scanned in a plurality of directions at a time.

Figure 92:
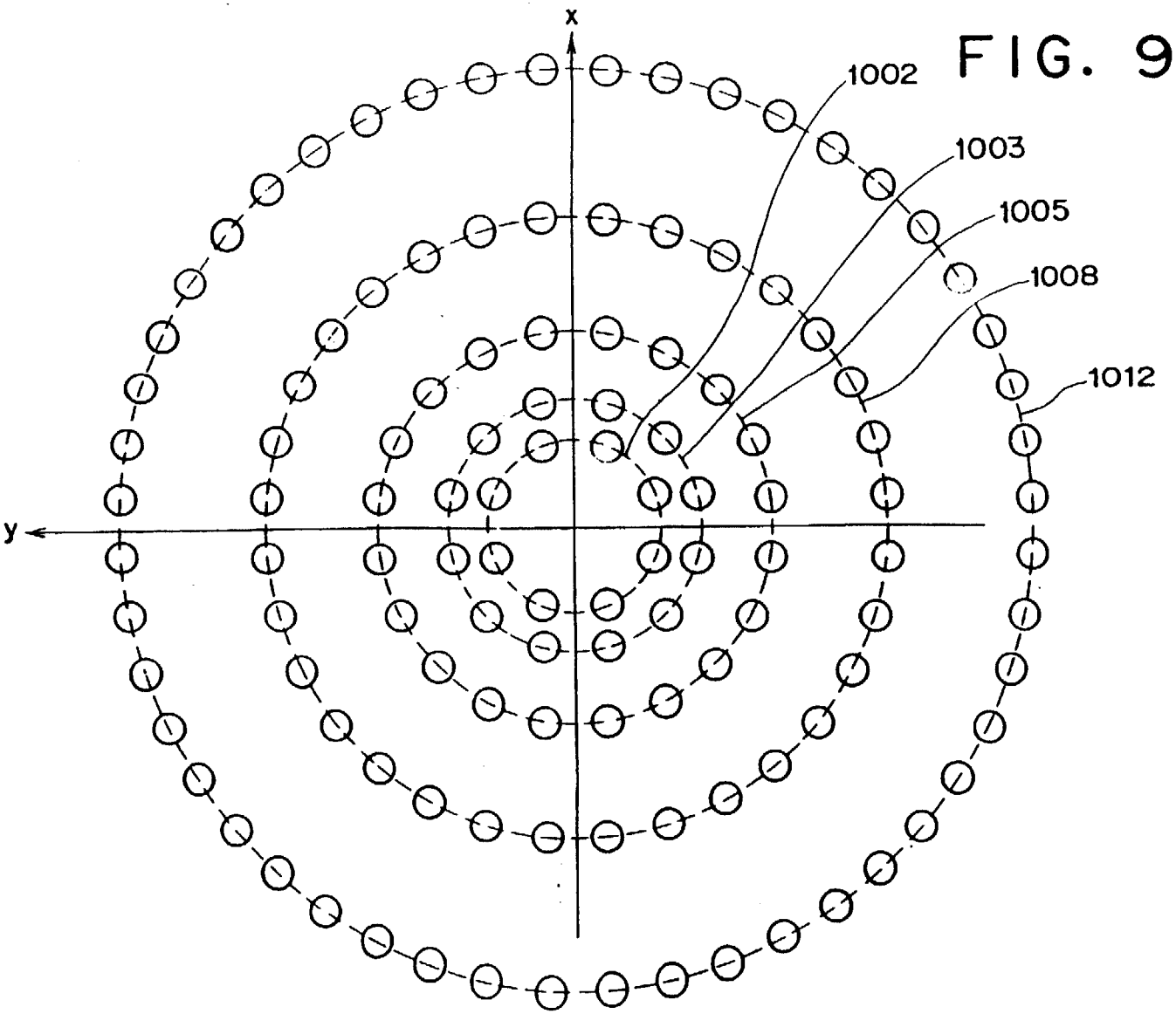
FIG. 92 is a top view showing an array antenna according to a twentieth embodiment of the present invention.
Figure 93:
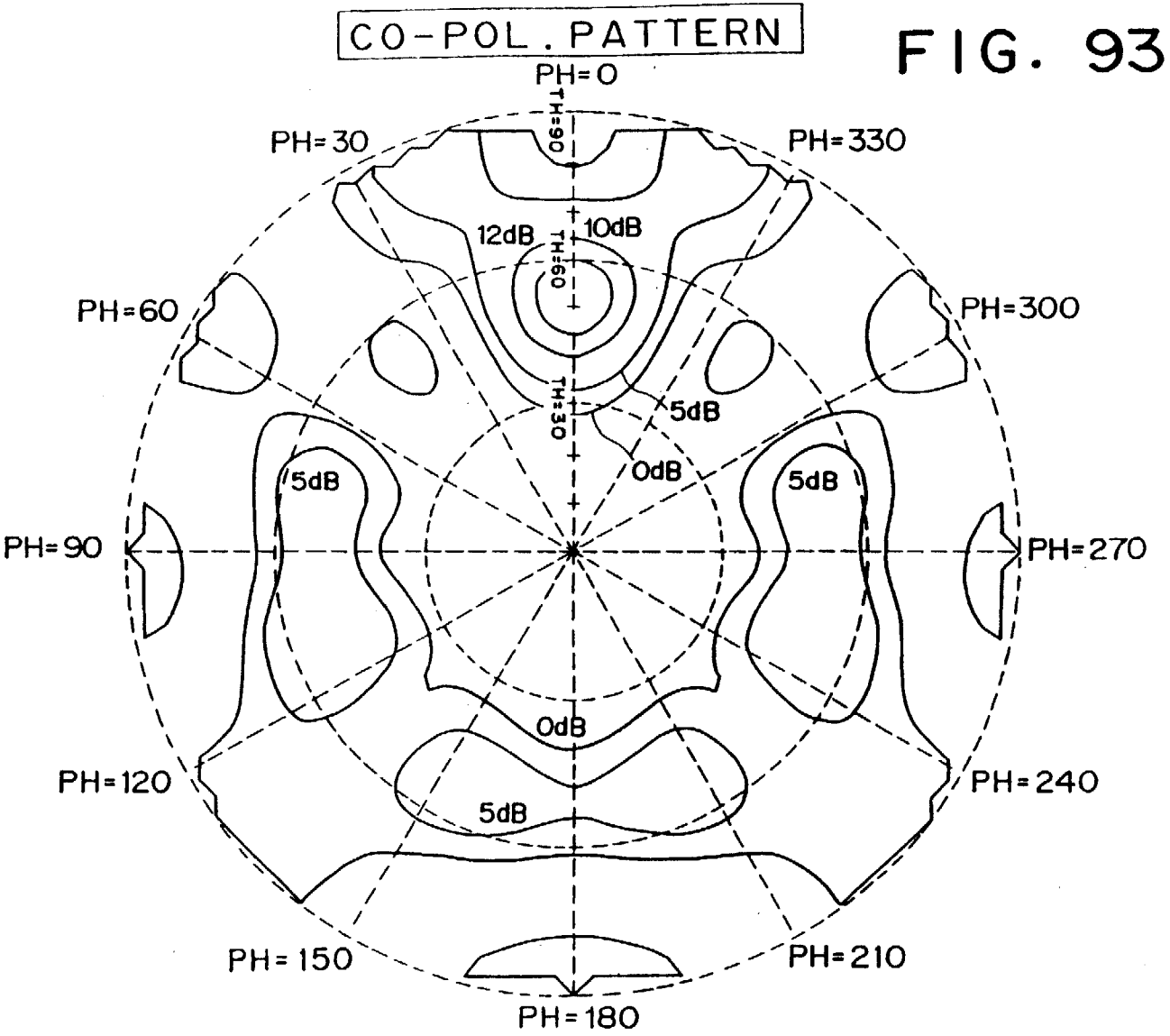
FIG. 93 is a graph showing radiation directivity of the array antenna according to the twentieth embodiment of the present invention.

FIG. 92 is a top view showing an array antenna according to the twentieth embodiment of the present invention. This antenna has five circular antenna arrays 1002, 1003, 1005, 1008, and 1012 disposed on peripheries of concentric circles with different radiuses. Each of the circular antenna arrays 1002, 1003, 1005, 1008, and 1012 is constructed of antenna elements. The direction numbers m of the circular antenna arrays 1002, 1003, 1005, 1008, and 1012 are designated 2, 3, 5, 8, and 12, respectively. As with the array antenna according to the eighteenth embodiment, the phase of a phase shifter for each of the circular antenna arrays 1002, 1003, 1005, 1008, and 1012 is set so that the composite beam of the radiation field of the antenna elements of the corresponding circular antenna array is scanned in the direction of a predetermined rotation angle $\phi$. In this embodiment, the difference between the two direction numbers m of any adjacent antenna arrays is unique. The practical designating method of the direction numbers m is not limited to that in this embodiment. FIG. 93 shows an example of radiation directivity of the array antenna according to the twentieth embodiment. In this embodiment, each circular antenna array is designed to form a conical beam in the direction of $\theta$=50 degrees. In addition, the exciting phase of each circular antenna array is set so that a main beam of a composite pattern is formed in the direction of $\phi$=0 degree. The construction of the feeding system of the array antenna according to the twentieth embodiment is the same as that according to the eighteenth embodiment shown in FIG. 85. In the twentieth embodiment, since the difference between the direction numbers m of any two adjacent circular antenna arrays is unique, only one beam is formed. Thus, the twentieth embodiment provides the effects similar to those of the eighteenth embodiment. Thus, the array antenna according to the twentieth embodiment is effectively used for an antenna installed in a mobile station.

The common effects of the nineteenth and twentieth embodiments are as follows.

The pitch of the antenna arrays of the array antennas according to the nineteenth and twentieth embodiments is wider than that according to the eighteenth embodiment. Thus, according to the nineteenth and twentieth embodiments, the size of each antenna elements can be increased, thereby improving the degree of freedom in design such as a variety of antenna types. For example, although the characteristics of circular polarized waves should be improved on the stage of antenna elements. However, when conventional circular microstrip antenna members are used, substrates with a low permittivity of around 1.5 should be used, thereby increasing the diameter of the resultant array antenna. Thus, in the construction according to the eighteenth embodiment, the antenna elements cannot be properly disposed. On the other hand, in the constructions according to the nineteenth and twentieth embodiments, since the pitches of the circular antenna arrays are large, the antenna elements can be properly disposed. In the constructions according to the nineteenth embodiment and the twentieth embodiment, since the pitches of the circular antenna arrays can be increased, the degree of freedom in design such as improvement of characteristics of circular polarized waves is improved.

Next, an embodiment according to a twenty-first embodiment of the present invention will be described.

Figure 94:
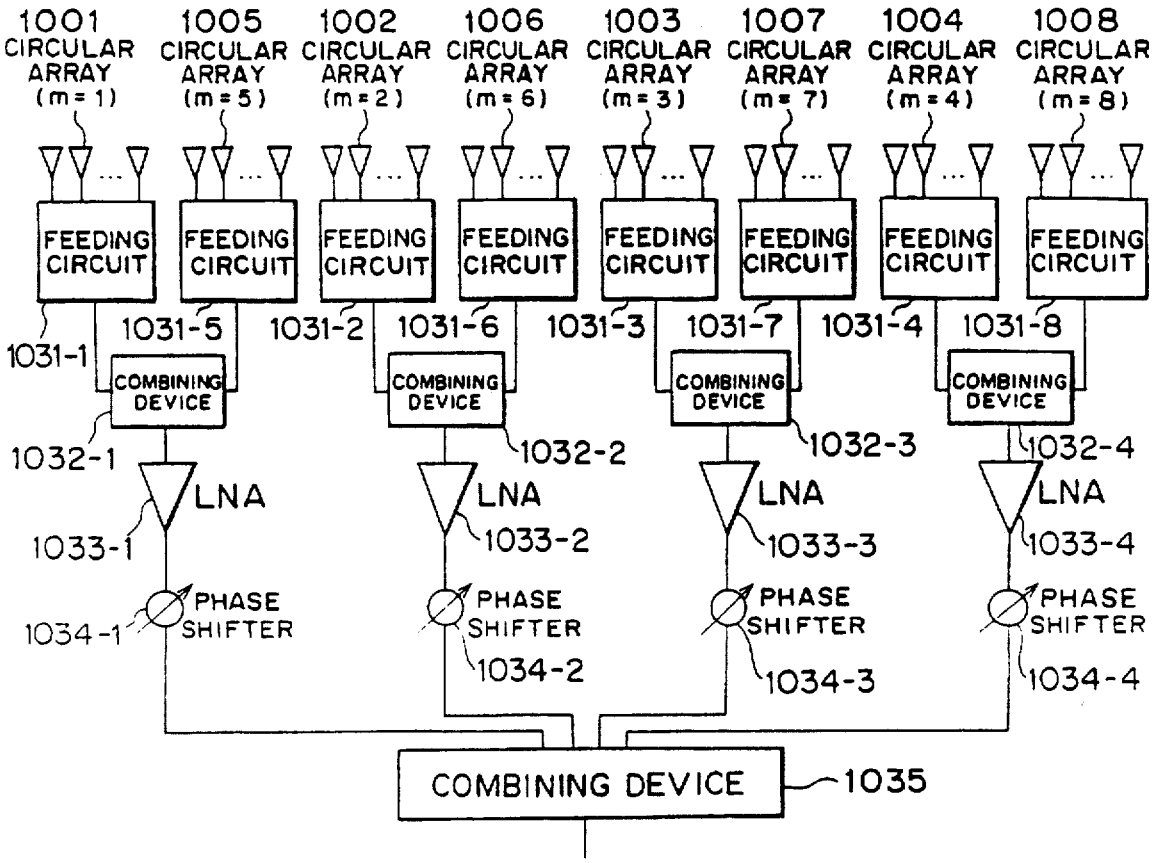
FIG. 94 is a circuit diagram showing the construction of a feeding system of an array antenna according to a twenty-first embodiment of present invention.

FIG. 94 is a circuit diagram showing a feeding system of an array antenna according to the twenty-first embodiment. Reference numerals 1031-1 to 1031-8 are feeding circuits which receive signals of circular antenna arrays 1001 (m=1), 1002 (m=2), 1003 (m=3), 1004 (m=4), 1005 (m=5), 1006 (m=6) 6), 1007 (m=7), and 1008 (m=8), respectively. The output signals of the feeding circuit 1031-1 and 1031-5 are sent to a combining device 1032-1 which combines these signals. The output signal of the combining device 1032-1 is sent to a low-noise amplifier (LNA) 1033-1 which amplifies the signal. The output signal of the LNA 1033-1 is sent to a phase shifter 1034-1 which shifts the phase of the signal for predetermined degrees. The output signal of the phase shifter 1034-1 is sent to a combining device 1035. The output signals of the feeding circuits 1031-2 and 1031-6 are sent to a combining device 1032-2. The output signal of the combining device 1032-2 is sent to a LNA 1033-2. The output signal of the LNA 1033-2 is sent to a phase shifter 1034-2. The output signal of the phase shifter 1034-2 is sent to the combing device 1035. The output signals of the feeding circuits 1031-3 and 1031-7 are sent to a combining device 1032-3. The output signal of the combining device 1032-3 is sent to a LNA 1033-3. The output signal of the LNA 1033-3 is sent to a phase shifter 1034-3. The output signal of the phase shifter 1034-3 is sent to the combining device 1035. The output signals of the feeding circuits 1004 and 1008 are sent to a combining device 1032-4. The output signal of the combining device 1032-4 is sent to a LNA 1033-4. The output signal of the LNA 1033-4 is sent to a phase shifter 1034-4. The output signal of the phase shifter 1034-4 is sent to the combining device 1035. The combining device 1035 combines the signals received from all the phase shifters 1034-1 to 1034-4. The phase shifter 1034-1 to 1034-4 operates with two bits, thereby controlling the phases of the corresponding signals at every 90 degrees.

The feature of the twenty-first embodiment is in that the output signals of two circular antenna arrays where the difference of direction numbers thereof is four are directly combined in the same phase. As shown in FIG. 89, the phase of each circular antenna array is proportional to the direction number. For example, when the phase of the array antenna is controlled, the phase of each of the circular antenna elements (m=1, 5, 9, . . . , etc.) becomes constant. Generally speaking, when a beam is scanned with p bits in the direction of the rotation angle $\phi$ (namely, at every $360/2^p$), the output signals of a plurality of circular antenna arrays with the relation where the difference between the direction numbers m of these arrays is a multiple of $2^p$ are directly combined. The composite output signal is sent to a phase shifter with p bits. Thereafter, the output signals of all phase shifters are combined. Thus, the composite output signal is obtained.

In the above-described construction, the number of phase shifters can be halved. Thus, the feeding system can be simply constructed, thereby lowering the production cost and simplifying the production steps. In particular, the array antenna according to the twenty-first embodiment is very effective for an antenna installed in a mobile station which is commercially used.

Next, a twenty-second embodiment of the present invention will be described.

Figure 95:
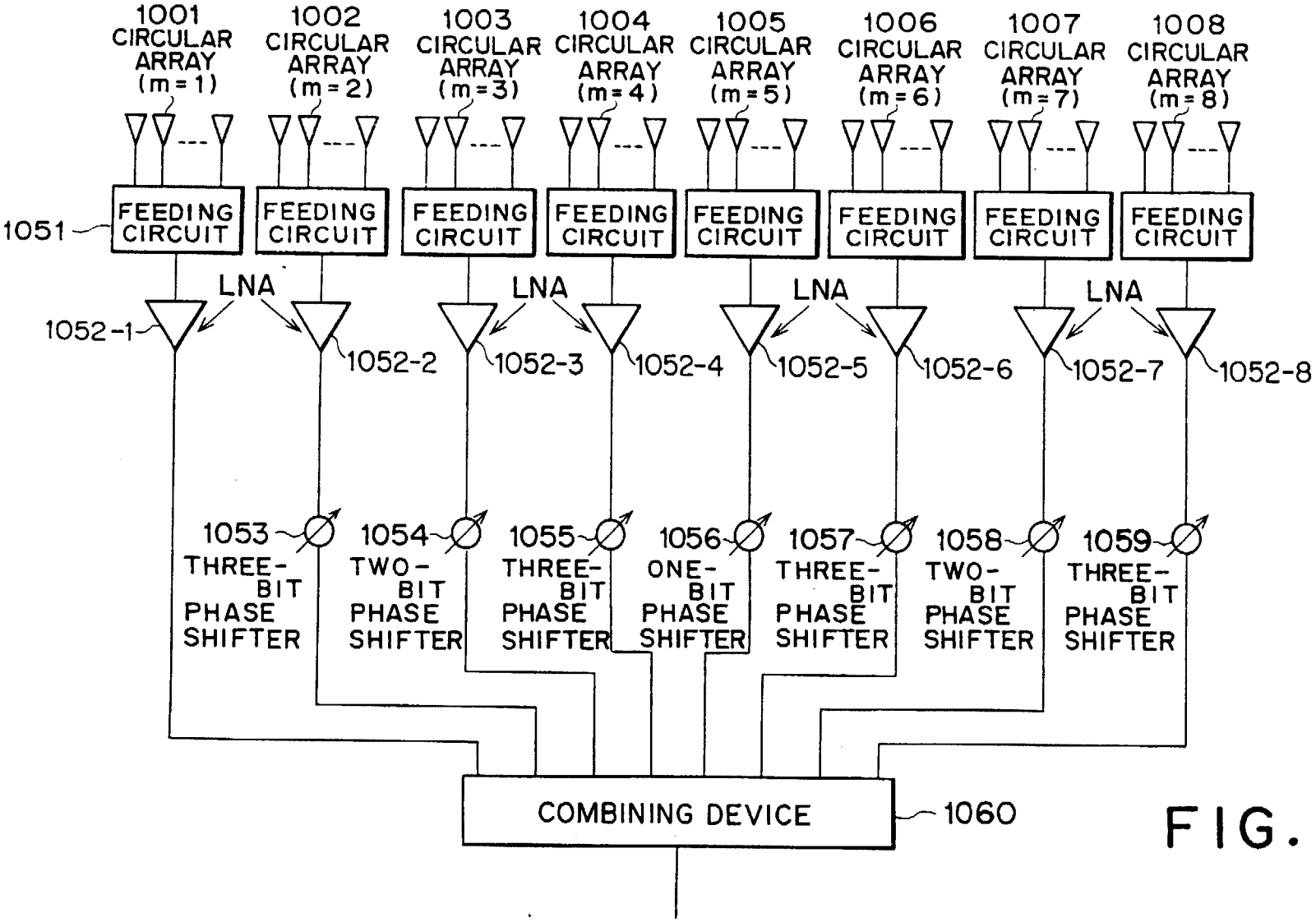
FIG. 95 is a circuit diagram showing the construction of a feeding system of an array antenna according to a twenty-second embodiment of the present invention.

FIG. 95 is a circuit diagram showing a feeding system of an array antenna according to the twenty-second embodiment of the present invention. The operation and construction of the array antenna according to the twenty-second embodiment are the same as those according to the eighteenth embodiment except that the number of bits of each of phase shifters electrically connected from feeding circuits to LNAs depend on each circular antenna array. In the twenty-second embodiment, a circular antenna array 1001 (phase direction coefficient m=1) is not electrically connected to a phase shifter (namely, a zero-bit phase shifter is connected). The circular antenna array 1001 is connected to a combining device 1060 through an LNA amplifier 1052-1. A circular antenna array 1002 (m=2) is connected to a three-bit phase shifter 1053 through an LNA amplifier 1052-2. A circular antenna array 1003 (m=3) is connected to a two-bit phase shifter 1054 through an LNA 1052-3. A circular antenna array 1004 (m=4) is connected to a three-bit phase shifter 1055 through an LNA 1052-4. A circular antenna array 1005 (m=5) is connected to a one-bit phase shifter 1056 through an LNA 1052-5. A circular antenna array 1006 (m=6) is connected to a three-bit phase shifter 1057 through an LNA 1052-6. A circular antenna array 1007 (m=7) is connected to a two-bit phase shifter 1058 through an LNA 1052-7. A circular antenna array 1008 (m=8) is connected to a three-bit phase shifter 1059 through an LNA 1052-8. The output signals of these phase shifters 1053 to 1059 and the LNA 1052-1 are sent to the combining device 1060. Thus, the combining device 1060 combines the signals received from all the circular antenna arrays.

In this construction, a beam can be scanned with three bits (namely, at every 45 degrees). Next, this scanning operation will be described practically. FIG. 96 is a table which gives exciting phases of antenna arrays in the case that a beam is scanned in the direction of rotation angle $\phi$ at every 45 degrees. Now, assume that the phase of the circular antenna array 1001 (m=1) is treated as a reference phase. In addition, assume that when the phase of each circular antenna array is 0, a beam is scanned in the direction of $\phi$=0 by the feeding system. The phase shifted by each phase shifter corresponding to each beam direction angle is determined by the relation shown in FIG. 89. FIG. 96 shows the phases (in degrees) obtained from the table of FIG. 89. In FIG. 96, numerals in parentheses represent values directly obtained from the table of FIG. 89. As is clear from the table of FIG. 96, when the number of bits of each phase shifter is the value shown in FIG. 95, a beam can be scanned with three bits. As the effect of such a construction, even if a beam is scanned with three bits, all the phase shifters required are not three-bit phase shifters. Half of the phase shifters required can be low-bit phase shifters. Thus, the phase shifters can be simplify constructed with low loss and at low cost. Thus, the production cost of the array antenna can be reduced.

Next, a beam scanning operation with two bits (at every 90 degrees) will be described. FIG. 97 gives exciting phases of circular antenna arrays. As was described in the array antenna according to the twenty-first embodiment, the phases of circular antenna arrays where the difference between the direction numbers m thereof is 4 become the same. Thus, the construction of the feeding system as shown in FIG. 94 is required. In this construction, no phase shifter is required for the output signals of the circular antenna arrays 1001 and 1005 (m=1 and 5). A two-bit phase sifter is required for the output signals of the circular antenna arrays 1002 and 1006 (m=2 and 6). A one-bit phase shifter is required for the output signals of the circular antenna arrays 1003 and 1007 (m=3 and 7). A two-bit phase shifter is required for the output signals of the circular antenna arrays 1004 and 1008 (m=4 and 8).

In the two examples according to the twenty-second embodiment, circular antenna arrays which do not require phase shifters can be freely designated by selecting a circular antenna array which has the reference phase. For example, in the example shown in FIG. 95, the phase shifter for the circular antenna array 1002 (m=2) can be omitted. In this case, a three-bit phase shifter is connected to the circular antenna array 1001 (m=1). A three-bit phase shifter is connected to the circular antenna array 1003 (m=3). A two-bit phase shifter is connected to the circular antenna array 1004 (m=4). A three-bit phase shifter is connected to the circular antenna array 1005 (m=5). A one-bit phase shifter is connected to the circular array antenna 1006 (m=6). A three-bit phase shifter is connected to the circular antenna array 1007 (m=7). A two-bit phase shifter is connected to the circular antenna array 1008 (m=8). In this case, the number of bits of each phase shifter increases one after the other. Therefore, the number of bits of each phase shifter can be freely designated corresponding to the gain of the antenna, the loss of the feeding system, and so forth.

The above-described construction can be generally expressed as follows. When a beam is scanned with p bits, corresponding to the phase direction coefficient m, the number of bits of the phase shifter for each circular antenna element is designated as follows. (K is positive integer)

For a circular antenna array ($m=k+2^p$), zero-bit phase shifter (no phase shifter) is required.

For a circular antenna array ($m=k+2^{p-1}+2^p$), one-bit phase shifter is required.

For a circular antenna array ($m=k+2^{p-2}+2^p$), two-bit phase shifter is required.

For a circular antenna array ($m=k+3\times2^{p-2}+2^p$), two-bit phase shifter is required.

For a circular antenna array ($m=k+(2t-1)\times2^{p-q}+2^p$), q-bit phase shifter is required (where $t=1, 2, \ldots 2^{q-1}$, q is any positive integer).

For a circular antenna array ($m=k+(2t-1)+2^p$), p-bit phase shifter is required (where $t=1, 2, \ldots, 2^{p-1}$).

Next, a twenty-third embodiment of the present invention will be described.

Figure 98:
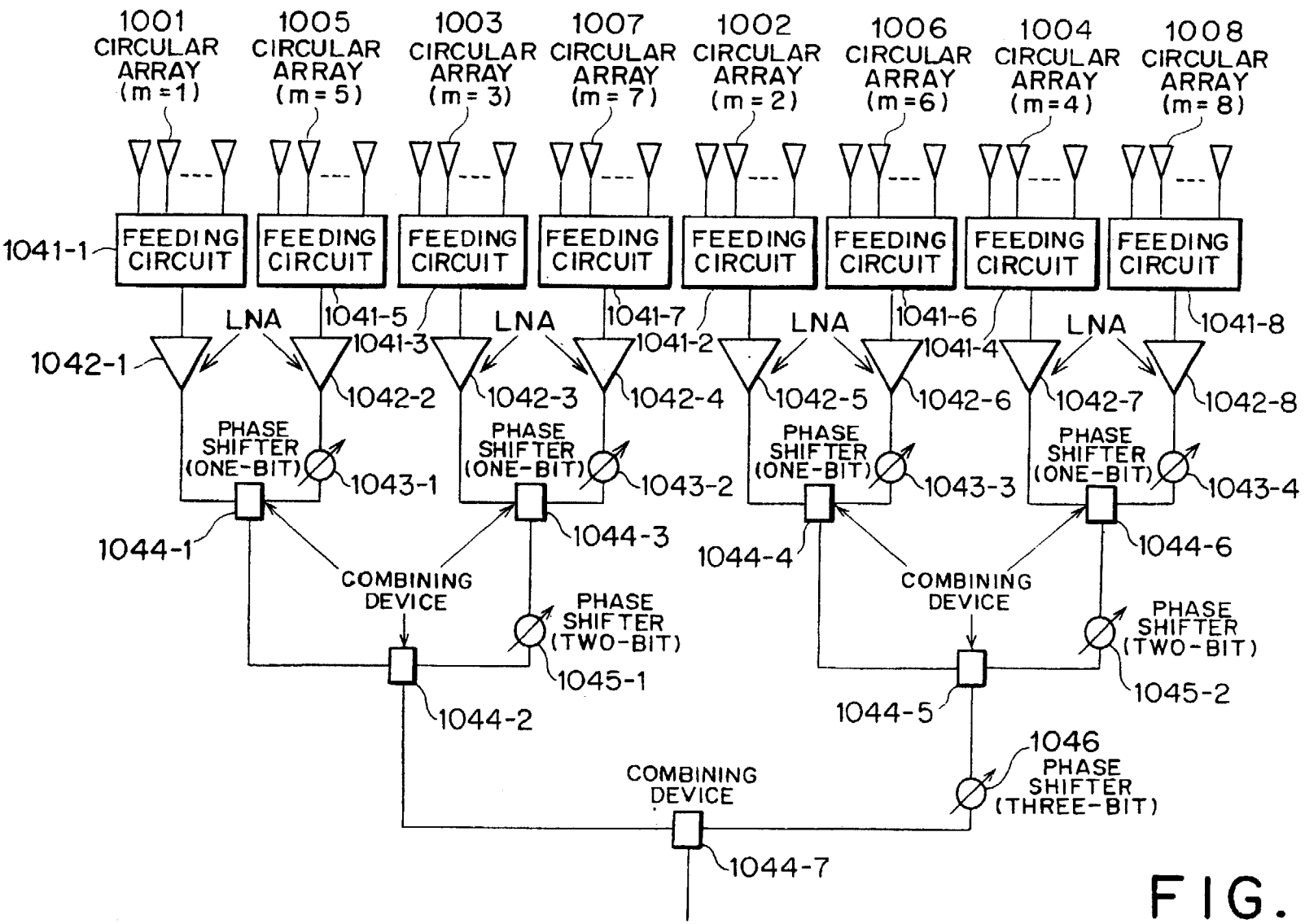
FIG. 98 is a circuit diagram showing the construction of a feeding system of an array antenna according to a twenty-third embodiment of the present invention.

FIG. 98 is a circuit diagram showing a feeding system of an array antenna according to the twenty-third embodiment of the present invention. The feature of this embodiment is in that a tournament type feeding circuit is used as a circuit which combines the output signals of feeding circuits for circular antenna arrays. In the construction shown in FIG. 98, a beam is scanned in the direction of the rotation angle $\phi$ with three bits (at every 45 degrees). The output signals of circular antenna arrays 1001 (m=1), 1005 (m=5), 1003 (m=3), 3), 1007 (m=7), 1002 (m=2), 1006 (m=6), 1004 (m=4), and 1008 (m=8) are sent to feeding circuit 1041-1, 1041-5, 1041-3, 1041-7, 1041-2, 1041-6, 1041-4, and 1041-8, respectively. The output signal of the feeding circuit 1041-1 is sent to an LNA 1042-1 which amplifies the signal. The output signal of the LNA 1042-1 is sent to a combining device 1044-1. The output signal of the feeding circuit 1041-5 is sent to an LNA 1042-2. The output signal of the LNA 1042-2 is sent to a one-bit phase shifter 1043-1 which shifts the phase of the signal for 180 degrees. The output signals of the LNA 1042-1 and phase shifter 1043-1 are sent to the combining device 1044-1. The output signal of the combining device 1044-1 is sent to a combining device 1044-2. The output signal of the feeding circuit 1041-3 is sent to an LNA 1042-3. The output signal of the LNA 1042-3 is sent to a combining device 1044-3. The output signal of the feeding circuit 1041-7 is sent to an LNA 1042-4. The output signal of the LNA 1042-4 is sent to a one-bit phase shifter 1043-2. The output signal of the phase shifter 1043-2 is sent to the combining device 1044-3. The output signal of the combining device 1044-3 is sent to a two-bit phase shifter 1045-1 which shifts the phase of the input signal for every 90 degrees. The output signal of the two-bit phase shifter 1045-1 is sent to the combining device 1044-2. The output signal of the combining device 1044-2 is sent to a combining device 1044. The output signal of the feeding circuit 1041-2 is sent to an LNA 1042-5. The output signal of the LNA 1042-5 is sent to a combining device 1044-4. The output signal of the feeding circuit 1041-6 is sent to an LNA 1042-6. The output signal of the LNA 1042-6 is sent to a one-bit phase shifter 1043-3 which shifts the phase of the input signal for every 180 degrees. The output signal of the one-bit phase shifter 1043-3 is sent to the combining device 1044-4. The output signal of the combining device 1044-4 is sent to a combining device 1044-5. The output signal of the feeding circuit 1041-4 is sent to an LNA 1042-7. The output signal of the LNA 1042-7 is sent to a combining device 1044-6. The output signal of the feeding circuit 1041-8 is sent to a LNA 1042-8. The output of the LNA 1042-8 is sent to a one-bit phase shifter which shifts the input signal for every 180 degrees. The output signal of the one-bit phase shifter 1043-4 is sent to the combining device 1044-6. The output signal of the combining device 1044-6 is sent to a two-bit phase shifter 1045-2 which shifts the phase of the input signal for every 90 degrees. The output signal of the two-bit phase shifter 1045-2 is sent to the combining device 1044-5. The output signal of the combining device 1044-5 is sent to a three-bit phase shifter 1046 which shifts the phase of the input signal for 45 degrees. The output signal of the three-bit phase shifter 1046 is sent to the combining device 1044-6. In other words, on the first combining stage, the output signals of two circular antenna arrays where the difference between the direction numbers m thereof is four are combined. On the first combining stage, one of the output signals is sent to the one-bit phase shifter 1043. On the second combining stage, the output signals where the difference between the phase direction coefficient m is two are combined. On this stage, one of the output signals is sent to the two-bit phase shifter 1045. Thus, the phases of the four circular antenna arrays are controlled with two bits. On the third (last) combining stage, the output signals of all the circular antenna arrays are combined. On this stage, one of the output signals is sent to the three-bit phase shifter 1046.

In this construction, a beam can be scanned with three bits. As with the effects of the twenty-second embodiment, low-bit phase shifters can be used, thereby simplifying the construction of the feeding system and lowering the production cost of the array antenna. In the construction according to the twenty-third embodiment, the number of phase shifters are reversely proportional to the number of bits thereof. Thus, in the twenty-third embodiment, a beam can be scanned with simpler phase shifters than those of the twenty-second embodiment.

The construction of the twenty-third embodiment can be generally expressed as follows. When a beam is scanned in the direction of the rotation angle $\phi$ at every ($360/2^p$) angles (where p is any positive integer which represents the number of bits), the output signals of each circular antenna array are combined in tournament feeding method. On the first stage, the output signals of two circular antenna arrays where the numbers m thereof is $2^{p-1}$ are combined. When the signals are combined, one of them is sent to a one-bit phase shifter so as to control the phase of the resultant signal at every 180 degrees. On the second stage, the output signals of four circular antenna arrays where the difference between the numbers m thereof is $2^{p-2}$ are combined. When the signals are combined, one of them is sent to a two-bit phase shifter so as to control the phase of the resultant signal at every 90 degrees. In this manner, two output signals are combined on each stage. One of the output signals is sent to a phase shifter so as to control the phase thereof. The number of bits of phase shifters increases as the phase number increases. Thus, on the last stage, a p-bit phase shifter is connected. In this construction, half of all the phase shifters required are one-bit phase shifters. The number of phase shifters with the largest bits is only one. Thus, since most of the phase shifters required are inexpensive low-bit phase shifters, the production cost of the antenna can be reduced.

Next, an embodiment of the twenty-fourth embodiment will be described.

Figure 99:
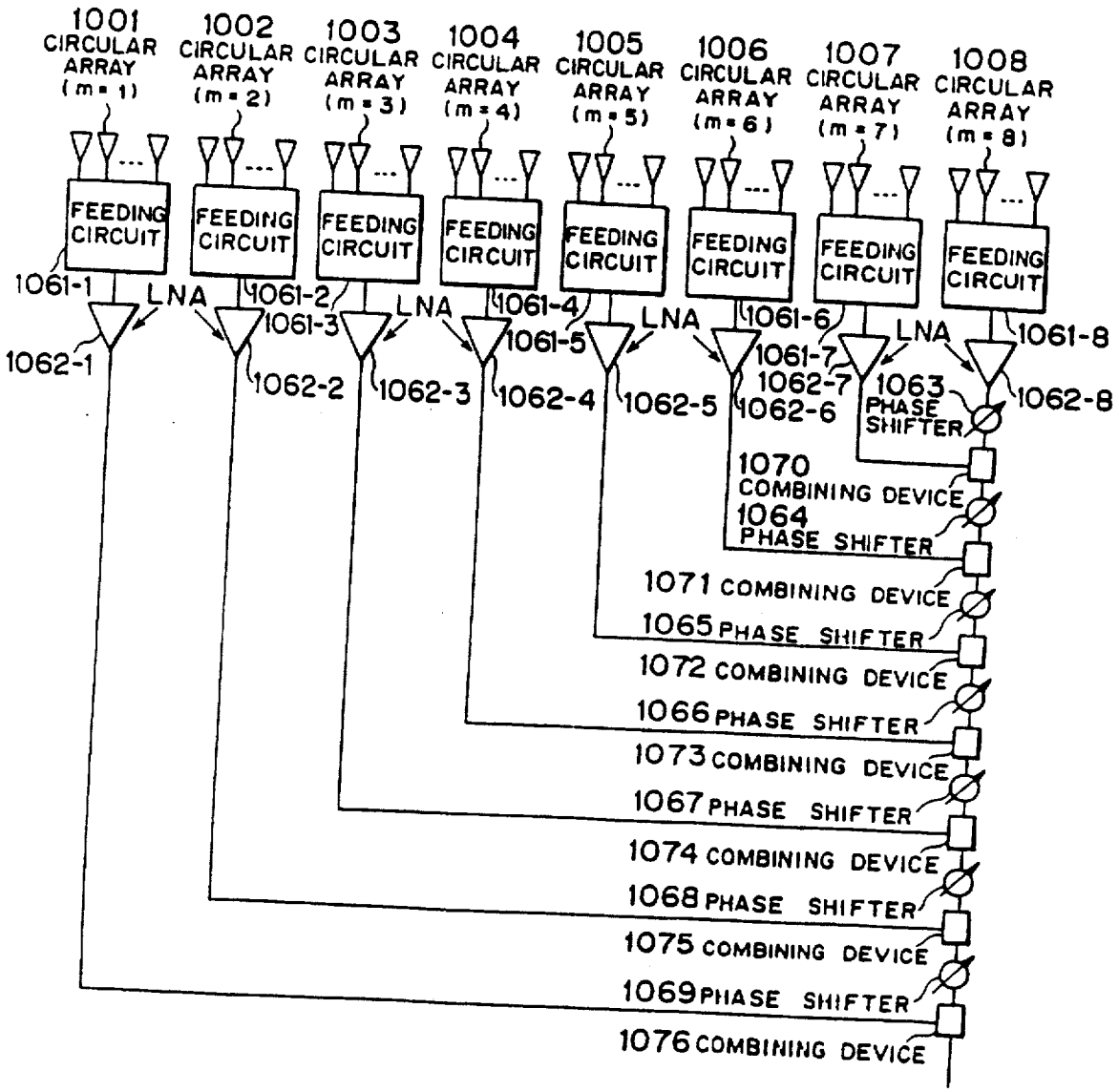
FIG. 99 is a circuit diagram showing the construction of a feeding system of an array antenna according to a twenty-fourth embodiment of the present invention.

FIG. 99 is a block diagram showing a feeding system of an array antenna according to the twenty-fourth embodiment of the present invention. In this construction, the output signals of feeding circuit 1061-1 (m=1) to 1061-8 (m=8) of circular antenna arrays are sent to LNAs 1062-1 to 1062-8, respectively. The output signal of the LNA 1062-8 is sent to a phase shifter 1063. The output signal of the phase shifter 1063 is sent to a combining device 1070. The output signal of the LNA 1062-7 is sent to the combing circuit 1070. The output signal of the combining device 1070 is sent to a phase shifter 1064. The output signal of the phase shifter 1064 is sent to a combining device 1071. The output signal of the LNA 1062-6 is sent to the combining device 1071. The output signal of the combining device 1071 is sent to a phase shifter 1065. The output signal of the phase shifter 1065 is sent to a combining device 1072. The output signal of the LNA 1062-5 is sent to the combining device 1072. The output signal of the combining device 1072 is sent to a phase shifter 1066. The output signal of the phase shifter 1066 is sent to a combining device 1073. The output signal of the LNA 1062-4 is sent to a combining device 1073. The output signal of the combining device 1073 is sent to a phase shifter 1067. The output signal of the phase shifter 1067 is sent to a combining device 1074. The output signal of the LNA 1062-3 is sent to the combining device 1074. The output signal of the combining device 1074 is sent to a phase shifter 1068. The output signal of the phase shifter 1068 is sent to a combining device 1075. The output signal of the LNA 1062-2 is sent to the combining device 1075. The output signal of the combining device 1075 is sent to a phase shifter 1069. The output signal of the phase shifter 1069 is sent to a combining device 1076. The output signal of the LNA 1062-1 is sent to the combining device 1076. In this construction, the combining devices which combine the output signals of each circular antenna array are disposed in series. Thus, the construction can be simplified. Since the feeding system can be formed of one layer of microstrip line pattern, the antenna can be formed thinly and compactly. In this construction, each phase shifter may have the same bits and same phase. In the case that the phase shifted by one phase shifter is β, when the phase direction coefficient m of the circular antenna array is 1, the phase is 0. When the phase direction coefficient m of the circular antenna array is 2, the phase is β. When the phase direction coefficient m of the circular antenna array is 3, the phase is 2β. Thus, the phases given by FIG. 89 can be obtained. Therefore, with the same phase shifters, a beam can be scanned in the direction of the rotation angle ϕ. In this construction, since only one type of phase shifters are used, the array antenna is suitable for quantitative production. In addition, since each phase shifter can be controlled in the same manner, the control circuit, power supply circuit, and so forth can be shared. Thus, the construction of the feeding system can be remarkably simplified.

In the twenty-fourth embodiment of the present invention, when a beam is scanned in the direction of the rotation angle ϕ with p bits, the feeding system can be constructed of one type of phase shifters. Thus, since the control circuit and the power supply circuit can be shared, the production cost of the array antenna can be reduced. Generally expressed, $2^p$ circular antenna arrays are connected to $(2^p-1)$ phase shifters in series so that the output signals of each circular antenna array flow to the following phase shifters. For a circular antenna array ($m=k+2^p$), the output signals thereof flow to no phase shifter. For a circular antenna array ($m=k+1+2^p$), the output signals thereof flow to one phase shifter. For a circular antenna array ($m=k+2^p+2^p$), the output signals thereof flow to two phase shifters. For a circular antenna array ($m=k+2^p-1+2^p$), the output signals thereof flow to all $(2^p-1)$ phase shifters.

In the twenty-fourth embodiment, when the power loss of each phase shifter is large, the composite output signal of each antenna array may not be properly amplified by each LNA. In this case, amplifiers may be connected to all or part of phase shifters so as to compensate the power loss. Thus, since the composite ratio of each circular antenna array is precisely matched, an array antenna with a high gain can be formed.

Next, a twenty-fifth embodiment of the present invention will be described.

Figure 100:
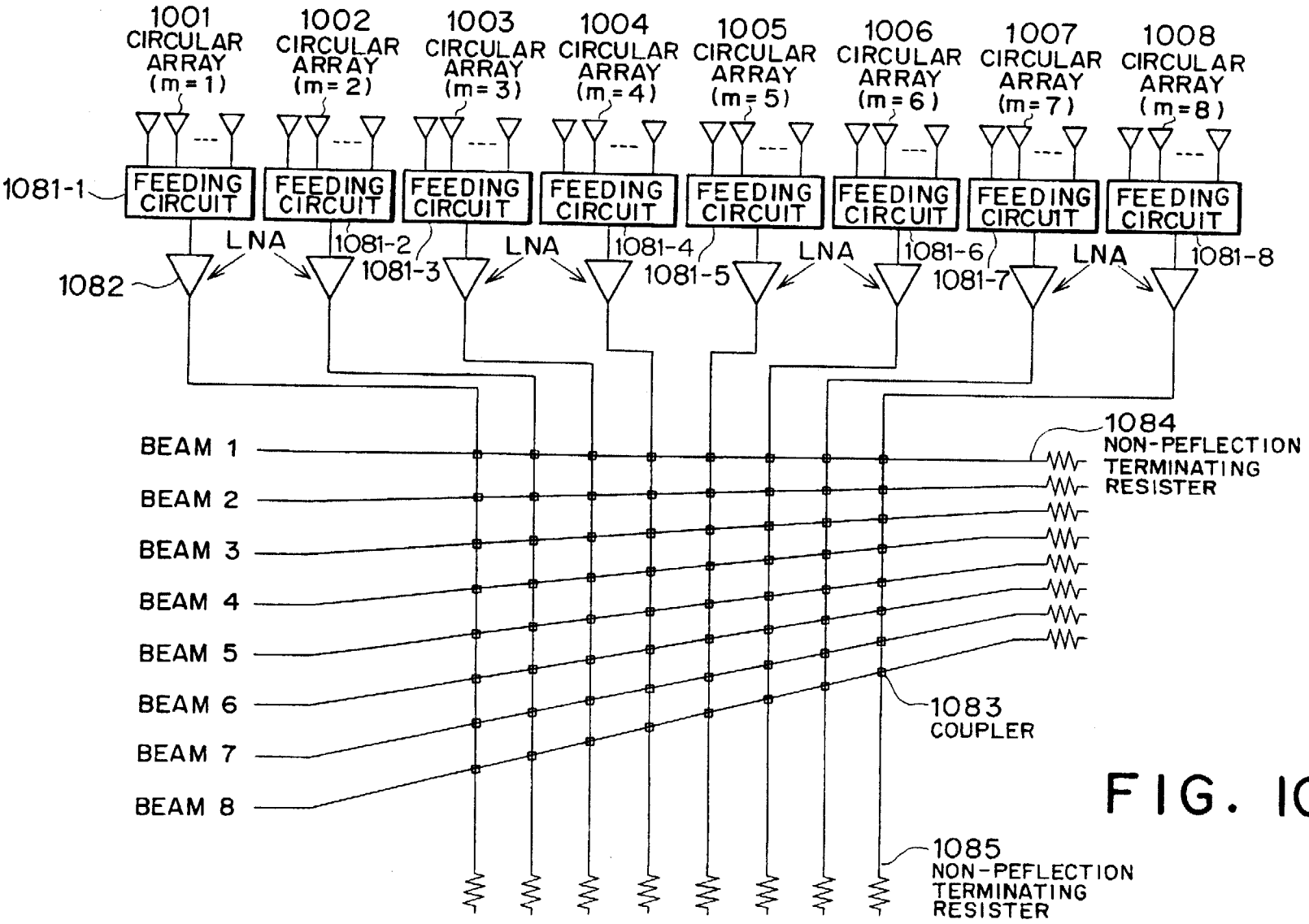
FIG. 100 is a circuit diagram showing the construction of a feeding system of an array antenna according to a twenty-fifth embodiment of the present invention.

FIG. 100 is a circuit diagram showing a feeding system of an array antenna according to the twenty-fifth embodiment of the present invention. In this embodiment, a matrix type feeding circuit which combines the output signals of each circular antenna array is used. In the construction of the feeding system shown in FIG. 100, the output signals of circular antenna arrays 1001 (m=1) to 1008 (m=8) are sent to feeding circuits 1081-1 to 1081-8, respectively. The output signal of each feeding circuit 1081 is sent to a corresponding LNA 1082 which amplifies the signal. The output of the LNA 1082 is sent to couplers 1083 which are disposed at intersections of matrix-shape transmission lines. Each transmission line is terminated with non-reflection terminating resisters 1084 and 1085. By adjusting the positions of the couplers 1083, the phase of the output signal of each circular antenna array can be freely set. Thus, a plurality of beams can be scanned in the directions of any direction angles ϕ. In this construction, a plurality of beams scanned in any directions can be easily formed with a simple circuit using a matrix feeding method. In addition, when the composite ratio of each circular antenna array is optimally set, the coupling ratio of each coupler can be newly used. Thus, the degree of freedom in design is improved. This construction is effectively used for a multi-beam antenna. With a switching means for selecting one of these beams, a beam scanning antenna can be formed.

Next, a twenty-sixth embodiment of the present invention will be described.

Figure 101:
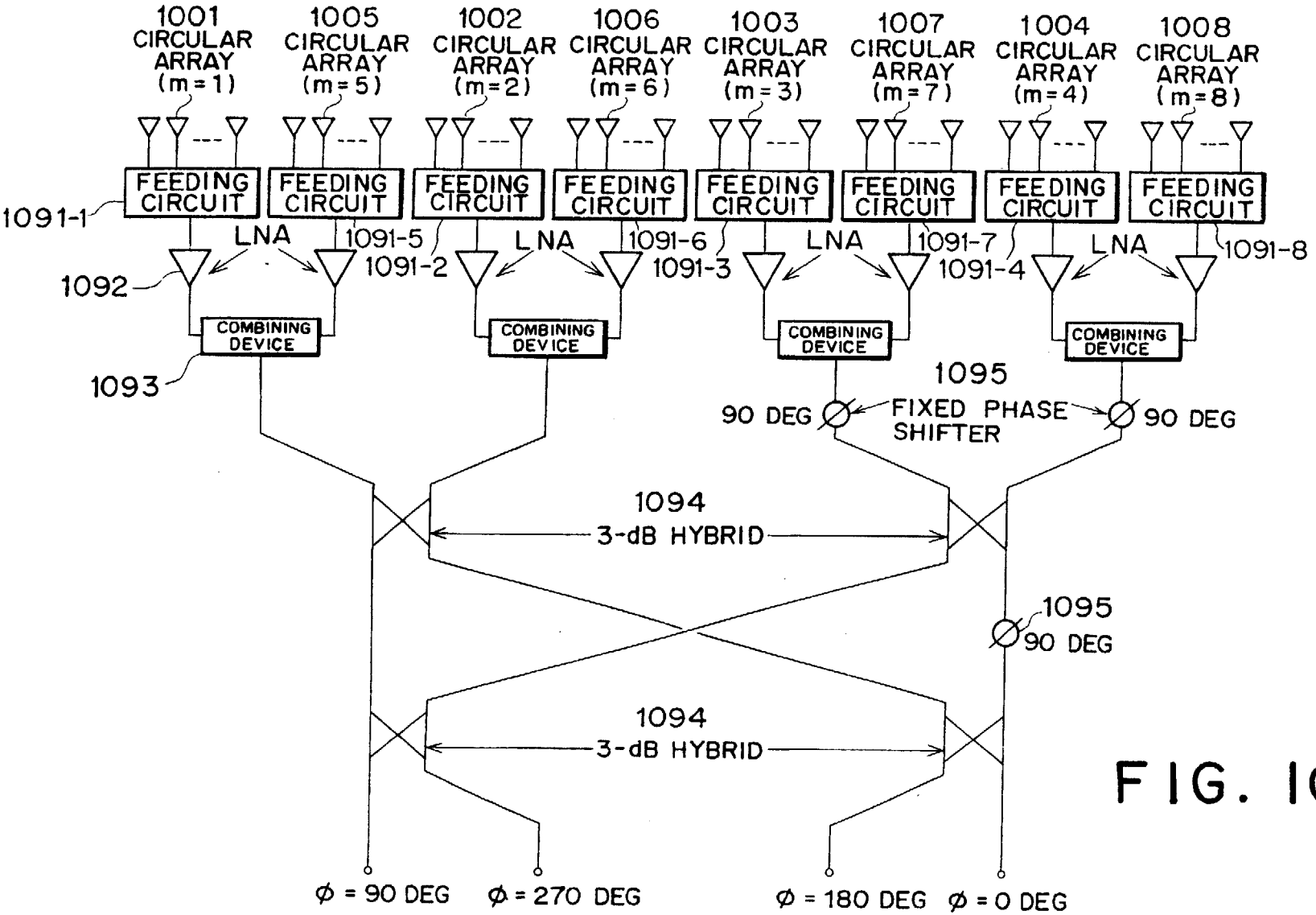
FIG. 101 is a circuit diagram showing the construction of a feeding system of an array antenna according to a twenty-sixth embodiment of the present invention.

FIG. 101 is a circuit diagram showing a feeding system of an array antenna according to the twenty-sixth embodiment of the present invention. In this embodiment, a battler-matrix type feeding circuit is used as a combining device which combines the output signals of feeding circuits 1091-1 to 1091-8 of all circular antenna arrays 1001 (m=1) to 1008 (m=8). In the construction of the feeding system shown in FIG. 101, the output signal of each feeding circuit

1091 is sent to a corresponding LNA 1092 which amplifies the signal. The output signals of two LNAs 1092 are sent to a combining device 1093.

Figure 102:
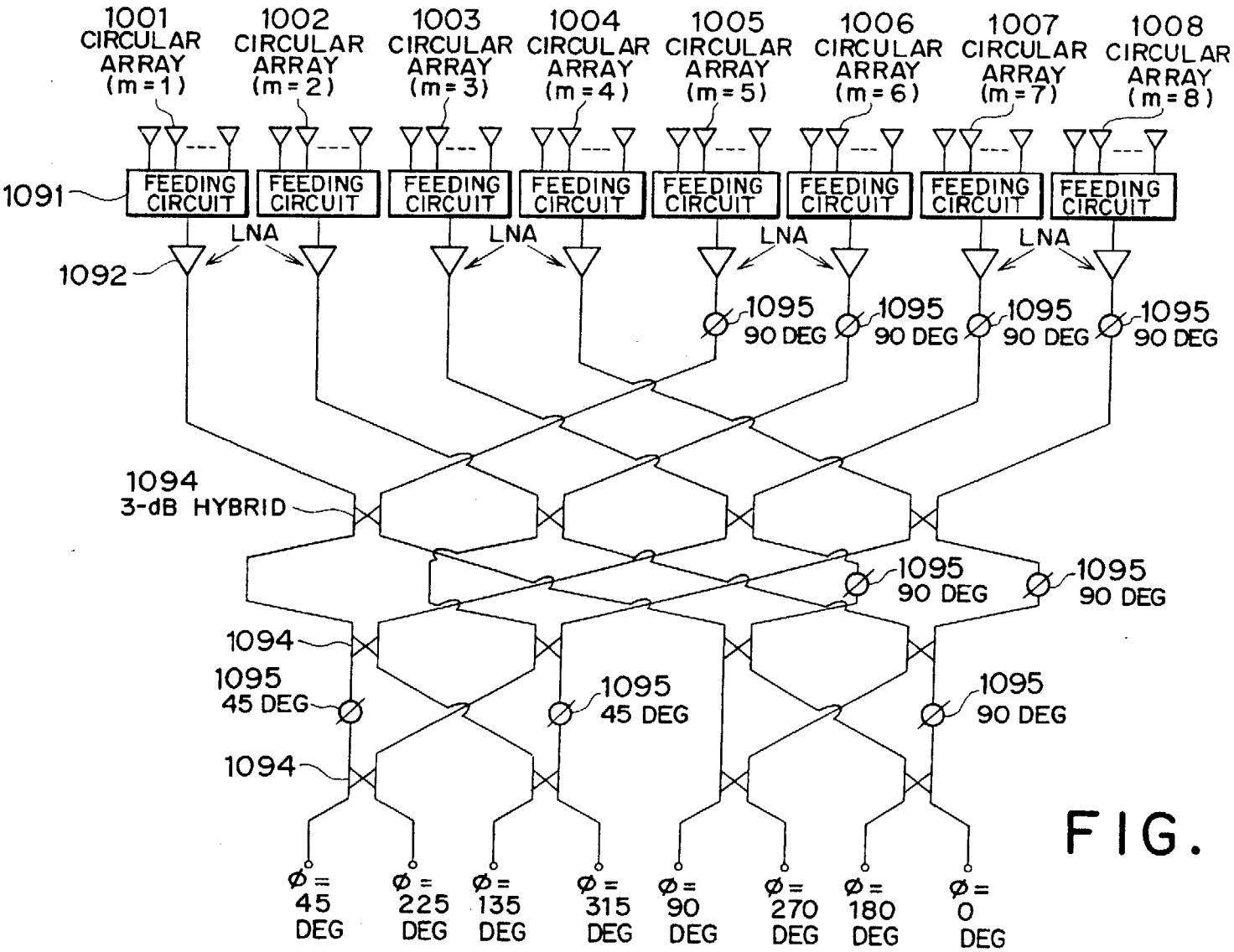
FIG. 102 is a circuit diagram showing the construction of another feeding system of the array antenna according to the twenty-sixth embodiment of the present invention.
Figure 103:
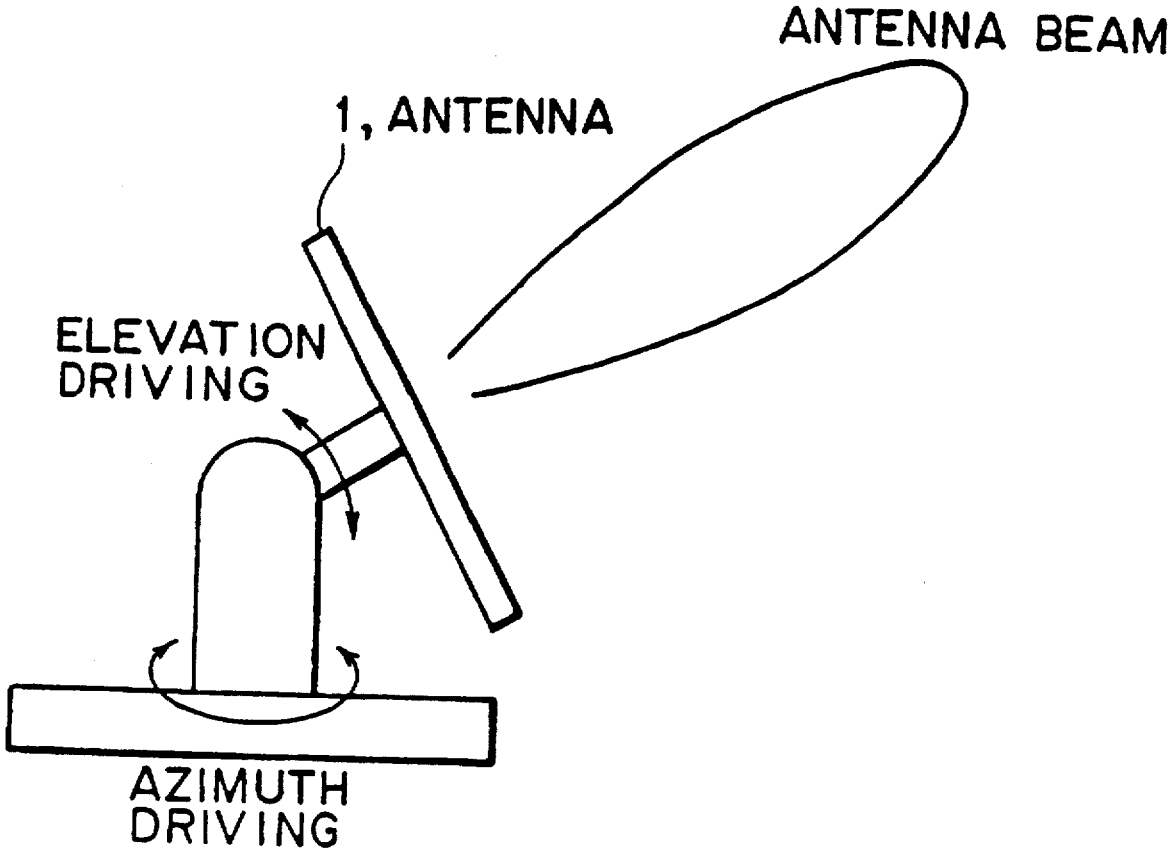
FIG. 103 PRIOR ART
FIG. 103 is a schematic diagram showing a conventional beam scanning antenna.

The output signal of the LNA 1092 is sent to hybrid couplers 1094. Thus, a plurality of beams are formed. In this embodiment, the output signals of eight circular antenna arrays 1001 to 1008 (m=1 to 8) are combined. Four beams are formed in the directions of the direction angles $\phi$ at every 90 degrees. As described above-mentioned embodiments, the phases of the output signals of circular antenna arrays where the difference of the direction numbers m thereof is four become the same. Thus, as shown in the figure, the output signals of these circular antenna elements are combined on the first stage. In the feeding system, four 3-dB hybrid couplers 1094 each of which shifts the phase of the input signal for 90 degrees with the same amplitude are used. These hybrid couplers 1094 are disposed on two stages. In these hybrid couplers 1094, a fixed phase shifter 1095 is disposed as shown in the figure. Thus, four beams are formed in the directions at every 90 degrees. The fixed phase shifter 1095 can be formed by varying the line length. In addition, the hybrid couplers 1095 of any type may be used. Moreover, as the hybrid couplers 1095, 180-degree hybrid couplers which shifts the phase of the signal for 180 degrees may be used. When the hybrid couplers are formed of a microstrip line pattern, they can be constructed thinly and compactly. In addition, a plurality of beams can be formed in the directions of the direction angles i with the simple construction. When each port is selected with a switch, a beam can be scanned in the direction of the rotation angle $\phi$. Thus, the array antenna according to this embodiment is very effective for an inexpensive, small, and thin antenna installed in a mobile station. FIG. 102 is a circuit diagram showing a feeding circuit which combines the output signals of eight circular antenna arrays (phase direction coefficient m=1 to 8) and forms eight beams in the directions of the direction angles $\phi$ at every 45 degrees. In this construction, 12 3-dB, 90-degree hybrid couplers 1094 are disposed on three stages. In addition, when 45-degree fixed phase shifters 1095 and 90-degree fixed phase shifters 1095 are disposed as shown in the figure, a beam in the rotation angle $\phi$ is formed at each port. As described above, when the battler-matrix type feeding system having hybrid couplers is used, a plurality of beams can be formed with simple construction.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. An array antenna comprising:

a circular antenna array constructed of a number i of antenna elements disposed on a periphery of a circle at respective position angles $\psi_i$ relative to a radial axis of the circle; and phase shifting means for giving a respective phase shift $\alpha_i$ to radiation directivity of each of said antenna elements and for making the phase shift $\alpha_i$ equal to n times the position angle $\psi_i$, n being an integer excluding 0, wherein said phase shifting means comprises a rotating antenna element and said rotating antenna element comprises said antenna elements, each of which rotates for an angle $\alpha_i$.

2. The array antenna as set forth in claim 1, wherein said rotating antenna element comprises a circular microstrip antenna member.

3. An array antenna comprising:

number k of circular antenna arrays constructed of a number of i of antenna elements disposed on any periphery of concentric circles having radii different from each other and disposed at respective position angles $\psi_{k-i}$ relative to a radial axis of the circle; and phase shifting means for giving a phase shift $\alpha_{k-i}$ to radiation directivity of each of said antenna elements disposed on the same periphery and for making the phase shift $\alpha_{k-i}$ equal to $n_k$ times position angle $\psi_{k-i}$, $n_k$ being an integer excluding 0, wherein said integers $n_k$ are different from each other.

4. The array antenna as set forth in claim 3, wherein said integers $n_k$ are continuous numbers if sorted in order of value of each $n_k$.

5. An array antenna comprising:

number k of circular antenna arrays constructed of a number of i of antenna elements disposed on any periphery of concentric circles having radii different from each other and disposed at respective position angles $\psi_{k-i}$ relative to a radial axis of the circle; and phase shifting means for giving a phase shift $\alpha_{k-i}$ to radiation directivity of each of said antenna elements disposed on the same periphery and for making the phase shift $\alpha_{k-i}$ equal to $n_k$ times position angle $\psi_{k-i}$, $n_k$ being an integer excluding 0, wherein the array antenna further comprises an RF switch for selecting a circular antenna array.

6. An array antenna comprising:

number k of circular antenna arrays, constructed of a number i of antenna elements disposed on any periphery of concentric circles having radii different from each other and disposed at respective position angles $\psi_{k-i}$ relative to a radial axis of the circle; and phase shifting means for giving a phase shift $\alpha_{k-i}$ to radiation directivity of each of said antenna elements disposed on the same periphery and for making the phase shift $\alpha_{k-i}$ equal to $n_k$ times position angle $\psi_{k-i}$, $n_k$ being an integer excluding 0, wherein said phase shifting means corresponding to each of said circular antenna arrays are electrically connected to feeding circuits being different from each other.

7. The array antenna as set forth in claim 6, wherein each of said feeding circuits includes a second phase shifting means for giving a phase shift $\beta_k$ to radiation directivity of each of said circular antenna arrays, $\beta_k$ being a numerical value.

8. The array antenna as set forth in claim 7, wherein said second phase shifting means comprises a phase shifter.

9. The array antenna as set forth in claim 7, wherein said second phase shifting means comprises a combination of at least one combining device and at least two phase shifters.

10. The array antenna as set forth from claim 7, wherein said phase shift $\beta_k$ is variable.

11. The array antenna as set forth in claim 6, wherein each of said feeding circuits includes a radial waveguide.

* * * * *

UNITED STATES PATENT AND TRADEMARK OFFICE

CERTIFICATE OF CORRECTION

PATENT NO. : 6,184,828 B1
DATED : February 6, 2001
INVENTOR(S) : Shoki

It is certified that error appears in the above-identified patent and that said Letters Patent is hereby corrected as shown below:

Column 68, claim 3,
Line 7, change "arrays" to -- arrays, --.
Line 8, delete "of" (first occurrence).

Column 68, claim 5,
Line 22, change "arrays" to -- arrays, --.

Signed and Sealed this

Twenty-sixth Day of March, 2002

*Attest:*

*Attesting Officer*

JAMES E. ROGAN
*Director of the United States Patent and Trademark Office*